US010426989B2

(12) United States Patent
Dalebout

(10) Patent No.: US 10,426,989 B2
(45) Date of Patent: Oct. 1, 2019

(54) CABLE SYSTEM INCORPORATED INTO A TREADMILL

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 175 days.

(21) Appl. No.: 14/732,965

(22) Filed: Jun. 8, 2015

(65) Prior Publication Data

US 2015/0352396 A1 Dec. 10, 2015

Related U.S. Application Data

(60) Provisional application No. 62/009,607, filed on Jun. 9, 2014.

(51) Int. Cl.
*A63B 21/04* (2006.01)
*A63B 22/02* (2006.01)
(Continued)

(52) U.S. Cl.
CPC ..... *A63B 21/0442* (2013.01); *A63B 21/0051* (2013.01); *A63B 21/153* (2013.01); *A63B 21/4043* (2015.10); *A63B 22/0007* (2013.01); *A63B 22/02* (2013.01); *A63B 23/1209* (2013.01); *A63B 21/023* (2013.01); *A63B 21/0552* (2013.01); *A63B 21/06* (2013.01); *A63B 21/4035* (2015.10); *A63B 22/0023* (2013.01); *A63B 22/0235* (2013.01); *A63B 22/0285* (2013.01); *A63B 23/0205* (2013.01);
(Continued)

(58) Field of Classification Search
CPC ..... A63B 21/0442; A63B 21/00192; A63B 21/0051; A63B 21/0052; A63B 21/04; A63B 21/0421; A63B 21/0435; A63B 60/56; A63B 69/0028; A63B 69/0035; A63B 21/153; A63B 21/154; A63B 22/02–22/0292
See application file for complete search history.

(56) References Cited

U.S. PATENT DOCUMENTS 9,595 A 2/1853 Moreland
9,695 A 5/1853 Hinsdale
(Continued)

FOREIGN PATENT DOCUMENTS

CN 2172137 y 7/1994
CN 101784308 11/2001
(Continued)

OTHER PUBLICATIONS

Exxentric, Movie Archives, obtained from http://exxentric.com/movies/ on Sep. 18, 2015.
(Continued)

*Primary Examiner* — Nyca T Nguyen
(74) *Attorney, Agent, or Firm* — Maschoff Brennan

(57) ABSTRACT

A treadmill includes an opening formed in a surface of a running deck, a resistance mechanism incorporated into the running deck, and a cable threaded through the opening, where the cable includes a resistance end connected to the resistance mechanism and a pull end accessible through the running deck.

17 Claims, 9 Drawing Sheets

(51) Int. Cl.

| | |
|---|---|
| ***A63B 69/00*** | (2006.01) |
| ***A63B 21/005*** | (2006.01) |
| ***A63B 21/00*** | (2006.01) |
| ***A63B 22/00*** | (2006.01) |
| ***A63B 23/12*** | (2006.01) |
| *A63B 21/02* | (2006.01) |
| *A63B 21/055* | (2006.01) |
| *A63B 21/06* | (2006.01) |
| *A63B 23/02* | (2006.01) |
| *A63B 71/06* | (2006.01) |

(52) U.S. Cl.

CPC ..... *A63B 23/0233* (2013.01); *A63B 23/1272* (2013.01); *A63B 2071/063* (2013.01); *A63B 2071/0625* (2013.01); *A63B 2210/50* (2013.01); *A63B 2220/20* (2013.01); *A63B 2225/093* (2013.01); *A63B 2230/75* (2013.01)

(56) References Cited

U.S. PATENT DOCUMENTS

| | | | |
|---|---|---|---|
| 34,577 | A | 3/1862 | Jabden |
| 104,973 | A | 7/1870 | Man |
| 115,826 | A | 6/1871 | Creed |
| 192,338 | A | 6/1877 | Marshall |
| 232,022 | A | 9/1880 | J H & G H Gifford |
| 232,579 | A | 9/1880 | Weeks |
| 248,121 | A | 10/1881 | Tuttle |
| 284,294 | A | 9/1883 | Graves |
| 321,388 | A | 6/1885 | Ruebsam |
| 325,435 | A | 9/1885 | North |
| 337,942 | A | 3/1886 | Parley |
| 339,638 | A | 4/1886 | Goldie |
| 348,493 | A | 8/1886 | Greene |
| 353,089 | A | 11/1886 | Smith |
| 356,219 | A | 1/1887 | Yeoman |
| 359,778 | A | 3/1887 | Pauber |
| 372,272 | A | 10/1887 | Murphy |
| 374,496 | A | 12/1887 | Reach |
| 421,779 | A | 2/1890 | Steven |
| 428,912 | A | 5/1890 | Holmes |
| 447,780 | A | 3/1891 | Luge |
| 450,792 | A | 4/1891 | Dodd |
| 457,400 | A | 8/1891 | Dowd |
| 470,837 | A | 3/1892 | Hart |
| 480,271 | A | 8/1892 | Newton |
| 484,352 | A | 10/1892 | Ayton |
| 549,084 | A | 10/1895 | Whitaker |
| 588,350 | A | 8/1897 | Perkins |
| 601,307 | A | 3/1898 | Salisbury |
| 603,350 | A | 5/1898 | Towers |
| 610,716 | A | 9/1898 | Marshal |
| 624,995 | A | 5/1899 | Tellefsen |
| 659,216 | A | 10/1900 | Dow ling |
| 663,486 | A | 12/1900 | Boren |
| 674,391 | A | 5/1901 | Baker |
| 679,784 | A | 8/1901 | Ryan |
| 680,556 | A | 8/1901 | Wray |
| 682,988 | A | 9/1901 | Carroll |
| 683,284 | A | 9/1901 | Honey |
| 685,788 | A | 11/1901 | Mcfadden |
| 689,418 | A | 12/1901 | Ryan |
| 722,462 | A | 3/1903 | Smith |
| 723,625 | A | 3/1903 | Thornley |
| 754,992 | A | 3/1904 | Grabner |
| 760,374 | A | 5/1904 | Belvoir |
| 761,504 | A | 5/1904 | Kleinbach |
| 766,930 | A | 8/1904 | Clemons |
| 772,906 | A | 10/1904 | Reach |
| 776,824 | A | 12/1904 | Gryon Jr. |
| 807,670 | A | 12/1905 | Grabner |
| 846,389 | A | 3/1907 | Blackburn |
| 852,193 | A | 4/1907 | Mcmillan |
| 881,521 | A | 3/1908 | Wilson |
| 897,722 | A | 9/1908 | Day |
| 931,394 | A | 8/1909 | Day |
| 937,796 | A | 10/1909 | Hackney |
| 943,127 | A | 12/1909 | Van Boven |
| 964,745 | A | 7/1910 | Blakoe |
| 979,609 | A | 12/1910 | Vaughn |
| 1,016,729 | A | 2/1912 | Barrett |
| 1,019,861 | A | 3/1912 | Titus |
| 1,020,777 | A | 3/1912 | Peterson |
| 1,064,968 | A | 6/1913 | Hagen |
| 1,082,940 | A | 12/1913 | Sharp & Smith |
| 1,115,826 | A | 11/1914 | Johnson |
| 1,123,272 | A | 1/1915 | Goodman |
| 1,144,085 | A | 6/1915 | Abplanalp |
| 1,211,765 | A | 1/1917 | Schmidt |
| 1,316,683 | A | 9/1919 | Calvert |
| 1,422,888 | A | 7/1922 | Reeves |
| 1,495,278 | A | 5/1924 | Titus |
| 1,539,214 | A | 5/1925 | Shockey |
| 1,570,482 | A | 1/1926 | Hale |
| 1,576,474 | A | 3/1926 | Walker |
| 1,580,530 | A | 4/1926 | Rambo |
| 1,585,748 | A | 5/1926 | Wendelken |
| 1,672,944 | A | 6/1928 | Jowett |
| 1,698,831 | A | 1/1929 | Harry |
| 1,715,870 | A | 6/1929 | Augustine |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brow |
| 1,851,843 | A | 3/1932 | Inman |
| 1,893,728 | A | 1/1933 | Bullis |
| 1,902,694 | A | 3/1933 | Edwards |
| 1,917,566 | A | 7/1933 | Alfred |
| 1,919,627 | A | 7/1933 | Gerald |
| 1,928,089 | A | 9/1933 | Blickman |
| 1,930,416 | A | 10/1933 | Alfred |
| 1,973,945 | A | 9/1934 | Chavin |
| 1,978,579 | A | 10/1934 | Hooks |
| 1,982,843 | A | 12/1934 | Traver |
| 1,982,872 | A | 12/1934 | Newton |
| 1,991,520 | A | 2/1935 | Postl |
| 2,067,136 | A | 1/1937 | Bridenbaugh |
| 2,117,957 | A | 5/1938 | Ritter |
| 2,129,262 | A | 9/1938 | Rex |
| 2,145,940 | A | 2/1939 | Marlowe |
| 2,153,077 | A | 4/1939 | Arthur |
| 2,165,700 | A | 7/1939 | Henry |
| 2,177,957 | A | 10/1939 | Stewart |
| 2,183,345 | A | 12/1939 | Brandon |
| 2,209,034 | A | 7/1940 | Rene |
| 2,219,219 | A | 10/1940 | Boger |
| 2,247,946 | A | 7/1941 | Hein et al. |
| 2,255,864 | A | 9/1941 | Stephens |
| 2,274,574 | A | 2/1942 | Zerne |
| 2,315,485 | A | 4/1943 | Le Roy |
| 2,346,105 | A | 4/1944 | Haehnel |
| 2,379,984 | A | 7/1945 | Nereaux |
| 2,399,915 | A | 5/1946 | Drake |
| 2,413,841 | A | 1/1947 | Minuto |
| 2,436,987 | A | 3/1948 | Bailleaux |
| 2,438,548 | A | 3/1948 | Ehmann |
| 2,440,644 | A | 4/1948 | Pow ell |
| 2,456,017 | A | 12/1948 | Park |
| 2,470,544 | A | 5/1949 | Bell |
| 2,472,391 | A | 6/1949 | Albizu |
| 2,500,299 | A | 3/1950 | Spitzkeit |
| 2,512,417 | A | 6/1950 | Polite |
| 2,569,007 | A | 9/1951 | Klyce |
| 2,573,351 | A | 10/1951 | Motis |
| 2,632,645 | A | 3/1953 | Eric |
| 2,637,319 | A | 5/1953 | Bruene |
| 2,640,696 | A | 6/1953 | Adalbert |
| 2,641,250 | A | 6/1953 | Brockman |
| 2,642,288 | A | 6/1953 | Bell |
| 2,645,539 | A | 7/1953 | Thompson |
| 2,646,282 | A | 7/1953 | Bernice |
| 2,648,540 | A | 8/1953 | William |
| 2,654,135 | A | 10/1953 | Grizzard et al. |

(56) References Cited

U.S. PATENT DOCUMENTS 2,674,453 A 4/1954 Hummert
2,695,797 A 11/1954 Mccarthy et al.
2,714,507 A 8/1955 Goodrich
2,740,178 A 4/1956 Kellems
2,743,623 A 5/1956 Wells
2,746,822 A 5/1956 Copenhaver
2,763,156 A 9/1956 Garigal
2,779,139 A 1/1957 Boettcher
2,842,365 A 7/1958 Kelley
2,843,858 A 7/1958 Berma
2,855,200 A 10/1958 Harry
2,874,971 A 2/1959 Devery
2,906,532 A 9/1959 Echols
2,924,456 A 2/1960 Miller
2,927,006 A 3/1960 Brooks
2,938,695 A 5/1960 Ciampa
2,968,337 A 1/1961 Bartlett
2,969,060 A 1/1961 Swanda
2,977,120 A 3/1961 Morris
2,978,830 A 4/1961 Killian
2,984,594 A 5/1961 Runton
2,985,933 A 5/1961 Peterson et al.
3,000,628 A 9/1961 Kellogg
3,035,671 A 5/1962 Sicherman
3,057,201 A 10/1962 Erich
3,059,312 A 10/1962 Jamieson
3,068,002 A 12/1962 Balne
3,068,950 A 12/1962 Davidson
3,072,426 A 1/1963 Gilbert
3,090,092 A 5/1963 Szemplak
3,099,509 A 7/1963 Duenke
3,112,108 A 11/1963 Hanke
3,115,332 A 12/1963 Singleton
3,118,441 A 1/1964 Prosser
3,127,171 A 3/1964 Noland et al.
3,161,395 A 12/1964 Carter
3,179,071 A 4/1965 Johnston
3,193,287 A 7/1965 Robinson
3,194,598 A 7/1965 Goldfuss
3,205,888 A 9/1965 Stroop
3,246,894 A 4/1966 Salisbury
3,256,630 A 6/1966 Spector
3,270,494 A 9/1966 Holmes
3,312,466 A 4/1967 Melchiona
3,316,898 A 5/1967 Brown
3,319,273 A 5/1967 Lawrence
3,323,367 A 6/1967 Searle
3,342,485 A 9/1967 Martin
3,345,067 A 10/1967 Smith
3,349,621 A 10/1967 Mullen
3,358,813 A 12/1967 Kohlhagen
3,370,584 A 2/1968 Wiliam
3,373,993 A 3/1968 Oja et al.
3,378,259 A 4/1968 Kupchinski
3,380,737 A 4/1968 Petros
3,381,958 A 5/1968 Gulland
3,384,370 A 5/1968 Eugene et al.
3,390,460 A 7/1968 Brown
3,394,934 A 7/1968 Petros
3,408,067 A 10/1968 Armstrong
3,408,069 A 10/1968 Lewis
3,411,497 A 11/1968 Rickey et al.
3,411,776 A 11/1968 Holkesvick et al.
3,416,174 A 12/1968 Novitske
3,424,005 A 1/1969 Brown
3,428,311 A 2/1969 Mitchell
3,428,312 A 2/1969 Machen
3,430,507 A 3/1969 Hurst et al.
3,432,164 A 3/1969 Deeks
3,444,830 A 5/1969 Doetsch
3,446,503 A 5/1969 Lawton
3,456,592 A 7/1969 Nelson
3,465,592 A 9/1969 Perrine
3,482,835 A 12/1969 Dean
3,488,051 A 1/1970 Scherer
3,495,824 A 2/1970 Cuinier
3,501,140 A 3/1970 Eichorn
3,511,500 A 5/1970 Dunn
3,514,110 A 5/1970 Thomander
3,518,985 A 7/1970 Quinton
3,540,724 A 11/1970 Hunter
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,588,101 A 6/1971 Jungreis
3,589,193 A 6/1971 Thornton
3,589,715 A 6/1971 Mark
3,589,720 A 6/1971 Agamian
3,592,466 A 7/1971 Parsons
3,598,404 A 8/1971 Bowman
3,601,398 A 8/1971 Brochman
3,602,502 A 8/1971 Jaegar
3,606,320 A 9/1971 Erwin Jr.
3,606,406 A 9/1971 Walters
3,608,898 A 9/1971 Berlin
3,614,097 A 10/1971 Blickman
3,614,108 A 10/1971 Garten
3,617,056 A 11/1971 Herbold
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,640,530 A 2/1972 Henson et al.
3,641,601 A 2/1972 Sieg
3,642,279 A 2/1972 Cutter
3,643,943 A 2/1972 Erwin, Jr. et al.
3,647,209 A 3/1972 La Lanne
3,650,529 A 3/1972 Salm
3,652,085 A 3/1972 Civalier
3,658,327 A 4/1972 Thiede
3,659,845 A 5/1972 Quinton
3,664,666 A 5/1972 Lloyd
3,664,910 A 5/1972 Hollie
3,664,916 A 5/1972 Grellier et al.
3,672,124 A 6/1972 Pirotta
3,679,244 A 7/1972 Reddy
3,686,776 A 8/1972 Dahl
3,689,066 A 9/1972 Hagen
3,690,655 A 9/1972 Chapman
3,703,284 A 11/1972 Hesen
3,708,166 A 1/1973 Annas
3,708,167 A 1/1973 Potgieter
3,709,197 A 1/1973 Moseley
3,728,940 A 4/1973 Peterson
3,731,917 A 5/1973 Townsend
3,738,649 A 6/1973 Miller
3,741,538 A 6/1973 Useldinger
3,744,480 A 7/1973 Gause et al.
3,744,712 A 7/1973 Papadopoulos
3,744,794 A 7/1973 Gause et al.
3,751,033 A 8/1973 Rosenthal
3,756,595 A 9/1973 Hague
3,758,109 A 9/1973 Bender
3,759,511 A 9/1973 Zinkin
3,761,083 A 9/1973 Buchner
3,767,195 A 10/1973 Dimick
3,771,785 A 11/1973 Speyer
3,782,718 A 1/1974 Saylor
3,784,193 A 1/1974 Simjian
3,788,412 A 1/1974 Vincent
3,789,467 A 2/1974 Aratani et al.
3,792,860 A 2/1974 Selnes
3,797,624 A 3/1974 Powell et al.
3,802,698 A 4/1974 Burian et al.
3,802,701 A 4/1974 Good
3,807,728 A 4/1974 Chillier

(56) References Cited

U.S. PATENT DOCUMENTS 3,809,393 A 5/1974 Jones
3,814,420 A 6/1974 Encke
3,815,903 A 6/1974 Blomqvist
3,818,194 A 6/1974 Biro
3,822,488 A 7/1974 Johnson
3,822,599 A 7/1974 Brentham
3,825,253 A 7/1974 Speyer
3,826,491 A 7/1974 Elder
3,831,942 A 8/1974 Del Mar
3,833,216 A 9/1974 Philbin
3,834,696 A 9/1974 Spector
3,840,227 A 10/1974 Chesemore
3,845,756 A 11/1974 Olsson
3,848,467 A 11/1974 Flavell
3,851,874 A 12/1974 Wilkin
3,858,873 A 1/1975 Jones
3,858,874 A 1/1975 Weider
3,858,938 A 1/1975 Kristensson et al.
3,859,840 A 1/1975 Gause et al.
3,861,215 A 1/1975 Bradley
3,869,121 A 3/1975 Flavell
3,870,297 A 3/1975 Elder
3,874,375 A 4/1975 Penner
3,874,657 A 4/1975 Niebojewski
3,880,274 A 4/1975 Bechtloff
3,883,922 A 5/1975 Fleischhauer
3,884,464 A 5/1975 Evangelos
3,891,207 A 6/1975 Helliwell
3,892,404 A 7/1975 Martucci
3,901,379 A 8/1975 Bruhm
3,902,480 A 9/1975 Wilson
3,902,717 A 9/1975 Kulkens
3,903,613 A 9/1975 Bisberg
3,904,196 A 9/1975 Berlin
3,909,857 A 10/1975 Herrera
3,912,263 A 10/1975 Yatso
3,913,908 A 10/1975 Speyer
3,918,710 A 11/1975 Niebojewski
3,920,240 A 11/1975 Ross
3,926,430 A 12/1975 Good, Jr.
3,929,026 A 12/1975 Hofmann
3,938,400 A 2/1976 Konyha
3,938,803 A 2/1976 Wilmoth
3,941,377 A 3/1976 Lie
3,948,513 A 4/1976 Pfotenhauer
3,953,025 A 4/1976 Mazman
3,957,266 A 5/1976 Rice
3,958,803 A 5/1976 Geisselbrecht
3,963,101 A 6/1976 Stadelmann et al.
3,971,555 A 7/1976 Mahnke
3,974,491 A 8/1976 Sipe
3,976,058 A 8/1976 Tidwell
3,977,451 A 8/1976 Duba
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,012,015 A 3/1977 Nelson et al.
4,020,795 A 5/1977 Marks
4,024,949 A 5/1977 Kleysteuber et al.
4,026,545 A 5/1977 Schonenberger
4,026,548 A 5/1977 Birdwell
4,027,531 A 6/1977 Dawson
4,029,312 A 6/1977 Wright
4,033,567 A 7/1977 Lipfert
4,042,305 A 8/1977 Vincent
4,043,552 A 8/1977 Kerkonian
4,056,265 A 11/1977 Ide
4,059,265 A 11/1977 Wieder et al.
4,060,240 A 11/1977 Dunston
4,061,257 A 12/1977 St. Clair
4,063,726 A 12/1977 Wilson
4,063,727 A 12/1977 Hall
4,066,257 A 1/1978 Moller
4,066,259 A 1/1978 Brentham
4,066,868 A 1/1978 Witkin et al.
4,067,372 A 1/1978 Masson
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,076,236 A 2/1978 Ionel
4,076,237 A 2/1978 Dussia
4,077,626 A 3/1978 Newman
4,082,267 A 4/1978 Flavell
4,093,196 A 6/1978 Bauer
4,093,211 A 6/1978 Hughes et al.
4,094,330 A 6/1978 Jong
4,098,100 A 7/1978 Wah
4,101,124 A 7/1978 Mahnke
4,111,417 A 9/1978 Gardner
4,112,928 A 9/1978 Putsch
4,113,071 A 9/1978 Muller et al.
4,120,294 A 10/1978 Wolfe
4,120,924 A 10/1978 Rainville
4,122,585 A 10/1978 Sharp et al.
4,131,701 A 12/1978 VanAuken
4,140,312 A 2/1979 Buchmann
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,154,441 A 5/1979 Gajda
4,157,181 A 6/1979 Cecka
4,157,594 A 6/1979 Raabe
4,167,938 A 9/1979 Remih
4,168,061 A 9/1979 Gordon
4,170,351 A 10/1979 Ozbey
4,171,805 A 10/1979 Abbott
4,176,836 A 12/1979 Coyle
4,179,134 A 12/1979 Atkinson
4,183,156 A 1/1980 Rudy
4,183,494 A 1/1980 Cleveland
4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,215,516 A 8/1980 Huschle et al.
4,216,856 A 8/1980 Moring et al.
4,220,996 A 9/1980 Searcy
4,227,689 A 10/1980 Keiser
4,231,568 A 11/1980 Riley
4,231,569 A 11/1980 Rae
4,235,437 A 11/1980 Ruis et al.
4,236,239 A 11/1980 Imgruth et al.
4,239,092 A 12/1980 Janson
4,240,627 A 12/1980 Brentham
4,241,915 A 12/1980 Noble
4,248,476 A 2/1981 Phelps
4,249,725 A 2/1981 Mattox
4,249,773 A 2/1981 Giambalvo
4,251,932 A 2/1981 Love
4,252,314 A 2/1981 Ceppo
4,253,661 A 3/1981 Russell
4,253,662 A 3/1981 Podolak
4,256,302 A 3/1981 Keiser et al.
4,257,590 A 3/1981 Sullivan et al.
4,258,821 A 3/1981 Wendt
4,258,913 A 3/1981 Brentham
4,263,897 A 4/1981 Terayama
4,274,625 A 6/1981 Gaetano
4,275,882 A 6/1981 Grosser et al.
4,278,095 A 7/1981 Lapeyre
4,278,249 A 7/1981 Forrest
4,286,782 A 9/1981 Fuhrhop
4,290,601 A 9/1981 Mittelstadt

(56) References Cited

U.S. PATENT DOCUMENTS 4,296,924 A 10/1981 Anzaldua et al.
4,298,893 A 11/1981 Holmes
4,300,760 A 11/1981 Bobroff
4,300,761 A 11/1981 Howard
4,301,808 A 11/1981 Taus
4,307,880 A 12/1981 Abram
4,313,602 A 2/1982 Sullivan
4,313,603 A 2/1982 Simjian
4,316,609 A 2/1982 Silberman
4,316,610 A 2/1982 Hinds
4,322,609 A 3/1982 Kato
4,323,237 A 4/1982 Jungerwirth
4,324,501 A 4/1982 Herbenar
4,325,548 A 4/1982 Piccini
4,327,713 A 5/1982 Omco
4,328,964 A 5/1982 Walls
4,328,965 A 5/1982 Hatfield
4,328,968 A 5/1982 Hacker
4,333,978 A 6/1982 Kocher
4,334,676 A 6/1982 Schonenberger
4,334,678 A 6/1982 Doyel
4,334,695 A 6/1982 Ashby
4,337,283 A 6/1982 Haas, Jr.
4,337,529 A 6/1982 Morokawa
4,342,452 A 8/1982 Summa
4,344,616 A 8/1982 Ogden
4,345,756 A 8/1982 Hoagland
4,346,888 A 8/1982 Szabo
4,349,192 A 9/1982 Lambert, Jr. et al.
4,349,597 A 9/1982 Fine et al.
4,350,336 A 9/1982 Hanford
4,354,675 A 10/1982 Barclay et al.
4,354,676 A 10/1982 Ariel
4,355,061 A 10/1982 Zeigler
4,355,645 A 10/1982 Mitani et al.
4,357,010 A 11/1982 Telle
4,357,011 A 11/1982 Voris
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,368,735 A 1/1983 Filmer
4,369,081 A 1/1983 Curry et al.
4,369,966 A 1/1983 Silberman et al.
4,370,766 A 2/1983 Teague, Jr.
4,371,162 A 2/1983 Hartzell
4,372,553 A 2/1983 Hatfield
4,373,716 A 2/1983 Pagani
4,374,587 A 2/1983 Ogden
4,374,588 A 2/1983 Ruggles
4,376,533 A 3/1983 Kolbel
4,377,045 A 3/1983 Moulinex
4,378,111 A 3/1983 Tsuchida et al.
4,382,596 A 5/1983 Silberman
4,383,684 A 5/1983 Schliep
4,383,714 A 5/1983 Ishida
4,384,715 A 5/1983 Savio et al.
4,387,893 A 6/1983 Baldwin
4,389,047 A 6/1983 Hall
4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,406,451 A 9/1983 Gaetano
4,408,613 A 10/1983 Relyea
4,422,635 A 12/1983 Herod
4,422,636 A 12/1983 de Angeli
4,423,630 A 1/1984 Morrison
4,423,864 A 1/1984 Wiik
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell
4,431,184 A 2/1984 Lew et al.
4,434,981 A 3/1984 Norton
4,441,708 A 4/1984 Brentham
4,445,684 A 5/1984 Ruff
4,448,434 A 5/1984 Anderson
4,452,448 A 6/1984 Ausherman
4,453,766 A 6/1984 DiVito
4,456,245 A 6/1984 Baldwin
4,456,246 A 6/1984 Szabo
4,461,472 A 7/1984 Martinez
4,461,473 A 7/1984 Cole
4,463,948 A 8/1984 Mohr
4,465,274 A 8/1984 Davenport
4,465,276 A 8/1984 Cox
4,465,277 A 8/1984 Dittrich
4,474,370 A 10/1984 Oman
4,476,582 A 10/1984 Strauss et al.
4,477,071 A 10/1984 Brown et al.
4,478,413 A 10/1984 Siwula
4,480,831 A 11/1984 Muller-Deinhardt
4,482,152 A 11/1984 Wolff
4,489,933 A 12/1984 Fisher
4,489,936 A 12/1984 Dal Monte
4,491,318 A 1/1985 Francke
4,492,375 A 1/1985 Connelly
4,493,561 A 1/1985 Bouchet
4,494,662 A 1/1985 Clymer
4,495,560 A 1/1985 Sugimoto et al.
4,496,147 A 1/1985 Decloux et al.
4,499,784 A 2/1985 Shum
4,502,679 A 3/1985 De Lorenzo
4,502,682 A 3/1985 Miller
4,504,055 A 3/1985 Wells
4,504,968 A 3/1985 Kaneko et al.
4,505,474 A 3/1985 Mattox
4,505,475 A 3/1985 Olschansky et al.
4,505,495 A 3/1985 Foss et al.
4,509,510 A 4/1985 Hook
4,511,137 A 4/1985 Jones
4,512,566 A 4/1985 Bicocchi
4,512,567 A 4/1985 Phillips
4,512,571 A 4/1985 Hermelin
4,515,363 A 5/1985 Schleffendorf
4,515,988 A 5/1985 Bayer et al.
4,519,603 A 5/1985 Decloux
4,521,013 A 6/1985 Dofel
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,536,244 A 8/1985 Greci et al.
4,537,396 A 8/1985 Hooper
4,538,805 A 9/1985 Parviainen
4,540,171 A 9/1985 Clark
4,540,173 A 9/1985 Hopkins, Jr.
4,542,897 A 9/1985 Melton
4,542,899 A 9/1985 Hendricks
4,544,152 A 10/1985 Taitel
4,544,153 A 10/1985 Babcock
4,546,967 A 10/1985 Kecala
4,546,970 A 10/1985 Mahnke
4,546,971 A 10/1985 Raasoch
4,548,405 A 10/1985 Lee
4,549,044 A 10/1985 Durham
4,549,433 A 10/1985 Gneiss et al.
4,549,733 A 10/1985 Salyer
4,549,734 A 10/1985 Hibler, Jr.
4,555,108 A 11/1985 Monteiro
4,555,109 A 11/1985 Hartmann
4,556,216 A 12/1985 Pitkanen
4,563,001 A 1/1986 Terauds
4,563,003 A 1/1986 Bugallo et al.
4,564,193 A 1/1986 Stewart
4,565,369 A 1/1986 Bedgood
4,566,461 A 1/1986 Lubell et al.
4,566,689 A 1/1986 Ogden

(56) References Cited

U.S. PATENT DOCUMENTS 4,566,690 A 1/1986 Schook
4,566,732 A 1/1986 Ostergaard, Sr.
4,569,518 A 2/1986 Fulks
4,569,519 A 2/1986 Mattox et al.
4,571,682 A 2/1986 Silverman et al.
4,572,500 A 2/1986 Weiss
4,572,504 A 2/1986 DiBartolo
4,573,449 A 3/1986 Warnke
4,575,074 A 3/1986 Damratoski
4,576,352 A 3/1986 Ogden
4,576,376 A 3/1986 Miller
4,576,377 A 3/1986 Wolff
4,577,860 A 3/1986 Matias et al.
4,577,861 A 3/1986 Bangerter et al.
4,577,865 A 3/1986 Shishido
4,579,360 A 4/1986 Nishimura et al.
4,580,983 A 4/1986 Cassini et al.
4,581,269 A 4/1986 Tilman
4,582,320 A 4/1986 Shaw
4,586,495 A 5/1986 Petrofsky
4,587,695 A 5/1986 Jensen
4,589,656 A 5/1986 Baldwin
4,591,147 A 5/1986 Smith et al.
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Jones
4,601,142 A 7/1986 Frommelt
4,602,779 A 7/1986 Ogden
4,603,855 A 8/1986 Sebelle
4,603,856 A 8/1986 Fiore
4,606,540 A 8/1986 Chin Sen
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,620,701 A 11/1986 Mojden
4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,627,614 A 12/1986 Angeli
4,627,615 A 12/1986 Nurkowski
4,627,616 A 12/1986 Kauffman
4,627,618 A 12/1986 Schwartz
4,630,817 A 12/1986 Buckley
4,632,385 A 12/1986 Geraci
4,632,386 A 12/1986 Beech
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,638,994 A 1/1987 Gogarty
4,641,833 A 2/1987 Trethewey
4,642,080 A 2/1987 Takano et al.
4,642,769 A 2/1987 Petrofsky
4,643,418 A 2/1987 Bart
4,643,420 A 2/1987 Riley
4,645,197 A 2/1987 Mcfee
4,645,198 A 2/1987 Levenston
4,645,200 A 2/1987 Hix
4,645,201 A 2/1987 Evans
4,645,917 A 2/1987 Penney et al.
4,647,037 A 3/1987 Donohue
4,647,040 A 3/1987 Ehrenfried
4,647,041 A 3/1987 Whiteley
4,648,481 A 3/1987 Lee
4,648,594 A 3/1987 Schleffendorf
4,650,067 A 3/1987 Brule
4,650,183 A 3/1987 McIntyre
4,650,184 A 3/1987 Brebner
4,650,185 A 3/1987 Cartwright
4,651,446 A 3/1987 Yukawa et al.
4,651,581 A 3/1987 Svensson
4,651,988 A 3/1987 Sobel
4,655,448 A 4/1987 Harder
4,657,246 A 4/1987 Salyer
4,659,074 A 4/1987 Taitel et al.
4,659,077 A 4/1987 Stropkay
4,659,078 A 4/1987 Blome
4,660,550 A 4/1987 Bodine
4,662,629 A 5/1987 Plovie
4,662,630 A 5/1987 Dignard et al.
4,664,371 A 5/1987 Viander
4,664,373 A 5/1987 Hait
4,664,646 A 5/1987 Rorabaugh
4,665,388 A 5/1987 Ivie et al.
4,666,149 A 5/1987 Olschansky et al.
4,666,151 A 5/1987 Chillier
4,671,257 A 6/1987 Kaiser et al.
4,673,177 A 6/1987 Szymski
4,673,180 A 6/1987 Rice
4,674,740 A 6/1987 Iams et al.
4,674,743 A 6/1987 Hirano
4,678,182 A 7/1987 Nakao et al.
4,678,185 A 7/1987 Mahnke
4,679,786 A 7/1987 Rodgers
4,679,787 A 7/1987 Guilbault
4,684,121 A 8/1987 Nestegard
4,684,126 A 8/1987 Dalebout et al.
4,685,671 A 8/1987 Hagerman et al.
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,706,953 A 11/1987 Graham
4,708,337 A 11/1987 Shyu
4,708,338 A 11/1987 Potts
4,708,837 A 11/1987 Baxter et al.
4,709,917 A 12/1987 Yang
4,709,918 A 12/1987 Grinblat
4,709,920 A 12/1987 Schnell
4,711,447 A 12/1987 Mansfield
4,714,244 A 12/1987 Kolomayets et al.
4,714,248 A 12/1987 Koss
4,717,146 A 1/1988 Nohara
4,718,207 A 1/1988 Frommelt
4,720,093 A 1/1988 Del Mar
4,720,099 A 1/1988 Carlson
4,720,789 A 1/1988 Hector et al.
4,721,301 A 1/1988 Drake
4,721,303 A 1/1988 Fitzpatrick
4,722,522 A 2/1988 Lundgren
4,725,057 A 2/1988 Shifferaw
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane

(56) References Cited

U.S. PATENT DOCUMENTS

| | | | |
|---|---|---|---|
| 4,730,829 | A | 3/1988 | Carlson |
| 4,733,858 | A | 3/1988 | Lan |
| 4,733,860 | A | 3/1988 | Steffee |
| 4,733,905 | A | 3/1988 | Buickerood |
| 4,741,530 | A | 5/1988 | Wolf |
| 4,743,009 | A | 5/1988 | Beale |
| 4,743,010 | A | 5/1988 | Geraci |
| 4,743,015 | A | 5/1988 | Marshall |
| 4,743,017 | A | 5/1988 | Jaeger |
| 4,744,559 | A | 5/1988 | Mahnke et al. |
| 4,746,115 | A | 5/1988 | Lahman |
| 4,749,184 | A | 6/1988 | Tobin |
| 4,750,736 | A | 6/1988 | Watterson |
| 4,750,738 | A | 6/1988 | Dang |
| 4,751,755 | A | 6/1988 | Carey, Jr. et al. |
| 4,753,437 | A | 6/1988 | Lapcevic |
| 4,756,098 | A | 7/1988 | Boggia |
| 4,756,527 | A | 7/1988 | Ledbetter |
| 4,757,495 | A | 7/1988 | Decker et al. |
| 4,757,987 | A | 7/1988 | Allemand |
| 4,759,540 | A | 7/1988 | Yu et al. |
| 4,763,284 | A | 8/1988 | Carlin |
| 4,763,897 | A | 8/1988 | Yakata |
| 4,765,610 | A | 8/1988 | Sidwell |
| 4,765,613 | A | 8/1988 | Voris |
| 4,765,616 | A | 8/1988 | Wolff |
| 4,768,780 | A | 9/1988 | Hayes |
| 4,770,411 | A | 9/1988 | Armstrong et al. |
| 4,771,148 | A | 9/1988 | Bersonnet |
| 4,771,577 | A | 9/1988 | Abe |
| 4,772,015 | A | 9/1988 | Carlson et al. |
| 4,773,170 | A | 9/1988 | Moore et al. |
| 4,773,640 | A | 9/1988 | Kolbel et al. |
| 4,774,679 | A | 9/1988 | Carlin |
| 4,775,149 | A | 10/1988 | Wilson |
| 4,776,581 | A | 10/1988 | Shepherdson |
| 4,776,582 | A | 10/1988 | Ramhorst |
| 4,776,587 | A | 10/1988 | Carlson et al. |
| 4,778,173 | A | 10/1988 | Joutras |
| 4,779,867 | A | 10/1988 | Hinds |
| 4,779,884 | A | 10/1988 | Minati |
| 4,784,384 | A | 11/1988 | Deola |
| 4,786,049 | A | 11/1988 | Lautenschlager |
| 4,786,050 | A | 11/1988 | Geschwender |
| 4,789,153 | A | 12/1988 | Brown |
| 4,790,522 | A | 12/1988 | Drutchas |
| 4,790,528 | A | 12/1988 | Nakao et al. |
| 4,790,596 | A | 12/1988 | Shifferaw |
| 4,792,134 | A | 12/1988 | Chen |
| 4,793,608 | A | 12/1988 | Mahnke et al. |
| 4,797,968 | A | 1/1989 | Wenzlick |
| 4,798,377 | A | 1/1989 | White |
| 4,798,760 | A | 1/1989 | Diaz-Kotti |
| 4,799,475 | A | 1/1989 | Iams et al. |
| 4,799,671 | A | 1/1989 | Hoggan et al. |
| 4,801,079 | A | 1/1989 | Gonella |
| 4,801,139 | A | 1/1989 | Vanhoutte |
| 4,801,140 | A | 1/1989 | Bergeron |
| 4,804,178 | A | 2/1989 | Friedebach |
| 4,805,901 | A | 2/1989 | Kulick |
| 4,807,874 | A | 2/1989 | Little |
| 4,807,893 | A | 2/1989 | Huang |
| 4,809,804 | A | 3/1989 | Houston et al. |
| 4,809,972 | A | 3/1989 | Rasmussen et al. |
| 4,809,973 | A | 3/1989 | Johns |
| 4,809,976 | A | 3/1989 | Berger |
| 4,813,665 | A | 3/1989 | Carr |
| 4,813,667 | A | 3/1989 | Watterson |
| 4,813,668 | A | 3/1989 | Solloway |
| 4,813,743 | A | 3/1989 | Mizelle |
| 4,814,661 | A | 3/1989 | Ratzlaff et al. |
| 4,817,938 | A | 4/1989 | Nakao et al. |
| 4,817,939 | A | 4/1989 | Augspurger et al. |
| 4,817,940 | A | 4/1989 | Shaw et al. |
| 4,818,175 | A | 4/1989 | Kimura |
| 4,818,234 | A | 4/1989 | Redington |
| 4,819,583 | A | 4/1989 | Guerra |
| 4,819,818 | A | 4/1989 | Simkus et al. |
| 4,822,029 | A | 4/1989 | Sarno |
| 4,822,034 | A | 4/1989 | Shields |
| 4,822,035 | A | 4/1989 | Jennings et al. |
| 4,822,038 | A | 4/1989 | Maag |
| 4,824,104 | A | 4/1989 | Bloch |
| 4,826,153 | A | 5/1989 | Schalip |
| 4,826,157 | A | 5/1989 | Fitzpatrick |
| 4,826,158 | A | 5/1989 | Fields, Jr. |
| 4,826,159 | A | 5/1989 | Hersey |
| 4,828,255 | A | 5/1989 | Lahman |
| 4,828,257 | A | 5/1989 | Dyer et al. |
| 4,828,522 | A | 5/1989 | Santos |
| 4,828,713 | A | 5/1989 | McDonald et al. |
| 4,830,362 | A | 5/1989 | Bull |
| 4,830,363 | A | 5/1989 | Kennedy |
| 4,830,365 | A | 5/1989 | March |
| 4,832,332 | A | 5/1989 | Dumbser |
| 4,834,365 | A | 5/1989 | Jones |
| 4,834,396 | A | 5/1989 | Schnell |
| 4,836,530 | A | 6/1989 | Stanley, Jr. |
| 4,836,535 | A | 6/1989 | Pearson |
| 4,837,157 | A | 6/1989 | Turnell et al. |
| 4,838,180 | A | 6/1989 | Gutgsell |
| 4,838,543 | A | 6/1989 | Armstrong et al. |
| 4,838,544 | A | 6/1989 | Sasakawa et al. |
| 4,840,372 | A | 6/1989 | Oglesby et al. |
| 4,840,373 | A | 6/1989 | Maag |
| 4,842,266 | A | 6/1989 | Sweeney, Sr. |
| 4,842,268 | A | 6/1989 | Jenkins |
| 4,842,274 | A | 6/1989 | Oosthuizen |
| 4,844,448 | A | 7/1989 | Niznik |
| 4,844,449 | A | 7/1989 | Truslaske |
| 4,844,453 | A | 7/1989 | Hestilow |
| 4,844,456 | A | 7/1989 | Habing et al. |
| 4,846,458 | A | 7/1989 | Potts |
| 4,846,693 | A | 7/1989 | Baer |
| 4,848,737 | A | 7/1989 | Ehrenfield |
| 4,850,585 | A | 7/1989 | Dalebout |
| 4,852,874 | A | 8/1989 | Sleichter, III et al. |
| 4,854,578 | A | 8/1989 | Fulks |
| 4,855,942 | A | 8/1989 | Bianco |
| 4,856,773 | A | 8/1989 | Deola |
| 4,856,775 | A | 8/1989 | Colledge |
| 4,858,912 | A | 8/1989 | Boyd |
| 4,858,915 | A | 8/1989 | Szabo |
| 4,858,918 | A | 8/1989 | Iams et al. |
| 4,860,763 | A | 8/1989 | Schminke |
| 4,861,020 | A | 8/1989 | Soligny, Sr. |
| 4,861,023 | A | 8/1989 | Wedman |
| 4,861,025 | A | 8/1989 | Rockwell |
| 4,863,157 | A | 9/1989 | Mendel et al. |
| 4,863,161 | A | 9/1989 | Telle |
| 4,863,163 | A | 9/1989 | Wehrell |
| 4,865,344 | A | 9/1989 | Romero, Sr. et al. |
| 4,866,704 | A | 9/1989 | Bergman |
| 4,867,442 | A | 9/1989 | Matthews |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,872,670 | A | 10/1989 | Nichols |
| 4,875,676 | A | 10/1989 | Zimmer |
| 4,877,239 | A | 10/1989 | Dela Rosa |
| 4,878,662 | A | 11/1989 | Chern |
| 4,878,663 | A | 11/1989 | Luquette |
| 4,880,227 | A | 11/1989 | Sowell |
| 4,880,229 | A | 11/1989 | Broussard |
| 4,880,230 | A | 11/1989 | Cook |
| 4,883,272 | A | 11/1989 | Lay |
| 4,886,266 | A | 12/1989 | Trulaske |
| 4,887,929 | A | 12/1989 | Hale |
| 4,889,108 | A | 12/1989 | Bond et al. |
| 4,889,131 | A | 12/1989 | Salem et al. |
| 4,889,458 | A | 12/1989 | Taylor |
| 4,891,764 | A | 1/1990 | McIntosh |
| 4,891,785 | A | 1/1990 | Donohoo |

(56) References Cited

U.S. PATENT DOCUMENTS 4,893,409 A 1/1990 Poehlmann
4,893,810 A 1/1990 Lee
4,894,933 A 1/1990 Tonkel et al.
4,898,379 A 2/1990 Shiba
4,898,381 A 2/1990 Gordon
4,900,012 A 2/1990 Fu
4,900,013 A 2/1990 Rodgers, Jr.
4,900,016 A 2/1990 Caruthers
4,900,017 A 2/1990 Bold, Jr.
4,900,018 A 2/1990 Ish, III
4,902,006 A 2/1990 Stallings, Jr.
4,902,007 A 2/1990 Ferrari
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,907,973 A 3/1990 Hon
4,909,504 A 3/1990 Yang
4,909,505 A 3/1990 Tee
4,911,427 A 3/1990 Matsumoto et al.
4,911,436 A 3/1990 Lighter
4,911,438 A 3/1990 Van Straaten
4,912,638 A 3/1990 Pratt, Jr.
4,913,396 A 4/1990 Dalebout et al.
4,913,419 A 4/1990 McAuliffe
4,913,422 A 4/1990 Elmore
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,245 A 5/1990 Roberts
4,921,247 A 5/1990 Sterling
4,923,193 A 5/1990 Pitzen et al.
4,925,183 A 5/1990 Kim
4,925,189 A 5/1990 Braeunig
4,925,200 A 5/1990 Jones
4,925,724 A 5/1990 Ogden
4,927,136 A 5/1990 Leask
4,927,138 A 5/1990 Ferrari
4,928,546 A 5/1990 Walters
4,928,957 A 5/1990 Lanier et al.
4,928,961 A 5/1990 Madden
4,930,768 A 6/1990 Lapcevic
4,930,769 A 6/1990 Nenoff
4,930,770 A 6/1990 Baker
4,934,690 A 6/1990 Bull
4,934,692 A 6/1990 Owens
4,934,694 A 6/1990 McIntosh
4,938,469 A 7/1990 Crandell
4,938,473 A 7/1990 Lee
4,938,474 A 7/1990 Sweeney et al.
4,940,233 A 7/1990 Bull
4,941,652 A 7/1990 Nagano et al.
4,941,673 A 7/1990 Bennett
4,944,518 A 7/1990 Flynn
4,948,121 A 8/1990 Haaheim et al.
4,948,123 A 8/1990 Schook
4,949,951 A 8/1990 Deola
4,949,954 A 8/1990 Hix
4,949,958 A 8/1990 Richey
4,949,993 A 8/1990 Stark et al.
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,959,713 A 9/1990 Morotomi et al.
4,960,276 A 10/1990 Feuer et al.
4,964,632 A 10/1990 Rockwell
4,968,028 A * 11/1990 Wehrell ..... A63B 5/16
482/124
4,971,305 A 11/1990 Rennex
4,971,316 A 11/1990 Dalebout et al.
4,973,050 A 11/1990 Santoro
4,974,831 A 12/1990 Dunham
4,974,832 A 12/1990 Dalebout
4,974,836 A 12/1990 Hirsch
4,974,838 A 12/1990 Sollenberger
4,976,424 A 12/1990 Sargeant et al.
4,976,428 A 12/1990 Ghazi
4,976,435 A 12/1990 Shatford
4,978,122 A 12/1990 Dibowski
4,982,955 A 1/1991 Heasley
4,983,847 A 1/1991 Bryan
4,984,810 A 1/1991 Stearns
4,986,261 A 1/1991 Iams et al.
4,986,534 A 1/1991 Meier et al.
4,986,689 A 1/1991 Drutchas
4,989,860 A 2/1991 Iams et al.
4,990,838 A 2/1991 Kawato et al.
4,992,190 A 2/1991 Shtarkman
4,995,777 A 2/1991 Warmington
4,998,723 A 3/1991 Santoro
4,998,725 A 3/1991 Watterson et al.
5,000,440 A 3/1991 Lynch
5,000,442 A 3/1991 Dalebout et al.
5,000,446 A 3/1991 Sarno
5,001,632 A 3/1991 Hall Tipping
5,002,271 A 3/1991 Gonzales
5,004,224 A 4/1991 Wang
5,005,832 A 4/1991 Hoeven
5,007,630 A 4/1991 Real et al.
5,007,631 A 4/1991 Wang
5,011,139 A 4/1991 Towley, III
5,011,142 A 4/1991 Eckler
5,013,031 A 5/1991 Bull
5,015,926 A 5/1991 Casler
5,016,870 A 5/1991 Bulloch et al.
5,018,725 A 5/1991 Cook
5,020,793 A 6/1991 Loane
5,020,794 A 6/1991 Englehardt et al.
5,020,795 A 6/1991 Airy et al.
5,022,377 A 6/1991 Stevens
5,024,441 A 6/1991 Rousseau
5,026,049 A 6/1991 Goodman
5,027,303 A 6/1991 Witte
5,029,801 A 7/1991 Dalebout et al.
5,029,848 A 7/1991 Sleamaker
5,029,849 A 7/1991 Nurkowski
5,029,850 A 7/1991 Van Straaten
5,031,455 A 7/1991 Cline
5,031,901 A 7/1991 Van Saarinen
5,031,905 A 7/1991 Walsh
5,032,048 A 7/1991 Walton et al.
5,033,740 A 7/1991 Schwartz
5,034,576 A 7/1991 Dalebout et al.
5,035,418 A 7/1991 Harabayashi
RE33,662 E 8/1991 Blair et al.
5,037,084 A 8/1991 Flor
5,037,089 A 8/1991 Spagnuolo
5,037,090 A 8/1991 Fitzpatrick
5,039,088 A 8/1991 Shifferaw
5,039,089 A 8/1991 Lapcevic
5,039,091 A 8/1991 Johnson
5,040,785 A 8/1991 Charnitski
5,040,787 A 8/1991 Brotman
5,040,788 A 8/1991 Randall
5,042,704 A 8/1991 Izzo
5,042,799 A 8/1991 Stanley
5,044,629 A 9/1991 Ryan
5,044,631 A 9/1991 Jones
5,044,632 A 9/1991 Jones
5,046,382 A 9/1991 Steinberg
5,046,722 A 9/1991 Antoon
5,048,823 A 9/1991 Bean
5,048,825 A 9/1991 Kelly
5,048,826 A 9/1991 Ryan
5,050,872 A 9/1991 Farenholtz
5,050,873 A 9/1991 Jones
5,051,638 A 9/1991 Pyles

(56) References Cited

U.S. PATENT DOCUMENTS

| | | | |
|---|---|---|---|
| 5,052,375 | A | 10/1991 | Stark |
| 5,052,684 | A | 10/1991 | Kosuge et al. |
| 5,054,770 | A | 10/1991 | Bull |
| 5,054,774 | A | 10/1991 | Chattecx |
| 5,056,777 | A | 10/1991 | Capjon et al. |
| 5,058,881 | A | 10/1991 | Measom |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,626 | A | 11/1991 | Dalebout et al. |
| 5,062,627 | A | 11/1991 | Bingham |
| 5,062,629 | A | 11/1991 | Vaughan |
| 5,062,630 | A | 11/1991 | Nelson |
| 5,062,631 | A | 11/1991 | Dau et al. |
| 5,062,632 | A | 11/1991 | Dalebout et al. |
| 5,062,633 | A | 11/1991 | Engel et al. |
| 5,064,191 | A | 11/1991 | Johnson |
| 5,066,000 | A | 11/1991 | Dolan |
| 5,067,710 | A | 11/1991 | Watterson et al. |
| 5,071,115 | A | 12/1991 | Welch |
| 5,071,119 | A | 12/1991 | Johnson |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,078,152 | A | 1/1992 | Bond et al. |
| 5,081,991 | A | 1/1992 | Chance |
| 5,085,426 | A | 2/1992 | Wanzer et al. |
| 5,085,427 | A | 2/1992 | Finn |
| 5,085,430 | A | 2/1992 | Habing |
| 5,086,385 | A | 2/1992 | Launey et al. |
| 5,087,047 | A | 2/1992 | McConnell |
| 5,088,729 | A | 2/1992 | Dalebout |
| 5,089,960 | A | 2/1992 | Sweeney, Jr. |
| 5,090,694 | A | 2/1992 | Pauls et al. |
| 5,094,249 | A | 3/1992 | Marras et al. |
| 5,094,447 | A | 3/1992 | Wang |
| 5,094,449 | A | 3/1992 | Stearns |
| 5,096,225 | A | 3/1992 | Osawa |
| 5,100,129 | A | 3/1992 | Porter |
| 5,102,121 | A | 4/1992 | Solow et al. |
| 5,102,122 | A | 4/1992 | Piane, Jr. |
| 5,102,124 | A | 4/1992 | Diodati |
| 5,102,380 | A | 4/1992 | Jacobson et al. |
| 5,104,119 | A | 4/1992 | Lynch |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,109,778 | A | 5/1992 | Berkowitz et al. |
| 5,110,117 | A | 5/1992 | Fisher et al. |
| 5,110,121 | A | 5/1992 | Foster |
| 5,112,045 | A | 5/1992 | Mason et al. |
| 5,112,287 | A | 5/1992 | Brewer |
| 5,113,427 | A | 5/1992 | Ryoichi et al. |
| 5,114,388 | A | 5/1992 | Trulaske |
| 5,114,391 | A | 5/1992 | Pitzen et al. |
| 5,116,297 | A | 5/1992 | Stonecipher |
| 5,117,674 | A | 6/1992 | Howard |
| 5,118,112 | A | 6/1992 | Bregman et al. |
| 5,120,289 | A | 6/1992 | Yu |
| 5,123,629 | A | 6/1992 | Takeuchi |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,895 | A | 7/1992 | Rogers, Jr. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,137,501 | A | 8/1992 | Mertesdorf |
| 5,138,730 | A | 8/1992 | Masuda |
| 5,141,478 | A | 8/1992 | Upper |
| 5,141,480 | A | 8/1992 | Lennox et al. |
| 5,141,483 | A | 8/1992 | Smith |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,151,071 | A | 9/1992 | Jain et al. |
| 5,152,210 | A | 10/1992 | Chen |
| 5,156,650 | A | 10/1992 | Bals |
| 5,158,093 | A | 10/1992 | Shvartz |
| 5,158,518 | A | 10/1992 | Pizzuto |
| 5,158,520 | A | 10/1992 | Lemke et al. |
| 5,160,305 | A | 11/1992 | Lin |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |
| 5,176,601 | A | 1/1993 | Reynolds |
| 5,176,602 | A | 1/1993 | Roberts |
| 5,178,590 | A | 1/1993 | Stephens |
| 5,178,593 | A | 1/1993 | Roberts |
| 5,178,599 | A | 1/1993 | Scott |
| 5,180,347 | A | 1/1993 | Chen |
| 5,180,351 | A | 1/1993 | Ehrenfried |
| 5,180,352 | A | 1/1993 | Sreter |
| 5,180,647 | A | 1/1993 | Rowland et al. |
| 5,181,894 | A | 1/1993 | Shieng |
| 5,184,295 | A | 2/1993 | Mann |
| 5,184,988 | A | 2/1993 | Dunham |
| 5,184,991 | A | 2/1993 | Brangi |
| 5,184,994 | A | 2/1993 | Morris |
| 5,186,471 | A | 2/1993 | Vancraeynest |
| 5,190,509 | A | 3/1993 | Davison, Jr. |
| 5,190,513 | A | 3/1993 | Habing et al. |
| 5,192,255 | A | 3/1993 | Dalebout et al. |
| 5,192,257 | A | 3/1993 | Panasewicz |
| 5,192,258 | A | 3/1993 | Keller |
| 5,194,059 | A | 3/1993 | Wu |
| 5,195,781 | A | 3/1993 | Osawa |
| 5,195,935 | A | 3/1993 | Fencel |
| 5,195,937 | A | 3/1993 | Engel et al. |
| 5,199,931 | A | 4/1993 | Easley et al. |
| 5,199,934 | A | 4/1993 | Lin |
| 5,199,935 | A | 4/1993 | Gibson et al. |
| 5,201,694 | A | 4/1993 | Zappel |
| 5,201,772 | A | 4/1993 | Maxwell |
| 5,202,424 | A | 4/1993 | Vlassara et al. |
| 5,203,126 | A | 4/1993 | Sorenson et al. |
| 5,203,229 | A | 4/1993 | Chen |
| 5,203,800 | A | 4/1993 | Meredith |
| 5,203,826 | A | 4/1993 | Dalebout |
| 5,204,670 | A | 4/1993 | Stinton |
| 5,205,798 | A | 4/1993 | Lekhtman |
| 5,205,800 | A | 4/1993 | Grant |
| 5,205,802 | A | 4/1993 | Swisher |
| 5,206,671 | A | 4/1993 | Eydelman et al. |
| 5,207,489 | A | 5/1993 | Miller |
| 5,207,621 | A | 5/1993 | Koch et al. |
| 5,207,622 | A | 5/1993 | Wilkinson et al. |
| 5,207,625 | A | 5/1993 | White |
| 5,207,628 | A | 5/1993 | Graham |
| 5,209,223 | A | 5/1993 | McGorry et al. |
| 5,209,482 | A | 5/1993 | Hopfer |
| 5,209,715 | A | 5/1993 | Walker et al. |
| 5,211,614 | A | 5/1993 | Henes |
| 5,211,617 | A | 5/1993 | Millen |
| 5,213,555 | A | 5/1993 | Hood |
| 5,215,510 | A | 6/1993 | Baran |
| 5,217,422 | A | 6/1993 | Domzalski |

(56) References Cited

U.S. PATENT DOCUMENTS

| | | | |
|---|---|---|---|
| 5,221,240 | A | 6/1993 | Mann |
| 5,221,245 | A | 6/1993 | Yeh |
| 5,222,928 | A | 6/1993 | Yacullo |
| 5,224,909 | A | 7/1993 | Hamilton |
| 5,226,866 | A | 7/1993 | Engel et al. |
| 5,226,868 | A | 7/1993 | Montgomery |
| 5,230,672 | A | 7/1993 | Brown et al. |
| 5,230,673 | A | 7/1993 | Maeyama et al. |
| 5,230,680 | A | 7/1993 | Wu |
| 5,231,752 | A | 8/1993 | Hereford |
| 5,232,422 | A | 8/1993 | Bishop, Jr. |
| 5,233,520 | A | 8/1993 | Kretsch et al. |
| 5,234,392 | A | 8/1993 | Clark |
| 5,234,395 | A | 8/1993 | Miller et al. |
| 5,236,406 | A | 8/1993 | Webber |
| 5,240,417 | A | 8/1993 | Smithson et al. |
| 5,242,339 | A | 9/1993 | Thornton |
| 5,242,340 | A | 9/1993 | Jerome |
| 5,242,342 | A | 9/1993 | Silverman |
| 5,242,343 | A | 9/1993 | Miller |
| 5,242,344 | A | 9/1993 | Hundley |
| 5,242,345 | A | 9/1993 | Mitchell |
| 5,242,347 | A | 9/1993 | Keeton |
| 5,242,348 | A | 9/1993 | Bates |
| 5,242,353 | A | 9/1993 | Cole et al. |
| 5,243,998 | A | 9/1993 | Silverman et al. |
| 5,244,444 | A | 9/1993 | Wostry |
| 5,246,411 | A | 9/1993 | Rackman |
| 5,247,853 | A | 9/1993 | Dalebout |
| 5,250,012 | A | 10/1993 | Whitcomb, Jr. |
| 5,250,013 | A | 10/1993 | Brangi |
| 5,254,065 | A | 10/1993 | Pollock |
| 5,254,066 | A | 10/1993 | Brown et al. |
| 5,254,067 | A | 10/1993 | Habing et al. |
| 5,256,115 | A | 10/1993 | Scholder |
| 5,256,117 | A | 10/1993 | Potts et al. |
| 5,256,118 | A | 10/1993 | Chen |
| 5,256,121 | A | 10/1993 | Brotman |
| 5,256,126 | A | 10/1993 | Grotstein |
| 5,257,084 | A | 10/1993 | Marsh |
| 5,257,701 | A | 11/1993 | Edelson |
| 5,257,964 | A | 11/1993 | Petters |
| 5,260,870 | A | 11/1993 | Tsuchiya et al. |
| 5,261,864 | A | 11/1993 | Fitzpatrick |
| 5,261,865 | A | 11/1993 | Trainor |
| 5,263,913 | A | 11/1993 | Boren |
| 5,263,915 | A | 11/1993 | Habing |
| 5,263,916 | A | 11/1993 | Bobich |
| 5,267,925 | A | 12/1993 | Boyd |
| 5,267,929 | A | 12/1993 | Chen |
| 5,267,930 | A | 12/1993 | Henes |
| 5,269,081 | A | 12/1993 | Gray |
| 5,269,519 | A | 12/1993 | Malone |
| 5,269,736 | A | 12/1993 | Roberts |
| 5,269,737 | A | 12/1993 | Sobotka |
| 5,269,738 | A | 12/1993 | Boren |
| 5,271,416 | A | 12/1993 | Lepley |
| 5,273,285 | A | 12/1993 | Long |
| 5,273,505 | A | 12/1993 | Jones |
| 5,277,678 | A | 1/1994 | Friedebach et al. |
| 5,277,683 | A | 1/1994 | Wilkins |
| 5,277,684 | A | 1/1994 | Harris |
| 5,279,528 | A | 1/1994 | Dalebout et al. |
| 5,279,529 | A | 1/1994 | Eschenbach |
| 5,279,531 | A | 1/1994 | Jen Huey |
| 5,280,936 | A | 1/1994 | Schmidlin |
| 5,281,193 | A | 1/1994 | Colbo, Jr. |
| 5,282,776 | A | 2/1994 | Dalebout |
| 5,284,461 | A | 2/1994 | Wilkinson et al. |
| 5,284,463 | A | 2/1994 | Shields |
| 5,284,464 | A | 2/1994 | Lee, III et al. |
| 5,286,243 | A | 2/1994 | Lapcevic |
| 5,290,205 | A | 3/1994 | Densmore et al. |
| 5,290,211 | A | 3/1994 | Stearns |
| 5,290,214 | A | 3/1994 | Chen |
| 5,292,293 | A | 3/1994 | Schumacher |
| 5,292,297 | A | 3/1994 | Hsu |
| 5,295,928 | A | 3/1994 | Rennex |
| 5,295,935 | A | 3/1994 | Wang |
| 5,298,002 | A | 3/1994 | Lin |
| 5,299,810 | A | 4/1994 | Pierce et al. |
| 5,299,992 | A | 4/1994 | Wilkinson |
| 5,299,993 | A | 4/1994 | Habing |
| 5,299,997 | A | 4/1994 | Chen |
| 5,301,154 | A | 4/1994 | Suga |
| 5,302,162 | A | 4/1994 | Pasero |
| 5,303,885 | A | 4/1994 | Wade |
| 5,306,218 | A | 4/1994 | Chen |
| 5,306,220 | A | 4/1994 | Kearney |
| 5,306,221 | A | 4/1994 | Itaru |
| 5,308,075 | A | 5/1994 | Theriault |
| 5,308,234 | A | 5/1994 | Nicke et al. |
| 5,308,296 | A | 5/1994 | Eckstein |
| 5,308,300 | A | 5/1994 | Chino et al. |
| 5,308,304 | A | 5/1994 | Habing |
| 5,309,355 | A | 5/1994 | Lockwood |
| 5,310,392 | A | 5/1994 | Lo |
| 5,310,394 | A | 5/1994 | Kallios |
| 5,313,852 | A | 5/1994 | Arena |
| 5,313,942 | A | 5/1994 | Platzker |
| 5,314,389 | A | 5/1994 | Dotan |
| 5,314,390 | A | 5/1994 | Westing et al. |
| 5,314,391 | A | 5/1994 | Potash et al. |
| 5,314,392 | A | 5/1994 | Hawkins et al. |
| 5,314,394 | A | 5/1994 | Ronan |
| 5,316,534 | A | 5/1994 | Dalebout et al. |
| 5,318,487 | A | 6/1994 | Golen et al. |
| 5,318,490 | A | 6/1994 | Henderson et al. |
| 5,318,491 | A | 6/1994 | Houston |
| 5,318,495 | A | 6/1994 | Malynowsky |
| 5,320,343 | A | 6/1994 | McKinney |
| 5,320,588 | A | 6/1994 | Wanzer et al. |
| 5,320,591 | A | 6/1994 | Harmon et al. |
| 5,322,489 | A | 6/1994 | Webb et al. |
| 5,323,650 | A | 6/1994 | Fullen et al. |
| 5,323,784 | A | 6/1994 | Shu |
| 5,324,242 | A | 6/1994 | Lo |
| 5,328,410 | A | 7/1994 | Amburgey et al. |
| 5,328,420 | A | 7/1994 | Allen |
| 5,328,422 | A | 7/1994 | Nichols |
| 5,328,428 | A | 7/1994 | Huang |
| 5,328,429 | A | 7/1994 | Potash et al. |
| 5,328,430 | A | 7/1994 | Vittone |
| 5,330,401 | A | 7/1994 | Walstead |
| 5,330,402 | A | 7/1994 | Johnson |
| 5,330,404 | A | 7/1994 | Lopeteguy et al. |
| 5,330,405 | A | 7/1994 | Habing et al. |
| 5,330,408 | A | 7/1994 | Westmoreland, Jr. |
| 5,334,120 | A | 8/1994 | Rasmussen |
| 5,335,188 | A | 8/1994 | Brisson |
| 5,336,142 | A | 8/1994 | Dalebout et al. |
| 5,336,143 | A | 8/1994 | Wu |
| 5,336,144 | A | 8/1994 | Rodden |
| 5,336,145 | A | 8/1994 | Keiser |
| 5,336,146 | A | 8/1994 | Piaget et al. |
| 5,336,148 | A | 8/1994 | Ish, III |
| 5,336,151 | A | 8/1994 | Van Ballegooie |
| 5,338,274 | A | 8/1994 | Jones |
| 5,338,277 | A | 8/1994 | Yang |
| 5,342,261 | A | 8/1994 | Johnston |
| 5,342,264 | A | 8/1994 | Gordon |
| 5,342,269 | A | 8/1994 | Huang |
| 5,342,271 | A | 8/1994 | Long |
| RE34,728 | E | 9/1994 | Hall-Tipping |
| 5,344,372 | A | 9/1994 | Hung |
| 5,344,374 | A | 9/1994 | Telle |
| 5,346,447 | A | 9/1994 | Stearns |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |

(56) References Cited

U.S. PATENT DOCUMENTS

| | | | |
|---|---|---|---|
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,357,696 | A | 10/1994 | Gray |
| 5,358,461 | A | 10/1994 | Bailey, Jr. |
| 5,358,462 | A | 10/1994 | Calderone |
| D352,536 | S | 11/1994 | Byrd et al. |
| 5,359,986 | A | 11/1994 | Magrath, III et al. |
| 5,361,091 | A | 11/1994 | Hoarty et al. |
| 5,361,778 | A | 11/1994 | Seitz |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,362,298 | A | 11/1994 | Brown et al. |
| 5,364,060 | A | 11/1994 | Donovan et al. |
| 5,364,271 | A | 11/1994 | Aknin et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,374,230 | A | 12/1994 | Bonnaime |
| 5,375,068 | A | 12/1994 | Palmer et al. |
| 5,376,053 | A | 12/1994 | Ponder |
| 5,377,171 | A | 12/1994 | Schlup |
| 5,377,258 | A | 12/1994 | Bro |
| 5,378,212 | A | 1/1995 | Pin-Kuo |
| 5,378,216 | A | 1/1995 | Ish, III et al. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,385,520 | A | 1/1995 | Lepine et al. |
| 5,387,164 | A | 2/1995 | Brown, Jr. |
| 5,387,169 | A | 2/1995 | Wang |
| 5,387,170 | A | 2/1995 | Rawls et al. |
| 5,387,171 | A | 2/1995 | Casey et al. |
| 5,391,080 | A | 2/1995 | Bernacki |
| 5,391,132 | A | 2/1995 | Greenwald |
| 5,392,476 | A | 2/1995 | Williams |
| 5,394,922 | A | 3/1995 | Colson et al. |
| 5,396,340 | A | 3/1995 | Ishii et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,409,435 | A | 4/1995 | Daniels |
| 5,410,471 | A | 4/1995 | Alyfuku et al. |
| 5,410,472 | A | 4/1995 | Anderson |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,222 | A | 5/1995 | Dempsey et al. |
| 5,417,634 | A | 5/1995 | Habing |
| 5,417,643 | A | 5/1995 | Taylor |
| 5,419,562 | A | 5/1995 | Cromarty |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,798 | A | 6/1995 | Bond et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,289 | A | 8/1995 | Liverance |
| 5,437,589 | A | 8/1995 | Habing |
| 5,439,225 | A | 8/1995 | Gvoich et al. |
| 5,441,467 | A | 8/1995 | Stevens |
| 5,441,468 | A | 8/1995 | Deckers et al. |
| 5,443,435 | A | 8/1995 | Wilkinson |
| 5,445,583 | A | 8/1995 | Habing |
| 5,447,480 | A | 9/1995 | Fulks |
| 5,449,332 | A | 9/1995 | Hervig |
| 5,449,334 | A | 9/1995 | Kingsbury |
| 5,451,191 | A | 9/1995 | Beenken |
| 5,451,922 | A | 9/1995 | Hamilton |
| 5,452,269 | A | 9/1995 | Cherdak |
| 5,453,066 | A | 9/1995 | Richter, Jr. |
| 5,454,772 | A | 10/1995 | Rodden |
| 5,454,773 | A | 10/1995 | Blanchard et al. |
| 5,456,262 | A | 10/1995 | Birnbaum |
| 5,456,644 | A | 10/1995 | Hecox et al. |
| 5,456,648 | A | 10/1995 | Edinburg |
| 5,458,553 | A | 10/1995 | Wu |
| 5,460,586 | A | 10/1995 | Wilkinson |
| 5,462,051 | A | 10/1995 | Oka et al. |
| 5,462,503 | A | 10/1995 | Benjamin et al. |
| 5,462,504 | A | 10/1995 | Trulaske et al. |
| 5,464,378 | A | 11/1995 | Kuo-Ron Lee |
| 5,466,200 | A | 11/1995 | Ulrich et al. |
| 5,466,203 | A | 11/1995 | Chen |
| 5,467,874 | A | 11/1995 | Whitaker |
| 5,468,205 | A | 11/1995 | McFall et al. |
| 5,469,740 | A | 11/1995 | French et al. |
| 5,470,298 | A | 11/1995 | Curtis |
| 5,471,405 | A | 11/1995 | Marsh |
| 5,472,205 | A | 12/1995 | Bouton |
| 5,472,397 | A | 12/1995 | Ammoscato et al. |
| 5,472,399 | A | 12/1995 | Szekely |
| 5,474,077 | A | 12/1995 | Suga |
| 5,474,087 | A | 12/1995 | Nashner |
| 5,474,090 | A | 12/1995 | Begun et al. |
| 5,474,510 | A | 12/1995 | Chen |

(56) References Cited

U.S. PATENT DOCUMENTS

| | | | |
|---|---|---|---|
| 5,476,428 | A | 12/1995 | Potash et al. |
| 5,476,430 | A | 12/1995 | Lee et al. |
| 5,478,295 | A | 12/1995 | Fracchia |
| 5,478,298 | A | 12/1995 | Chen |
| 5,480,212 | A | 1/1996 | Marconet |
| 5,482,472 | A | 1/1996 | Garoni et al. |
| 5,484,358 | A | 1/1996 | Wang et al. |
| 5,484,362 | A | 1/1996 | Skowronski et al. |
| 5,484,365 | A | 1/1996 | Jones et al. |
| 5,484,389 | A | 1/1996 | Stark |
| 5,486,001 | A | 1/1996 | Baker |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,518 | A | 2/1996 | Measom |
| 5,492,520 | A | 2/1996 | Brown |
| 5,493,127 | A | 2/1996 | Lloyd et al. |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,496,244 | A | 3/1996 | Caruthers |
| 5,498,222 | A | 3/1996 | Hur |
| 5,498,223 | A | 3/1996 | Iams et al. |
| 5,499,956 | A | 3/1996 | Habing et al. |
| 5,499,961 | A | 3/1996 | Mattox |
| 5,501,647 | A | 3/1996 | Snyder |
| 5,501,656 | A | 3/1996 | Homma et al. |
| 5,503,608 | A | 4/1996 | Chang |
| 5,505,011 | A | 4/1996 | Bleimhofer |
| 5,505,677 | A | 4/1996 | Hinds |
| 5,507,271 | A | 4/1996 | Actor |
| 5,507,710 | A | 4/1996 | Chen |
| 5,509,870 | A | 4/1996 | Lloyd |
| 5,510,828 | A | 4/1996 | Lutterbach |
| 5,512,025 | A | 4/1996 | Dalebout et al. |
| 5,512,029 | A | 4/1996 | Barnard |
| 5,514,053 | A | 5/1996 | Hawkins et al. |
| 5,514,059 | A | 5/1996 | Romney |
| 5,516,334 | A | 5/1996 | Easton |
| 5,518,471 | A | 5/1996 | Hettinger et al. |
| 5,518,473 | A | 5/1996 | Miller |
| 5,518,476 | A | 5/1996 | Mcleon |
| 5,518,477 | A | 5/1996 | Simonson |
| 5,518,483 | A | 5/1996 | Oswald |
| 5,518,486 | A | 5/1996 | Sheeler |
| 5,519,189 | A | 5/1996 | Gibisch |
| 5,520,599 | A | 5/1996 | Chen |
| 5,522,783 | A | 6/1996 | Gordon |
| 5,524,110 | A | 6/1996 | Danneels et al. |
| 5,524,637 | A | 6/1996 | Erickson |
| 5,527,239 | A | 6/1996 | Abbondanza |
| 5,527,245 | A | 6/1996 | Dalebout et al. |
| 5,527,249 | A | 6/1996 | Harris |
| 5,527,250 | A | 6/1996 | Chen |
| 5,527,253 | A | 6/1996 | Wilkinson |
| 5,529,554 | A | 6/1996 | Eschenbach |
| 5,529,560 | A | 6/1996 | Dise |
| 5,531,658 | A | 7/1996 | L. S. C. |
| 5,533,899 | A | 7/1996 | Young |
| 5,533,948 | A | 7/1996 | Wilkinson |
| 5,533,951 | A | 7/1996 | Chang |
| 5,533,952 | A | 7/1996 | Schaber |
| 5,535,664 | A | 7/1996 | Rokowski |
| 5,538,486 | A | 7/1996 | France et al. |
| 5,538,489 | A | 7/1996 | Magid |
| 5,540,642 | A | 7/1996 | Sprague |
| 5,542,420 | A | 8/1996 | Goldman |
| 5,542,672 | A | 8/1996 | Meredith |
| 5,542,892 | A | 8/1996 | Buhler |
| 5,545,112 | A | 8/1996 | Densmore et al. |
| 5,545,114 | A | 8/1996 | Gvoich |
| 5,547,439 | A | 8/1996 | Rawls et al. |
| 5,549,052 | A | 8/1996 | Hoffman |
| 5,549,530 | A | 8/1996 | Fulks |
| 5,549,532 | A | 8/1996 | Kropp |
| 5,549,533 | A | 8/1996 | Olson et al. |
| 5,549,536 | A | 8/1996 | Clark |
| 5,551,934 | A | 9/1996 | Binette |
| 5,551,937 | A | 9/1996 | Kwo |
| 5,554,033 | A | 9/1996 | Bizzi et al. |
| 5,554,083 | A | 9/1996 | Chen |
| 5,554,085 | A | 9/1996 | Dalebout |
| 5,554,086 | A | 9/1996 | Habing et al. |
| 5,556,362 | A | 9/1996 | Whipps |
| 5,556,369 | A | 9/1996 | Roberts |
| 5,558,608 | A | 9/1996 | Hall |
| 5,562,572 | A | 10/1996 | Carmein |
| 5,562,574 | A | 10/1996 | Miller |
| 5,562,577 | A | 10/1996 | Nichols, Sr. et al. |
| 5,563,487 | A | 10/1996 | Davis |
| 5,568,993 | A | 10/1996 | Potzick |
| 5,569,120 | A | 10/1996 | Anjanappa et al. |
| 5,569,128 | A | 10/1996 | Dalebout |
| 5,569,133 | A | 10/1996 | Vittone |
| 5,569,138 | A | 10/1996 | Wang et al. |
| 5,571,064 | A | 11/1996 | Holm |
| 5,572,643 | A | 11/1996 | Judson |
| 5,573,485 | A | 11/1996 | Geschwender |
| 5,575,740 | A | 11/1996 | Piaget |
| 5,576,951 | A | 11/1996 | Lockwood |
| 5,577,186 | A | 11/1996 | Mann, II et al. |
| 5,577,981 | A | 11/1996 | Jarvik |
| 5,577,985 | A | 11/1996 | Miller |
| 5,577,987 | A | 11/1996 | Brown |
| 5,580,249 | A | 12/1996 | Jacobsen et al. |
| 5,580,340 | A | 12/1996 | Yu |
| 5,580,341 | A | 12/1996 | Simonson |
| 5,582,563 | A | 12/1996 | Fan |
| 5,582,565 | A | 12/1996 | Soria |
| 5,584,700 | A | 12/1996 | Feldman et al. |
| 5,584,779 | A | 12/1996 | Knecht |
| 5,584,784 | A | 12/1996 | Wu |
| 5,585,583 | A | 12/1996 | Owen |
| 5,586,736 | A | 12/1996 | Mollet |
| 5,586,811 | A | 12/1996 | Tornero |
| 5,586,962 | A | 12/1996 | Hallmark |
| 5,588,938 | A | 12/1996 | Schnider et al. |
| 5,588,942 | A | 12/1996 | Dillard |
| 5,590,128 | A | 12/1996 | Maloney et al. |
| 5,590,181 | A | 12/1996 | Hogan et al. |
| 5,590,893 | A | 1/1997 | Robinson et al. |
| 5,591,104 | A | 1/1997 | Andrus et al. |
| 5,591,106 | A | 1/1997 | Dalebout et al. |
| 5,591,107 | A | 1/1997 | Rodgers, Jr. |
| 5,591,908 | A | 1/1997 | Reid |
| 5,593,372 | A | 1/1997 | Rodgers, Jr. |
| 5,593,380 | A | 1/1997 | Bittikofer |
| 5,595,545 | A | 1/1997 | O'Brien |
| 5,595,556 | A | 1/1997 | Dalebout et al. |
| 5,595,559 | A | 1/1997 | Viel |
| 5,597,362 | A | 1/1997 | Lee |
| 5,597,375 | A | 1/1997 | Simonson |
| 5,598,849 | A | 2/1997 | Browne |
| 5,599,261 | A | 2/1997 | Easley et al. |
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,336 | A | 2/1997 | Gaoiran |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |

(56) References Cited

U.S. PATENT DOCUMENTS 5,618,245 A 4/1997 Trulaske et al.
5,618,250 A 4/1997 Butz
5,619,412 A 4/1997 Hapka
5,619,991 A 4/1997 Sloane
5,620,402 A 4/1997 Simonson
5,620,403 A 4/1997 Lundin
5,622,527 A 4/1997 Watterson et al.
5,624,353 A 4/1997 Naidus
5,624,360 A 4/1997 Wilkins
5,624,361 A 4/1997 Lai
5,625,577 A 4/1997 Kunii et al.
5,626,539 A 5/1997 Piaget
5,626,546 A 5/1997 Little
5,626,548 A 5/1997 Coyle
5,628,715 A 5/1997 Simonson
5,628,716 A 5/1997 Brice
5,630,566 A 5/1997 Case
5,632,209 A 5/1997 Sakakibara
5,632,711 A 5/1997 Hwang
5,634,870 A 6/1997 Wilkinson
5,637,064 A 6/1997 Olson et al.
5,638,343 A 6/1997 Ticknor
5,643,142 A 7/1997 Salerno et al.
5,643,144 A 7/1997 Trulaske
5,643,146 A 7/1997 Stark et al.
5,643,147 A 7/1997 Huang
5,643,152 A 7/1997 Simonson
5,643,153 A 7/1997 Nylen et al.
5,643,157 A 7/1997 Seliber
5,643,162 A 7/1997 Landers et al.
5,645,509 A 7/1997 Brewer et al.
5,645,510 A 7/1997 Wilkinson
5,645,513 A 7/1997 Haydocy et al.
5,645,914 A 7/1997 Horowitz
5,649,882 A 7/1997 Parikh et al.
5,650,709 A 7/1997 Rotunda et al.
5,652,304 A 7/1997 Calderon et al.
5,652,824 A 7/1997 Hirayama et al.
5,653,662 A 8/1997 Rodgers, Jr.
5,653,669 A 8/1997 Cheng
5,655,945 A 8/1997 Jani
5,655,997 A 8/1997 Greenberg et al.
5,656,001 A 8/1997 Baatz
5,656,003 A 8/1997 Robinson et al.
5,658,227 A 8/1997 Stearns
5,659,691 A 8/1997 Durward et al.
5,662,557 A 9/1997 Watterson et al.
5,665,031 A 9/1997 Hsieh
5,665,033 A 9/1997 Palmer
5,665,041 A 9/1997 Hsieh
5,667,459 A 9/1997 Su
5,667,465 A 9/1997 McCollum et al.
5,669,455 A 9/1997 Dietrich
5,669,833 A 9/1997 Stone
5,669,857 A 9/1997 Watterson et al.
5,669,862 A 9/1997 Sayman
5,669,865 A 9/1997 Gordon
5,672,140 A 9/1997 Watterson et al.
5,674,156 A 10/1997 Watterson et al.
5,674,167 A 10/1997 Piaget et al.
5,674,453 A 10/1997 Watterson et al.
5,676,138 A 10/1997 Zawilinski
5,676,624 A 10/1997 Watterson et al.
5,679,047 A 10/1997 Engel
5,679,100 A 10/1997 Charnitski
5,679,101 A 10/1997 Magid
5,681,247 A 10/1997 Webber
5,681,249 A 10/1997 Endelman
5,683,332 A 11/1997 Watterson et al.
5,683,334 A 11/1997 Webber
5,685,804 A 11/1997 Whan-Tong et al.
5,685,810 A 11/1997 Chung
5,688,196 A 11/1997 O'neil
5,688,209 A 11/1997 Trulaske et al.
5,688,210 A 11/1997 Chou
5,688,212 A 11/1997 Walker
5,688,216 A 11/1997 Mauriello
5,690,582 A 11/1997 Ulrich et al.
5,690,587 A 11/1997 Gruenangerl
5,690,589 A 11/1997 Rodgers, Jr.
5,690,852 A 11/1997 Saito et al.
5,692,994 A 12/1997 Eschenbach
5,692,996 A 12/1997 Widerman
5,692,997 A 12/1997 Stearns
5,693,004 A 12/1997 Carlson et al.
5,695,400 A 12/1997 Fennell, Jr. et al.
5,695,434 A 12/1997 Dalebout et al.
5,695,436 A 12/1997 Huang
5,697,834 A 12/1997 Heumann et al.
5,702,323 A 12/1997 Poulton
5,702,325 A 12/1997 Watterson et al.
5,704,875 A 1/1998 Tanabe
5,704,879 A 1/1998 Watterson et al.
5,707,168 A 1/1998 Sharon
5,707,319 A 1/1998 Riley
5,708,355 A 1/1998 Schrey
5,709,428 A 1/1998 Hugghins
5,709,632 A 1/1998 Socwell
5,709,633 A 1/1998 Sokol
5,709,634 A 1/1998 Pointer
5,709,636 A 1/1998 Vallone
5,709,638 A 1/1998 Mackert et al.
5,710,884 A 1/1998 Dedrick
5,711,745 A 1/1998 Yang
5,711,746 A 1/1998 Carlson
5,711,749 A 1/1998 Miller
5,713,549 A 2/1998 Shieh
5,713,794 A 2/1998 Shimojima et al.
5,713,821 A 2/1998 Nissen
5,716,308 A 2/1998 Lee
5,718,657 A 2/1998 Dalebout et al.
5,718,660 A 2/1998 Chen
5,719,825 A 2/1998 Dotter
5,720,200 A 2/1998 Anderson et al.
5,720,474 A 2/1998 Sugiyama
5,720,702 A 2/1998 Lee
5,720,771 A 2/1998 Snell
5,721,539 A 2/1998 Goetzl
5,722,418 A 3/1998 Bro
5,722,420 A 3/1998 Lee
5,722,917 A 3/1998 Olschansky et al.
5,722,920 A 3/1998 Bauer
5,722,921 A 3/1998 Simonson
5,722,922 A 3/1998 Watterson et al.
5,724,025 A 3/1998 Tavori
5,725,459 A 3/1998 Rexach
5,725,463 A 3/1998 Colonello et al.
5,730,236 A 3/1998 Miller et al.
5,733,227 A 3/1998 Lee
5,733,228 A 3/1998 Stevens
5,733,229 A 3/1998 Dalebout et al.
5,733,232 A 3/1998 Hsu
5,734,625 A 3/1998 Kondo
5,735,586 A 4/1998 Cheng
5,735,773 A 4/1998 Vittone
5,735,776 A 4/1998 Swezey
5,738,612 A 4/1998 Van Dongen et al.
5,738,616 A 4/1998 Robertson
5,739,457 A 4/1998 Devecka
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,746,687 A 5/1998 Vial et al.
5,746,688 A 5/1998 Prager
5,749,372 A 5/1998 Allen
5,749,668 A 5/1998 Mcilvain
5,749,787 A 5/1998 Jank
5,749,807 A 5/1998 Webb
5,749,809 A 5/1998 Lin
5,749,813 A 5/1998 Domzalski
5,752,879 A 5/1998 Berdut

(56) References Cited

U.S. PATENT DOCUMENTS 5,752,883 A 5/1998 Butcher et al.
5,752,897 A 5/1998 Skowronski et al.
5,752,901 A 5/1998 Lee
5,754,765 A 5/1998 Danneels et al.
5,755,642 A 5/1998 Miller
5,755,645 A 5/1998 Miller et al.
5,755,646 A 5/1998 Chu
5,755,651 A 5/1998 Homyonfer
5,755,823 A 5/1998 Cleary
5,759,136 A 6/1998 Chen
5,759,139 A 6/1998 Wright
5,759,199 A 6/1998 Snell et al.
5,760,353 A 6/1998 Rapp
5,761,831 A 6/1998 Cho
5,762,503 A 6/1998 Hoo et al.
5,762,584 A 6/1998 Daniels
5,762,587 A 6/1998 Dalebout et al.
5,762,588 A 6/1998 Chen
5,766,118 A 6/1998 Conner
5,769,755 A 6/1998 Henry et al.
5,769,762 A 6/1998 Towley, III et al.
5,771,152 A 6/1998 Crompton et al.
5,771,354 A 6/1998 Crawford
5,772,508 A 6/1998 Sugita et al.
5,772,522 A 6/1998 Nesbit
5,772,558 A 6/1998 Rodgers, Jr.
5,772,560 A 6/1998 Watterson et al.
5,772,563 A 6/1998 Lin
5,776,040 A 7/1998 Webb et al.
5,776,582 A 7/1998 Needham
5,777,678 A 7/1998 Ogata et al.
5,779,596 A 7/1998 Weber
5,779,599 A 7/1998 Chen
5,779,604 A 7/1998 Towley, III et al.
5,779,607 A 7/1998 Harris
5,782,639 A 7/1998 Beal
5,782,723 A 7/1998 Kuo
5,785,630 A 7/1998 Bobick et al.
5,785,631 A 7/1998 Heidecke
5,785,632 A 7/1998 Greenberg et al.
5,788,609 A 8/1998 Miller
5,788,610 A 8/1998 Eschenbach
5,788,611 A 8/1998 Kuo
5,788,616 A 8/1998 Polidi
5,788,618 A 8/1998 Joutras
5,790,785 A 8/1998 Klug et al.
5,792,027 A 8/1998 Gvoich
5,792,028 A 8/1998 Jarvie
5,792,029 A 8/1998 Gordon
5,792,031 A 8/1998 Alton
5,792,034 A 8/1998 Kozlovsky
5,794,210 A 8/1998 Goldhaber et al.
5,795,270 A 8/1998 Woods et al.
5,795,274 A 8/1998 Kasbohm
5,797,578 A 8/1998 Graffeo
5,797,639 A 8/1998 Zorzenon
5,797,805 A 8/1998 Lubell et al.
5,799,281 A 8/1998 Login et al.
5,800,310 A 9/1998 Jones
5,800,321 A 9/1998 Webber
5,800,323 A 9/1998 Ansel
5,803,870 A 9/1998 Buhler
5,803,874 A 9/1998 Wilkinson
5,803,877 A 9/1998 Franey
5,803,882 A 9/1998 Habing et al.
5,807,210 A 9/1998 Devlin
5,807,214 A 9/1998 Riazi
5,810,696 A 9/1998 Webb
5,810,697 A 9/1998 Joiner
5,810,698 A 9/1998 Hullett et al.
5,810,702 A 9/1998 Wilkinson
5,810,747 A 9/1998 Brudny et al.
5,813,142 A 9/1998 Demon
5,813,864 A 9/1998 Ikuta
5,813,945 A 9/1998 Bernacki
5,813,947 A 9/1998 Densmore
5,813,953 A 9/1998 Whipple
5,816,372 A 10/1998 Carlson et al.
5,816,443 A 10/1998 Bustos
5,816,981 A 10/1998 Hung
5,816,983 A 10/1998 Dawes et al.
5,820,478 A 10/1998 Wood et al.
5,820,525 A 10/1998 Riley
5,820,529 A 10/1998 Weintraub
5,820,532 A 10/1998 Oliver
5,823,618 A 10/1998 Fox et al.
5,823,913 A 10/1998 Aruin
5,825,983 A 10/1998 Park et al.
5,827,154 A 10/1998 Gill
5,827,155 A 10/1998 Jensen et al.
5,827,158 A 10/1998 Drecksel
5,829,771 A 11/1998 Hsu
5,830,107 A 11/1998 Brigliadoro
5,830,113 A * 11/1998 Coody ..... A63B 22/02 482/54
5,830,114 A 11/1998 Halfen et al.
5,833,577 A 11/1998 Hurt
5,833,582 A 11/1998 Chen
5,833,583 A 11/1998 Chuang
5,833,584 A 11/1998 Piaget et al.
5,833,587 A 11/1998 Strong et al.
5,836,770 A 11/1998 Powers
5,836,854 A 11/1998 Kuo
5,836,858 A 11/1998 Sharff
5,838,906 A 11/1998 Doyle et al.
5,839,990 A 11/1998 Virkkala
5,839,993 A 11/1998 Fox
5,839,997 A 11/1998 Roth et al.
5,842,956 A 12/1998 Strachan
5,842,961 A 12/1998 Davis
5,845,230 A 12/1998 Lamberson
5,846,166 A 12/1998 Kuo
5,848,396 A 12/1998 Gerace
5,848,954 A 12/1998 Stearns et al.
5,852,264 A 12/1998 Muller
5,854,833 A 12/1998 Hogan et al.
5,855,537 A 1/1999 Coody et al.
5,855,538 A 1/1999 Argabright
5,857,939 A 1/1999 Kaufman
5,857,940 A 1/1999 Husted
5,857,941 A 1/1999 Maresh
5,857,942 A 1/1999 Moon et al.
5,857,943 A 1/1999 Murray
5,860,190 A 1/1999 Cano
5,860,893 A 1/1999 Watterson et al.
5,860,894 A 1/1999 Dalebout et al.
5,860,899 A 1/1999 Rassman
5,864,018 A 1/1999 Morser et al.
5,865,710 A 2/1999 Wilson-Hyde
5,865,714 A 2/1999 Marlowe
5,865,733 A 2/1999 Malinouskas et al.
5,868,108 A 2/1999 Schmitz et al.
5,868,648 A 2/1999 Coody et al.
5,868,653 A 2/1999 Klasen
5,871,421 A 2/1999 Trulaske et al.
5,871,424 A 2/1999 Conner
5,873,369 A 2/1999 Laniado et al.
5,876,095 A 3/1999 Johnston
5,876,310 A 3/1999 Mackey et al.
5,876,313 A 3/1999 Krull
5,879,247 A 3/1999 Winter et al.
5,879,270 A 3/1999 Huish et al.
5,879,271 A 3/1999 Stearns et al.
5,879,273 A 3/1999 Wei
5,879,276 A 3/1999 Miller
5,880,677 A 3/1999 Lestician
5,882,281 A 3/1999 Stearns et al.
5,885,196 A 3/1999 Gvoich
5,885,197 A 3/1999 Barton
5,888,172 A 3/1999 Andrus et al.
5,890,149 A 3/1999 Schmonsees
5,890,562 A 4/1999 Bartels et al.
5,890,906 A 4/1999 Macri
5,890,995 A 4/1999 Bobick et al.

(56) References Cited

U.S. PATENT DOCUMENTS

| | | | |
|---|---|---|---|
| 5,890,996 | A | 4/1999 | Frame et al. |
| 5,890,997 | A | 4/1999 | Roth |
| 5,891,001 | A | 4/1999 | Carnes et al. |
| 5,891,003 | A | 4/1999 | Deac et al. |
| 5,891,004 | A | 4/1999 | Berry |
| 5,891,042 | A | 4/1999 | Sham et al. |
| 5,895,339 | A | 4/1999 | Maresh |
| 5,895,340 | A | 4/1999 | Keller |
| 5,895,342 | A | 4/1999 | Solland |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,897,467 | A | 4/1999 | Habing et al. |
| 5,897,469 | A | 4/1999 | Yalch |
| 5,897,472 | A | 4/1999 | Thulasingam |
| 5,897,474 | A | 4/1999 | Romero |
| 5,899,833 | A | 5/1999 | Ryan et al. |
| 5,899,834 | A | 5/1999 | Dalebout et al. |
| 5,899,963 | A | 5/1999 | Hutchings |
| 5,902,214 | A | 5/1999 | Makikawa et al. |
| 5,904,398 | A | 5/1999 | Farricielli |
| 5,904,636 | A | 5/1999 | Chen |
| 5,904,638 | A | 5/1999 | Habing et al. |
| 5,905,442 | A | 5/1999 | Mosebrook et al. |
| 5,906,269 | A | 5/1999 | Zabron et al. |
| 5,906,494 | A | 5/1999 | Ogawa et al. |
| 5,906,564 | A | 5/1999 | Jacobsen |
| 5,906,566 | A | 5/1999 | Whitcomb |
| 5,906,581 | A | 5/1999 | Tsuda |
| 5,908,373 | A | 6/1999 | Pitre |
| 5,909,544 | A | 6/1999 | Anderson, II et al. |
| 5,910,070 | A | 6/1999 | Henry et al. |
| 5,910,072 | A | 6/1999 | Rawls et al. |
| 5,910,073 | A | 6/1999 | Conner |
| 5,911,044 | A | 6/1999 | Lo et al. |
| 5,911,132 | A | 6/1999 | Sloane |
| 5,911,649 | A | 6/1999 | Miller |
| 5,911,687 | A | 6/1999 | Sato et al. |
| 5,913,310 | A | 6/1999 | Brown |
| 5,913,751 | A | 6/1999 | Eschenbach |
| 5,913,830 | A | 6/1999 | Miles |
| 5,916,063 | A | 6/1999 | Alessandri |
| 5,916,064 | A | 6/1999 | Eschenbach |
| 5,916,065 | A | 6/1999 | McBride et al. |
| 5,916,069 | A | 6/1999 | Wang |
| 5,917,405 | A | 6/1999 | Joao |
| 5,917,692 | A | 6/1999 | Schmitz et al. |
| 5,919,117 | A | 7/1999 | Thompson et al. |
| 5,919,118 | A | 7/1999 | Stearns |
| 5,921,891 | A | 7/1999 | Browne |
| 5,921,892 | A | 7/1999 | Easton |
| 5,921,896 | A | 7/1999 | Boland |
| 5,921,901 | A | 7/1999 | Palacios |
| 5,924,966 | A | 7/1999 | Havlovic |
| 5,925,001 | A | 7/1999 | Hoyt et al. |
| 5,927,780 | A | 7/1999 | Chandler |
| 5,928,116 | A | 7/1999 | Chiang |
| 5,929,748 | A | 7/1999 | Odinak |
| 5,929,782 | A | 7/1999 | Stark |
| 5,929,848 | A | 7/1999 | Albukerk et al. |
| 5,931,763 | A | 8/1999 | Alessandri |
| 5,931,767 | A | 8/1999 | Morales |
| 5,935,048 | A | 8/1999 | Krull |
| 5,937,387 | A | 8/1999 | Summerell et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,574 | A | 8/1999 | Webber |
| 5,938,575 | A | 8/1999 | Stearns |
| 5,940,502 | A | 8/1999 | Hirai et al. |
| 5,940,911 | A | 8/1999 | Wang |
| 5,941,797 | A | 8/1999 | Kashiwaguchi |
| 5,941,800 | A | 8/1999 | Laconis |
| 5,941,803 | A | 8/1999 | Chamberlain |
| 5,941,807 | A | 8/1999 | Cassidy |
| 5,943,794 | A | 8/1999 | Gelsomini |
| 5,944,638 | A | 8/1999 | Maresh |
| 5,944,641 | A | 8/1999 | Habing |
| 5,944,642 | A | 8/1999 | Krull |
| 5,947,868 | A | 9/1999 | Dugan |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,954,106 | A | 9/1999 | Huang |
| 5,954,621 | A | 9/1999 | Joutras et al. |
| 5,956,509 | A | 9/1999 | Kevner |
| 5,957,699 | A | 9/1999 | Peterson et al. |
| 5,957,814 | A | 9/1999 | Eschenbach |
| 5,957,819 | A | 9/1999 | Cortesi |
| 5,961,423 | A | 10/1999 | Sellers |
| 5,961,428 | A | 10/1999 | Webber |
| 5,961,430 | A | 10/1999 | Zuckerman et al. |
| 5,961,561 | A | 10/1999 | Wakefield, II |
| 5,961,593 | A | 10/1999 | Gabber et al. |
| 5,964,684 | A | 10/1999 | Sokol |
| 5,964,701 | A | 10/1999 | Asada et al. |
| 5,967,944 | A | 10/1999 | Vittone et al. |
| 5,967,948 | A | 10/1999 | Carr |
| 5,967,950 | A | 10/1999 | Hsu |
| 5,967,954 | A | 10/1999 | Habing |
| 5,967,955 | A | 10/1999 | Westfall et al. |
| 5,967,975 | A | 10/1999 | Ridgeway |
| 5,970,340 | A | 10/1999 | Edgar |
| 5,971,892 | A | 10/1999 | Lee |
| 5,971,895 | A | 10/1999 | Habing |
| 5,971,902 | A | 10/1999 | Robertson et al. |
| 5,973,696 | A | 10/1999 | Agranat et al. |
| 5,976,039 | A | 11/1999 | Epel et al. |
| 5,976,061 | A | 11/1999 | Moon et al. |
| 5,976,083 | A | 11/1999 | Richardson et al. |
| 5,980,429 | A | 11/1999 | Nashner |
| 5,980,430 | A | 11/1999 | Wang |
| 5,980,432 | A | 11/1999 | Ahman |
| 5,981,168 | A | 11/1999 | Reiner et al. |
| 5,984,798 | A | 11/1999 | Gilmour |
| 5,984,836 | A | 11/1999 | Casali |
| 5,984,839 | A | 11/1999 | Corkum |
| 5,989,161 | A | 11/1999 | Wang et al. |
| 5,989,163 | A | 11/1999 | Rodgers, Jr. |
| 5,989,164 | A | 11/1999 | Kullman et al. |
| 5,989,165 | A | 11/1999 | Giannelli et al. |
| 5,989,166 | A | 11/1999 | Capizzo et al. |
| 5,989,168 | A | 11/1999 | See |
| 5,990,405 | A | 11/1999 | Auten et al. |
| 5,991,143 | A | 11/1999 | Wright et al. |
| 5,993,356 | A | 11/1999 | Houston |
| 5,993,358 | A | 11/1999 | Gureghian et al. |
| 5,993,359 | A | 11/1999 | Eschenbach |
| 5,993,362 | A | 11/1999 | Ghobadi |
| 5,995,868 | A | 11/1999 | Dorfmeister et al. |
| 5,997,447 | A | 12/1999 | Giannelli et al. |
| 5,997,450 | A | 12/1999 | Wilkinson |
| 5,997,476 | A | 12/1999 | Brown |
| 5,998,897 | A | 12/1999 | Bosten et al. |
| 6,002,982 | A | 12/1999 | Fry |
| 6,003,294 | A | 12/1999 | Fitzgerald et al. |
| 6,003,481 | A | 12/1999 | Pischinger et al. |
| 6,004,243 | A | 12/1999 | Ewert |
| 6,004,244 | A | 12/1999 | Simonson |
| 6,004,246 | A | 12/1999 | Sencil |
| 6,004,247 | A | 12/1999 | Webber |
| 6,006,379 | A | 12/1999 | Hensley |
| 6,007,268 | A | 12/1999 | Whittington et al. |
| 6,010,432 | A | 1/2000 | Vawter |
| 6,010,451 | A | 1/2000 | Clawson |
| 6,011,134 | A | 1/2000 | Marks et al. |
| 6,012,591 | A | 1/2000 | Brandenberg |
| 6,012,772 | A | 1/2000 | Conde et al. |
| 6,013,007 | A | 1/2000 | Root et al. |

(56) References Cited

U.S. PATENT DOCUMENTS

| | | | | |
|---|---|---|---|---|
| 6,013,009 | A | 1/2000 | Karkanen | |
| 6,013,011 | A | 1/2000 | Moore et al. | |
| 6,014,432 | A | 1/2000 | Modney | |
| 6,014,634 | A | 1/2000 | Scroggie et al. | |
| 6,015,367 | A | 1/2000 | Scaramucci | |
| 6,015,368 | A | 1/2000 | Clem | |
| 6,015,371 | A | 1/2000 | Davitt | |
| 6,017,293 | A | 1/2000 | Pfefferle | |
| 6,018,705 | A | 1/2000 | Gaudet et al. | |
| 6,019,403 | A | 2/2000 | Corbett | |
| 6,022,300 | A | 2/2000 | Hightower | |
| 6,022,302 | A | 2/2000 | McBride | |
| 6,024,677 | A | 2/2000 | Siwertz | |
| 6,027,428 | A | 2/2000 | Thomas et al. | |
| 6,027,429 | A | 2/2000 | Daniels | |
| 6,027,430 | A | 2/2000 | Stearns et al. | |
| 6,027,432 | A | 2/2000 | Cheng | |
| 6,027,433 | A | 2/2000 | Flynn | |
| 6,029,858 | A | 2/2000 | Srokose | |
| 6,030,320 | A | 2/2000 | Stearns et al. | |
| 6,030,321 | A * | 2/2000 | Fuentes | A63B 21/04 482/74 |
| 6,030,323 | A | 2/2000 | Fontenot et al. | |
| 6,033,227 | A | 3/2000 | Ishige | |
| 6,033,344 | A | 3/2000 | Trulaske et al. | |
| 6,033,347 | A | 3/2000 | Dalebout et al. | |
| 6,033,350 | A | 3/2000 | Krull | |
| 6,036,622 | A | 3/2000 | Gordon | |
| 6,036,625 | A | 3/2000 | Woodruff | |
| 6,039,677 | A | 3/2000 | Spletzer | |
| 6,039,678 | A | 3/2000 | Dawson | |
| 6,042,512 | A | 3/2000 | Eschenbach | |
| 6,042,514 | A | 3/2000 | Abelbeck | |
| 6,042,515 | A | 3/2000 | Wang | |
| 6,042,516 | A | 3/2000 | Norton | |
| 6,042,518 | A | 3/2000 | Hildebrandt et al. | |
| 6,042,519 | A | 3/2000 | Shea | |
| 6,042,523 | A | 3/2000 | Graham | |
| 6,045,487 | A | 4/2000 | Miller | |
| 6,045,488 | A | 4/2000 | Eschenbach | |
| 6,045,490 | A | 4/2000 | Shafer | |
| 6,045,491 | A | 4/2000 | McNergney | |
| 6,050,822 | A | 4/2000 | Faughn | |
| 6,050,920 | A | 4/2000 | Ehrenfried | |
| 6,050,921 | A | 4/2000 | Wang | |
| 6,050,922 | A | 4/2000 | Wang | |
| 6,050,923 | A | 4/2000 | Yu | |
| 6,050,924 | A | 4/2000 | Shea | |
| 6,050,942 | A | 4/2000 | Rust et al. | |
| 6,053,737 | A | 4/2000 | Babbitt et al. | |
| 6,053,816 | A | 4/2000 | Immel | |
| 6,053,844 | A | 4/2000 | Clem | |
| 6,053,847 | A | 4/2000 | Stearns et al. | |
| 6,053,848 | A | 4/2000 | Eschenbach | |
| 6,053,853 | A | 4/2000 | Hinds | |
| 6,055,513 | A | 4/2000 | Katz et al. | |
| 6,055,573 | A | 4/2000 | Gardenswartz et al. | |
| 6,055,747 | A | 5/2000 | Lombardino | |
| 6,056,670 | A | 5/2000 | Shu et al. | |
| 6,056,678 | A | 5/2000 | Giannelli et al. | |
| 6,059,576 | A | 5/2000 | Brann | |
| 6,059,692 | A | 5/2000 | Hickman | |
| 6,059,695 | A | 5/2000 | Hung | |
| 6,059,698 | A | 5/2000 | Mazor | |
| 6,059,701 | A | 5/2000 | George et al. | |
| 6,063,009 | A | 5/2000 | Stearns | |
| 6,065,572 | A | 5/2000 | Schober et al. | |
| 6,066,075 | A | 5/2000 | Poulton | |
| 6,066,077 | A | 5/2000 | Horst | |
| 6,066,705 | A | 5/2000 | Calderon et al. | |
| 6,068,578 | A | 5/2000 | Wang | |
| 6,068,579 | A | 5/2000 | Killian et al. | |
| 6,071,031 | A | 6/2000 | Bailey | |
| 6,071,216 | A | 6/2000 | Giannelli et al. | |
| 6,071,217 | A | 6/2000 | Barnett | |
| 6,074,328 | A | 6/2000 | Johnson | |
| 6,075,525 | A | 6/2000 | Hsieh | |
| 6,077,196 | A | 6/2000 | Eschenbach | |
| 6,077,198 | A | 6/2000 | Eschenbach | |
| 6,077,199 | A | 6/2000 | Hsu | |
| 6,077,200 | A | 6/2000 | Lin | |
| 6,079,915 | A | 6/2000 | Bosten et al. | |
| 6,080,091 | A | 6/2000 | Habing et al. | |
| 6,082,346 | A | 7/2000 | Andrews et al. | |
| 6,083,144 | A | 7/2000 | Towley, III et al. | |
| 6,086,379 | A | 7/2000 | Pendergast et al. | |
| 6,086,520 | A | 7/2000 | Rodriquez | |
| 6,086,521 | A | 7/2000 | Solland | |
| 6,090,014 | A | 7/2000 | Eschenbach | |
| 6,090,016 | A | 7/2000 | Kuo | |
| 6,090,017 | A | 7/2000 | Wang | |
| 6,090,020 | A | 7/2000 | Webber | |
| 6,095,951 | A | 8/2000 | Skowronski et al. | |
| 6,095,954 | A | 8/2000 | Svanberg | |
| 6,099,439 | A | 8/2000 | Ryan et al. | |
| 6,099,442 | A | 8/2000 | Krull | |
| 6,099,444 | A | 8/2000 | Domenge | |
| 6,101,684 | A | 8/2000 | Ginocchio | |
| 6,102,412 | A | 8/2000 | Staffaroni | |
| 6,102,832 | A | 8/2000 | Tani | |
| 6,102,836 | A | 8/2000 | Person | |
| 6,102,837 | A | 8/2000 | Hubbard | |
| 6,102,846 | A | 8/2000 | Patton et al. | |
| 6,103,203 | A | 8/2000 | Fischer | |
| 6,106,297 | A | 8/2000 | Pollak et al. | |
| 6,106,437 | A | 8/2000 | Brooks | |
| 6,106,439 | A | 8/2000 | Boland | |
| 6,110,075 | A | 8/2000 | Woodruff | |
| 6,110,077 | A | 8/2000 | Yu | |
| 6,110,081 | A | 8/2000 | Barrett | |
| 6,112,624 | A | 9/2000 | Chen | |
| 6,113,188 | A | 9/2000 | Stewart et al. | |
| 6,113,323 | A | 9/2000 | Bosten et al. | |
| 6,113,518 | A | 9/2000 | Maresh | |
| 6,113,522 | A | 9/2000 | Montgomery | |
| 6,113,537 | A | 9/2000 | Castano | |
| 6,113,564 | A | 9/2000 | McGuire | |
| 6,117,049 | A | 9/2000 | Lowe | |
| 6,120,421 | A | 9/2000 | Kuo | |
| 6,120,424 | A | 9/2000 | Arline | |
| 6,122,340 | A | 9/2000 | Darley et al. | |
| 6,123,646 | A | 9/2000 | Colassi | |
| 6,123,647 | A | 9/2000 | Mitchell | |
| 6,123,648 | A | 9/2000 | Stevens | |
| 6,123,649 | A | 9/2000 | Lee et al. | |
| 6,123,650 | A | 9/2000 | Birrell | |
| 6,125,851 | A | 10/2000 | Walker et al. | |
| 6,126,574 | A | 10/2000 | Stearns et al. | |
| 6,126,575 | A | 10/2000 | Wang | |
| 6,126,576 | A | 10/2000 | Wang | |
| 6,126,577 | A | 10/2000 | Chang | |
| 6,128,663 | A | 10/2000 | Thomas | |
| 6,128,981 | A | 10/2000 | Bondhus et al. | |
| 6,129,651 | A | 10/2000 | Denaro | |
| 6,129,962 | A | 10/2000 | Quigley et al. | |
| 6,132,337 | A | 10/2000 | Krupka et al. | |
| 6,132,340 | A | 10/2000 | Wang | |
| 6,132,347 | A | 10/2000 | Alessandri | |
| 6,133,610 | A | 10/2000 | Bolam et al. | |
| 6,135,924 | A | 10/2000 | Gibbs et al. | |
| 6,135,925 | A | 10/2000 | Liu | |
| 6,135,926 | A | 10/2000 | Lee | |
| 6,135,927 | A | 10/2000 | Lo | |
| 6,142,870 | A | 11/2000 | Wada et al. | |
| 6,142,912 | A | 11/2000 | Profaci | |
| 6,142,913 | A | 11/2000 | Ewert | |
| 6,142,914 | A | 11/2000 | Crawford et al. | |
| 6,142,915 | A | 11/2000 | Eschenbach | |
| 6,146,315 | A | 11/2000 | Schonenberger | |
| 6,148,262 | A | 11/2000 | Fry | |
| 6,149,551 | A | 11/2000 | Pyles et al. | |
| 6,149,552 | A | 11/2000 | Chen | |
| 6,149,556 | A | 11/2000 | Jordan | |
| 6,149,558 | A | 11/2000 | Chen | |

(56) References Cited

U.S. PATENT DOCUMENTS

| | | | |
|---|---|---|---|
| 6,149,559 | A | 11/2000 | Mackey |
| 6,151,586 | A | 11/2000 | Brown |
| 6,152,854 | A | 11/2000 | Carmein |
| 6,152,856 | A | 11/2000 | Studor et al. |
| 6,152,859 | A | 11/2000 | Stearns |
| 6,152,864 | A | 11/2000 | Giannelli et al. |
| 6,159,131 | A | 12/2000 | Pfeffer |
| 6,162,151 | A | 12/2000 | Tani et al. |
| 6,162,153 | A | 12/2000 | Perez, Jr. |
| 6,162,183 | A | 12/2000 | Hoover |
| 6,162,189 | A | 12/2000 | Girone et al. |
| 6,163,451 | A | 12/2000 | Chiu |
| 6,165,107 | A | 12/2000 | Birrell |
| 6,165,110 | A | 12/2000 | Gajda |
| 6,168,551 | B1 | 1/2001 | Mcguinness |
| 6,168,557 | B1 | 1/2001 | Liao |
| 6,171,186 | B1 | 1/2001 | Kurosawa et al. |
| 6,171,216 | B1 | 1/2001 | Wang |
| 6,171,218 | B1 | 1/2001 | Shea |
| 6,172,178 | B1 | 1/2001 | Koning et al. |
| 6,174,265 | B1 | 1/2001 | Alessandri |
| 6,174,267 | B1 | 1/2001 | Dalebout |
| 6,174,268 | B1 | 1/2001 | Novak |
| 6,175,608 | B1 | 1/2001 | Pyles et al. |
| 6,175,994 | B1 | 1/2001 | Nicoletti |
| 6,176,241 | B1 | 1/2001 | Blau et al. |
| 6,176,814 | B1 | 1/2001 | Ryan et al. |
| 6,179,746 | B1 | 1/2001 | Delman |
| 6,179,748 | B1 | 1/2001 | Barr |
| 6,179,753 | B1 | 1/2001 | Barker et al. |
| 6,181,647 | B1 | 1/2001 | Tipton et al. |
| 6,183,259 | B1 | 2/2001 | Macri et al. |
| 6,183,397 | B1 | 2/2001 | Stearns et al. |
| 6,183,400 | B1 | 2/2001 | Pope |
| 6,183,401 | B1 | 2/2001 | Krull |
| 6,183,403 | B1 | 2/2001 | Dunn |
| 6,183,425 | B1 | 2/2001 | Whalen |
| 6,186,145 | B1 | 2/2001 | Brown |
| 6,186,290 | B1 | 2/2001 | Carlson |
| 6,186,460 | B1 | 2/2001 | Lin |
| 6,186,926 | B1 | 2/2001 | Ellis |
| 6,186,927 | B1 | 2/2001 | Krull |
| 6,186,928 | B1 | 2/2001 | Chen |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,631 | B1 | 2/2001 | Hickman |
| 6,193,635 | B1 | 2/2001 | Webber et al. |
| 6,196,952 | B1 | 3/2001 | Chen |
| 6,196,954 | B1 | 3/2001 | Chen |
| 6,198,394 | B1 | 3/2001 | Jacobsen et al. |
| 6,199,732 | B1 | 3/2001 | Swetish |
| 6,203,473 | B1 | 3/2001 | Atwood |
| 6,203,474 | B1 | 3/2001 | Jones |
| 6,206,795 | B1 | 3/2001 | Ou |
| 6,206,804 | B1 | 3/2001 | Maresh |
| 6,210,305 | B1 | 4/2001 | Eschenbach |
| 6,211,451 | B1 | 4/2001 | Tohgi et al. |
| 6,213,919 | B1 | 4/2001 | Wang |
| 6,213,923 | B1 | 4/2001 | Cameron et al. |
| 6,215,870 | B1 | 4/2001 | Hirai et al. |
| 6,217,483 | B1 | 4/2001 | Kallassy |
| 6,217,487 | B1 | 4/2001 | Reinert |
| 6,217,493 | B1 | 4/2001 | Spletzer |
| 6,217,495 | B1 | 4/2001 | Yalch |
| 6,220,865 | B1 | 4/2001 | Macri et al. |
| 6,220,990 | B1 | 4/2001 | Crivello |
| 6,220,992 | B1 | 4/2001 | Shafik |
| 6,220,995 | B1 | 4/2001 | Chen |
| 6,221,451 | B1 | 4/2001 | Lauer et al. |
| 6,221,667 | B1 | 4/2001 | Reiner et al. |
| 6,224,387 | B1 | 5/2001 | Jones |
| 6,224,516 | B1 | 5/2001 | Disch |
| 6,224,519 | B1 | 5/2001 | Doolittle |
| 6,225,977 | B1 | 5/2001 | Li |
| 6,227,968 | B1 | 5/2001 | Suzuki et al. |
| 6,228,003 | B1 | 5/2001 | Hald et al. |
| 6,230,047 | B1 | 5/2001 | McHugh |
| 6,230,460 | B1 | 5/2001 | Huyett |
| 6,230,501 | B1 | 5/2001 | Bailey, Sr. et al. |
| 6,231,481 | B1 | 5/2001 | Brock |
| 6,231,482 | B1 | 5/2001 | Thompson |
| 6,231,489 | B1 | 5/2001 | McBride et al. |
| 6,231,946 | B1 | 5/2001 | Brown, Jr. et al. |
| 6,234,935 | B1 | 5/2001 | Chu |
| 6,234,936 | B1 | 5/2001 | Wang |
| 6,234,941 | B1 | 5/2001 | Chu |
| 6,237,583 | B1 | 5/2001 | Ripley et al. |
| 6,238,322 | B1 | 5/2001 | Hsu |
| 6,238,323 | B1 | 5/2001 | Simonson |
| 6,241,524 | B1 | 6/2001 | Aoshima et al. |
| 6,241,553 | B1 | 6/2001 | Hsia |
| 6,241,638 | B1 | 6/2001 | Hurt |
| 6,244,987 | B1 | 6/2001 | Ohsuga et al. |
| 6,244,988 | B1 | 6/2001 | Delman |
| 6,244,992 | B1 | 6/2001 | James |
| 6,244,995 | B1 | 6/2001 | Prsala |
| 6,245,001 | B1 | 6/2001 | Siaperas |
| 6,251,047 | B1 | 6/2001 | Stearns et al. |
| 6,251,048 | B1 | 6/2001 | Kaufman |
| 6,251,052 | B1 | 6/2001 | Simonson |
| 6,252,153 | B1 | 6/2001 | Toyama |
| 6,254,513 | B1 | 7/2001 | Takenaka et al. |
| 6,254,514 | B1 | 7/2001 | Maresh et al. |
| 6,254,515 | B1 | 7/2001 | Carman et al. |
| 6,254,516 | B1 | 7/2001 | Giannelli et al. |
| 6,259,944 | B1 | 7/2001 | Margulis et al. |
| 6,260,970 | B1 | 7/2001 | Horn |
| 6,261,022 | B1 | 7/2001 | Dalebout et al. |
| 6,261,209 | B1 | 7/2001 | Coody |
| 6,264,272 | B1 | 7/2001 | Jones et al. |
| 6,264,586 | B1 | 7/2001 | Webber |
| 6,264,588 | B1 | 7/2001 | Ellis |
| 6,267,710 | B1 | 7/2001 | Liu |
| 6,267,711 | B1 | 7/2001 | Hinds |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,278,378 | B1 | 8/2001 | Feiner et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,760 | B1 | 9/2001 | Wakamoto |
| 6,283,859 | B1 | 9/2001 | Carlson et al. |
| 6,283,896 | B1 | 9/2001 | Grunfeld |
| 6,287,239 | B1 | 9/2001 | Hernandez |
| 6,287,240 | B1 | 9/2001 | Trabbic |
| 6,287,241 | B1 | 9/2001 | Ellis |
| 6,290,630 | B1 | 9/2001 | Boland |
| 6,292,688 | B1 | 9/2001 | Patton |
| 6,293,375 | B1 | 9/2001 | Chen |
| 6,293,802 | B1 | 9/2001 | Ahlgren |
| 6,293,892 | B1 | 9/2001 | Slawinski et al. |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,308,565 | B1 | 10/2001 | French |
| 6,309,331 | B1 | 10/2001 | Raymond |
| 6,312,363 | B1 | 11/2001 | Watterson et al. |
| 6,312,366 | B1 | 11/2001 | Prusick |
| 6,313,363 | B1 | 11/2001 | Joly et al. |
| 6,314,058 | B1 | 11/2001 | Lee |
| 6,314,667 | B1 | 11/2001 | Rife et al. |
| 6,315,486 | B1 | 11/2001 | Lunz |
| 6,315,702 | B1 | 11/2001 | Ikonomopoulos |

(56) References Cited

U.S. PATENT DOCUMENTS 6,317,151 B1 11/2001 Ohsuga et al.
6,319,176 B1 11/2001 Landfair
6,319,178 B1 11/2001 Webber
6,319,179 B1 11/2001 Hinds
6,322,059 B1 11/2001 Kelm et al.
6,322,451 B1 11/2001 Miura
6,322,481 B1 11/2001 Krull
6,322,483 B1 11/2001 Rotella
6,325,745 B1 12/2001 Yu
6,325,746 B1 12/2001 Wang
6,328,325 B1 12/2001 Greenwood
6,328,676 B1 12/2001 Alessandri
6,328,677 B1 12/2001 Drapeau
6,334,624 B1 1/2002 Giglio
6,335,100 B1 1/2002 Tominaga et al.
6,336,891 B1 1/2002 Fedrigon et al.
6,338,701 B1 1/2002 Webber
6,340,340 B1 1/2002 Stearns
6,342,028 B1 1/2002 De Sane
6,344,986 B1 2/2002 Jain et al.
6,345,197 B1 2/2002 Fabrizio
6,347,603 B1 2/2002 Felger
6,347,731 B1 2/2002 Burger
6,348,028 B1 2/2002 Cragg
6,350,218 B1 2/2002 Dalebout et al.
6,350,219 B1 2/2002 Hobson
6,350,221 B1 2/2002 Krull
6,352,494 B2 3/2002 McAlonan
6,356,856 B1 3/2002 Damen et al.
6,357,077 B1 3/2002 Jones, Jr. et al.
6,358,187 B1 3/2002 Smith
6,360,408 B1 3/2002 Dykstra et al.
6,361,476 B1 3/2002 Eschenbach
6,368,251 B1 4/2002 Casler
6,368,252 B1 4/2002 Stearns
6,368,254 B1 4/2002 Wall
6,369,313 B2 4/2002 Devecka
6,371,123 B1 4/2002 Stark et al.
6,371,738 B2 4/2002 Jones
6,371,850 B1 4/2002 Sonoda
6,371,895 B1 4/2002 Endelman et al.
6,375,580 B1 4/2002 Schmidt
6,379,287 B1 4/2002 Slawinski et al.
6,379,289 B1 4/2002 Gossie
6,382,627 B1 5/2002 Lundberg
6,383,120 B1 5/2002 Lo
6,385,651 B2 5/2002 Dancs et al.
6,387,015 B1 5/2002 Watson
6,387,016 B1 5/2002 Lo
6,387,018 B1 5/2002 Krull
6,387,019 B1 5/2002 Krull
6,387,022 B1 5/2002 Smith
6,387,024 B1 5/2002 Monti et al.
6,390,923 B1 5/2002 Yoshitomi et al.
6,390,927 B1 5/2002 Cleveland, III
6,390,953 B1 5/2002 Maresh
6,390,955 B1 5/2002 Wang
6,394,239 B1 5/2002 Carlson
6,394,935 B1 5/2002 Lake
6,394,936 B1 5/2002 Voris
6,394,938 B1 5/2002 Tornabene
6,397,797 B1 6/2002 Kolmanovsky et al.
6,398,695 B2 6/2002 Miller
6,402,520 B1 6/2002 Freer
6,402,558 B1 6/2002 Hung-Ju et al.
6,402,666 B2 6/2002 Krull
6,404,418 B1 6/2002 Leem
6,405,077 B1 6/2002 Birnbaum et al.
6,409,513 B1 6/2002 Kawamura et al.
6,409,632 B1 6/2002 Eschenbach
6,409,633 B1 6/2002 Abelbeck
6,413,196 B1 7/2002 Crowson
6,413,197 B2 7/2002 McKechnie et al.
6,416,442 B1 7/2002 Stearns et al.
6,416,444 B1 7/2002 Lim
6,416,446 B1 7/2002 Krull
6,416,447 B1 7/2002 Harmon
6,418,394 B1 7/2002 Puolakanaho et al.
6,419,611 B1 7/2002 Levine et al.
6,421,358 B1 7/2002 Stimmel et al.
6,422,976 B1 7/2002 Eschenbach
6,422,977 B1 7/2002 Eschenbach
6,422,979 B1 7/2002 Krull
6,422,980 B1 7/2002 Simonson
6,422,981 B1 7/2002 Riser
6,422,983 B1 7/2002 Weck
6,427,805 B1 8/2002 Gibson et al.
6,428,449 B1 8/2002 Apseloff
6,428,450 B1 8/2002 Ho
6,430,997 B1 8/2002 French et al.
6,432,026 B1 8/2002 Wang
6,435,466 B1 8/2002 Adams
6,436,007 B1 8/2002 Eschenbach
6,436,008 B1 8/2002 Skowronski et al.
6,436,013 B1 8/2002 Krull
6,440,013 B1 8/2002 Brown
6,440,042 B2 8/2002 Eschenbach
6,440,045 B1 8/2002 Gaston
6,443,521 B1 9/2002 Nye et al.
6,443,875 B1 9/2002 Golen, Jr. et al.
6,443,877 B1 9/2002 Hoecht
6,443,878 B1 9/2002 Webber
6,446,745 B1 9/2002 Lee
6,447,424 B1 9/2002 Ashby et al.
6,447,430 B1 9/2002 Webb et al.
6,447,432 B1 9/2002 Krull
6,450,284 B1 9/2002 Sakyo et al.
6,450,922 B1 9/2002 Henderson et al.
6,450,923 B1 9/2002 Vatti
6,450,925 B1 9/2002 Kuo
6,450,928 B1 9/2002 Larkins, Jr.
6,454,050 B2 9/2002 Gibson et al.
6,454,679 B1 * 9/2002 Radow ..... A63B 22/0235 482/4
6,454,682 B1 9/2002 Kuo
6,455,960 B1 9/2002 Trago et al.
6,458,060 B1 10/2002 Watterson et al.
6,458,061 B2 10/2002 Simonson
6,461,275 B1 10/2002 Wang et al.
6,461,279 B1 10/2002 Kuo
6,461,284 B1 10/2002 Francavilla
6,463,385 B1 10/2002 Fry
6,464,618 B1 10/2002 Shea
6,466,460 B1 10/2002 Rein et al.
6,468,189 B2 10/2002 Alessandri
6,471,622 B1 10/2002 Hammer et al.
6,471,624 B1 10/2002 Voris
6,473,483 B2 10/2002 Pyles
6,474,193 B1 11/2002 Farney
6,475,115 B1 11/2002 Candito
6,475,121 B2 11/2002 Wang
6,475,122 B2 11/2002 Wu
6,478,721 B1 11/2002 Hunter
6,478,736 B1 11/2002 Mault
6,482,128 B1 11/2002 Michalow
6,482,130 B1 11/2002 Pasero et al.
6,482,132 B2 11/2002 Eschenbach
6,482,134 B1 11/2002 Rasmussen
6,482,139 B1 11/2002 Haag
6,484,062 B1 11/2002 Kim
6,485,397 B1 11/2002 Manderbacka
6,488,020 B1 12/2002 Rosas-Magallan
6,488,599 B2 12/2002 Nye
6,488,612 B2 12/2002 Sechrest et al.
6,491,268 B1 12/2002 Channer et al.
6,491,609 B2 12/2002 Webber
6,491,610 B1 12/2002 Henn
6,493,652 B1 12/2002 Ohlenbusch et al.
6,494,814 B1 12/2002 Wang
6,494,817 B2 12/2002 Lake
6,497,426 B2 12/2002 Vanpelt
6,500,097 B1 12/2002 Hall
6,500,101 B1 12/2002 Chen
6,500,102 B1 12/2002 Domenge

(56) References Cited

U.S. PATENT DOCUMENTS

| | | | |
|---|---|---|---|
| 6,503,173 | B2 | 1/2003 | Clem |
| 6,505,503 | B1 | 1/2003 | Teresi et al. |
| 6,506,142 | B2 | 1/2003 | Itoh et al. |
| 6,510,760 | B2 | 1/2003 | Matsuo |
| 6,511,402 | B2 | 1/2003 | Shu et al. |
| 6,513,381 | B2 | 2/2003 | Fyfe et al. |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,515,182 | B2 | 2/2003 | Hosokawa et al. |
| 6,515,593 | B1 | 2/2003 | Stark et al. |
| 6,520,531 | B1 | 2/2003 | Gien |
| 6,520,891 | B1 | 2/2003 | Stephens, Jr. |
| 6,524,226 | B2 | 2/2003 | Kushner |
| 6,527,674 | B1 | 3/2003 | Clem |
| 6,527,678 | B1 | 3/2003 | Wang |
| 6,527,683 | B2 | 3/2003 | Tolles |
| 6,527,685 | B2 | 3/2003 | Endelman et al. |
| 6,527,711 | B1 | 3/2003 | Stivoric et al. |
| 6,527,712 | B1 | 3/2003 | Brown et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,537,185 | B1 | 3/2003 | Hur |
| 6,539,931 | B2 | 4/2003 | Trajkovic et al. |
| 6,540,650 | B1 | 4/2003 | Krull |
| 6,540,651 | B1 | 4/2003 | Aberton et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,217 | B2 | 4/2003 | Kaganovsky |
| 6,551,218 | B2 | 4/2003 | Goh |
| 6,551,220 | B1 | 4/2003 | Schroeder |
| 6,551,223 | B2 | 4/2003 | Cheng |
| 6,551,226 | B1 | 4/2003 | Webber et al. |
| 6,554,749 | B2 | 4/2003 | Iund et al. |
| 6,558,300 | B2 | 5/2003 | Deola |
| 6,558,301 | B1 | 5/2003 | Jackson |
| 6,558,302 | B2 | 5/2003 | Cluff |
| 6,560,903 | B1 | 5/2003 | Darley |
| 6,561,951 | B2 | 5/2003 | Cannon et al. |
| 6,561,955 | B1 | 5/2003 | Dreissigacker et al. |
| 6,561,956 | B1 | 5/2003 | Allison |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,575,885 | B1 | 6/2003 | Weck et al. |
| 6,579,210 | B1 | 6/2003 | Stearns et al. |
| 6,579,213 | B1 | 6/2003 | Webber et al. |
| 6,579,214 | B2 | 6/2003 | Crump |
| 6,582,342 | B2 | 6/2003 | Kaufman |
| 6,582,344 | B2 | 6/2003 | Tang |
| 6,582,345 | B2 | 6/2003 | Roy |
| 6,585,622 | B1 | 7/2003 | Shum et al. |
| 6,585,624 | B1 | 7/2003 | Chen |
| 6,585,626 | B2 | 7/2003 | McBride |
| 6,589,138 | B2 | 7/2003 | Dyer et al. |
| 6,592,498 | B1 | 7/2003 | Trainor |
| 6,592,499 | B2 | 7/2003 | Parker |
| 6,592,502 | B1 | 7/2003 | Phillips |
| 6,595,905 | B2 | 7/2003 | McBride |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,602,191 | B2 | 8/2003 | Quy |
| 6,604,008 | B2 | 8/2003 | Chudley et al. |
| 6,604,023 | B1 | 8/2003 | Brown et al. |
| 6,604,419 | B2 | 8/2003 | Guzman |
| 6,605,020 | B1 | 8/2003 | Huang |
| 6,605,024 | B2 | 8/2003 | Stearns |
| 6,605,038 | B1 | 8/2003 | Teller et al. |
| 6,605,044 | B2 | 8/2003 | Bimbaum |
| 6,606,374 | B1 | 8/2003 | Rokoff et al. |
| 6,607,472 | B2 | 8/2003 | Toole |
| 6,609,478 | B2 | 8/2003 | Del Valle |
| 6,610,063 | B2 | 8/2003 | Kumar et al. |
| 6,611,789 | B1 | 8/2003 | Darley |
| 6,612,170 | B2 | 9/2003 | Brown |
| 6,612,492 | B1 | 9/2003 | Yen |
| 6,612,969 | B2 | 9/2003 | Eschenbach |
| 6,612,971 | B1 | 9/2003 | Morris |
| 6,616,578 | B2 | 9/2003 | Alessandri |
| 6,619,681 | B2 | 9/2003 | Gutierrez |
| 6,619,835 | B2 | 9/2003 | Kita |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,800 | B1 | 9/2003 | Casler |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,908 | B2 | 10/2003 | Hamady |
| 6,629,909 | B1 | 10/2003 | Stearns et al. |
| 6,629,910 | B1 | 10/2003 | Krull |
| 6,632,160 | B2 | 10/2003 | LaFond et al. |
| 6,632,161 | B1 | 10/2003 | Nir |
| 6,634,992 | B1 | 10/2003 | Ogawa |
| 6,634,996 | B2 | 10/2003 | Jacobsen |
| 6,634,997 | B2 | 10/2003 | Breibart et al. |
| 6,634,998 | B2 | 10/2003 | Siaperas |
| 6,635,015 | B2 | 10/2003 | Sagel |
| 6,637,811 | B2 | 10/2003 | Zheng |
| 6,637,818 | B2 | 10/2003 | Williams |
| 6,638,160 | B2 | 10/2003 | Yoshitomi |
| 6,645,124 | B1 | 11/2003 | Clem |
| 6,645,125 | B1 | 11/2003 | Stearns et al. |
| 6,645,126 | B1 | 11/2003 | Martin et al. |
| 6,645,129 | B2 | 11/2003 | Eschenbach |
| 6,645,130 | B2 | 11/2003 | Webber |
| 6,648,353 | B1 | 11/2003 | Cabal |
| 6,648,798 | B2 | 11/2003 | Yoo |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,419 | B1 | 11/2003 | Rota |
| 6,652,424 | B2 | 11/2003 | Dalebout |
| 6,652,425 | B1 | 11/2003 | Martin et al. |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,091 | B1 | 12/2003 | Abelbeck |
| 6,656,093 | B2 | 12/2003 | Chen |
| 6,659,916 | B1 | 12/2003 | Shea |
| 6,659,946 | B1 | 12/2003 | Batchelor et al. |
| 6,660,949 | B2 | 12/2003 | Kamino et al. |
| 6,661,136 | B1 | 12/2003 | Lee |
| 6,662,651 | B1 | 12/2003 | Roth |
| 6,663,127 | B2 | 12/2003 | Miller |
| 6,663,498 | B2 | 12/2003 | Stipan |
| 6,663,500 | B2 | 12/2003 | Huang |
| 6,666,796 | B1 | 12/2003 | MacCready, Jr. |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,606 | B2 | 12/2003 | Krull |
| 6,669,607 | B2 | 12/2003 | Slawinski et al. |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,569 | B1 | 1/2004 | Radow |

(56) References Cited

U.S. PATENT DOCUMENTS 6,676,572 B2 1/2004 Wang
6,676,573 B2 1/2004 Abelbeck et al.
6,676,577 B2 1/2004 Stearns
6,676,579 B1 1/2004 Lin
6,677,299 B2 1/2004 Stern et al.
6,679,816 B1 1/2004 Krull
6,679,820 B2 1/2004 Barkus et al.
6,681,014 B1 1/2004 Ghassabian
6,681,704 B1 1/2004 Brookhiser
6,681,728 B2 1/2004 Haghgooie
6,682,460 B2 1/2004 Lo
6,682,461 B2 1/2004 Wang
6,685,480 B2 2/2004 Nishimoto et al.
6,685,600 B1 2/2004 Ullman
6,685,601 B1 2/2004 Knapp
6,685,602 B2 2/2004 Colosky, Jr. et al.
6,685,607 B1 2/2004 Olson
6,687,535 B2 2/2004 Hautala et al.
6,689,019 B2 2/2004 Ohrt et al.
6,689,023 B2 2/2004 Baumler
6,689,025 B2 2/2004 Emick
6,689,057 B1 2/2004 Shinsel et al.
6,691,839 B1 2/2004 El-Kassouf
6,692,415 B1 2/2004 Winston
6,692,417 B2 2/2004 Burrell
6,695,620 B1 2/2004 Huang
6,695,694 B2 2/2004 Ishikawa et al.
6,695,799 B2 2/2004 Kitadou et al.
6,698,110 B1 3/2004 Robbins
6,699,146 B1 3/2004 Winter et al.
6,699,159 B2 * 3/2004 Rouse ..... A63B 22/02 482/51
6,699,161 B1 3/2004 Speas
6,699,162 B2 3/2004 Chen
6,700,788 B2 3/2004 Matsushita et al.
6,701,271 B2 3/2004 Willner et al.
6,702,719 B1 3/2004 Brown et al.
6,702,723 B2 3/2004 Landfair
6,702,726 B2 3/2004 Lin
6,705,974 B1 3/2004 Tardif
6,705,976 B1 3/2004 Piane, Jr.
6,705,977 B1 3/2004 Ziak
6,708,427 B2 3/2004 Sussmann et al.
6,711,789 B2 3/2004 Ping
6,712,737 B1 3/2004 Nusbaum
6,712,740 B2 3/2004 Simonson
6,716,139 B1 4/2004 Hosseinzadeh-Dolkhani
6,716,142 B2 4/2004 Kuo
6,716,144 B1 4/2004 Shifferaw
6,719,667 B2 4/2004 Wong et al.
6,719,669 B1 4/2004 Wang
6,719,672 B1 4/2004 Ellis et al.
6,719,674 B2 4/2004 Krull
6,722,888 B1 4/2004 Macri et al.
6,723,413 B2 4/2004 Walters
6,726,113 B2 4/2004 Guo
6,726,600 B2 4/2004 Miller
6,726,601 B1 4/2004 Beutel
6,726,602 B2 4/2004 Chang
6,730,002 B2 5/2004 Hald et al.
6,733,423 B1 5/2004 Chang
6,733,424 B2 5/2004 Krull
6,736,360 B1 5/2004 Buczek
6,736,759 B1 5/2004 Stubbs et al.
6,736,765 B2 5/2004 Wallace et al.
6,736,766 B1 5/2004 Gallant
6,738,274 B2 5/2004 Prasad et al.
6,740,007 B2 5/2004 Gordon et al.
6,740,009 B1 5/2004 Hall
6,741,052 B2 5/2004 Fitzgibbon
6,743,153 B2 6/2004 Watterson et al.
6,746,247 B2 6/2004 Barton
6,746,370 B1 6/2004 Fleming et al.
6,746,371 B1 6/2004 Brown et al.
6,746,380 B2 6/2004 Lien et al.
6,746,381 B2 6/2004 Krull
6,747,427 B1 6/2004 Carson
6,749,432 B2 6/2004 French et al.
6,749,536 B1 6/2004 Cuskaden et al.
6,749,537 B1 6/2004 Hickman
6,749,540 B1 6/2004 Pasero et al.
6,749,542 B2 6/2004 Wu
6,749,546 B2 6/2004 Yang
6,749,547 B2 6/2004 Krull
6,751,439 B2 6/2004 Tice et al.
6,752,745 B1 6/2004 Davis
6,757,572 B1 6/2004 Forest
6,758,790 B1 7/2004 Ellis
6,758,791 B1 7/2004 Kuo
6,758,792 B1 7/2004 Chang
6,761,387 B2 7/2004 Sloss
6,761,667 B1 7/2004 Cutler et al.
6,761,672 B1 7/2004 Williams
6,764,429 B1 7/2004 Michalow
6,764,430 B1 7/2004 Fencel
6,764,431 B2 7/2004 Yoss
6,765,726 B2 7/2004 French et al.
6,767,314 B2 7/2004 Thompson
6,769,689 B1 8/2004 Shimomura et al.
6,770,014 B2 8/2004 Amore
6,770,015 B2 8/2004 Simonson
6,776,740 B1 8/2004 Anderson et al.
6,778,938 B1 8/2004 Ng et al.
6,783,482 B2 8/2004 Oglesby et al.
6,786,415 B2 9/2004 Yiu
6,786,821 B2 9/2004 Nobe et al.
6,786,847 B1 9/2004 Morgan et al.
6,786,848 B2 9/2004 Yamashita et al.
6,786,850 B2 9/2004 Nizamuddin
6,786,852 B2 9/2004 Watterson et al.
6,790,162 B1 9/2004 Ellis et al.
6,790,163 B1 9/2004 Van De Laarschot
6,790,178 B1 9/2004 Mault et al.
6,793,607 B2 9/2004 Neil
6,793,609 B1 9/2004 Fan
6,796,159 B2 9/2004 Kelm et al.
6,796,925 B2 9/2004 Martinez et al.
6,796,927 B2 9/2004 Toyama
6,798,378 B1 9/2004 Walters
6,802,800 B1 10/2004 Hobson
6,807,869 B2 10/2004 Farringdon et al.
6,808,458 B1 10/2004 Jung
6,808,472 B1 10/2004 Hickman
6,808,473 B2 10/2004 Hisano et al.
6,808,475 B2 10/2004 Kehrbaum
6,811,516 B1 11/2004 Dugan
6,811,519 B2 11/2004 Kuo
6,811,520 B2 11/2004 Wu
6,817,117 B1 11/2004 Campbell
6,817,968 B2 11/2004 Galbraith et al.
6,817,979 B2 11/2004 Nihtilä
6,821,230 B2 11/2004 Dalebout et al.
6,823,036 B1 11/2004 Chen
6,823,327 B1 11/2004 Klug
6,824,210 B2 11/2004 Zheng
6,824,502 B1 11/2004 Huang
6,825,164 B1 11/2004 Stern et al.
6,825,876 B1 11/2004 Easwar et al.
6,827,669 B2 12/2004 Cohen et al.
6,827,670 B1 12/2004 Stark et al.
6,827,822 B2 12/2004 Tao et al.
6,830,540 B2 12/2004 Watterson et al.
6,830,541 B2 12/2004 Wu
6,835,166 B1 12/2004 Stearns et al.
6,837,827 B1 1/2005 Lee et al.
6,837,829 B2 1/2005 Eschenbach
6,837,830 B2 1/2005 Eldridge
6,837,838 B2 1/2005 List
6,840,892 B1 1/2005 Wu
6,840,904 B2 1/2005 Goldberg
6,842,928 B2 1/2005 Yang et al.
6,843,732 B1 1/2005 Huang
6,846,270 B1 1/2005 Etnyre
6,846,272 B2 1/2005 Rosenow et al.

(56) References Cited

U.S. PATENT DOCUMENTS

| | | | |
|---|---|---|---|
| 6,849,032 | B2 | 2/2005 | Chu |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,859,215 | B1 | 2/2005 | Brown et al. |
| 6,860,131 | B2 | 3/2005 | Armstrong et al. |
| 6,860,836 | B1 | 3/2005 | Wu |
| 6,860,839 | B1 | 3/2005 | Dice |
| 6,860,841 | B1 | 3/2005 | Mortorano |
| 6,863,641 | B1 | 3/2005 | Brown et al. |
| 6,866,613 | B1 | 3/2005 | Brown et al. |
| 6,872,077 | B2 | 3/2005 | Yeager |
| 6,872,168 | B2 | 3/2005 | Wang et al. |
| 6,872,173 | B2 | 3/2005 | Krull |
| 6,872,175 | B2 | 3/2005 | Lin |
| 6,872,187 | B1 | 3/2005 | Stark et al. |
| 6,875,157 | B1 | 4/2005 | Wang |
| 6,875,160 | B2 | 4/2005 | Watterson et al. |
| 6,876,496 | B2 | 4/2005 | French et al. |
| 6,876,947 | B1 | 4/2005 | Darley et al. |
| 6,878,099 | B2 | 4/2005 | Corbalis et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,882,955 | B1 | 4/2005 | Ohlenbusch et al. |
| 6,885,971 | B2 | 4/2005 | Vock et al. |
| 6,886,613 | B1 | 5/2005 | Zahdeh |
| 6,886,645 | B2 | 5/2005 | Bise et al. |
| 6,887,185 | B1 | 5/2005 | Kuo |
| 6,887,190 | B1 | 5/2005 | Azari |
| 6,893,381 | B2 | 5/2005 | Slawinski |
| 6,893,383 | B1 | 5/2005 | Chang et al. |
| 6,896,342 | B1 | 5/2005 | Cheng |
| 6,896,645 | B1 | 5/2005 | Krull |
| 6,899,657 | B2 | 5/2005 | Chuang |
| 6,899,659 | B2 | 5/2005 | Anderson et al. |
| 6,899,661 | B1 | 5/2005 | Krull |
| 6,902,513 | B1 | 6/2005 | McClure |
| 6,902,515 | B2 | 6/2005 | Howell et al. |
| 6,902,516 | B2 | 6/2005 | Krull |
| 6,905,440 | B2 | 6/2005 | Heppert |
| 6,905,446 | B2 | 6/2005 | Greenland |
| 6,908,416 | B2 | 6/2005 | Mercado et al. |
| 6,908,417 | B2 | 6/2005 | Jackson |
| 6,910,992 | B2 | 6/2005 | Arguilez |
| 6,913,562 | B2 | 7/2005 | Chen |
| 6,913,563 | B2 | 7/2005 | Chen |
| 6,915,271 | B1 | 7/2005 | Meyer et al. |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,918,861 | B2 | 7/2005 | Liao et al. |
| 6,921,351 | B1 | 7/2005 | Hickman et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,923,748 | B1 | 8/2005 | Mauz |
| 6,923,749 | B1 | 8/2005 | Smith |
| 6,926,644 | B2 | 8/2005 | Chen |
| 6,926,646 | B1 | 8/2005 | Nguyen |
| 6,926,649 | B2 | 8/2005 | Slawinski |
| 6,929,589 | B1 | 8/2005 | Bruggemann et al. |
| 6,932,745 | B1 | 8/2005 | Ellis |
| 6,934,658 | B2 | 8/2005 | Clabes et al. |
| 6,936,007 | B2 | 8/2005 | Quy |
| 6,937,289 | B1 | 8/2005 | Ranta et al. |
| 6,939,271 | B1 | 9/2005 | Whan-Tong et al. |
| 6,941,620 | B1 | 9/2005 | Hinds |
| 6,942,599 | B1 | 9/2005 | Racine |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,949,054 | B1 | 9/2005 | Stearns |
| 6,952,221 | B1 | 10/2005 | Holtz et al. |
| 6,953,418 | B1 | 10/2005 | Chen |
| 6,955,542 | B2 | 10/2005 | Roncalez et al. |
| 6,960,156 | B2 | 11/2005 | Smith |
| 6,964,632 | B1 | 11/2005 | Ko |
| 6,966,872 | B2 | 11/2005 | Eschenbach |
| 6,971,972 | B1 | 12/2005 | Mcgovern |
| 6,971,973 | B2 | 12/2005 | Cohen et al. |
| 6,971,974 | B2 | 12/2005 | Bowman |
| 6,971,975 | B2 | 12/2005 | Croft |
| 6,971,978 | B2 | 12/2005 | Hyder |
| 6,974,403 | B2 | 12/2005 | Wong et al. |
| 6,974,404 | B1 | 12/2005 | Watterson et al. |
| 6,974,405 | B2 | 12/2005 | Krull |
| 6,975,910 | B1 | 12/2005 | Brown et al. |
| 6,976,624 | B2 | 12/2005 | Hsiao |
| 6,976,698 | B2 | 12/2005 | Kuiken |
| 6,976,941 | B2 | 12/2005 | Britt |
| 6,976,943 | B1 | 12/2005 | Hsiung |
| 6,976,958 | B2 | 12/2005 | Quy |
| 6,979,283 | B2 | 12/2005 | Pan |
| 6,991,586 | B2 | 1/2006 | Lapcevic |
| 6,991,588 | B1 | 1/2006 | Adams |
| 6,994,306 | B1 | 2/2006 | Sweere et al. |
| 6,994,657 | B1 | 2/2006 | Eschenbach |
| 6,994,683 | B1 | 2/2006 | Starr |
| 6,996,852 | B1 | 2/2006 | Cabrera |
| 6,997,852 | B2 | 2/2006 | Watterson et al. |
| 6,997,853 | B1 | 2/2006 | Cuskaden et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,015,950 | B1 | 3/2006 | Pryor |
| 7,016,812 | B2 | 3/2006 | Aritsuka et al. |
| 7,020,508 | B2 | 3/2006 | Stivoric |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,029,425 | B2 | 4/2006 | Krull |
| 7,032,870 | B2 | 4/2006 | Sweere et al. |
| 7,033,176 | B2 | 4/2006 | Feldman |
| 7,033,306 | B2 | 4/2006 | Graber |
| 7,035,936 | B2 | 4/2006 | Fouquet |
| 7,037,246 | B2 | 5/2006 | Kim |
| 7,038,855 | B2 | 5/2006 | French et al. |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,041,049 | B1 | 5/2006 | Raniere |
| 7,044,066 | B1 | 5/2006 | Miller |
| 7,044,891 | B1 | 5/2006 | Rivera |
| 7,044,897 | B2 | 5/2006 | Myers et al. |
| 7,048,638 | B2 | 5/2006 | Novotny |
| 7,048,677 | B2 | 5/2006 | Mackert |
| 7,051,049 | B2 | 5/2006 | Samn |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,056,265 | B1 | 6/2006 | Shea |

(56) References Cited

U.S. PATENT DOCUMENTS

| | | | |
|---|---|---|---|
| 7,060,005 | B2 | 6/2006 | Carlsen et al. |
| 7,060,006 | B1 | 6/2006 | Watterson et al. |
| 7,060,008 | B2 | 6/2006 | Watterson et al. |
| 7,060,011 | B1 | 6/2006 | Krull |
| 7,060,012 | B2 | 6/2006 | Howell et al. |
| 7,060,031 | B2 | 6/2006 | Webb et al. |
| 7,063,644 | B2 | 6/2006 | Albert et al. |
| 7,065,768 | B1 | 6/2006 | Janzig et al. |
| 7,066,865 | B2 | 6/2006 | Radow |
| 7,066,867 | B2 | 6/2006 | Krull |
| 7,070,415 | B2 | 7/2006 | Hojo et al. |
| 7,070,539 | B2 | 7/2006 | Brown et al. |
| 7,070,542 | B2 | 7/2006 | Reyes et al. |
| 7,070,545 | B2 | 7/2006 | Lull et al. |
| 7,072,789 | B2 | 7/2006 | Vock et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,083,536 | B2 | 8/2006 | Lu et al. |
| 7,083,549 | B1 | 8/2006 | Fan |
| 7,083,554 | B1 | 8/2006 | Lo Presti |
| 7,086,994 | B2 | 8/2006 | Turak et al. |
| 7,086,999 | B2 | 8/2006 | Jeneve et al. |
| 7,087,000 | B1 | 8/2006 | Walker |
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,091,635 | B1 | 8/2006 | Gilliland et al. |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,163 | B2 | 9/2006 | Krull |
| 7,113,166 | B1 | 9/2006 | Rosenberg et al. |
| 7,115,073 | B2 | 10/2006 | Nizamuddin |
| 7,115,076 | B2 | 10/2006 | Oglesby et al. |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,125,371 | B2 | 10/2006 | Henderson |
| 7,125,373 | B1 | 10/2006 | Garza |
| 7,128,692 | B2 | 10/2006 | Black |
| 7,128,693 | B2 | 10/2006 | Brown et al. |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tyndall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,139,835 | B2 | 11/2006 | Fouquet et al. |
| 7,140,626 | B1 | 11/2006 | Keay |
| 7,141,008 | B2 | 11/2006 | Krull et al. |
| 7,148,879 | B2 | 12/2006 | Amento et al. |
| 7,150,168 | B1 | 12/2006 | Kuo |
| 7,151,214 | B2 | 12/2006 | Barry |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,156,808 | B2 | 1/2007 | Quy |
| 7,156,809 | B2 | 1/2007 | Quy |
| 7,158,938 | B2 | 1/2007 | Labbe et al. |
| 7,163,489 | B1 | 1/2007 | Nelson |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,170,016 | B2 | 1/2007 | Dumornay |
| 7,171,331 | B2 | 1/2007 | Vock et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,182,738 | B2 | 2/2007 | Bonutti et al. |
| 7,186,189 | B2 | 3/2007 | Huang |
| 7,187,961 | B2 | 3/2007 | Yamashita et al. |
| 7,188,439 | B2 | 3/2007 | DiBenedetto et al. |
| 7,192,387 | B2 | 3/2007 | Mendel |
| 7,192,388 | B2 | 3/2007 | Dalebout et al. |
| 7,192,389 | B2 | 3/2007 | Allison |
| 7,195,568 | B2 | 3/2007 | Huang |
| 7,197,029 | B1 | 3/2007 | Osterhout et al. |
| 7,200,517 | B2 | 4/2007 | Darley et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,170 | B2 | 5/2007 | Sumners |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,216 | B1 | 5/2007 | McBride |
| 7,224,326 | B2 | 5/2007 | Sefton |
| 7,225,282 | B1 | 5/2007 | Lyle |
| 7,225,565 | B2 | 6/2007 | DiBenedetto et al. |
| 7,225,694 | B2 | 6/2007 | Said |
| 7,226,402 | B1 | 6/2007 | Joya |
| 7,229,391 | B2 | 6/2007 | Francis et al. |
| 7,232,404 | B2 | 6/2007 | Nelson |
| 7,235,942 | B2 | 6/2007 | Nagaoka et al. |
| 7,236,154 | B1 | 6/2007 | Kerr et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,254,516 | B2 | 8/2007 | Case, Jr. et al. |
| 7,255,665 | B2 | 8/2007 | Ish, III |
| 7,255,666 | B2 | 8/2007 | Cardenas |
| 7,257,468 | B1 | 8/2007 | Costa et al. |

(56) References Cited

U.S. PATENT DOCUMENTS

| | | | |
|---|---|---|---|
| 7,258,651 | B2 | 8/2007 | Clarke |
| 7,259,906 | B1 | 8/2007 | Islam |
| 7,261,678 | B2 | 8/2007 | Crawford et al. |
| 7,264,554 | B2 | 9/2007 | Bentley |
| 7,264,578 | B1 | 9/2007 | Krull |
| 7,269,038 | B2 | 9/2007 | Shekhawat et al. |
| 7,276,017 | B2 | 10/2007 | Lin |
| 7,278,934 | B2 | 10/2007 | McBride et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,285,090 | B2 | 10/2007 | Stivoric et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,308,818 | B2 | 12/2007 | Considine et al. |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,906 | B2 | 1/2008 | Webber |
| 7,322,907 | B2 | 1/2008 | Bowser |
| 7,322,909 | B1 | 1/2008 | Loccarini |
| 7,328,119 | B1 | 2/2008 | Pryor |
| 7,329,684 | B2 | 2/2008 | Mjalli et al. |
| 7,331,911 | B2 | 2/2008 | Webber et al. |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,147 | B2 | 2/2008 | Jones |
| 7,336,178 | B2 | 2/2008 | Le |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |
| 7,347,806 | B2 | 3/2008 | Nakano et al. |
| 7,350,787 | B2 | 4/2008 | Voss |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,123 | B1 | 4/2008 | Krull |
| 7,361,125 | B2 | 4/2008 | Webber et al. |
| 7,361,127 | B2 | 4/2008 | Tremayne |
| 7,364,538 | B2 | 4/2008 | Aucamp |
| 7,365,647 | B2 | 4/2008 | Nativ |
| 7,366,921 | B2 | 4/2008 | Ranganathan |
| 7,367,926 | B2 | 5/2008 | Clark |
| 7,367,927 | B2 | 5/2008 | Krull |
| 7,369,121 | B2 | 5/2008 | Lane |
| 7,370,498 | B1 | 5/2008 | Miao |
| 7,372,485 | B1 | 5/2008 | Bodnar et al. |
| 7,373,820 | B1 | 5/2008 | James |
| 7,374,519 | B2 | 5/2008 | Naidus |
| 7,374,522 | B2 | 5/2008 | Arnold |
| 7,377,881 | B2 | 5/2008 | Moon |
| 7,377,886 | B2 | 5/2008 | Wu |
| 7,383,081 | B2 | 6/2008 | Butt et al. |
| 7,384,013 | B2 | 6/2008 | Yen |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,398,151 | B1 | 7/2008 | Burrell et al. |
| 7,401,918 | B2 | 7/2008 | Howell et al. |
| 7,402,125 | B2 | 7/2008 | Wang |
| 7,402,145 | B1 | 7/2008 | Woggon |
| 7,412,206 | B1 | 8/2008 | Hutchings et al. |
| 7,413,056 | B2 | 8/2008 | Gonzi et al. |
| 7,413,065 | B2 | 8/2008 | Gauthier |
| 7,413,532 | B1 | 8/2008 | Monsrud et al. |
| 7,413,533 | B2 | 8/2008 | Lin |
| 7,416,537 | B1 | 8/2008 | Stark et al. |
| 7,418,862 | B2 | 9/2008 | Gruben et al. |
| 7,425,189 | B1 | 9/2008 | Eschenbach |
| 7,428,760 | B2 | 9/2008 | McCrimmon |
| 7,429,235 | B2 | 9/2008 | Lin |
| 7,429,236 | B2 | 9/2008 | Dalebout et al. |
| 7,432,184 | B2 | 10/2008 | Hosokawa et al. |
| 7,432,454 | B1 | 10/2008 | Sze et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,438,673 | B1 | 10/2008 | Jones |
| 7,448,823 | B2 | 11/2008 | Silva |
| 7,452,336 | B2 | 11/2008 | Thompson |
| 7,454,002 | B1 | 11/2008 | Gardner et al. |
| 7,455,621 | B1 | 11/2008 | Anthony |
| 7,455,622 | B2 | 11/2008 | Watterson et al. |
| 7,455,626 | B2 | 11/2008 | Trevino et al. |
| 7,455,628 | B1 | 11/2008 | Stearns |
| 7,455,633 | B2 | 11/2008 | Brown et al. |
| 7,462,141 | B1 | 12/2008 | Raboin et al. |
| 7,465,257 | B1 | 12/2008 | Morgan, Jr. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,477,890 | B1 | 1/2009 | Narayanaswami |
| 7,478,794 | B1 | 1/2009 | Gohlke et al. |
| 7,480,512 | B2 | 1/2009 | Graham et al. |
| 7,482,050 | B2 | 1/2009 | Olson |
| 7,485,077 | B2 | 2/2009 | Chen |
| 7,488,277 | B1 | 2/2009 | Knapp |
| 7,489,979 | B2 | 2/2009 | Rosenberg |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,497,784 | B2 | 3/2009 | Henry |
| 7,497,814 | B1 | 3/2009 | Krull |
| 7,503,476 | B2 | 3/2009 | Bhavnani |
| 7,503,878 | B1 | 3/2009 | Amsbury et al. |
| 7,503,883 | B2 | 3/2009 | Madden |
| 7,507,183 | B2 | 3/2009 | Anderson |
| 7,507,186 | B2 | 3/2009 | Stearns |
| 7,507,187 | B2 | 3/2009 | Dyer et al. |
| 7,507,189 | B2 | 3/2009 | Krull |
| 7,507,190 | B2 | 3/2009 | Piane, Jr. |
| 7,510,509 | B2 | 3/2009 | Hickman |
| 7,510,511 | B2 | 3/2009 | Von Detten |
| 7,517,303 | B2 | 4/2009 | Crawford et al. |
| 7,517,304 | B1 | 4/2009 | Swanson et al. |
| 7,519,327 | B2 | 4/2009 | White |
| 7,519,537 | B2 | 4/2009 | Rosenberg |
| 7,520,840 | B2 | 4/2009 | Shifferaw |
| 7,520,845 | B2 | 4/2009 | Towley, III et al. |

(56) References Cited

U.S. PATENT DOCUMENTS

| | | | |
|---|---|---|---|
| 7,521,623 | B2 | 4/2009 | Bowen |
| 7,524,272 | B2 | 4/2009 | Bruck et al. |
| 7,525,293 | B1 | 4/2009 | Notohamiprodjo et al. |
| 7,532,977 | B2 | 5/2009 | Chen |
| 7,534,200 | B1 | 5/2009 | Martinez |
| 7,534,206 | B1 | 5/2009 | Lovitt et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,539,487 | B2 | 5/2009 | Sinclair et al. |
| 7,540,828 | B2 * | 6/2009 | Watterson ..... A63B 22/0023 482/51 |
| 7,540,829 | B1 | 6/2009 | Lin |
| 7,542,816 | B2 | 6/2009 | Rosenberg |
| 7,543,934 | B2 | 6/2009 | Howell et al. |
| 7,544,153 | B2 | 6/2009 | Trevino et al. |
| 7,549,947 | B2 | 6/2009 | Hickman et al. |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,267 | B1 | 6/2009 | Hauser |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,561,989 | B2 | 7/2009 | Banks et al. |
| 7,562,117 | B2 | 7/2009 | Rosenberg |
| 7,563,203 | B2 | 7/2009 | Dalebout et al. |
| 7,563,205 | B2 | 7/2009 | Alling |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,569,000 | B2 | 8/2009 | Wang |
| 7,569,004 | B2 | 8/2009 | Kolomeir |
| 7,569,005 | B2 | 8/2009 | Geeting |
| 7,571,517 | B2 | 8/2009 | Smith et al. |
| 7,575,536 | B1 | 8/2009 | Hickman |
| 7,575,537 | B2 | 8/2009 | Ellis |
| 7,575,538 | B1 | 8/2009 | Clark |
| 7,577,522 | B2 | 8/2009 | Rosenberg |
| 7,578,771 | B1 | 8/2009 | Towley, III et al. |
| 7,578,772 | B2 | 8/2009 | Lippitt |
| 7,579,946 | B2 | 8/2009 | Case, Jr. |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,585,262 | B1 | 9/2009 | Vayntraub |
| 7,586,032 | B2 | 9/2009 | Louis |
| 7,588,520 | B2 | 9/2009 | Nalley |
| 7,591,763 | B1 | 9/2009 | Fucci |
| 7,591,770 | B2 | 9/2009 | Stewart et al. |
| 7,591,773 | B2 | 9/2009 | Weir |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,594,881 | B2 | 9/2009 | Shifferaw |
| 7,598,255 | B2 | 10/2009 | Dvorak |
| 7,601,096 | B2 | 10/2009 | Negrin |
| 7,601,097 | B2 | 10/2009 | Miyamaru et al. |
| 7,601,101 | B2 | 10/2009 | Jackson et al. |
| 7,601,105 | B1 | 10/2009 | Gipson, III et al. |
| 7,602,301 | B1 | 10/2009 | Stirling et al. |
| 7,603,255 | B2 | 10/2009 | Case, Jr. et al. |
| 7,604,571 | B2 | 10/2009 | Wilkins |
| 7,604,572 | B2 | 10/2009 | Stanford |
| 7,604,573 | B2 | 10/2009 | Dalebout et al. |
| 7,604,576 | B2 | 10/2009 | Drechsler |
| 7,604,578 | B2 | 10/2009 | Liu |
| 7,607,243 | B2 | 10/2009 | Berner, Jr. et al. |
| 7,608,015 | B2 | 10/2009 | Radow |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,611,445 | B2 | 11/2009 | Brown et al. |
| 7,611,450 | B2 | 11/2009 | Mancini |
| 7,614,639 | B2 | 11/2009 | Tholkes et al. |
| 7,614,981 | B2 | 11/2009 | Cao |
| 7,614,984 | B1 | 11/2009 | Krull |
| 7,616,097 | B1 | 11/2009 | Whang |
| 7,618,345 | B2 | 11/2009 | Corbalis et al. |
| 7,618,346 | B2 | 11/2009 | Crawford et al. |
| 7,619,514 | B1 | 11/2009 | Stone |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,315 | B2 | 12/2009 | Hickman |
| 7,625,316 | B1 | 12/2009 | Amsbury et al. |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,628,743 | B1 | 12/2009 | Flentye et al. |
| 7,631,382 | B2 | 12/2009 | DiBenedetto et al. |
| 7,632,221 | B1 | 12/2009 | Kolander |
| 7,637,847 | B1 | 12/2009 | Hickman |
| 7,637,850 | B2 | 12/2009 | Lin |
| 7,639,520 | B1 | 12/2009 | Zansky et al. |
| 7,641,592 | B2 | 1/2010 | Roche |
| 7,643,895 | B2 | 1/2010 | Gupta et al. |
| 7,645,212 | B2 | 1/2010 | Ashby et al. |
| 7,645,213 | B2 | 1/2010 | Watterson |
| 7,645,214 | B2 | 1/2010 | Lull |
| 7,645,218 | B2 | 1/2010 | Potok et al. |
| 7,645,221 | B1 | 1/2010 | Curry |
| 7,647,196 | B2 | 1/2010 | Kahn et al. |
| 7,648,443 | B2 | 1/2010 | Schenk |
| 7,648,446 | B2 | 1/2010 | Chiles et al. |
| 7,648,463 | B1 | 1/2010 | Elhag et al. |
| 7,648,858 | B2 | 1/2010 | Tang et al. |
| 7,651,442 | B2 | 1/2010 | Carlson |
| 7,651,450 | B2 | 1/2010 | Wehrell |
| 7,654,229 | B2 | 2/2010 | Smith |
| 7,654,940 | B2 | 2/2010 | Webber et al. |
| 7,654,948 | B2 | 2/2010 | Kaplan et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,662,065 | B1 | 2/2010 | Kahn et al. |
| 7,662,282 | B2 | 2/2010 | Lee et al. |
| 7,670,263 | B2 | 3/2010 | Ellis |
| 7,670,269 | B2 | 3/2010 | Webber et al. |
| 7,670,270 | B2 | 3/2010 | Alessandri et al. |
| 7,674,205 | B2 | 3/2010 | Dalebout et al. |
| 7,674,206 | B2 | 3/2010 | Jones |
| 7,674,216 | B1 | 3/2010 | Bolling |
| 7,676,332 | B2 | 3/2010 | Damen |
| 7,677,518 | B2 | 3/2010 | Chouinard et al. |
| 7,677,723 | B2 | 3/2010 | Howell et al. |
| 7,678,023 | B1 | 3/2010 | Shea |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,683,252 | B2 | 3/2010 | Oliver et al. |
| 7,689,437 | B1 | 3/2010 | Teller et al. |
| 7,690,556 | B1 | 4/2010 | Kahn et al. |
| 7,691,042 | B2 | 4/2010 | Pandozy |
| 7,695,409 | B2 | 4/2010 | Helie et al. |
| 7,698,101 | B2 | 4/2010 | Alten et al. |
| 7,698,359 | B2 | 4/2010 | Wray et al. |
| 7,699,752 | B1 | 4/2010 | Anderson |
| 7,699,753 | B2 | 4/2010 | Daikeler |

(56) References Cited

U.S. PATENT DOCUMENTS

| | | | |
|---|---|---|---|
| 7,699,754 | B2 | 4/2010 | Schneider |
| 7,699,755 | B2 | 4/2010 | Feldman et al. |
| 7,702,781 | B2 | 4/2010 | Devolites |
| 7,703,974 | B2 | 4/2010 | Bouille |
| 7,704,191 | B2 | 4/2010 | Smith et al. |
| 7,704,192 | B2 | 4/2010 | Dyer et al. |
| 7,704,195 | B2 | 4/2010 | Alessandri et al. |
| 7,705,230 | B2 | 4/2010 | Bowen |
| 7,708,668 | B2 | 5/2010 | Rodgers, Jr. |
| 7,708,672 | B2 | 5/2010 | Gibson et al. |
| 7,713,171 | B1 | 5/2010 | Hickman |
| 7,713,172 | B2 | 5/2010 | Watterson et al. |
| 7,713,177 | B2 | 5/2010 | Lo |
| 7,717,825 | B2 | 5/2010 | Van Der Hoeven |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,717,833 | B1 | 5/2010 | Nelson et al. |
| 7,717,866 | B2 | 5/2010 | Damen |
| 7,722,503 | B1 | 5/2010 | Smith et al. |
| 7,722,509 | B2 | 5/2010 | Eder |
| 7,725,362 | B2 | 5/2010 | Weathers, Jr. |
| 7,727,117 | B2 | 6/2010 | Feldman et al. |
| 7,727,125 | B2 | 6/2010 | Day |
| 7,728,214 | B2 | 6/2010 | Oliver et al. |
| 7,730,588 | B1 | 6/2010 | Bernier |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,739,076 | B1 | 6/2010 | Vock et al. |
| 7,740,562 | B2 | 6/2010 | Jones |
| 7,740,563 | B2 | 6/2010 | Dalebout et al. |
| 7,740,568 | B2 | 6/2010 | Webb |
| 7,740,570 | B2 | 6/2010 | Winston |
| 7,740,588 | B1 | 6/2010 | Sciarra |
| 7,745,716 | B1 | 6/2010 | Murphy |
| 7,747,671 | B2 | 6/2010 | Ku |
| 7,749,137 | B2 | 7/2010 | Watt et al. |
| 7,749,140 | B1 | 7/2010 | Lindemeier et al. |
| 7,753,824 | B2 | 7/2010 | Wang |
| 7,753,825 | B2 | 7/2010 | Jaquish et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,758,523 | B2 | 7/2010 | Collings et al. |
| 7,761,300 | B2 | 7/2010 | Klingler |
| 7,762,931 | B2 | 7/2010 | Fisher et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,764,990 | B2 | 7/2010 | Martikka et al. |
| 7,765,348 | B2 | 7/2010 | Dybsetter |
| 7,766,794 | B2 | 8/2010 | Oliver et al. |
| 7,766,797 | B2 | 8/2010 | Dalebout |
| 7,766,798 | B2 | 8/2010 | Hamilton |
| 7,770,181 | B2 | 8/2010 | Snover et al. |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,952 | B1 | 8/2010 | Curran et al. |
| 7,775,953 | B2 | 8/2010 | Wang |
| 7,780,578 | B2 | 8/2010 | Packham |
| 7,780,583 | B2 | 8/2010 | Brown |
| 7,780,585 | B1 | 8/2010 | Rivas |
| 7,789,800 | B1 | 9/2010 | Watterson et al. |
| 7,789,806 | B2 | 9/2010 | Yang |
| 7,794,014 | B2 | 9/2010 | Beall et al. |
| 7,794,363 | B2 | 9/2010 | Wang |
| 7,794,371 | B2 | 9/2010 | Webber et al. |
| 7,795,824 | B2 | 9/2010 | Shen et al. |
| 7,798,942 | B2 | 9/2010 | Digiulio |
| 7,798,946 | B2 | 9/2010 | Dalebout et al. |
| 7,803,096 | B2 | 9/2010 | Mehta |
| 7,805,149 | B2 | 9/2010 | Werner et al. |
| 7,806,780 | B1 | 10/2010 | Plunkett |
| 7,806,805 | B2 | 10/2010 | Barufka et al. |
| 7,806,806 | B2 | 10/2010 | Jaquish |
| 7,806,815 | B2 | 10/2010 | Fernandez |
| 7,809,153 | B2 | 10/2010 | Bravomalo et al. |
| 7,811,200 | B2 | 10/2010 | Lai |
| 7,811,201 | B1 | 10/2010 | Mikan et al. |
| 7,811,202 | B2 | 10/2010 | Planke |
| 7,811,209 | B2 | 10/2010 | Crawford et al. |
| 7,811,213 | B2 | 10/2010 | Chen |
| 7,813,715 | B2 | 10/2010 | McKillop et al. |
| 7,815,548 | B2 | 10/2010 | Barre et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,784 | B1 | 10/2010 | Caswell et al. |
| 7,819,785 | B2 | 10/2010 | Maiaro et al. |
| 7,822,547 | B2 | 10/2010 | Lindroos |
| 7,825,319 | B2 | 11/2010 | Turner |
| 7,827,000 | B2 | 11/2010 | Stirling et al. |
| 7,828,703 | B1 | 11/2010 | Boesch |
| 7,830,570 | B2 | 11/2010 | Morita et al. |
| 7,833,129 | B2 | 11/2010 | Badarneh |
| 7,833,135 | B2 | 11/2010 | Radow |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,596 | B2 | 11/2010 | Astilean |
| 7,837,598 | B1 | 11/2010 | Boozel, Jr. |
| 7,837,599 | B2 | 11/2010 | Kowalczewski et al. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,840,346 | B2 | 11/2010 | Huhtala et al. |
| 7,841,967 | B1 | 11/2010 | Kahn |
| 7,841,971 | B2 | 11/2010 | Smith |
| 7,846,067 | B2 | 12/2010 | Hanoun |
| 7,846,070 | B2 | 12/2010 | Oglesby et al. |
| 7,846,080 | B2 | 12/2010 | Boren |
| 7,850,584 | B2 | 12/2010 | Uygan |
| 7,854,669 | B2 | 12/2010 | Marty et al. |
| 7,857,731 | B2 | 12/2010 | Hickman et al. |
| 7,857,732 | B2 | 12/2010 | Nielson |
| 7,862,476 | B2 | 1/2011 | Radow |
| 7,862,478 | B2 | 1/2011 | Watterson et al. |
| 7,862,483 | B2 | 1/2011 | Hendrickson et al. |
| 7,862,486 | B1 | 1/2011 | Watson |
| 7,862,489 | B2 | 1/2011 | Savsek et al. |
| 7,867,088 | B2 | 1/2011 | Prum |
| 7,871,355 | B2 | 1/2011 | Yeh |
| 7,871,357 | B2 | 1/2011 | Yamada |
| 7,874,957 | B2 | 1/2011 | Hurwitz et al. |
| 7,874,961 | B2 | 1/2011 | McKee et al. |
| 7,878,950 | B1 | 2/2011 | Bastian |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,894,177 | B2 | 2/2011 | Rothkopf |
| 7,894,849 | B2 | 2/2011 | Kass et al. |
| 7,896,782 | B2 | 3/2011 | Tamari |

(56) References Cited

U.S. PATENT DOCUMENTS

| | | | |
|---|---|---|---|
| 7,900,324 | B2 | 3/2011 | Ginocchio |
| 7,901,292 | B1 | 3/2011 | Uhlir et al. |
| 7,901,323 | B2 | 3/2011 | Olason et al. |
| 7,901,324 | B2 | 3/2011 | Kodama |
| 7,901,325 | B2 | 3/2011 | Henderson |
| 7,901,335 | B2 | 3/2011 | Webber et al. |
| 7,908,981 | B2 | 3/2011 | Agee |
| 7,909,741 | B2 | 3/2011 | Kim et al. |
| 7,909,742 | B2 | 3/2011 | Ish, III et al. |
| 7,909,743 | B1 | 3/2011 | Webber |
| 7,909,745 | B2 | 3/2011 | Mills et al. |
| 7,913,297 | B2 | 3/2011 | Wyld |
| 7,914,420 | B2 | 3/2011 | Daly et al. |
| 7,914,421 | B2 | 3/2011 | Weier et al. |
| 7,914,425 | B2 | 3/2011 | Hanoun |
| 7,914,468 | B2 | 3/2011 | Shalon et al. |
| 7,917,148 | B2 | 3/2011 | Rosenberg |
| 7,918,732 | B2 | 4/2011 | Van Noland |
| 7,919,950 | B2 | 4/2011 | Uno et al. |
| 7,922,635 | B2 | 4/2011 | Lull et al. |
| 7,927,253 | B2 | 4/2011 | Vincent |
| 7,927,258 | B2 | 4/2011 | Irving et al. |
| 7,931,563 | B2 | 4/2011 | Shaw et al. |
| 7,931,570 | B2 | 4/2011 | Hoffman |
| 7,934,983 | B1 | 5/2011 | Eisner |
| 7,935,026 | B2 | 5/2011 | Mcsorley |
| 7,935,032 | B1 | 5/2011 | Jackson |
| 7,938,751 | B2 | 5/2011 | Nicolas et al. |
| 7,938,752 | B1 | 5/2011 | Wang |
| 7,938,755 | B1 | 5/2011 | Dyer et al. |
| 7,938,760 | B1 | 5/2011 | Webber et al. |
| 7,938,761 | B2 | 5/2011 | Simonson |
| 7,942,788 | B2 | 5/2011 | Wu |
| 7,942,793 | B2 * | 5/2011 | Mills ..... A63B 21/00069 482/126 |
| 7,946,959 | B2 | 5/2011 | Shum et al. |
| 7,946,961 | B2 | 5/2011 | Blum et al. |
| 7,946,968 | B2 | 5/2011 | Kjellberg |
| 7,949,295 | B2 | 5/2011 | Kumar et al. |
| 7,950,297 | B2 | 5/2011 | Moore et al. |
| 7,951,046 | B1 | 5/2011 | Barber, Jr. |
| 7,953,549 | B2 | 5/2011 | Graham et al. |
| 7,955,219 | B2 | 6/2011 | Birrell et al. |
| 7,959,124 | B2 | 6/2011 | Phifer et al. |
| 7,959,567 | B2 | 6/2011 | Stivoric et al. |
| 7,963,889 | B2 | 6/2011 | Badarneh et al. |
| 7,963,892 | B2 | 6/2011 | Poblete Castro et al. |
| 7,967,728 | B2 | 6/2011 | Zavadsky |
| 7,967,734 | B1 | 6/2011 | Damian |
| 7,968,574 | B2 | 6/2011 | Hangauer, Jr. |
| 7,972,245 | B2 | 7/2011 | Temple et al. |
| 7,972,247 | B2 | 7/2011 | Daikeler |
| 7,972,249 | B1 | 7/2011 | Napalan |
| 7,973,231 | B2 | 7/2011 | Bowen |
| 7,974,889 | B2 | 7/2011 | Raimbeault |
| 7,976,437 | B1 | 7/2011 | Von Detten |
| 7,976,443 | B2 | 7/2011 | Krull |
| 7,976,518 | B2 | 7/2011 | Shaughnessy et al. |
| 7,978,081 | B2 | 7/2011 | Shears et al. |
| 7,980,996 | B2 | 7/2011 | Hickman |
| 7,981,000 | B2 | 7/2011 | Watterson et al. |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ashby |
| 7,988,598 | B2 | 8/2011 | Trzecieski |
| 7,988,599 | B2 | 8/2011 | Ainsworth et al. |
| 7,988,600 | B2 | 8/2011 | Rodgers, Jr. |
| 7,988,605 | B1 | 8/2011 | Wyeroski |
| 7,993,251 | B1 | 8/2011 | Webber et al. |
| 7,998,036 | B2 | 8/2011 | Ish, III |
| 7,998,042 | B2 | 8/2011 | Bowser et al. |
| 8,001,472 | B2 | 8/2011 | Gilley et al. |
| 8,002,671 | B1 | 8/2011 | Vigilia |
| 8,002,674 | B2 | 8/2011 | Piaget et al. |
| 8,002,678 | B1 | 8/2011 | Krull |
| 8,002,684 | B2 | 8/2011 | Laurent |
| 8,006,711 | B2 | 8/2011 | Pietrzak et al. |
| 8,007,409 | B2 | 8/2011 | Elllis |
| 8,007,413 | B1 | 8/2011 | Wu |
| 8,007,415 | B1 | 8/2011 | Lundquist |
| RE42,698 | E | 9/2011 | Kuo et al. |
| 8,012,064 | B2 | 9/2011 | Martens |
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,021,270 | B2 | 9/2011 | Eredita |
| 8,021,277 | B2 | 9/2011 | Baudhuin |
| 8,025,607 | B2 | 9/2011 | Ranky et al. |
| 8,025,608 | B2 | 9/2011 | Popescu |
| 8,025,612 | B1 | 9/2011 | Buzzanco |
| 8,025,613 | B1 | 9/2011 | Wang |
| 8,028,443 | B2 | 10/2011 | Case, Jr. |
| 8,029,415 | B2 | 10/2011 | Ashby et al. |
| 8,029,425 | B2 | 10/2011 | Bronston et al. |
| 8,033,959 | B2 | 10/2011 | Oleson et al. |
| 8,033,960 | B1 | 10/2011 | Dalebout et al. |
| 8,033,965 | B1 | 10/2011 | Krull |
| 8,034,294 | B1 | 10/2011 | Goldberg |
| 8,037,017 | B2 | 10/2011 | Samn |
| 8,038,577 | B2 | 10/2011 | Mcintosh |
| 8,040,758 | B1 | 10/2011 | Dickinson |
| 8,043,173 | B2 | 10/2011 | Menalagha et al. |
| 8,046,803 | B1 | 10/2011 | Lee |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,580 | B2 | 11/2011 | Saalasti et al. |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,360 | B2 | 11/2011 | Shea |
| 8,057,367 | B2 | 11/2011 | Giannelli et al. |
| 8,057,368 | B1 | 11/2011 | Lyszczarz |
| 8,062,182 | B2 | 11/2011 | Somers |
| 8,062,192 | B1 | 11/2011 | Arstein |
| 8,062,196 | B1 | 11/2011 | Khubani |
| 8,065,185 | B2 | 11/2011 | Foladare et al. |
| 8,066,514 | B2 | 11/2011 | Clarke |
| 8,070,655 | B1 | 12/2011 | Napolitano |
| 8,070,657 | B2 | 12/2011 | Loach |
| 8,072,902 | B2 | 12/2011 | Moon |
| 8,075,453 | B1 | 12/2011 | Wilkinson |
| 8,078,426 | B2 | 12/2011 | Pipinich et al. |
| 8,079,939 | B1 | 12/2011 | Wang |
| 8,082,029 | B2 | 12/2011 | Honda |
| 8,083,643 | B2 | 12/2011 | Ng et al. |
| 8,083,693 | B1 | 12/2011 | McKeon et al. |
| 8,086,421 | B2 | 12/2011 | Case, Jr. et al. |
| 8,088,043 | B2 | 1/2012 | Andren et al. |
| 8,088,044 | B2 | 1/2012 | Tchao et al. |
| 8,092,351 | B1 | 1/2012 | Rodgers, Jr. |
| 8,092,381 | B2 | 1/2012 | Edwards |
| 8,096,926 | B1 | 1/2012 | Batca |
| 8,101,843 | B2 | 1/2012 | Turner |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,207 | B1 | 1/2012 | Lannon |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,112,281 | B2 | 2/2012 | Yeung et al. |
| 8,113,990 | B2 | 2/2012 | Kolman et al. |
| 8,113,991 | B2 | 2/2012 | Kutliroff |
| 8,113,994 | B2 | 2/2012 | Piaget et al. |
| 8,116,841 | B2 | 2/2012 | Bly et al. |
| 8,121,785 | B2 | 2/2012 | Swisher et al. |
| 8,123,527 | B2 | 2/2012 | Holljes |
| 8,128,533 | B2 | 3/2012 | Nakagawa et al. |

(56) References Cited

U.S. PATENT DOCUMENTS

| | | | |
|---|---|---|---|
| 8,141,276 | B2 | 3/2012 | Ellis |
| 8,142,298 | B2 | 3/2012 | King et al. |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |
| 8,152,693 | B2 | 4/2012 | Nurmela et al. |
| 8,152,695 | B2 | 4/2012 | Riley et al. |
| 8,152,702 | B2 | 4/2012 | Pacheco |
| 8,157,706 | B2 | 4/2012 | Ainsworth et al. |
| 8,157,731 | B2 | 4/2012 | Teller et al. |
| 8,162,804 | B2 | 4/2012 | Tagliabue |
| 8,162,857 | B2 | 4/2012 | Lanfermann et al. |
| 8,165,893 | B1 | 4/2012 | Goldberg et al. |
| 8,167,776 | B2 | 5/2012 | Lannon |
| 8,172,723 | B1 | 5/2012 | Yanev et al. |
| 8,172,729 | B2 | 5/2012 | Ellis |
| 8,172,882 | B2 | 5/2012 | Klyce et al. |
| 8,176,101 | B2 | 5/2012 | Rosenberg |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,188,868 | B2 | 5/2012 | Case, Jr. |
| 8,192,332 | B2 | 6/2012 | Baker et al. |
| 8,197,392 | B2 | 6/2012 | Silverman et al. |
| 8,200,323 | B2 | 6/2012 | Dibenedetto et al. |
| 8,206,274 | B2 | 6/2012 | Svenberg et al. |
| 8,212,445 | B2 | 7/2012 | Ritchey |
| 8,213,908 | B2 | 7/2012 | Sangster et al. |
| 8,215,886 | B2 | 7/2012 | Campbell |
| 8,221,290 | B2 | 7/2012 | Vincent et al. |
| 8,221,292 | B2 | 7/2012 | Barker et al. |
| 8,224,429 | B2 | 7/2012 | Prstojevich et al. |
| 8,225,024 | B2 | 7/2012 | Dybsetter |
| 8,231,506 | B2 | 7/2012 | Molyneux et al. |
| 8,235,724 | B2 | 8/2012 | Gilley et al. |
| 8,240,430 | B2 | 8/2012 | Downey |
| 8,241,118 | B2 | 8/2012 | Camhi |
| 8,241,186 | B2 | 8/2012 | Brodess et al. |
| 8,241,187 | B2 | 8/2012 | Moon et al. |
| 8,249,686 | B2 | 8/2012 | Libbus et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,253,586 | B1 | 8/2012 | Matak |
| 8,257,228 | B2 | 9/2012 | Quatrochi et al. |
| 8,260,667 | B2 | 9/2012 | Graham et al. |
| 8,260,858 | B2 | 9/2012 | Belz et al. |
| 8,262,546 | B1 | 9/2012 | Lashinske |
| 8,269,093 | B2 | 9/2012 | Naik et al. |
| 8,272,996 | B2 | 9/2012 | Weier |
| 8,275,143 | B2 | 9/2012 | Johnson |
| 8,275,265 | B2 | 9/2012 | Kobyakov et al. |
| 8,276,434 | B2 | 10/2012 | Senoo |
| 8,280,259 | B2 | 10/2012 | George et al. |
| 8,287,434 | B2 | 10/2012 | Zavadsky et al. |
| 8,296,172 | B2 | 10/2012 | Marci et al. |
| 8,298,123 | B2 | 10/2012 | Hickman |
| 8,298,125 | B2 | 10/2012 | Colledge et al. |
| 8,306,635 | B2 | 11/2012 | Pryor |
| 8,308,620 | B2 | 11/2012 | Lyszczarz |
| 8,308,794 | B2 | 11/2012 | Martinson et al. |
| 8,314,840 | B1 | 11/2012 | Funk |
| 8,315,636 | B2 | 11/2012 | Moon et al. |
| 8,315,823 | B2 | 11/2012 | Berme et al. |
| 8,320,578 | B2 | 11/2012 | Kahn et al. |
| 8,321,004 | B2 | 11/2012 | Moon et al. |
| 8,323,157 | B2 | 12/2012 | Campanaro et al. |
| 8,332,544 | B1 | 12/2012 | Ralls et al. |
| 8,333,681 | B2 | 12/2012 | Schmidt |
| 8,337,335 | B2 | 12/2012 | Dugan |
| 8,341,557 | B2 | 12/2012 | Pisula et al. |
| 8,343,016 | B1 | 1/2013 | Astilean |
| 8,348,840 | B2 | 1/2013 | Heit et al. |
| 8,360,785 | B2 | 1/2013 | Park et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,363,913 | B2 | 1/2013 | Boushey et al. |
| 8,364,250 | B2 | 1/2013 | Moon et al. |
| 8,364,389 | B2 | 1/2013 | Dorogusker et al. |
| 8,368,329 | B1 | 2/2013 | Depew et al. |
| 8,369,936 | B2 | 2/2013 | Farringdon et al. |
| 8,371,990 | B2 | 2/2013 | Shea |
| 8,374,688 | B2 | 2/2013 | Libbus et al. |
| 8,376,910 | B2 | 2/2013 | Cheung et al. |
| 8,378,647 | B2 | 2/2013 | Yonezawa et al. |
| 8,384,551 | B2 | 2/2013 | Ross et al. |
| 8,394,005 | B2 | 3/2013 | Solow et al. |
| 8,395,366 | B2 | 3/2013 | Uno |
| 8,398,529 | B2 | 3/2013 | Ellis et al. |
| 8,398,546 | B2 | 3/2013 | Pacione et al. |
| 8,403,845 | B2 | 3/2013 | Stivoric et al. |
| 8,407,623 | B2 | 3/2013 | Kerr et al. |
| 8,412,317 | B2 | 4/2013 | Mazar |
| 8,419,593 | B2 | 4/2013 | Ainsworth et al. |
| 8,429,223 | B2 | 4/2013 | Gilley et al. |
| 8,430,770 | B2 | 4/2013 | Dugan |
| 8,435,160 | B1 | 5/2013 | Clum |
| 8,437,824 | B2 | 5/2013 | Moon et al. |
| 8,444,537 | B1 | 5/2013 | Santoro |
| 8,446,275 | B2 | 5/2013 | Utter, II |
| 8,449,620 | B2 | 5/2013 | Hakansson et al. |
| 8,452,259 | B2 | 5/2013 | Ellis et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,460,001 | B1 | 6/2013 | Chuang |
| 8,460,189 | B2 | 6/2013 | Libbus et al. |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,475,370 | B2 | 7/2013 | McCombie et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,982 | B2 | 7/2013 | Gavish et al. |
| 8,485,996 | B2 | 7/2013 | Bluman |
| 8,487,759 | B2 | 7/2013 | Hill |
| 8,491,446 | B2 | 7/2013 | Hinds et al. |
| 8,491,572 | B2 | 7/2013 | Martinson et al. |
| 8,493,822 | B2 | 7/2013 | Lee et al. |
| 8,500,608 | B1 | 8/2013 | Bonomi |
| 8,503,086 | B2 | 8/2013 | French et al. |
| 8,505,597 | B2 | 8/2013 | Sharperson |
| 8,506,370 | B2 | 8/2013 | Homsi |
| 8,506,457 | B2 | 8/2013 | Baudhuin |
| 8,506,458 | B2 | 8/2013 | Dugan |
| 8,506,459 | B2 | 8/2013 | Cassidy et al. |
| 8,512,210 | B2 | 8/2013 | Shauli |
| 8,512,212 | B2 | 8/2013 | Ish, III |
| 8,515,930 | B2 | 8/2013 | Hong |
| 8,516,723 | B2 | 8/2013 | Ferrigan et al. |
| 8,517,896 | B2 | 8/2013 | Robinette et al. |
| 8,517,899 | B2 | 8/2013 | Zhou |
| 8,523,743 | B1 | 9/2013 | Miles et al. |
| 8,523,789 | B2 | 9/2013 | Keiser |
| 8,527,038 | B2 | 9/2013 | Moon et al. |
| 8,529,409 | B1 | 9/2013 | Lesea-Ames |
| 8,529,415 | B2 | 9/2013 | Svenberg |
| 8,531,386 | B1 | 9/2013 | Kerr et al. |
| 8,533,007 | B2 | 9/2013 | Egami et al. |
| 8,533,620 | B2 | 9/2013 | Hoffman et al. |
| 8,535,204 | B2 | 9/2013 | Stacey |
| 8,535,247 | B2 | 9/2013 | Williams |
| 8,538,333 | B2 | 9/2013 | Jain et al. |
| 8,538,723 | B2 | 9/2013 | Chang |
| 8,540,560 | B2 | 9/2013 | Crowley et al. |
| 8,540,641 | B2 | 9/2013 | Kroll et al. |
| 8,543,185 | B2 | 9/2013 | Yuen et al. |
| 8,545,417 | B2 | 10/2013 | Banet et al. |

(56) References Cited

U.S. PATENT DOCUMENTS

| | | | |
|---|---|---|---|
| 8,550,962 | B2 | 10/2013 | Piaget et al. |
| 8,550,964 | B2 | 10/2013 | Ish, III et al. |
| 8,554,214 | B2 | 10/2013 | Sweeney et al. |
| 8,554,802 | B1 | 10/2013 | Barden et al. |
| 8,556,778 | B1 | 10/2013 | Dugan |
| 8,560,951 | B1 | 10/2013 | Snyder et al. |
| 8,562,489 | B2 | 10/2013 | Maximillian |
| 8,562,496 | B2 | 10/2013 | Webber et al. |
| 8,568,278 | B2 | 10/2013 | Riley et al. |
| 8,568,279 | B2 | 10/2013 | Golesh |
| 8,571,880 | B2 | 10/2013 | Goldberg |
| 8,572,576 | B2 | 10/2013 | Elvanoglu et al. |
| 5,585,561 | A1 | 11/2013 | Watt et al. |
| 8,572,764 | B2 | 11/2013 | Thellmann |
| 8,572,820 | B2 | 11/2013 | Richards |
| 8,573,572 | B2 | 11/2013 | Bowen et al. |
| 8,573,982 | B1 | 11/2013 | Chuang |
| 8,579,767 | B2 | 11/2013 | Ellis et al. |
| 8,585,561 | B2 | 11/2013 | Watt et al. |
| 8,588,476 | B1 | 11/2013 | Spicola, Jr. |
| 8,590,120 | B2 | 11/2013 | Sakai |
| 8,591,386 | B2 | 11/2013 | Meyer |
| 8,591,411 | B2 | 11/2013 | Banet et al. |
| 8,594,772 | B2 | 11/2013 | Eggenberger et al. |
| RE44,650 | E | 12/2013 | Anderson et al. |
| 8,597,093 | B2 | 12/2013 | Engelberg et al. |
| 8,602,951 | B2 | 12/2013 | Morris |
| 8,602,997 | B2 | 12/2013 | Banet et al. |
| 8,605,048 | B2 | 12/2013 | Ye et al. |
| 8,608,624 | B2 | 12/2013 | Shabodyash et al. |
| 8,610,593 | B2 | 12/2013 | Van Acht et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,622,873 | B2 | 1/2014 | Mcgown |
| 8,628,333 | B2 | 1/2014 | Prinzel, III et al. |
| 8,628,453 | B2 | 1/2014 | Balakrishnan et al. |
| 8,631,544 | B1 | 1/2014 | Shotey et al. |
| 8,639,020 | B1 | 1/2014 | Kutliroff et al. |
| 8,647,239 | B1 | 2/2014 | Sokolovas |
| 8,647,240 | B2 | 2/2014 | Heidecke |
| 8,649,890 | B2 | 2/2014 | Martin |
| 8,652,010 | B2 | 2/2014 | Ellis et al. |
| 8,654,198 | B2 | 2/2014 | Pryor |
| 8,655,004 | B2 | 2/2014 | Prest et al. |
| 8,657,724 | B2 | 2/2014 | Yang |
| 8,662,901 | B2 | 3/2014 | Tzao et al. |
| 8,663,106 | B2 | 3/2014 | Stivoric et al. |
| 8,667,194 | B2 | 3/2014 | Dybsetter et al. |
| 8,670,222 | B2 | 3/2014 | Rothkopf |
| 8,672,852 | B2 | 3/2014 | Gavish |
| 8,676,170 | B2 | 3/2014 | Porrati et al. |
| 8,676,541 | B2 | 3/2014 | Schrock et al. |
| 8,678,979 | B2 | 3/2014 | Stark et al. |
| 8,684,925 | B2 | 4/2014 | Manicka et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,696,527 | B2 | 4/2014 | Wu |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,704,068 | B2 | 4/2014 | Bowen |
| 8,706,530 | B2 | 4/2014 | Ohnemus et al. |
| 8,708,842 | B2 | 4/2014 | Ganuza |
| 8,708,870 | B2 | 4/2014 | Nalley |
| 8,712,510 | B2 | 4/2014 | Quy |
| 8,715,140 | B1 | 5/2014 | Gertz |
| 8,718,752 | B2 | 5/2014 | Libbus et al. |
| 8,719,202 | B1 | 5/2014 | Maeng |
| 8,727,947 | B2 | 5/2014 | Tagliabue |
| 8,734,157 | B1 | 5/2014 | Hummel, III |
| 8,734,296 | B1 | 5/2014 | Brumback et al. |
| 8,734,301 | B2 | 5/2014 | Remelius |
| 8,734,302 | B2 | 5/2014 | Hsieh |
| 8,734,304 | B2 | 5/2014 | Webber et al. |
| 8,734,308 | B1 | 5/2014 | Joslin |
| 8,738,732 | B2 | 5/2014 | Karidi |
| 8,740,751 | B2 | 6/2014 | Shum |
| 8,740,753 | B2 | 6/2014 | Olson et al. |
| 8,740,756 | B2 | 6/2014 | Shabodyash et al. |
| 8,740,802 | B2 | 6/2014 | Banet et al. |
| 8,740,807 | B2 | 6/2014 | Banet et al. |
| 8,744,803 | B2 | 6/2014 | Park et al. |
| 8,745,104 | B1 | 6/2014 | Rosenberg |
| 8,745,496 | B2 | 6/2014 | Gilley et al. |
| 8,747,330 | B2 | 6/2014 | Banet et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,762,167 | B2 | 6/2014 | Blander et al. |
| 8,762,313 | B2 | 6/2014 | Lahav et al. |
| 8,764,609 | B1 | 7/2014 | Elahmadie |
| 8,764,651 | B2 | 7/2014 | Tran |
| 8,768,769 | B2 | 7/2014 | Foladare et al. |
| 8,770,742 | B2 | 7/2014 | Howell et al. |
| 8,771,153 | B2 | 7/2014 | Dalebout et al. |
| 8,771,206 | B2 | 7/2014 | Gettelman et al. |
| 8,775,454 | B2 | 7/2014 | Geer |
| 8,776,264 | B2 | 7/2014 | Kiernan |
| 8,777,815 | B2 | 7/2014 | Case, Jr. et al. |
| 8,777,820 | B2 | 7/2014 | Lo |
| 8,781,568 | B2 | 7/2014 | Dugan |
| 8,783,326 | B1 | 7/2014 | Vaninger et al. |
| 8,784,271 | B2 | 7/2014 | Brumback et al. |
| 8,784,273 | B2 | 7/2014 | Dugan |
| 8,784,274 | B1 | 7/2014 | Chuang |
| 8,784,286 | B2 | 7/2014 | Reyes |
| 8,790,220 | B2 | 7/2014 | Karvonen |
| 8,790,222 | B2 | 7/2014 | Burger |
| 8,790,259 | B2 | 7/2014 | Katra et al. |
| 8,795,138 | B1 | 8/2014 | Yeh et al. |
| 8,799,200 | B2 | 8/2014 | Lahav |
| 8,801,581 | B2 | 8/2014 | Lai et al. |
| 8,805,844 | B2 | 8/2014 | Schorzman et al. |
| 8,805,941 | B2 | 8/2014 | Barak et al. |
| 8,808,152 | B1 | 8/2014 | Midgett |
| 8,814,754 | B2 | 8/2014 | Weast et al. |
| 8,815,189 | B2 | 8/2014 | Arnold et al. |
| 8,821,350 | B2 | 9/2014 | Maertz |
| 8,821,351 | B2 | 9/2014 | Abuelsaad et al. |
| 8,821,354 | B1 | 9/2014 | Tabahi |
| 8,821,359 | B1 | 9/2014 | Kassel |
| 8,821,870 | B2 | 9/2014 | Robinson et al. |
| 8,824,697 | B2 | 9/2014 | Christoph |
| 8,825,445 | B2 | 9/2014 | Hoffman et al. |
| 8,827,870 | B2 | 9/2014 | Dyer et al. |
| 8,827,879 | B2 | 9/2014 | Nicholas |
| 8,831,407 | B2 | 9/2014 | Meschter et al. |
| 8,831,538 | B2 | 9/2014 | Yuen |
| 8,838,471 | B1 | 9/2014 | Shum et al. |
| 8,845,497 | B2 | 9/2014 | Turner |
| 8,845,498 | B2 | 9/2014 | Webb |
| 8,845,499 | B1 | 9/2014 | Boatwright |
| 8,847,988 | B2 | 9/2014 | Geisner et al. |
| 8,851,565 | B2 | 10/2014 | Hontz et al. |
| 8,861,860 | B2 | 10/2014 | Gupta |
| 8,864,587 | B2 | 10/2014 | Framel et al. |
| 8,864,627 | B2 | 10/2014 | Bayerlein et al. |
| 8,868,448 | B2 | 10/2014 | Freishtat et al. |
| 8,870,720 | B1 | 10/2014 | Webber et al. |
| 8,870,791 | B2 | 10/2014 | Sabatino |
| 8,876,131 | B1 | 11/2014 | Gomes |
| 8,876,661 | B2 | 11/2014 | Lu |
| 8,876,674 | B2 | 11/2014 | Webb et al. |
| 8,882,637 | B2 | 11/2014 | Ainsworth et al. |
| 8,882,666 | B1 | 11/2014 | Goldberg et al. |
| 8,888,583 | B2 | 11/2014 | Dugan et al. |
| 8,888,660 | B1 | 11/2014 | Oteman |
| 8,888,700 | B2 | 11/2014 | Banet et al. |
| 8,894,551 | B2 | 11/2014 | Kerdjoudj |
| 8,897,868 | B2 | 11/2014 | Mazar et al. |
| 8,900,099 | B1 | 12/2014 | Boyette |

(56) References Cited

U.S. PATENT DOCUMENTS

| | | | |
|---|---|---|---|
| 8,902,714 | B2 | 12/2014 | Gossweiler, III et al. |
| 8,903,671 | B2 | 12/2014 | Park et al. |
| 8,908,894 | B2 | 12/2014 | Amento et al. |
| 8,915,823 | B2 | 12/2014 | McKirdy et al. |
| 8,918,465 | B2 | 12/2014 | Barak |
| 8,918,543 | B2 | 12/2014 | Karstens |
| 8,920,291 | B2 | 12/2014 | Chen et al. |
| 8,920,332 | B2 | 12/2014 | Hong et al. |
| 8,920,343 | B2 | 12/2014 | Sabatino |
| 8,926,475 | B2 | 1/2015 | Lin et al. |
| 8,926,479 | B2 | 1/2015 | Chen et al. |
| 8,932,188 | B2 | 1/2015 | Svenberg |
| 8,939,831 | B2 | 1/2015 | Dugan |
| 8,943,002 | B2 | 1/2015 | Zelenko et al. |
| 8,944,958 | B1 | 2/2015 | Brumback et al. |
| 8,944,968 | B2 | 2/2015 | Baudhuin |
| 8,945,328 | B2 | 2/2015 | Longinotti-Buitoni et al. |
| 8,947,226 | B2 | 2/2015 | Dugan |
| 8,951,106 | B2 | 2/2015 | Crowley |
| 8,951,164 | B2 | 2/2015 | Morris et al. |
| 8,951,168 | B2 | 2/2015 | Baudhuin |
| 8,954,135 | B2 | 2/2015 | Yuen et al. |
| 8,954,290 | B2 | 2/2015 | Yuen et al. |
| 8,956,268 | B2 | 2/2015 | Huang et al. |
| 8,956,290 | B2 | 2/2015 | Gilley et al. |
| 8,956,303 | B2 | 2/2015 | Hong et al. |
| 8,956,715 | B2 | 2/2015 | Kim |
| 8,958,631 | B2 | 2/2015 | Kutliroff et al. |
| 8,961,371 | B2 | 2/2015 | Sultan |
| 8,961,413 | B2 | 2/2015 | Teller et al. |
| 8,961,414 | B2 | 2/2015 | Teller et al. |
| 8,965,348 | B1 | 2/2015 | Cronin |
| 8,965,498 | B2 | 2/2015 | Katra et al. |
| 8,965,541 | B2 | 2/2015 | Martinez et al. |
| 8,965,732 | B2 | 2/2015 | Robinette et al. |
| 8,968,155 | B2 | 3/2015 | Bird |
| 8,968,161 | B2 | 3/2015 | Shapiro et al. |
| 8,968,163 | B1 | 3/2015 | Vidmar |
| 8,972,199 | B2 | 3/2015 | Liang |
| 8,976,007 | B2 | 3/2015 | Dugan |
| 8,977,194 | B2 | 3/2015 | Jain et al. |
| 8,979,709 | B2 | 3/2015 | Toback et al. |
| 8,979,765 | B2 | 3/2015 | Banet et al. |
| 8,986,165 | B2 | 3/2015 | Ashby |
| 8,992,383 | B2 | 3/2015 | Bilang |
| 8,992,387 | B2 | 3/2015 | Watterson et al. |
| 9,005,085 | B2 | 4/2015 | Astilean |
| 9,005,129 | B2 | 4/2015 | Venkatraman et al. |
| 9,010,222 | B2 | 4/2015 | Peirce |
| 9,011,291 | B2 | 4/2015 | Birrell |
| 9,011,292 | B2 | 4/2015 | Weast et al. |
| 9,011,293 | B2 | 4/2015 | Shavit et al. |
| 9,011,301 | B2 | 4/2015 | Balandis et al. |
| 9,015,952 | B2 | 4/2015 | Magosaki |
| 9,017,230 | B1 | 4/2015 | Pitts |
| 9,022,906 | B1 | 5/2015 | Nelson |
| 9,022,907 | B2 | 5/2015 | Wang |
| 9,026,927 | B2 | 5/2015 | Brumback et al. |
| 9,028,368 | B2 | 5/2015 | Ashby et al. |
| 9,028,381 | B2 | 5/2015 | Mestemaker |
| 9,028,441 | B2 | 5/2015 | Kuhn |
| 9,031,812 | B2 | 5/2015 | Roberts et al. |
| 9,037,578 | B2 | 5/2015 | Brust et al. |
| 9,038,218 | B1 | 5/2015 | Heil et al. |
| 9,038,549 | B1 | 5/2015 | Zebarjad |
| 9,039,578 | B2 | 5/2015 | Dalebout |
| 9,039,581 | B2 | 5/2015 | Chia et al. |
| 9,039,614 | B2 | 5/2015 | Yuen et al. |
| 9,042,596 | B2 | 5/2015 | Connor |
| 9,044,635 | B2 | 6/2015 | Lull |
| 9,050,491 | B2 | 6/2015 | Gordon et al. |
| 9,050,497 | B2 | 6/2015 | Reyes |
| 9,050,498 | B2 | 6/2015 | Lu et al. |
| 9,052,798 | B1 | 6/2015 | Klassen et al. |
| 9,055,868 | B2 | 6/2015 | Islam |
| 9,064,342 | B2 | 6/2015 | Yuen et al. |
| 9,069,380 | B2 | 6/2015 | Rahman et al. |
| 9,072,930 | B2 | 7/2015 | Ashby et al. |
| 9,072,932 | B2 | 7/2015 | Piaget et al. |
| 9,079,068 | B2 | 7/2015 | Muehl |
| 9,083,826 | B2 | 7/2015 | Lu et al. |
| 9,084,912 | B2 | 7/2015 | Jaquish et al. |
| 9,089,732 | B2 | 7/2015 | Andon et al. |
| 9,089,733 | B2 | 7/2015 | Fisbein et al. |
| 9,095,740 | B2 | 8/2015 | Wu |
| 9,107,586 | B2 | 8/2015 | Tran |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,123,317 | B2 | 9/2015 | Watterson et al. |
| 9,123,380 | B2 | 9/2015 | Holtz et al. |
| 9,125,620 | B2 | 9/2015 | Walke |
| 9,126,072 | B2 | 9/2015 | Watterson et al. |
| 9,128,981 | B1 | 9/2015 | Geer |
| 9,132,051 | B2 | 9/2015 | Heil |
| 9,135,347 | B2 | 9/2015 | Damman et al. |
| 9,137,309 | B2 | 9/2015 | Ananny et al. |
| 9,138,612 | B2 | 9/2015 | Breaux |
| 9,138,614 | B2 | 9/2015 | Lu et al. |
| 9,138,615 | B2 | 9/2015 | Olson et al. |
| 9,141,087 | B2 | 9/2015 | Brown et al. |
| 9,143,881 | B2 | 9/2015 | Fan et al. |
| 9,144,703 | B2 | 9/2015 | Dalebout et al. |
| 9,144,709 | B2 | 9/2015 | Reich |
| 9,146,147 | B1 | 9/2015 | Bakhsh |
| 9,162,102 | B1 | 10/2015 | Eder et al. |
| 9,162,104 | B1 | 10/2015 | Lee |
| 9,162,106 | B1 | 10/2015 | Scheiman |
| 9,162,142 | B2 | 10/2015 | Shum et al. |
| 9,168,001 | B2 | 10/2015 | Stivoric et al. |
| 9,168,414 | B2 | 10/2015 | Liu et al. |
| 9,173,593 | B2 | 11/2015 | Banet et al. |
| 9,173,594 | B2 | 11/2015 | Banet et al. |
| 9,174,084 | B2 | 11/2015 | Morris et al. |
| 9,174,085 | B2 | 11/2015 | Foley |
| 9,178,635 | B2 | 11/2015 | Ben-Shlomo |
| 9,183,498 | B2 | 11/2015 | Landers |
| 9,186,537 | B2 | 11/2015 | Arnold et al. |
| 9,186,549 | B2 | 11/2015 | Watterson et al. |
| 9,186,552 | B1 | 11/2015 | Deal |
| 9,189,021 | B2 | 11/2015 | Jerauld |
| 9,192,800 | B1 | 11/2015 | Meyer et al. |
| 9,192,816 | B2 | 11/2015 | Molyneux et al. |
| 9,199,115 | B2 | 12/2015 | Yim et al. |
| 9,199,123 | B2 | 12/2015 | Solow et al. |
| 9,201,405 | B2 | 12/2015 | Clarkson et al. |
| 9,201,458 | B2 | 12/2015 | Hunt et al. |
| 9,205,301 | B2 | 12/2015 | Cohen |
| 9,208,764 | B2 | 12/2015 | Ghosh et al. |
| 9,211,431 | B2 | 12/2015 | Hornback et al. |
| 9,211,433 | B2 | 12/2015 | Hall |
| 9,211,440 | B2 | 12/2015 | Lagree |
| 9,213,803 | B2 | 12/2015 | Rolley |
| 9,220,940 | B2 | 12/2015 | Al Kuw ari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,229,476 | B2 | 1/2016 | Yanev et al. |
| 9,230,064 | B2 | 1/2016 | Yanev et al. |
| 9,233,269 | B2 | 1/2016 | Lannon |
| 9,241,635 | B2 | 1/2016 | Yuen et al. |
| 9,245,428 | B2 | 1/2016 | Weddle et al. |
| 9,247,543 | B2 | 1/2016 | Berlin et al. |
| 9,248,329 | B2 | 2/2016 | Heideman |
| 9,253,168 | B2 | 2/2016 | Panther |
| 9,254,099 | B2 | 2/2016 | Connor |
| 9,254,409 | B2 | 2/2016 | Dalebout et al. |
| 9,256,910 | B2 | 2/2016 | Goldberg |
| 9,257,054 | B2 | 2/2016 | Coza et al. |
| 9,258,670 | B2 | 2/2016 | Goyal et al. |
| 9,259,633 | B2 | 2/2016 | Meyers |

(56) References Cited

U.S. PATENT DOCUMENTS 9,262,064 B2 2/2016 Yanev et al.
9,265,984 B2 2/2016 Huber
9,269,119 B2 2/2016 Warner
9,272,183 B2 3/2016 Quy
9,272,186 B2 3/2016 Reich et al.
9,275,617 B2 3/2016 Regnier
9,279,734 B2 3/2016 Walker
9,283,429 B2 3/2016 Aragones et al.
9,288,298 B2 3/2016 Choudhary et al.
9,289,063 B2 3/2016 Baugh et al.
9,289,644 B2 3/2016 Carson
9,292,935 B2 3/2016 Koduri et al.
9,295,302 B1 3/2016 Reed et al.
9,295,422 B2 3/2016 Tai
9,295,894 B2 3/2016 Papadopolous
9,305,141 B2 4/2016 Fabrizio
9,308,409 B2 4/2016 Beaver et al.
9,308,415 B2 4/2016 Crawford et al.
9,308,417 B2 4/2016 Grundy
9,311,802 B1 4/2016 Chin et al.
9,314,658 B2 4/2016 Kaye
9,314,659 B2 4/2016 Gvoich
9,317,662 B2 4/2016 Bangera et al.
9,318,030 B2 4/2016 Harris et al.
9,320,935 B1 4/2016 Paris
9,320,938 B1 4/2016 Belmore
9,320,940 B2 4/2016 Rainey
9,327,159 B1 5/2016 Medina
9,329,053 B2 5/2016 Lakovic et al.
9,332,363 B2 5/2016 Jain et al.
9,333,388 B2 5/2016 Lee et al.
9,339,209 B2 5/2016 Banet et al.
9,339,681 B1 5/2016 Nalley
9,339,682 B2 5/2016 Braier et al.
9,339,683 B2 5/2016 Dilli et al.
9,339,691 B2 5/2016 Brammer
9,339,692 B2 5/2016 Hashish
9,345,947 B2 5/2016 Harris et al.
9,349,280 B2 5/2016 Baldwin et al.
9,350,598 B2 5/2016 Barak et al.
9,352,181 B2 5/2016 O'Neil
9,352,185 B2 5/2016 Hendrickson et al.
9,352,186 B2 5/2016 Watterson
9,352,187 B2 5/2016 Piaget et al.
9,357,551 B2 5/2016 Gutman
9,357,921 B2 6/2016 Chang et al.
9,358,422 B2 6/2016 Brontman
9,358,426 B2 6/2016 Aragones et al.
9,364,158 B2 6/2016 Banet et al.
9,364,703 B1 6/2016 Kuka
9,364,706 B2 6/2016 Lo
9,364,708 B2 6/2016 Luger et al.
9,364,712 B2 6/2016 Wu
9,364,714 B2 6/2016 Koduri et al.
9,367,668 B2 6/2016 Flynt et al.
9,370,679 B2 6/2016 Lagree et al.
9,370,687 B2 6/2016 Hao
9,374,279 B2 6/2016 Yuen et al.
9,375,602 B2 6/2016 Krull
9,375,629 B2 6/2016 Schieffer et al.
9,377,314 B2 6/2016 Tseng et al.
9,378,336 B2 6/2016 Ohnemus et al.
9,381,420 B2 7/2016 Burroughs
9,381,445 B2 7/2016 Ventura et al.
9,385,810 B2 7/2016 Hazani
9,387,355 B1 7/2016 Joya
9,387,357 B2 7/2016 Mueller
9,387,387 B2 7/2016 Dalebout
9,389,057 B2 7/2016 Meschter et al.
9,389,718 B1 7/2016 Letourneur
9,389,754 B2 7/2016 Reese et al.
9,390,229 B1 7/2016 Kahn et al.
9,392,941 B2 7/2016 Powch et al.
9,393,453 B2 7/2016 Watterson
9,395,754 B2 7/2016 Cronin
9,401,078 B2 7/2016 Barrett
9,403,047 B2 8/2016 Olson et al.
9,403,048 B2 8/2016 Balandis et al.
9,403,053 B2 8/2016 Kaiser et al.
9,405,892 B2 8/2016 Baldwin et al.
9,409,047 B2 8/2016 Kamenskikh
9,409,050 B2 8/2016 Mintz
9,409,052 B2 8/2016 Werner
9,411,936 B2 8/2016 Landrum et al.
9,411,940 B2 8/2016 Burroughs et al.
9,415,257 B2 8/2016 Habing
9,420,083 B2 8/2016 Roberts et al.
9,420,542 B2 8/2016 Henia
9,421,422 B2 8/2016 Yuen et al.
9,421,448 B2 8/2016 Tropper et al.
9,422,018 B2 8/2016 Pelot et al.
9,427,611 B1 8/2016 Balentine
9,430,043 B1 8/2016 Amento et al.
9,430,920 B2 8/2016 Munro et al.
9,439,574 B2 9/2016 McCombie et al.
9,440,134 B2 9/2016 Nicora
9,442,100 B2 9/2016 Connor
9,446,288 B1 9/2016 Pazan
9,451,897 B2 9/2016 Mazar et al.
9,452,315 B1 9/2016 Murray et al.
9,452,320 B2 9/2016 Yang
9,455,784 B2 9/2016 Cune et al.
9,457,220 B2 10/2016 Olson
9,457,224 B2 10/2016 Giannelli et al.
9,457,256 B2 10/2016 Aragones et al.
9,460,421 B2 10/2016 Lai et al.
9,462,844 B2 10/2016 Schrock et al.
9,463,345 B2 10/2016 Simonetti
9,463,349 B1 10/2016 Chang
9,463,572 B2 10/2016 Parente
9,468,382 B2 10/2016 Hanoun
9,468,792 B2 10/2016 Simonetti
9,468,794 B2 10/2016 Barton
9,473,593 B2 10/2016 Wallace
9,474,666 B1 10/2016 Smith
9,474,925 B1 10/2016 Hsiung
9,474,935 B2 10/2016 Abbondanza et al.
9,477,303 B2 10/2016 Fleischmann et al.
9,480,874 B2 11/2016 Cutler
9,486,070 B2 11/2016 Labrosse et al.
9,486,382 B1 11/2016 Boss
9,486,658 B2 11/2016 Alexander
9,491,562 B2 11/2016 Cronin
9,495,015 B1 11/2016 Kahn et al.
9,495,860 B2 11/2016 Lett
9,498,066 B2 11/2016 Christanson et al.
9,498,666 B1 11/2016 Boatwright
9,498,668 B2 11/2016 Smith
9,498,671 B1 11/2016 Softky
9,498,704 B1 11/2016 Cohen et al.
9,500,464 B2 11/2016 Coza
9,504,414 B2 11/2016 Coza et al.
9,505,241 B2 11/2016 Cuzin
9,506,528 B2 11/2016 Tucker et al.
9,506,529 B2 11/2016 Tucker et al.
9,509,269 B1 11/2016 Rosenberg
9,511,259 B2 12/2016 Mountain
9,517,378 B2 12/2016 Ashby et al.
9,517,406 B2 12/2016 Shum et al.
9,526,937 B2 12/2016 Uygan
9,529,385 B2 12/2016 Connor
9,529,437 B2 12/2016 Kahn et al.
9,532,002 B2 12/2016 Glass et al.
9,532,734 B2 1/2017 Hoffman et al.
9,533,228 B2 1/2017 Dugan
9,535,505 B2 1/2017 Erkkila et al.
9,536,449 B2 1/2017 Connor
9,539,458 B1 * 1/2017 Ross ..... A63B 21/0058
9,540,071 B2 1/2017 Jordan et al.
9,540,174 B2 1/2017 Josserond et al.
9,545,535 B2 1/2017 Lagree
9,545,540 B1 1/2017 Moschel
9,545,541 B2 1/2017 Aragones et al.
9,549,585 B2 1/2017 Amos et al.

(56) References Cited

U.S. PATENT DOCUMENTS

| | | | |
|---|---|---|---|
| 9,550,091 | B2 | 1/2017 | Emerson |
| 9,555,278 | B2 | 1/2017 | Kaye et al. |
| 9,555,280 | B2 | 1/2017 | Kaye et al. |
| 9,560,917 | B2 | 2/2017 | Roslund, Jr. |
| 9,563,336 | B2 | 2/2017 | Barak et al. |
| 9,563,700 | B2 | 2/2017 | Garmark et al. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,071 | B2 | 2/2017 | Baldwin et al. |
| 9,582,976 | B2 | 2/2017 | Chin et al. |
| 9,585,563 | B2 | 3/2017 | Mensinger et al. |
| 9,586,090 | B2 | 3/2017 | Watterson et al. |
| 9,589,482 | B2 | 3/2017 | Baldwin et al. |
| 9,593,992 | B2 | 3/2017 | Wu |
| 9,594,433 | B2 | 3/2017 | Baldwin et al. |
| 9,597,540 | B2 | 3/2017 | Arnold |
| 9,599,981 | B2 | 3/2017 | Crabtree |
| 9,600,079 | B2 | 3/2017 | Baldwin et al. |
| 9,602,210 | B2 | 3/2017 | Berlin et al. |
| 9,604,092 | B2 | 3/2017 | Krull |
| 9,604,096 | B2 | 3/2017 | Arnold et al. |
| 9,604,099 | B2 | 3/2017 | Taylor |
| 9,610,475 | B1 | 4/2017 | DeKnock et al. |
| 9,610,506 | B2 | 4/2017 | Dugan |
| 9,615,215 | B2 | 4/2017 | Yuen et al. |
| 9,615,785 | B2 | 4/2017 | Rocker et al. |
| 9,616,274 | B2 | 4/2017 | Wehrell |
| 9,616,276 | B2 | 4/2017 | Dalebout et al. |
| 9,616,281 | B2 | 4/2017 | Hsiung |
| 9,616,284 | B1 | 4/2017 | Aganyan et al. |
| 9,616,292 | B2 | 4/2017 | Orfield |
| 9,621,959 | B2 | 4/2017 | Mountain |
| 9,622,537 | B2 | 4/2017 | Amos et al. |
| 9,623,285 | B1 | 4/2017 | Ruiz |
| 9,623,286 | B1 | 4/2017 | Chen |
| 9,628,286 | B1 | 4/2017 | Nguyen et al. |
| 9,630,048 | B2 | 4/2017 | Kaye et al. |
| 9,632,746 | B2 | 4/2017 | Keipert et al. |
| 9,636,539 | B1 | 5/2017 | Brumit |
| 9,636,540 | B2 | 5/2017 | Mueller et al. |
| 9,636,543 | B2 | 5/2017 | Dyer et al. |
| 9,636,567 | B2 | 5/2017 | Brammer et al. |
| 9,642,764 | B2 | 5/2017 | Kuehne et al. |
| 9,643,042 | B2 | 5/2017 | Madden |
| 9,646,137 | B2 | 5/2017 | Gilley et al. |
| 9,646,481 | B2 | 5/2017 | Messenger et al. |
| 9,647,758 | B2 | 5/2017 | Hazani |
| 9,655,053 | B2 | 5/2017 | Park et al. |
| 9,656,115 | B2 | 5/2017 | Young |
| 9,656,144 | B2 | 5/2017 | Jafarifesharaki |
| 9,656,591 | B1 | 5/2017 | Dumenigo et al. |
| 9,658,066 | B2 | 5/2017 | Yuen et al. |
| 9,661,355 | B2 | 5/2017 | Ho |
| 9,661,781 | B2 | 5/2017 | Anolik et al. |
| 9,662,529 | B2 | 5/2017 | Miller et al. |
| 9,669,261 | B2 | 6/2017 | Eder |
| 9,672,196 | B2 | 6/2017 | Shachar et al. |
| 9,672,754 | B2 | 6/2017 | Yuen et al. |
| 9,673,904 | B2 | 6/2017 | Palanisamy et al. |
| 9,675,836 | B2 | 6/2017 | Babon |
| 9,678,626 | B2 | 6/2017 | Whang |
| 9,681,313 | B2 | 6/2017 | Malach |
| 9,682,267 | B2 | 6/2017 | Kaye et al. |
| 9,682,306 | B2 | 6/2017 | Lin et al. |
| 9,687,689 | B2 | 6/2017 | Lin |
| 9,692,844 | B2 | 6/2017 | Messenger et al. |
| RE46,481 | E | 7/2017 | Sako et al. |
| 9,694,234 | B2 | 7/2017 | Dalebout et al. |
| 9,694,247 | B2 | 7/2017 | Nurnberg |
| 9,697,740 | B2 | 7/2017 | Zhang et al. |
| 9,700,752 | B1 | 7/2017 | Powers |
| 9,700,753 | B1 | 7/2017 | Boatwright |
| 9,700,780 | B2 | 7/2017 | Riley et al. |
| 9,700,802 | B2 | 7/2017 | Dugan |
| 9,701,530 | B2 | 7/2017 | Kline et al. |
| 9,707,435 | B1 | 7/2017 | Ferlito et al. |
| 9,707,441 | B2 | 7/2017 | Yang |
| 9,707,447 | B1 | 7/2017 | Lopez Babodilla et al. |
| 9,710,711 | B2 | 7/2017 | Dibenedetto et al. |
| 9,712,629 | B2 | 7/2017 | Molettiere et al. |
| 9,713,739 | B2 | 7/2017 | Dalmia |
| 9,715,774 | B2 | 7/2017 | Baldwin et al. |
| 9,719,797 | B2 | 8/2017 | Fino et al. |
| 9,720,443 | B2 | 8/2017 | Malhotra |
| 9,720,912 | B2 | 8/2017 | Morimoto et al. |
| 9,723,393 | B2 | 8/2017 | Nguyen et al. |
| 9,724,553 | B2 | 8/2017 | Kaye et al. |
| 9,724,563 | B2 | 8/2017 | Schmidt |
| 9,724,589 | B2 | 8/2017 | Baudhuin |
| 9,728,059 | B2 | 8/2017 | Arnold et al. |
| 9,729,921 | B2 | 8/2017 | Kim et al. |
| 9,729,989 | B2 | 8/2017 | Marten |
| 9,730,025 | B2 | 8/2017 | Yuen et al. |
| 9,730,228 | B2 | 8/2017 | Harel |
| 9,730,619 | B2 | 8/2017 | Messenger et al. |
| 9,731,158 | B1 | 8/2017 | Lo |
| 9,734,184 | B1 | 8/2017 | LagacÉ et al. |
| 9,737,261 | B2 | 8/2017 | Coza et al. |
| 9,737,747 | B1 | 8/2017 | Walsh et al. |
| 9,743,861 | B2 | 8/2017 | Giedwoyn et al. |
| 9,750,454 | B2 | 9/2017 | Walke et al. |
| 9,756,895 | B2 | 9/2017 | Rice et al. |
| 9,757,605 | B2 | 9/2017 | Olson et al. |
| 9,757,611 | B1 | 9/2017 | Colburn |
| 9,763,581 | B2 | 9/2017 | Bonutti et al. |
| 9,764,184 | B2 | 9/2017 | Kueker et al. |
| 9,764,188 | B1 | 9/2017 | Aganyan et al. |
| 9,767,212 | B2 | 9/2017 | Lavi et al. |
| 9,769,522 | B2 | 9/2017 | Richardson |
| 9,772,612 | B2 | 9/2017 | Mccarthy, Iii et al. |
| 9,775,123 | B2 | 9/2017 | Harel |
| 9,776,032 | B2 | 10/2017 | Moran et al. |
| 9,776,039 | B1 | 10/2017 | Xu |
| 9,776,042 | B2 | 10/2017 | Prokhorov |
| 9,778,280 | B2 | 10/2017 | Yuen et al. |
| 9,782,125 | B2 | 10/2017 | Berner, Jr. et al. |
| 9,782,625 | B1 | 10/2017 | Blum et al. |
| 9,789,362 | B1 | 10/2017 | Su et al. |
| 9,792,361 | B1 | 10/2017 | Geer |
| 9,795,819 | B2 | 10/2017 | Wehrell |
| 9,795,822 | B2 | 10/2017 | Smith et al. |
| 9,795,827 | B2 | 10/2017 | Wiener et al. |
| 9,795,828 | B2 | 10/2017 | Andrade |
| 9,795,855 | B2 | 10/2017 | Jafarifesharaki |
| 9,797,920 | B2 | 10/2017 | Kahn et al. |
| 9,798,309 | B2 | 10/2017 | Tirpak |
| 9,801,547 | B2 | 10/2017 | Yuen et al. |
| 9,802,075 | B2 | 10/2017 | Gvoich |
| 9,802,081 | B2 | 10/2017 | Ridgel et al. |
| 9,808,202 | B2 | 11/2017 | Wu et al. |
| 9,808,673 | B2 | 11/2017 | Robinson et al. |
| 9,811,639 | B2 | 11/2017 | Aragones et al. |
| 9,814,920 | B1 | 11/2017 | Monterrey |
| 9,814,922 | B2 | 11/2017 | Moran et al. |
| 9,814,927 | B2 | 11/2017 | Forystek |
| 9,814,928 | B2 | 11/2017 | Taylor et al. |
| 9,814,929 | B2 | 11/2017 | Moser |
| 9,814,930 | B2 | 11/2017 | Manzke et al. |
| 9,818,285 | B2 | 11/2017 | Clarke et al. |
| 9,819,561 | B2 | 11/2017 | Freishtat et al. |
| 9,819,754 | B2 | 11/2017 | Park et al. |
| 9,821,191 | B2 | 11/2017 | Abbondanza et al. |
| 9,821,212 | B2 | 11/2017 | Kolman et al. |
| 9,824,110 | B2 | 11/2017 | Giudici et al. |
| 9,824,578 | B2 | 11/2017 | Burton et al. |
| 9,827,458 | B2 | 11/2017 | Dalton |
| 9,829,068 | B2 | 11/2017 | Marchetti |
| 9,829,327 | B2 | 11/2017 | Nagy et al. |
| 9,833,141 | B2 | 12/2017 | Kampman et al. |
| 9,833,654 | B1 | 12/2017 | Gant et al. |
| 9,833,658 | B2 | 12/2017 | Wiener et al. |
| 9,838,736 | B2 | 12/2017 | Smith et al. |
| 9,841,077 | B2 | 12/2017 | Modrezejewski et al. |

(56) References Cited

U.S. PATENT DOCUMENTS

| | | | |
|---|---|---|---|
| 9,849,330 | B2 | 12/2017 | Lagree |
| 9,849,333 | B2 | 12/2017 | Fung |
| 9,849,361 | B2 | 12/2017 | Coza et al. |
| 9,852,271 | B2 | 12/2017 | Aragones et al. |
| 9,858,307 | B2 | 1/2018 | Sultan et al. |
| 9,861,300 | B2 | 1/2018 | Gettelman et al. |
| 9,864,844 | B2 | 1/2018 | Durham et al. |
| 9,866,596 | B2 | 1/2018 | Das et al. |
| 9,868,006 | B1 | 1/2018 | Epler |
| 9,878,200 | B2 | 1/2018 | Edmondson |
| 9,878,201 | B1 | 1/2018 | Moschel |
| 9,880,805 | B1 | 1/2018 | Guralnick |
| 9,881,326 | B2 | 1/2018 | Gilley et al. |
| 9,882,736 | B2 | 1/2018 | Lett |
| 9,882,992 | B2 | 1/2018 | Baldwin et al. |
| 9,884,224 | B2 | 2/2018 | Spoeth et al. |
| 9,885,575 | B2 | 2/2018 | Collin |
| 9,886,309 | B2 | 2/2018 | Alles et al. |
| 9,886,871 | B1 | 2/2018 | Rauhala et al. |
| 9,889,334 | B2 | 2/2018 | Ashby et al. |
| 9,892,417 | B2 | 2/2018 | Shachar et al. |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | Deluca et al. |
| 9,901,805 | B2 | 2/2018 | Hughes, Jr. |
| 9,906,572 | B2 | 2/2018 | Wang et al. |
| 9,907,396 | B1 | 3/2018 | Labrosse et al. |
| 9,910,498 | B2 | 3/2018 | Kutliroff et al. |
| 9,914,003 | B2 | 3/2018 | Kuehne et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,919,198 | B2 | 3/2018 | Romeo et al. |
| 9,921,726 | B1 | 3/2018 | Sculley et al. |
| 9,937,375 | B2 | 4/2018 | Zhu |
| 9,940,161 | B1 | 4/2018 | Kahn et al. |
| 9,940,682 | B2 | 4/2018 | Hoffman et al. |
| 9,943,159 | B1 | 4/2018 | Novikova |
| 9,943,719 | B2 | 4/2018 | Smith et al. |
| 9,943,722 | B2 | 4/2018 | Dalebout |
| 9,946,857 | B2 | 4/2018 | Beals |
| 9,948,349 | B2 | 4/2018 | Malach |
| 9,948,477 | B2 | 4/2018 | Marten |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,959,902 | B2 | 5/2018 | Mcnamee |
| 9,960,980 | B2 | 5/2018 | Wilson |
| 9,962,081 | B2 | 5/2018 | Mensinger et al. |
| 9,962,305 | B2 | 5/2018 | Yamada et al. |
| 9,962,576 | B2 | 5/2018 | Anderson |
| 9,965,059 | B2 | 5/2018 | Myers et al. |
| 9,967,614 | B2 | 5/2018 | McCarthy, III |
| 9,968,821 | B2 | 5/2018 | Finlayson et al. |
| 9,968,823 | B2 | 5/2018 | Cutler |
| 9,974,997 | B2 | 5/2018 | Cei |
| 9,977,874 | B2 | 5/2018 | Aragones et al. |
| 9,983,011 | B2 | 5/2018 | Mountain |
| 9,986,315 | B2 | 5/2018 | Oleson et al. |
| 9,987,513 | B2 | 6/2018 | Yim et al. |
| 9,987,517 | B1 | 6/2018 | Kuo |
| 9,989,507 | B2 | 6/2018 | Benn |
| 9,993,680 | B2 | 6/2018 | Gordon |
| 9,993,683 | B2 | 6/2018 | Moschel |
| 9,996,066 | B2 | 6/2018 | Beals |
| 10,004,656 | B2 | 6/2018 | Whalen et al. |
| 10,004,934 | B2 | 6/2018 | Pennington |
| 10,004,940 | B2 | 6/2018 | Badarneh |
| 10,008,090 | B2 | 6/2018 | Yuen et al. |
| 10,010,745 | B1 | 7/2018 | Brumit |
| 10,013,986 | B1 | 7/2018 | Bhaya et al. |
| 10,015,216 | B2 | 7/2018 | Wang et al. |
| 10,016,646 | B2 | 7/2018 | Butler |
| 10,016,655 | B2 | 7/2018 | Lagree |
| 10,021,188 | B2 | 7/2018 | Oleson et al. |
| 10,022,583 | B2 | 7/2018 | Wang |
| 10,022,589 | B2 | 7/2018 | Case, Jr. et al. |
| 10,022,590 | B2 | 7/2018 | Foley et al. |
| 10,029,172 | B2 | 7/2018 | Galasso et al. |
| 10,035,010 | B1 | 7/2018 | Wagstaff |
| 10,037,053 | B2 | 7/2018 | Malhotra |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0024998 | A1 | 9/2001 | Novak et al. |
| 2001/0027266 | A1 | 10/2001 | Hautala et al. |
| 2001/0028350 | A1 | 10/2001 | Matsuoka et al. |
| 2001/0041647 | A1 | 11/2001 | Itoh et al. |
| 2001/0049320 | A1 | 12/2001 | Cohen et al. |
| 2001/0049470 | A1 | 12/2001 | Mault et al. |
| 2001/0051564 | A1 | 12/2001 | Iund et al. |
| 2001/0051566 | A1 | 12/2001 | Krull |
| 2001/0053883 | A1 | 12/2001 | Yoshimura et al. |
| 2002/0004191 | A1 | 1/2002 | Tice et al. |
| 2002/0004439 | A1 | 1/2002 | Galbraith et al. |
| 2002/0013200 | A1 | 1/2002 | Sechrest |
| 2002/0013717 | A1 | 1/2002 | Ando et al. |
| 2002/0016235 | A1 | 2/2002 | Ashby et al. |
| 2002/0019298 | A1 | 2/2002 | Eschenbach |
| 2002/0022551 | A1 | 2/2002 | Watterson et al. |
| 2002/0022555 | A1 | 2/2002 | Nesci |
| 2002/0022559 | A1 | 2/2002 | Krull |
| 2002/0024521 | A1 | 2/2002 | Goden |
| 2002/0025888 | A1 | 2/2002 | Germanton et al. |
| 2002/0025891 | A1 | 2/2002 | Colosky et al. |
| 2002/0026130 | A1 | 2/2002 | West |
| 2002/0026292 | A1 | 2/2002 | Isami |
| 2002/0028733 | A1 | 3/2002 | Martens |
| 2002/0031756 | A1 | 3/2002 | Holtz |
| 2002/0035017 | A1 | 3/2002 | Pertegaz-Esteban |
| 2002/0039952 | A1 | 4/2002 | Clem |
| 2002/0042328 | A1 | 4/2002 | Yoo |
| 2002/0042912 | A1 | 4/2002 | Jun Lijima |
| 2002/0043909 | A1 | 4/2002 | Nielsen |
| 2002/0045519 | A1 | 4/2002 | Watterson |
| 2002/0047867 | A1 | 4/2002 | Mault |
| 2002/0049123 | A1 | 4/2002 | Krull |
| 2002/0052268 | A1 | 5/2002 | Morcillo-Quintero |
| 2002/0054244 | A1 | 5/2002 | Holtz |
| 2002/0055418 | A1 | 5/2002 | Pyles et al. |
| 2002/0055419 | A1 | 5/2002 | Hinnebusch |
| 2002/0055420 | A1 | 5/2002 | Stearns et al. |
| 2002/0055422 | A1 | 5/2002 | Airmet |
| 2002/0055426 | A1 | 5/2002 | Krull |
| 2002/0055857 | A1 | 5/2002 | Mault |
| 2002/0060335 | A1 | 5/2002 | Edgar |
| 2002/0062236 | A1 | 5/2002 | Murashita |
| 2002/0066735 | A1 | 6/2002 | Hewlitt et al. |
| 2002/0068887 | A1 | 6/2002 | Kikumoto |
| 2002/0068991 | A1 | 6/2002 | Fitzsimmons, Jr. |
| 2002/0070954 | A1 | 6/2002 | Lang |
| 2002/0072436 | A1 | 6/2002 | Liu |
| 2002/0077219 | A1 | 6/2002 | Cohen |
| 2002/0077221 | A1 | 6/2002 | Dalebout et al. |
| 2002/0083122 | A1 | 6/2002 | Lemchen |
| 2002/0086779 | A1 | 7/2002 | Wilkinson |
| 2002/0088337 | A1 | 7/2002 | Devecka |
| 2002/0091043 | A1 | 7/2002 | Rexach |
| 2002/0091796 | A1 | 7/2002 | Higginson |
| 2002/0094914 | A1 | 7/2002 | Maresh et al. |
| 2002/0098957 | A1 | 7/2002 | Webber |
| 2002/0101880 | A1 | 8/2002 | Kim |
| 2002/0106617 | A1 | 8/2002 | Hersh |
| 2002/0107058 | A1 | 8/2002 | Namba et al. |
| 2002/0109710 | A1 | 8/2002 | Holtz et al. |
| 2002/0111541 | A1 | 8/2002 | Bibl et al. |
| 2002/0115536 | A1 | 8/2002 | Hojo |
| 2002/0116266 | A1 | 8/2002 | Marshall |
| 2002/0119870 | A1 | 8/2002 | Chen |
| 2002/0128119 | A1 | 9/2002 | Arai |
| 2002/0128127 | A1 | 9/2002 | Chen |

(56) References Cited

U.S. PATENT DOCUMENTS

2002/0132703 A1 9/2002 Martinez
2002/0132706 A1 9/2002 Sleamaker
2002/0137605 A1 9/2002 Olsen
2002/0138023 A1 9/2002 Kume et al.
2002/0142887 A1 10/2002 O'Malley
2002/0142890 A1 10/2002 Ohrt
2002/0147078 A1 10/2002 Wu
2002/0151413 A1 10/2002 Dalebout
2002/0155416 A1 10/2002 Barton
2002/0156351 A1 10/2002 Sagel
2002/0156387 A1 10/2002 Dardik
2002/0160883 A1 10/2002 Dugan
2002/0160891 A1 10/2002 Gallagher
2002/0164929 A1 11/2002 Pinson
2002/0169634 A1 11/2002 Nishi
2002/0171070 A1 11/2002 Shim
2002/0173407 A1 11/2002 Bowman
2002/0187879 A1 12/2002 Ball
2002/0193213 A1 12/2002 Batca
2002/0193214 A1 12/2002 Ish
2002/0193215 A1 12/2002 Cheng
2002/0194604 A1 12/2002 Sanchez et al.
2002/0198084 A1 12/2002 Stearns et al.
2002/0198776 A1 12/2002 Nara
2003/0004424 A1 1/2003 Birnbaum
2003/0008731 A1 1/2003 Anderson et al.
2003/0013072 A1 1/2003 Thomas
2003/0017918 A1 1/2003 Webb et al.
2003/0021273 A1 1/2003 Fouquet
2003/0022765 A1 1/2003 Wu
2003/0022770 A1 1/2003 Lee
2003/0032524 A1 2/2003 Lamar et al.
2003/0032528 A1* 2/2003 Wu ..... A63B 21/005 482/92
2003/0032531 A1 2/2003 Simonson
2003/0032535 A1 2/2003 Wang et al.
2003/0033600 A1 2/2003 Cliff et al.
2003/0040348 A1 2/2003 Martens
2003/0041076 A1 2/2003 Lucovsky
2003/0043986 A1 3/2003 Creamer et al.
2003/0043989 A1 3/2003 Creamer et al.
2003/0044021 A1 3/2003 Wilkinson
2003/0045406 A1 3/2003 Stone
2003/0060331 A1 3/2003 Polk
2003/0060344 A1 3/2003 David
2003/0060345 A1 3/2003 Piane
2003/0063133 A1 4/2003 Foote et al.
2003/0065561 A1 4/2003 Brown et al.
2003/0069108 A1 4/2003 Michael
2003/0073545 A1 4/2003 Liu
2003/0078138 A1 4/2003 Toyama
2003/0087737 A1 5/2003 Studdard
2003/0088196 A1 5/2003 Steve
2003/0089596 A1 5/2003 Tao et al.
2003/0092532 A1 5/2003 Giannelli et al.
2003/0092533 A1 5/2003 Hippensteel
2003/0092540 A1 5/2003 Gillen
2003/0092542 A1 5/2003 Bartholomew et al.
2003/0096675 A1 5/2003 Wang
2003/0096683 A1 5/2003 Fenelon
2003/0097878 A1 5/2003 Farringdon et al.
2003/0100406 A1 5/2003 Millington
2003/0100413 A1 5/2003 Huang
2003/0100415 A1 5/2003 Augustine et al.
2003/0104907 A1 6/2003 Sankrithi
2003/0104908 A1 6/2003 Tung
2003/0105390 A1 6/2003 Alessandri
2003/0114276 A1 6/2003 Schiff
2003/0114281 A1 6/2003 MacKert
2003/0115157 A1 6/2003 Circenis
2003/0115955 A1 6/2003 Keiser
2003/0119635 A1 6/2003 Arbuckle
2003/0122384 A1 7/2003 Swanson et al.
2003/0125165 A1 7/2003 Trevino
2003/0126593 A1 7/2003 Mault
2003/0128186 A1 7/2003 Laker
2003/0134714 A1 7/2003 Oishi et al.
2003/0134718 A1 7/2003 Kim
2003/0138761 A1 7/2003 Pesnell
2003/0139254 A1 7/2003 Chang
2003/0142951 A1 7/2003 Tsurugai
2003/0148853 A1 8/2003 Alessandri
2003/0148857 A1 8/2003 Yu
2003/0148862 A1 8/2003 Chen
2003/0149344 A1 8/2003 Nizan
2003/0153434 A1 8/2003 Dalebout
2003/0153436 A1 8/2003 Ho
2003/0153439 A1 8/2003 Krull
2003/0158014 A1 8/2003 Valentin-Sivico
2003/0158016 A1 8/2003 Kolda
2003/0158019 A1 8/2003 Giannelli
2003/0158024 A1 8/2003 Saure
2003/0163287 A1 8/2003 Vock et al.
2003/0165802 A1 9/2003 Murphy
2003/0166434 A1 9/2003 Lopez-Santillana et al.
2003/0171189 A1 9/2003 Kaufman
2003/0171190 A1 9/2003 Rice
2003/0171192 A1 9/2003 Wu
2003/0176261 A1 9/2003 Simonson et al.
2003/0176815 A1 9/2003 Baba et al.
2003/0181289 A1 9/2003 Oscar Moavro
2003/0181291 A1 9/2003 Ogawa
2003/0181293 A1 9/2003 Baatz
2003/0183027 A1 10/2003 Koch
2003/0186792 A1 10/2003 Keeler
2003/0195089 A1 10/2003 Schroeder
2003/0199368 A1 10/2003 Krull
2003/0207237 A1 11/2003 Glezerman
2003/0208113 A1 11/2003 Mault et al.
2003/0211449 A1 11/2003 Seiller
2003/0211916 A1 11/2003 Capuano
2003/0212536 A1 11/2003 Wang
2003/0214530 A1 11/2003 Wang
2003/0216227 A1 11/2003 Smith
2003/0216228 A1 11/2003 Rast
2003/0216229 A1 11/2003 Bastyr
2003/0216230 A1 11/2003 Wang
2003/0220143 A1 11/2003 Shteyn et al.
2003/0222419 A1 12/2003 Geary
2003/0224337 A1 12/2003 Shum et al.
2003/0227473 A1 12/2003 Shih
2003/0232703 A1 12/2003 Webber
2003/0232707 A1 12/2003 Dalebout et al.
2003/0236153 A1 12/2003 Pan et al.
2004/0005958 A1 1/2004 Kamen et al.
2004/0005959 A1 1/2004 Takizawa
2004/0005961 A1 1/2004 Iund
2004/0005965 A1 1/2004 Panatta
2004/0008220 A1 1/2004 Snyder et al.
2004/0009855 A1 1/2004 Webber
2004/0009856 A1 1/2004 Markus Hamner
2004/0010420 A1 1/2004 Rooks
2004/0012335 A1 1/2004 Shon et al.
2004/0014014 A1 1/2004 Hess
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0018920 A1 1/2004 Simonson
2004/0019654 A1 1/2004 Powers
2004/0021046 A1 2/2004 Hutchison
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0025993 A1 2/2004 Russell
2004/0027368 A1 2/2004 Snyder et al.
2004/0029645 A1 2/2004 Chen
2004/0030762 A1 2/2004 Silverthorne
2004/0033865 A1 2/2004 Wu
2004/0033866 A1 2/2004 Shapiro

(56) References Cited

U.S. PATENT DOCUMENTS

2004/0033868 A1 2/2004 Van Straaten
2004/0043873 A1* 3/2004 Wilkinson ..... A63B 22/0005 482/54
2004/0046692 A1 3/2004 Robson
2004/0051392 A1 3/2004 Badarneh
2004/0053748 A1 3/2004 Lo et al.
2004/0053752 A1 3/2004 Yang
2004/0053756 A1 3/2004 Tremayne
2004/0054350 A1 3/2004 Shaughnessy
2004/0063549 A1 4/2004 Kuo
2004/0067821 A1 4/2004 Kehrbaum
2004/0067833 A1 4/2004 Talish
2004/0072652 A1 4/2004 Alessandri et al.
2004/0072659 A1 4/2004 Alessandri
2004/0072661 A1 4/2004 Krull
2004/0072662 A1 4/2004 Landfair
2004/0077462 A1 4/2004 Brown
2004/0077468 A1 4/2004 Myles
2004/0077975 A1 4/2004 Zimmerman
2004/0078208 A1 4/2004 Burwell
2004/0082444 A1 4/2004 Golesh
2004/0087420 A1 5/2004 Montesquieux
2004/0092367 A1 5/2004 Corbalis
2004/0095516 A1 5/2004 Rohlicek
2004/0097331 A1 5/2004 Zillig
2004/0097337 A1 5/2004 Chuang
2004/0097353 A1 5/2004 Mencis
2004/0100484 A1 5/2004 Barrett
2004/0102292 A1* 5/2004 Pyles ..... A63B 21/0051 482/54
2004/0102931 A1 5/2004 Ellis
2004/0103146 A1 5/2004 Park
2004/0103432 A1 5/2004 Barrett
2004/0114768 A1 6/2004 Luo
2004/0116258 A1 6/2004 Hyder
2004/0116837 A1 6/2004 Yamaguchi
2004/0116899 A1 6/2004 Shaughnessy
2004/0117072 A1 6/2004 Takeda
2004/0117214 A1 6/2004 Shea
2004/0127285 A1 7/2004 Kavana
2004/0127334 A1 7/2004 Heppert
2004/0127335 A1 7/2004 Watterson
2004/0127336 A1 7/2004 Lapcevic
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0138032 A1 7/2004 Van Straaten
2004/0142799 A1 7/2004 Yeo
2004/0142800 A1 7/2004 Gerschefske
2004/0142801 A1 7/2004 Lin
2004/0144626 A1 7/2004 Saeki
2004/0152566 A1 8/2004 Yeh
2004/0155622 A1 8/2004 Mayhew et al.
2004/0157546 A1 8/2004 Fantaay
2004/0157709 A1 8/2004 Olson
2004/0160336 A1 8/2004 Hoch
2004/0162188 A1 8/2004 Watterson
2004/0162189 A1 8/2004 Hickman
2004/0162191 A1 8/2004 Ercanbrack
2004/0162194 A1 8/2004 Habing
2004/0162196 A1 8/2004 Degroot
2004/0162198 A1 8/2004 Towley
2004/0163574 A1 8/2004 Schoenbach
2004/0166996 A1 8/2004 Kolda
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0185988 A1 9/2004 Hsiung
2004/0186390 A1 9/2004 Ross et al.
2004/0192514 A1 9/2004 Piaget
2004/0198555 A1 10/2004 Anderson
2004/0198559 A1 10/2004 Grossi
2004/0198569 A1 10/2004 Sanford-Schwentke
2004/0198571 A1 10/2004 Howell
2004/0204294 A2 10/2004 Wilkinson
2004/0208943 A1 10/2004 Miketin
2004/0210661 A1 10/2004 Thompson
2004/0214693 A1 10/2004 Piaget et al.
2004/0215958 A1 10/2004 Ellis
2004/0220017 A1 11/2004 Gordon
2004/0220025 A1 11/2004 Krull
2004/0224740 A1 11/2004 Ball et al.
2004/0224825 A1 11/2004 Giannelli et al.
2004/0224827 A1 11/2004 Ashley
2004/0225239 A1 11/2004 Yamamoto
2004/0225532 A1 11/2004 Gadiyak
2004/0229730 A1 11/2004 Ainsworth et al.
2004/0230138 A1 11/2004 Inoue et al.
2004/0242378 A1 12/2004 Pan
2004/0242379 A1 12/2004 Juva
2004/0242380 A1 12/2004 Kuivala
2004/0242388 A1 12/2004 Kusminsky
2004/0248699 A1 12/2004 Colley
2004/0248713 A1 12/2004 Campanaro
2004/0254020 A1 12/2004 Dragusin
2004/0256524 A1 12/2004 Beck et al.
2004/0259689 A1 12/2004 Wilkins et al.
2004/0260191 A1 12/2004 Stubbs
2004/0266587 A1 12/2004 Miller
2004/0266591 A1 12/2004 Alessandri et al.
2004/0266961 A1 12/2004 Solan
2005/0003338 A1 1/2005 Norcott et al.
2005/0003931 A1 1/2005 Alden Mils et al.
2005/0003933 A1 1/2005 Kau
2005/0003938 A1 1/2005 Henderson
2005/0008992 A1 1/2005 Westergaard et al.
2005/0009668 A1 1/2005 Savettiere
2005/0009672 A1 1/2005 Yeh
2005/0012622 A1 1/2005 Sutton
2005/0013433 A1 1/2005 Ghassabian
2005/0013658 A1 1/2005 Muders et al.
2005/0014571 A1 1/2005 Varner
2005/0014616 A1 1/2005 Tiahrt
2005/0015281 A1 1/2005 Clark et al.
2005/0020887 A1 1/2005 Goldberg
2005/0023292 A1 2/2005 Market et al.
2005/0026750 A1 2/2005 Oglesby et al.
2005/0026811 A1 2/2005 Mjalli
2005/0032610 A1 2/2005 Nelson
2005/0032611 A1 2/2005 Webber
2005/0037898 A1 2/2005 Chang
2005/0037904 A1 2/2005 Chang
2005/0038698 A1 2/2005 Lukose
2005/0038699 A1 2/2005 Lillibridge
2005/0043145 A1 2/2005 Anderson et al.
2005/0043146 A1 2/2005 Lo et al.
2005/0043155 A1 2/2005 Yannitte
2005/0044210 A1 2/2005 Ku
2005/0044984 A1 3/2005 Jones
2005/0048461 A1 3/2005 Lahteenmaki
2005/0049117 A1 3/2005 Rodgers
2005/0049123 A1 3/2005 Dalebout et al.
2005/0054492 A1 3/2005 Neff
2005/0054940 A1 3/2005 Almen
2005/0060238 A1 3/2005 Gravina et al.
2005/0061587 A1 3/2005 Tsai
2005/0062841 A1 3/2005 Rivera-Cintron
2005/0064994 A1 3/2005 Matsumoto
2005/0065003 A1 3/2005 Klotzki
2005/0071462 A1 3/2005 Bodin et al.
2005/0071463 A1 3/2005 Bodin et al.
2005/0075213 A1 4/2005 Arick
2005/0075222 A1 4/2005 Adley
2005/0075903 A1 4/2005 Ficcionelli Gregory A
2005/0079905 A1 4/2005 Martens
2005/0079961 A1 4/2005 Dalebout
2005/0085348 A1 4/2005 Kiefer

(56) References Cited

U.S. PATENT DOCUMENTS

2005/0085352 A1 4/2005 Baxter
2005/0090770 A1 4/2005 Chen
2005/0096187 A1 5/2005 Hsu
2005/0096189 A1 5/2005 Chen
2005/0096196 A1 5/2005 Webber
2005/0096197 A1 5/2005 Webber
2005/0096198 A1 5/2005 Webber
2005/0101458 A1 5/2005 Huang
2005/0101463 A1 5/2005 Chen
2005/0102172 A1 5/2005 Sirmans
2005/0107216 A1 5/2005 Lee et al.
2005/0107220 A1 5/2005 Wang
2005/0107226 A1 5/2005 Monda
2005/0107723 A1 5/2005 Wehman et al.
2005/0107726 A1 5/2005 Oyen
2005/0112601 A1 5/2005 Hassibi
2005/0113158 A1 5/2005 Sterchi et al.
2005/0113223 A1 5/2005 Dovner et al.
2005/0113652 A1 5/2005 Stark et al.
2005/0113723 A1 5/2005 Ueyama
2005/0124463 A1 6/2005 Yeo et al.
2005/0124471 A1 6/2005 Wilkinson
2005/0129253 A1 6/2005 Chen
2005/0129903 A1 6/2005 Carr
2005/0130807 A1 6/2005 Cutler
2005/0130814 A1 6/2005 Nitta et al.
2005/0131319 A1 6/2005 Der Meer
2005/0132838 A1 6/2005 Lin
2005/0143226 A1 6/2005 Heidecke
2005/0143228 A1 6/2005 Lee
2005/0143230 A1 6/2005 Dalebout
2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0148445 A1 7/2005 Carle
2005/0159273 A1 7/2005 Chen
2005/0159277 A1 7/2005 Mcvay
2005/0159278 A1 7/2005 Mcvay
2005/0159712 A1 7/2005 Andersen
2005/0160141 A1 7/2005 Galley
2005/0164832 A1 7/2005 Maschke
2005/0164837 A1 7/2005 Anderson et al.
2005/0164838 A1 7/2005 Watterson
2005/0164839 A1 7/2005 Watterson
2005/0164853 A1 7/2005 Naidus
2005/0167907 A1 8/2005 Curkendall et al.
2005/0170935 A1 8/2005 Manser
2005/0170936 A1 8/2005 Quinn
2005/0170937 A1 8/2005 van Straaten
2005/0172311 A1 8/2005 Hjelt et al.
2005/0176560 A1 8/2005 Chen
2005/0178210 A1 8/2005 Lanham
2005/0181347 A1 8/2005 Barnes et al.
2005/0181911 A1 8/2005 Porth
2005/0181916 A1 8/2005 Frost et al.
2005/0187075 A1 8/2005 Bellamy
2005/0187082 A1 8/2005 Bowser
2005/0187704 A1 8/2005 Peters
2005/0192162 A1 9/2005 Pan
2005/0192163 A1 9/2005 Pan et al.
2005/0195094 A1 9/2005 White
2005/0196737 A1 9/2005 Mann
2005/0202862 A1 9/2005 Shuman et al.
2005/0202934 A1 9/2005 Olrik et al.
2005/0209050 A1 9/2005 Bartels
2005/0209051 A1 9/2005 Santomassimo et al.
2005/0209052 A1 9/2005 Ashby
2005/0209056 A1 9/2005 Daly
2005/0209060 A1 9/2005 Lull
2005/0209062 A1 9/2005 Anderson et al.
2005/0209887 A1 9/2005 Pollner
2005/0210169 A1 9/2005 Chou
2005/0212202 A1 9/2005 Meyer
2005/0213442 A1 9/2005 Sako
2005/0215335 A1 9/2005 Marquardt
2005/0215397 A1 9/2005 Watterson
2005/0221962 A1 10/2005 Warner et al.
2005/0227811 A1 10/2005 Shum et al.
2005/0227820 A1 10/2005 Dyer et al.
2005/0227826 A1 10/2005 Oga
2005/0227831 A1 10/2005 Mills
2005/0227832 A1 10/2005 Wu
2005/0228245 A1 10/2005 Quy
2005/0228883 A1 10/2005 Brown
2005/0229367 A1 10/2005 Thompson
2005/0233859 A1 10/2005 Takai
2005/0233861 A1 10/2005 Hickman
2005/0233866 A1 10/2005 Miyamaru et al.
2005/0233871 A1 10/2005 Anders
2005/0233873 A1 10/2005 Chen
2005/0238182 A1 10/2005 Shih et al.
2005/0239600 A1 10/2005 Liang
2005/0239601 A1 10/2005 Thomas
2005/0239607 A1 10/2005 Chang
2005/0239612 A1 10/2005 Keiser
2005/0240444 A1 10/2005 Wooten
2005/0245365 A1 11/2005 Rolli
2005/0245370 A1 11/2005 Boland
2005/0245431 A1 11/2005 Demmer et al.
2005/0248713 A1 11/2005 Hirosue et al.
2005/0250619 A1 11/2005 Daikeler et al.
2005/0250622 A1 11/2005 Chang
2005/0261609 A1 11/2005 Collings et al.
2005/0266961 A1 12/2005 Shum et al.
2005/0269601 A1 12/2005 Tsubaki
2005/0272561 A1 12/2005 Cammerata
2005/0272562 A1 12/2005 Alessandri et al.
2005/0272564 A1 12/2005 Pyles et al.
2005/0272575 A1 12/2005 Melegati
2005/0272577 A1 12/2005 Olson
2005/0274188 A1 12/2005 Cabanis et al.
2005/0277520 A1 12/2005 Van Waes
2005/0277525 A1 12/2005 Liu
2005/0281963 A1 12/2005 Cook
2005/0283051 A1 12/2005 Chen
2005/0283911 A1 12/2005 Roussy
2005/0288155 A1 12/2005 Yang
2005/0288954 A1 12/2005 McCarthy et al.
2006/0003869 A1 1/2006 Huang et al.
2006/0003872 A1 1/2006 Chiles et al.
2006/0003876 A1 1/2006 Duhamel
2006/0003877 A1 1/2006 Harmon
2006/0004265 A1 1/2006 Pulkkinen et al.
2006/0006005 A1 1/2006 Dumornay
2006/0009332 A1 1/2006 Jones
2006/0013351 A1 1/2006 Crider
2006/0019224 A1 1/2006 Behar et al.
2006/0019804 A1 1/2006 Young
2006/0019806 A1 1/2006 Mikulski
2006/0020174 A1 1/2006 Matsumura
2006/0020556 A1 1/2006 Hamnen
2006/0020990 A1 1/2006 McEneaney
2006/0021155 A1 2/2006 Lang et al.
2006/0025287 A1 2/2006 Chermack
2006/0030462 A1 2/2006 Ish
2006/0030465 A1 2/2006 Johnson
2006/0033392 A1 2/2006 Ritchey
2006/0034161 A1 2/2006 Muller
2006/0035755 A1* 2/2006 Dalebout ..... A63B 21/00072
482/52
2006/0035757 A1 2/2006 Flick et al.
2006/0035758 A1 2/2006 Rogozinski
2006/0035764 A1 2/2006 Webber
2006/0035768 A1 2/2006 Kowallis
2006/0035772 A1 2/2006 Golesh et al.
2006/0035774 A1 2/2006 Marks
2006/0040244 A1 2/2006 Kain
2006/0040246 A1 2/2006 Ding et al.
2006/0040793 A1 2/2006 Martens
2006/0040797 A1 2/2006 Chang
2006/0040798 A1 2/2006 Weier et al.
2006/0040810 A1 2/2006 Chu

(56) References Cited

U.S. PATENT DOCUMENTS

2006/0046807 A1 3/2006 Sanchez
2006/0046898 A1 3/2006 Harvey
2006/0046905 A1 3/2006 Doody, Jr.
2006/0047447 A1 3/2006 Brady et al.
2006/0052220 A1 3/2006 Jackson et al.
2006/0052222 A1 3/2006 Cardenas
2006/0053586 A1 3/2006 Chase
2006/0053587 A1 3/2006 Chase
2006/0058155 A1 3/2006 Kumar
2006/0058158 A1 3/2006 McAvoy
2006/0058162 A1 3/2006 Vieno et al.
2006/0063644 A1 3/2006 Yang
2006/0063980 A1 3/2006 Hwang et al.
2006/0068978 A1 3/2006 Moon
2006/0069102 A1 3/2006 Leban et al.
2006/0075544 A1 4/2006 Kriesel
2006/0079800 A1 4/2006 Martikka et al.
2006/0084422 A1 4/2006 Huang et al.
2006/0084551 A1 4/2006 Volpe, Jr.
2006/0084556 A1 4/2006 Payne
2006/0084851 A1 4/2006 Lee et al.
2006/0089238 A1 4/2006 Huang et al.
2006/0094569 A1 5/2006 Day
2006/0094570 A1 5/2006 Schneider
2006/0097453 A1 5/2006 Feldman
2006/0100069 A1 5/2006 Dibble et al.
2006/0100070 A1 5/2006 Abdo
2006/0100546 A1 5/2006 Silk
2006/0104047 A1 5/2006 Guzman
2006/0105888 A1 5/2006 Piane
2006/0105889 A1 5/2006 Webb
2006/0111944 A1 5/2006 Sirmans, Jr.
2006/0116253 A1 6/2006 Nizam
2006/0116254 A1 6/2006 Webber
2006/0116558 A1 6/2006 Jang
2006/0122034 A1 6/2006 Chen
2006/0122035 A1 6/2006 Felix
2006/0122038 A1 6/2006 Chou Lin
2006/0122044 A1 6/2006 Ho
2006/0122468 A1 6/2006 Tavor
2006/0122474 A1 6/2006 Teller et al.
2006/0123814 A1 6/2006 Choi et al.
2006/0128534 A1 6/2006 Roque
2006/0128540 A1 6/2006 Engle
2006/0129432 A1 6/2006 Choi et al.
2006/0132070 A1 6/2006 Heydt et al.
2006/0135274 A1 6/2006 Henry
2006/0135322 A1 6/2006 Rocker
2006/0142665 A1 6/2006 Garay et al.
2006/0148622 A1 7/2006 Chen
2006/0151303 A1 7/2006 Motoda
2006/0155576 A1 7/2006 Deluz
2006/0160639 A1 7/2006 Klein
2006/0160665 A1 7/2006 Tai
2006/0160666 A1 7/2006 Wang
2006/0160667 A1 7/2006 Oglesby et al.
2006/0160677 A1 7/2006 Piane
2006/0160681 A1 7/2006 McBride et al.
2006/0161455 A1 7/2006 Anastasia
2006/0161621 A1 7/2006 Rosenberg
2006/0161656 A1 7/2006 Sorvisto
2006/0161850 A1 7/2006 Seaberg
2006/0166737 A1 7/2006 Bentley
2006/0166790 A1 7/2006 Wang
2006/0166791 A1 7/2006 Liao
2006/0166798 A1 7/2006 Nelson
2006/0166799 A1 7/2006 Boland et al.
2006/0172862 A1 8/2006 Badarneh et al.
2006/0173556 A1 8/2006 Rosenberg
2006/0173828 A1 8/2006 Rosenberg
2006/0179044 A1 8/2006 Rosenberg
2006/0179056 A1 8/2006 Rosenberg
2006/0183602 A1 8/2006 Astilean
2006/0183980 A1 8/2006 Yang
2006/0184427 A1 8/2006 Singh
2006/0186197 A1 8/2006 Rosenberg
2006/0189439 A1 8/2006 Baudhuin
2006/0189440 A1 8/2006 Gravagne
2006/0189452 A1 8/2006 Chou
2006/0189458 A1 8/2006 Walkerdine
2006/0189460 A1 8/2006 Katterjohn
2006/0189462 A1 8/2006 Pearson et al.
2006/0189854 A1 8/2006 Webb et al.
2006/0194679 A1 8/2006 Hatcher
2006/0195361 A1 8/2006 Rosenberg
2006/0198613 A1 9/2006 Lee
2006/0199155 A1 9/2006 Mosher
2006/0199706 A1 9/2006 Wehrell
2006/0203972 A1 9/2006 Hays
2006/0205349 A1 9/2006 Passier et al.
2006/0205564 A1 9/2006 Peterson
2006/0205568 A1 9/2006 Huang
2006/0205569 A1 9/2006 Watterson
2006/0205571 A1 9/2006 Krull
2006/0217231 A1 9/2006 Parks et al.
2006/0217236 A1 9/2006 Watterson
2006/0217240 A1 9/2006 White
2006/0217242 A1 9/2006 Karpachev
2006/0217245 A1 9/2006 Golesh et al.
2006/0218253 A1 9/2006 Hays
2006/0223635 A1 10/2006 Rosenberg
2006/0223637 A1 10/2006 Rosenberg
2006/0223674 A1 10/2006 Korkie
2006/0223680 A1 10/2006 Chang
2006/0223681 A1 10/2006 Loane
2006/0224051 A1 10/2006 Teller et al.
2006/0228683 A1 10/2006 Jianping
2006/0229058 A1 10/2006 Rosenberg
2006/0229163 A1 10/2006 Waters
2006/0229164 A1 10/2006 Einav
2006/0229170 A1 10/2006 Ozawa et al.
2006/0232147 A1 10/2006 Cheng
2006/0234832 A1 10/2006 Toyama et al.
2006/0234840 A1 10/2006 Watson
2006/0240947 A1 10/2006 Qu
2006/0240951 A1 10/2006 Wang
2006/0240956 A1 10/2006 Piane, Jr.
2006/0240959 A1 10/2006 Huang
2006/0244187 A1 11/2006 Downey
2006/0247095 A1 11/2006 Rummerfield
2006/0247098 A1 11/2006 Raniere
2006/0247107 A1 11/2006 Carter
2006/0247109 A1 11/2006 Powell
2006/0248965 A1 11/2006 Wyatt
2006/0250524 A1 11/2006 Roche
2006/0251638 A1 11/2006 Guenzler-Pukall
2006/0252600 A1 11/2006 Grogan
2006/0252602 A1 11/2006 Brown
2006/0252608 A1 11/2006 Kang et al.
2006/0252612 A1 11/2006 Sofun
2006/0253010 A1 11/2006 Brady et al.
2006/0253210 A1 11/2006 Rosenberg
2006/0256007 A1 11/2006 Rosenberg
2006/0256008 A1 11/2006 Rosenberg
2006/0258513 A1 11/2006 Routley
2006/0258515 A1 11/2006 Kang et al.
2006/0258519 A1 11/2006 Ardito et al.
2006/0259275 A1 11/2006 Maschke
2006/0259574 A1 11/2006 Rosenberg
2006/0262752 A1 11/2006 Moore et al.
2006/0264299 A1 11/2006 Farinelli et al.
2006/0264306 A1 11/2006 Tischler et al.
2006/0264730 A1 11/2006 Stivoric et al.
2006/0265469 A1 11/2006 Estrade
2006/0269251 A1 11/2006 Hsu
2006/0270522 A1 11/2006 Yonehana et al.
2006/0271286 A1 11/2006 Outland
2006/0276306 A1 12/2006 Pan et al.
2006/0279294 A1 12/2006 Cehelnik
2006/0281603 A1 12/2006 Hickman
2006/0281605 A1 12/2006 Lo
2006/0281608 A1 12/2006 Tumminello
2006/0283050 A1 12/2006 Carnes et al.
2006/0287089 A1 12/2006 Addington et al.

(56) References Cited

U.S. PATENT DOCUMENTS

2006/0287147 A1 12/2006 Kriesel
2006/0287161 A1 12/2006 Dalebout
2006/0287163 A1 12/2006 Wang
2006/0288846 A1 12/2006 Logan
2006/0293156 A1 12/2006 Trees
2006/0293608 A1 12/2006 Rothman et al.
2006/0293617 A1 12/2006 Einav et al.
2007/0000154 A1 1/2007 Dibenedetto
2007/0004561 A1 1/2007 Yoo
2007/0004562 A1 1/2007 Pan et al.
2007/0004565 A1 1/2007 Gebhardt
2007/0004569 A1 1/2007 Cao
2007/0004736 A1 1/2007 Kubo
2007/0005395 A1 1/2007 Singh
2007/0006489 A1 1/2007 Case et al.
2007/0010383 A1 1/2007 Pertegaz-Esteban
2007/0011027 A1 1/2007 Melendez
2007/0011391 A1 1/2007 Kim et al.
2007/0011920 A1 1/2007 DiBenedetto et al.
2007/0013655 A1 1/2007 Rosenberg et al.
2007/0014422 A1 1/2007 Wesemann et al.
2007/0015635 A1 1/2007 Donner
2007/0015636 A1 1/2007 Molter
2007/0015644 A1 1/2007 Aucamp
2007/0015752 A1 1/2007 Hangauer, Jr.
2007/0016444 A1 1/2007 Holkkola
2007/0016930 A1 1/2007 Wesemann et al.
2007/0017025 A1 1/2007 Myer
2007/0018465 A1 1/2007 Vassilakos
2007/0021280 A1 1/2007 Tyree
2007/0026958 A1 2/2007 Barasch et al.
2007/0026999 A1 2/2007 Merolle et al.
2007/0027000 A1 2/2007 Shirai et al.
2007/0027002 A1 2/2007 Clark et al.
2007/0027003 A1 2/2007 Clark
2007/0028749 A1 2/2007 Basson et al.
2007/0032345 A1 2/2007 Padmanabhan
2007/0032351 A1 2/2007 Reyes
2007/0032353 A1 2/2007 Wilkins et al.
2007/0032481 A1 2/2007 Dvorak
2007/0033012 A1 2/2007 Rosenberg
2007/0033068 A1 2/2007 Rao
2007/0033069 A1 2/2007 Rao
2007/0037667 A1 2/2007 Gordon
2007/0037676 A1 2/2007 Denisco
2007/0038038 A1 2/2007 Stivoric et al.
2007/0038137 A1 2/2007 Arand et al.
2007/0038153 A1 2/2007 Basson et al.
2007/0042866 A1 2/2007 Skilken
2007/0042868 A1 2/2007 Fisher
2007/0042878 A1 2/2007 Lundquist
2007/0049384 A1 3/2007 King et al.
2007/0049461 A1 3/2007 Kim et al.
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0051369 A1 3/2007 Choi et al.
2007/0054778 A1 3/2007 Blanarovich
2007/0054790 A1 3/2007 Dodge et al.
2007/0057001 A1 3/2007 Wang
2007/0060408 A1 3/2007 Schultz et al.
2007/0060446 A1 3/2007 Asukai et al.
2007/0060449 A1 3/2007 Lo
2007/0060450 A1 3/2007 Lo
2007/0060451 A1 3/2007 Lucas
2007/0060898 A1 3/2007 Shaughnessy
2007/0061314 A1 3/2007 Rosenberg
2007/0063033 A1 3/2007 Silverbrook et al.
2007/0066448 A1 3/2007 Pan et al.
2007/0072156 A1 3/2007 Kaufman et al.
2007/0072748 A1 3/2007 Lee
2007/0072752 A1 3/2007 Koch
2007/0074617 A1 4/2007 Vergo
2007/0075127 A1 4/2007 Rosenberg
2007/0079691 A1 4/2007 Turner
2007/0083095 A1 4/2007 Rippo et al.
2007/0083323 A1 4/2007 Rosenberg
2007/0083975 A1 4/2007 Senegal
2007/0087908 A1 4/2007 Pan et al.
2007/0087918 A1 4/2007 Towley et al.
2007/0087920 A1 4/2007 Dachraoui et al.
2007/0093360 A1 4/2007 Neff
2007/0093369 A1 4/2007 Bocchicchio
2007/0099780 A1 5/2007 Bowser
2007/0100595 A1 5/2007 Earles
2007/0100666 A1 5/2007 Stivoric et al.
2007/0106484 A1 5/2007 Sweatman et al.
2007/0109491 A1 5/2007 Howell et al.
2007/0111753 A1 5/2007 Vock
2007/0111858 A1 5/2007 Dugan
2007/0111866 A1 5/2007 McVay et al.
2007/0117680 A1 5/2007 Neff
2007/0117683 A1 5/2007 Ercanbrack et al.
2007/0117693 A1 5/2007 Ilioi
2007/0122786 A1 5/2007 Relan et al.
2007/0123389 A1 5/2007 Martin
2007/0123390 A1 5/2007 Mathis
2007/0123395 A1 5/2007 Ellis
2007/0123396 A1 5/2007 Ellis
2007/0124762 A1 5/2007 Chickering et al.
2007/0129220 A1 6/2007 Bardha
2007/0129907 A1 6/2007 Demon
2007/0131409 A1 6/2007 Asahi
2007/0135264 A1 6/2007 Rosenberg
2007/0135272 A1 6/2007 Stuckey
2007/0135276 A1 6/2007 Alessandri
2007/0135279 A1 6/2007 Purdy et al.
2007/0135738 A1 6/2007 Bonutti
2007/0136093 A1 6/2007 Rankin et al.
2007/0137307 A1 6/2007 Gruben
2007/0137331 A1 6/2007 Kachouh
2007/0140403 A1 6/2007 Yuguchi et al.
2007/0141871 A1 6/2007 Scherer et al.
2007/0142175 A1 6/2007 Morgan
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0146347 A1 6/2007 Rosenberg
2007/0149362 A1 6/2007 Lee et al.
2007/0149363 A1 6/2007 Wang
2007/0149364 A1 6/2007 Blau
2007/0150188 A1 6/2007 Rosenberg
2007/0151489 A1 7/2007 Byrne
2007/0153639 A1 7/2007 Lafever
2007/0155277 A1 7/2007 Amitai et al.
2007/0155495 A1 7/2007 Goo
2007/0155589 A1 7/2007 Feldman
2007/0155600 A1 7/2007 Cunningham et al.
2007/0156335 A1 7/2007 McBride et al.
2007/0161459 A1 7/2007 Watson
2007/0161466 A1 7/2007 Oglesby et al.
2007/0161468 A1 7/2007 Yanagisawa et al.
2007/0161470 A1 7/2007 Berryman
2007/0161472 A1 7/2007 Drechsler
2007/0161480 A1 7/2007 Trancart
2007/0167291 A1 7/2007 Kuo
2007/0167292 A1 7/2007 Kuo
2007/0167293 A1 7/2007 Nally
2007/0167299 A1 7/2007 Simonson et al.
2007/0167300 A1 7/2007 Krull
2007/0169381 A1 7/2007 Gordon
2007/0173355 A1 7/2007 Klein
2007/0173384 A1 7/2007 Sechrest et al.
2007/0173392 A1 7/2007 Stanford
2007/0176035 A1 8/2007 Campbell
2007/0179023 A1 8/2007 Dyer
2007/0179030 A1 8/2007 Slawinski
2007/0179359 A1 8/2007 Goodwin
2007/0180737 A1 8/2007 DiBenedetto et al.
2007/0184944 A1 8/2007 Huang
2007/0184953 A1 8/2007 Luberski et al.

(56) References Cited

U.S. PATENT DOCUMENTS

2007/0189544 A1 8/2007 Gastrher
2007/0190508 A1 8/2007 Dalton
2007/0191141 A1 8/2007 Weber
2007/0191190 A1 8/2007 Kuo
2007/0191197 A1 8/2007 Vittone
2007/0197193 A1 8/2007 Zhou
2007/0197274 A1 8/2007 Dugan
2007/0197345 A1 8/2007 Wallace et al.
2007/0197346 A1 8/2007 Seliber
2007/0197353 A1 8/2007 Hundley
2007/0197920 A1 8/2007 Adams
2007/0201727 A1 8/2007 Birrell et al.
2007/0202992 A1 8/2007 Grasshoff
2007/0203001 A1 8/2007 Krull
2007/0203004 A1 8/2007 Campanaro et al.
2007/0204430 A1 9/2007 Chase
2007/0207733 A1 9/2007 Wong et al.
2007/0207902 A1 9/2007 Tiahrt
2007/0208392 A1 9/2007 Kuschner et al.
2007/0208530 A1 9/2007 Vock
2007/0213110 A1 9/2007 Rosenberg
2007/0213126 A1 9/2007 Deutsch et al.
2007/0213178 A1 9/2007 Lemmela
2007/0213183 A1 9/2007 Menektchiev
2007/0213185 A1 9/2007 Habing
2007/0214630 A1 9/2007 Kim
2007/0218432 A1 9/2007 Glass
2007/0219057 A1 9/2007 Fleishman
2007/0219058 A1 9/2007 Fleishman
2007/0219059 A1 9/2007 Schwartz et al.
2007/0219062 A1 9/2007 Rodgers
2007/0219066 A1 9/2007 Wang
2007/0219068 A1 9/2007 Korfmacher
2007/0219074 A1 9/2007 Pride
2007/0219457 A1 9/2007 Lo
2007/0225118 A1 9/2007 Giorno
2007/0225119 A1 9/2007 Schenk
2007/0225120 A1 9/2007 Schenk
2007/0225126 A1 9/2007 Yoo
2007/0225127 A1 9/2007 Pan et al.
2007/0225136 A1 9/2007 Roman
2007/0225622 A1 9/2007 Huang et al.
2007/0232450 A1 10/2007 Hanoun
2007/0232452 A1 10/2007 Hanoun
2007/0232453 A1 10/2007 Hanoun
2007/0232455 A1 10/2007 Hanoun
2007/0232461 A1 10/2007 Jenkins et al.
2007/0232462 A1 10/2007 Webber
2007/0232463 A1 10/2007 Wu
2007/0233743 A1 10/2007 Rosenberg
2007/0239479 A1 10/2007 Arrasvuori
2007/0243974 A1 10/2007 Li
2007/0243975 A1 10/2007 Gearon
2007/0245258 A1 10/2007 Ginggen et al.
2007/0245612 A1 10/2007 Tresenfeld
2007/0247320 A1 10/2007 Morahan
2007/0249467 A1 10/2007 Hong et al.
2007/0249468 A1 10/2007 Chen
2007/0254778 A1 11/2007 Ashby
2007/0254785 A1 11/2007 Lin
2007/0259759 A1 11/2007 Sumners et al.
2007/0259763 A1 11/2007 McKeown et al.
2007/0260184 A1 11/2007 Justis et al.
2007/0260255 A1 11/2007 Haddock et al.
2007/0260482 A1 11/2007 Nurmela
2007/0265146 A1 11/2007 Jan Kow Alczewski
2007/0270284 A1 11/2007 Lin
2007/0270294 A1 11/2007 Sheets
2007/0270663 A1 11/2007 Ng et al.
2007/0270667 A1 11/2007 Coppi et al.
2007/0270721 A1 11/2007 Ananny et al.
2007/0270726 A1 11/2007 Chou
2007/0271065 A1 11/2007 Gupta et al.
2007/0271116 A1 11/2007 Wysocki et al.
2007/0271387 A1 11/2007 Lydon et al.
2007/0272011 A1 11/2007 Chapa, Jr.
2007/0275825 A1 11/2007 O'Brien
2007/0275826 A1 11/2007 Niemimaki et al.
2007/0275830 A1 11/2007 Lee
2007/0276870 A1 11/2007 Rosenberg
2007/0281828 A1 12/2007 Rice
2007/0281831 A1 12/2007 Wang
2007/0281836 A1 12/2007 Gearon
2007/0283853 A1 12/2007 Sun
2007/0284495 A1 12/2007 Charles
2007/0287141 A1 12/2007 Milner
2007/0287597 A1 12/2007 Cameron
2007/0287600 A1 12/2007 Prenatt
2007/0287601 A1 12/2007 Burck et al.
2007/0287606 A1 12/2007 Mac Millan
2007/0287611 A1 12/2007 Januszek
2007/0287930 A1 12/2007 Sutton
2007/0288204 A1 12/2007 Gienke et al.
2007/0288251 A1 12/2007 Ebrom et al.
2007/0288331 A1 12/2007 Ebrom et al.
2007/0288476 A1 12/2007 Flanagan
2007/0288969 A1 12/2007 Prum
2007/0293377 A1 12/2007 Webber
2007/0293378 A1 12/2007 Webber
2007/0293781 A1 12/2007 Sims et al.
2007/0296313 A1 12/2007 Wang
2007/0298405 A1 12/2007 Ebrom et al.
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0001866 A1 1/2008 Martin
2008/0004162 A1 1/2008 Chen
2008/0005276 A1 1/2008 Frederick
2008/0009275 A1 1/2008 Werner
2008/0015061 A1 1/2008 Klein
2008/0015087 A1 1/2008 Negrin
2008/0015088 A1 1/2008 Del Monaco
2008/0015089 A1 1/2008 Hurwitz
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0020911 A1 1/2008 Castello Neto
2008/0020912 A1 1/2008 Dalebout et al.
2008/0026658 A1 1/2008 Kriesel
2008/0026838 A1 1/2008 Dunstan et al.
2008/0027337 A1 1/2008 Dugan
2008/0027673 A1 1/2008 Trumm
2008/0032864 A1 2/2008 Hakki
2008/0032865 A1 2/2008 Wu
2008/0032870 A1 2/2008 Wu
2008/0032871 A1 2/2008 Yeh
2008/0032873 A1 2/2008 Towley et al.
2008/0037375 A1 2/2008 Ellner et al.
2008/0039301 A1 2/2008 Halbridge
2008/0039302 A1 2/2008 Grant
2008/0045384 A1 2/2008 Matsubara
2008/0046246 A1 2/2008 Goldstein et al.
2008/0051256 A1 2/2008 Ashby et al.
2008/0051258 A1 2/2008 Schmehl et al.
2008/0051260 A1 2/2008 Simonson et al.
2008/0051261 A1 2/2008 Lewis
2008/0051919 A1 2/2008 Sakai et al.
2008/0051993 A1 2/2008 Graham
2008/0057889 A1 3/2008 Jan
2008/0058169 A1 3/2008 Fox
2008/0058170 A1 3/2008 Giannascoli et al.
2008/0058172 A1 3/2008 Tyree
2008/0058176 A1 3/2008 Webber et al.
2008/0058177 A1 3/2008 Webber
2008/0059064 A1 3/2008 Werner
2008/0062818 A1 3/2008 Plancon et al.
2008/0064571 A1 3/2008 Lee
2008/0064576 A1 3/2008 Tyree
2008/0067302 A1 3/2008 Olivera

(56) References Cited

U.S. PATENT DOCUMENTS

2008/0068559 A1 3/2008 Howell et al.
2008/0070755 A1 3/2008 McKee et al.
2008/0070756 A1 3/2008 Chu
2008/0070761 A1 3/2008 Lin
2008/0070765 A1 3/2008 Brown et al.
2008/0070766 A1 3/2008 Brown et al.
2008/0076637 A1 3/2008 Gilley et al.
2008/0076969 A1 3/2008 Kraft
2008/0076972 A1 3/2008 Dorogusker et al.
2008/0077489 A1 3/2008 Gilley et al.
2008/0077619 A1 3/2008 Gilley et al.
2008/0082311 A1 4/2008 Meijer et al.
2008/0085819 A1 4/2008 Yang et al.
2008/0085820 A1 4/2008 Majkrzak
2008/0085821 A1 4/2008 Webb
2008/0086318 A1 4/2008 Gilley et al.
2008/0089551 A1 4/2008 Heather et al.
2008/0090703 A1 4/2008 Rosenberg
2008/0096726 A1 4/2008 Riley et al.
2008/0096735 A1 4/2008 Grider
2008/0096745 A1 4/2008 Perry
2008/0097633 A1 4/2008 Jochelson et al.
2008/0098797 A1 5/2008 Considine et al.
2008/0103023 A1 5/2008 Chung et al.
2008/0103024 A1 5/2008 Habing
2008/0103030 A1 5/2008 Watson et al.
2008/0103034 A1 5/2008 Mihara et al.
2008/0108481 A1 5/2008 Limma et al.
2008/0108483 A1 5/2008 Fife
2008/0108917 A1 5/2008 Joutras et al.
2008/0109121 A1 5/2008 Takeda
2008/0109243 A1 5/2008 Ebrom et al.
2008/0109295 A1 5/2008 McConochie et al.
2008/0109310 A1 5/2008 Ebrom et al.
2008/0109841 A1 5/2008 Heather et al.
2008/0109851 A1 5/2008 Heather et al.
2008/0119332 A1 5/2008 Roman
2008/0119333 A1 5/2008 Bowser
2008/0119337 A1 5/2008 Wilkins et al.
2008/0120436 A1 5/2008 Cowgill et al.
2008/0129825 A1 6/2008 DeAngelis et al.
2008/0132386 A1 6/2008 Helie et al.
2008/0132389 A1 6/2008 Webber et al.
2008/0132391 A1 6/2008 Edeker
2008/0132798 A1 6/2008 Hong et al.
2008/0139370 A1 6/2008 Charnitski
2008/0141135 A1 6/2008 Mason et al.
2008/0146334 A1 6/2008 Kil
2008/0146336 A1 6/2008 Feldman et al.
2008/0146416 A1 6/2008 Mueller et al.
2008/0146418 A1 6/2008 Summers
2008/0146890 A1 6/2008 LeBoeuf et al.
2008/0146892 A1 6/2008 LeBoeuf et al.
2008/0147502 A1 6/2008 Baker
2008/0153670 A1 6/2008 McKirdy
2008/0153671 A1 6/2008 Ogg et al.
2008/0153676 A1 6/2008 Krietzman
2008/0153677 A1 6/2008 Webber et al.
2008/0153682 A1 6/2008 Chen et al.
2008/0155077 A1 6/2008 James
2008/0161168 A1 7/2008 Hsiao
2008/0161170 A1 7/2008 Lumpee
2008/0161653 A1 7/2008 Lin et al.
2008/0167535 A1 7/2008 Stivoric et al.
2008/0167536 A1 7/2008 Teller
2008/0167958 A1 7/2008 Balaban et al.
2008/0171636 A1 7/2008 Usui et al.
2008/0171640 A1 7/2008 Chang
2008/0171922 A1 7/2008 Teller
2008/0171945 A1 7/2008 Dotter
2008/0172328 A1 7/2008 Ajilian
2008/0176655 A1 7/2008 James
2008/0176713 A1 7/2008 Olivera Brizzio
2008/0176717 A1 7/2008 Wang
2008/0176718 A1 7/2008 Wang
2008/0176721 A1 7/2008 Boren
2008/0176722 A1 7/2008 Steffee
2008/0179214 A1 7/2008 Hall
2008/0182685 A1 7/2008 Marty et al.
2008/0182724 A1 7/2008 Guthrie
2008/0182731 A1 7/2008 Vittone
2008/0182732 A1 7/2008 Webber et al.
2008/0183049 A1 7/2008 Karkanias et al.
2008/0183052 A1 7/2008 Teller
2008/0187689 A1 8/2008 Dierkens et al.
2008/0188354 A1 8/2008 Pauws et al.
2008/0188362 A1 8/2008 Chen
2008/0189733 A1 8/2008 Apostolopoulos
2008/0190745 A1 8/2008 Taniguchi et al.
2008/0191864 A1 8/2008 Wolfson
2008/0195258 A1 8/2008 Schendel
2008/0200287 A1 8/2008 Marty et al.
2008/0200310 A1 8/2008 Tagliabue
2008/0200312 A1 8/2008 Tagliabue
2008/0200314 A1 8/2008 Dalebout et al.
2008/0200778 A1 8/2008 Taskinen
2008/0200853 A1 8/2008 Tielve
2008/0204225 A1 8/2008 Kitchen
2008/0207401 A1 8/2008 Harding et al.
2008/0207402 A1 8/2008 Fisher et al.
2008/0207407 A1 8/2008 Yeh
2008/0207415 A1 8/2008 Tsai
2008/0214358 A1 9/2008 Ogg et al.
2008/0214359 A1 9/2008 Niva et al.
2008/0214365 A1 9/2008 Webber et al.
2008/0214367 A1 9/2008 Webber et al.
2008/0214903 A1 9/2008 Orbach
2008/0214971 A1 9/2008 Talish
2008/0216717 A1 9/2008 Jones
2008/0218307 A1 9/2008 Schoettle
2008/0220941 A1 9/2008 Shaw
2008/0224988 A1 9/2008 Whang
2008/0227607 A1 9/2008 Nizam
2008/0228110 A1 9/2008 Berme
2008/0229875 A1 9/2008 Ray
2008/0234023 A1 9/2008 Mullahkhel et al.
2008/0234110 A1 9/2008 Webber et al.
2008/0234111 A1 9/2008 Packham
2008/0234113 A1 9/2008 Einav
2008/0242510 A1 10/2008 Topel
2008/0242511 A1 10/2008 Munoz et al.
2008/0242512 A1 10/2008 Kim
2008/0242513 A1 10/2008 Skilken et al.
2008/0242520 A1 10/2008 Hubbard
2008/0244870 A1 10/2008 Chase
2008/0245944 A1 10/2008 Chase
2008/0248926 A1 10/2008 Cole et al.
2008/0248929 A1 10/2008 Webber et al.
2008/0248935 A1 10/2008 Solow
2008/0249736 A1 10/2008 Prstojevich
2008/0250729 A1 10/2008 Kriesel
2008/0253378 A1 10/2008 Curry
2008/0254420 A1 10/2008 Nerenberg
2008/0254947 A1 10/2008 MacKay
2008/0255430 A1 10/2008 Alexandersson et al.
2008/0255794 A1 10/2008 Levine
2008/0261636 A1 10/2008 Lau et al.
2008/0261774 A1 10/2008 Fisher
2008/0261776 A1 10/2008 Skiba
2008/0261785 A1 10/2008 Albanese
2008/0262381 A1 10/2008 Kolen
2008/0262392 A1 10/2008 Ananny et al.
2008/0267444 A1 10/2008 Simons-Nikolova et al.
2008/0269016 A1 10/2008 Ungari et al.
2008/0269017 A1 10/2008 Ungari
2008/0273008 A1 11/2008 Chang
2008/0279896 A1 11/2008 Heinen et al.
2008/0280731 A1 11/2008 Dalebout et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0287270 A1 11/2008 Carter

(56) References Cited

U.S. PATENT DOCUMENTS

2008/0293023 A1 11/2008 Diehl
2008/0295129 A1 11/2008 Laut
2008/0296883 A1 12/2008 Burkhardtsmaier
2008/0300109 A1 12/2008 Karkanias et al.
2008/0300110 A1 12/2008 Lauijp
2008/0300114 A1 12/2008 Dalebout
2008/0300115 A1 12/2008 Erlandson
2008/0300116 A1 12/2008 Eder
2008/0300118 A1 12/2008 Wehrell
2008/0300914 A1 12/2008 Karkanias et al.
2008/0305934 A1 12/2008 Medina
2008/0305936 A1 12/2008 Cao
2008/0306762 A1 12/2008 James
2008/0312039 A1 12/2008 Bucay-Bissu
2008/0312041 A1 12/2008 Schwabe et al.
2008/0312047 A1 12/2008 Feng
2008/0312052 A1 12/2008 Krietzman
2008/0315371 A1 12/2008 Tang et al.
2008/0318737 A1 12/2008 Chu
2008/0318738 A1 12/2008 Chen
2008/0318743 A1 12/2008 Bizzell
2008/0318744 A1 12/2008 Barra
2008/0319787 A1 12/2008 Stivoric
2008/0319796 A1 12/2008 Stivoric
2008/0319855 A1 12/2008 Stivoric
2009/0001831 A1 1/2009 Cho et al.
2009/0005224 A1 1/2009 Davis et al.
2009/0011907 A1 1/2009 Radow
2009/0017991 A1 1/2009 Hung
2009/0018000 A1 1/2009 Brown
2009/0023553 A1 1/2009 Shim
2009/0023554 A1 1/2009 Shim
2009/0023556 A1 1/2009 Daly
2009/0023562 A1 1/2009 Lamarque
2009/0024233 A1 1/2009 Shirai et al.
2009/0027925 A1 1/2009 Kanouda et al.
2009/0028005 A1 1/2009 You et al.
2009/0029831 A1 1/2009 Weier et al.
2009/0029834 A1 1/2009 Isom
2009/0036276 A1 2/2009 Loach
2009/0036277 A1 2/2009 Ish, III et al.
2009/0040231 A1 2/2009 Sano et al.
2009/0040301 A1 2/2009 Sandler et al.
2009/0041298 A1 2/2009 Sandler et al.
2009/0042174 A1 2/2009 Aries
2009/0042696 A1 2/2009 Wang
2009/0042698 A1 2/2009 Wang
2009/0043531 A1 2/2009 Kahn et al.
2009/0047645 A1 2/2009 Dibenedetto et al.
2009/0048044 A1 2/2009 Oleson et al.
2009/0048073 A1 2/2009 Roimicher
2009/0048074 A1 2/2009 Kamins
2009/0048079 A1 2/2009 Nalley
2009/0048493 A1 2/2009 James et al.
2009/0048939 A1 2/2009 Williams
2009/0049092 A1 2/2009 Capio et al.
2009/0053682 A1 2/2009 Stern
2009/0054207 A1 2/2009 Lin et al.
2009/0054214 A1 2/2009 Kadar
2009/0054751 A1 2/2009 Babashan et al.
2009/0061870 A1 3/2009 Finkelstein et al.
2009/0062072 A1 3/2009 Packham
2009/0062598 A1 3/2009 Haisma et al.
2009/0069156 A1 3/2009 Kurunmäki et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0075793 A1 3/2009 Trainor
2009/0076335 A1 3/2009 Schwarzberg et al.
2009/0076903 A1 3/2009 Schwarzberg et al.
2009/0080808 A1 3/2009 Hagen
2009/0082176 A1 3/2009 Watterson et al.
2009/0082880 A1 3/2009 Saunders
2009/0085873 A1 4/2009 Betts et al.
2009/0088248 A1 4/2009 Stevens
2009/0088299 A1 4/2009 Chen
2009/0088301 A1 4/2009 Alling
2009/0093319 A1 4/2009 Omidi
2009/0093341 A1 4/2009 James
2009/0093347 A1 4/2009 Wang
2009/0098980 A1 4/2009 Waters
2009/0098981 A1 4/2009 Del Giorno
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0105560 A1 4/2009 Solomon
2009/0109346 A1 4/2009 Viarani et al.
2009/0111656 A1 4/2009 Sullivan et al.
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0117890 A1 5/2009 Jacobsen et al.
2009/0118098 A1 5/2009 Yeh
2009/0118099 A1 5/2009 Fisher
2009/0118103 A1 5/2009 Ellis
2009/0118105 A1 5/2009 Schiff
2009/0119032 A1 5/2009 Meyer
2009/0120208 A1 5/2009 Meyer
2009/0120210 A1 5/2009 Phillips et al.
2009/0124460 A1 5/2009 Chen
2009/0124463 A1 5/2009 Chen
2009/0124464 A1 5/2009 Kastelic
2009/0124465 A1 5/2009 Wang
2009/0124466 A1 5/2009 Zhang
2009/0124470 A1 5/2009 Yu
2009/0128342 A1 5/2009 Cohen
2009/0128516 A1 5/2009 Rimon et al.
2009/0131230 A1 5/2009 Cole
2009/0131231 A1 5/2009 Smith
2009/0137367 A1 5/2009 Hendrickson et al.
2009/0137370 A1 5/2009 Kushnir
2009/0143201 A1 6/2009 Uygan
2009/0144080 A1 6/2009 Gray et al.
2009/0144084 A1 6/2009 Neumaier
2009/0144639 A1 6/2009 Nims et al.
2009/0149299 A1 6/2009 Tchao et al.
2009/0149302 A1 6/2009 Thuma
2009/0149721 A1 6/2009 Yang
2009/0150178 A1 6/2009 Sutton et al.
2009/0156363 A1 6/2009 Guidi et al.
2009/0156364 A1 6/2009 Simeoni
2009/0158871 A1 6/2009 Chuo
2009/0163262 A1 6/2009 Kang
2009/0163323 A1 6/2009 Bocchicchio
2009/0163326 A1 6/2009 Wang
2009/0163327 A1 6/2009 Huang et al.
2009/0163331 A1 6/2009 Lacher
2009/0163334 A1 6/2009 Gibson et al.
2009/0170663 A1 7/2009 Cox et al.
2009/0170667 A1 7/2009 Irving et al.
2009/0170668 A1 7/2009 Giannelli et al.
2009/0170669 A1 7/2009 Giannelli et al.
2009/0170672 A1 7/2009 McMullen
2009/0170675 A1 7/2009 Giannelli et al.
2009/0171229 A1 7/2009 Saldarelli
2009/0174558 A1 7/2009 White
2009/0176526 A1 7/2009 Altman
2009/0176581 A1 7/2009 Barnes et al.
2009/0176625 A1 7/2009 Giannelli et al.
2009/0176628 A1 7/2009 Radding et al.
2009/0177068 A1 7/2009 Stivoric et al.
2009/0180646 A1 7/2009 Vulfson et al.
2009/0181826 A1 7/2009 Turner
2009/0181829 A1 7/2009 Wu
2009/0181830 A1 7/2009 Wu
2009/0181831 A1 7/2009 Kuo
2009/0181833 A1 7/2009 Cassidy
2009/0186748 A1 7/2009 Golesh et al.
2009/0186749 A1 7/2009 Zhou
2009/0191988 A1 7/2009 Klein

(56) References Cited

U.S. PATENT DOCUMENTS

2009/0192391 A1 7/2009 Lovitt et al.
2009/0192871 A1 7/2009 Deacon et al.
2009/0193344 A1 7/2009 Smyers
2009/0193796 A1 8/2009 Wei et al.
2009/0195350 A1 8/2009 Tsern et al.
2009/0196417 A1 8/2009 Beaver et al.
2009/0197739 A1 8/2009 Hashimoto
2009/0197740 A1 8/2009 Julskjaer et al.
2009/0197745 A1 8/2009 Olson
2009/0203501 A1 8/2009 Rodgers, Jr.
2009/0204422 A1 8/2009 James
2009/0204668 A1 8/2009 Huang
2009/0205482 A1 8/2009 Shirai et al.
2009/0209393 A1 8/2009 Crater et al.
2009/0210078 A1 8/2009 Crowley
2009/0215594 A1 8/2009 Panaiotov
2009/0216629 A1 8/2009 James
2009/0217178 A1 8/2009 Niyogi et al.
2009/0221404 A1 9/2009 Dorogusker et al.
2009/0221405 A1 9/2009 Wang
2009/0221407 A1 9/2009 Hauk
2009/0227424 A1 9/2009 Hirata et al.
2009/0227428 A1 9/2009 Tamari
2009/0227429 A1 9/2009 Baudhuin
2009/0227432 A1 9/2009 Pacheco
2009/0232420 A1 9/2009 Eisenberg et al.
2009/0233769 A1 9/2009 Pryor
2009/0233771 A1 9/2009 Quatrochi et al.
2009/0238400 A1 9/2009 Im
2009/0239714 A1 9/2009 Sellers
2009/0240858 A1 9/2009 Takebayashi
2009/0246746 A1 10/2009 Roerdink et al.
2009/0247366 A1 10/2009 Frumer
2009/0247376 A1 10/2009 Merrithew et al.
2009/0253109 A1 10/2009 Anvari
2009/0253554 A1 10/2009 McIntosh
2009/0257323 A1 10/2009 Soltani
2009/0258710 A1 10/2009 Quatrochi et al.
2009/0258758 A1 10/2009 Hickman
2009/0258763 A1 10/2009 Richter
2009/0262088 A1 10/2009 Moll-Carrillo et al.
2009/0263772 A1 10/2009 Root
2009/0264258 A1 10/2009 Lo
2009/0264260 A1 10/2009 Piaget et al.
2009/0265649 A1 10/2009 Schlossberg et al.
2009/0267783 A1 10/2009 Vock et al.
2009/0269728 A1 10/2009 Verstegen et al.
2009/0270226 A1 10/2009 Watterson
2009/0270234 A1 10/2009 Alessandri et al.
2009/0270743 A1 10/2009 Dugan
2009/0278707 A1 11/2009 Biggins et al.
2009/0280964 A1 11/2009 Lin
2009/0282080 A1 11/2009 Schlossberg et al.
2009/0286653 A1 11/2009 Wiber
2009/0292178 A1 11/2009 Ellis et al.
2009/0293319 A1 12/2009 Avni
2009/0298649 A1 12/2009 Dyer et al.
2009/0305852 A1 12/2009 Svenberg
2009/0309891 A1 12/2009 Karkanias et al.
2009/0312151 A1 12/2009 Thieberger
2009/0312158 A1 12/2009 Trevino et al.
2009/0312658 A1 12/2009 Thieberger
2010/0003573 A1 1/2010 Jeanne et al.
2010/0003647 A1 1/2010 Brown et al.
2010/0004104 A1 1/2010 Gustafson
2010/0005624 A1 1/2010 Swearingen et al.
2010/0009809 A1 1/2010 Carrington
2010/0009810 A1 1/2010 Trzecieski
2010/0015585 A1 1/2010 Baker
2010/0016127 A1 1/2010 Farnsworth et al.
2010/0016129 A1 1/2010 Chou
2010/0016742 A1 1/2010 James
2010/0017402 A1 1/2010 Fleming et al.
2010/0019593 A1 1/2010 Ritchey
2010/0022354 A1 1/2010 Fisher
2010/0024590 A1 2/2010 O'Neill et al.
2010/0031803 A1 2/2010 Lozada et al.
2010/0032533 A1 2/2010 Chen et al.
2010/0034665 A1 2/2010 Zhong et al.
2010/0035726 A1 2/2010 Fisher et al.
2010/0036736 A1 2/2010 Mcgee et al.
2010/0038149 A1 2/2010 Corel
2010/0041000 A1 2/2010 Glass
2010/0041516 A1 2/2010 Kodama
2010/0041526 A1 2/2010 Bowser et al.
2010/0048358 A1 2/2010 Tchao et al.
2010/0048368 A1 2/2010 Donofrio
2010/0050082 A1 2/2010 Katz et al.
2010/0056339 A1 3/2010 Chen
2010/0056340 A1 3/2010 Ellis
2010/0056345 A1 3/2010 Liu
2010/0056876 A1 3/2010 Ellis
2010/0062818 A1 3/2010 Haughay, Jr. et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0068684 A1 3/2010 Sabel
2010/0069202 A1 3/2010 Olsen
2010/0075812 A1 3/2010 Piaget et al.
2010/0076278 A1 3/2010 van der Zande et al.
2010/0077564 A1 4/2010 Saier et al.
2010/0079291 A1 4/2010 Kroll et al.
2010/0081116 A1 4/2010 Barasch et al.
2010/0081548 A1 4/2010 Labedz et al.
2010/0087298 A1 4/2010 Zaccherini
2010/0087701 A1 4/2010 Berka et al.
2010/0088023 A1 4/2010 Werner
2010/0093492 A1 4/2010 Watterson et al.
2010/0093493 A1 4/2010 Eldridge
2010/0099437 A1 4/2010 Moerdijk
2010/0099541 A1 4/2010 Patel
2010/0099954 A1 4/2010 Dickinson et al.
2010/0105527 A1 4/2010 Johnson
2010/0105530 A1 4/2010 Inaizumi
2010/0112536 A1 5/2010 Claassen et al.
2010/0113222 A1 5/2010 Radow
2010/0113223 A1 5/2010 Chiles et al.
2010/0113948 A1 5/2010 Yang et al.
2010/0120585 A1 5/2010 Quy
2010/0125026 A1 5/2010 Zavadsky et al.
2010/0125029 A1 5/2010 Nielson et al.
2010/0125183 A1 5/2010 Vayalattu et al.
2010/0130337 A1 5/2010 Stewart
2010/0137049 A1 6/2010 Epstein
2010/0137105 A1 6/2010 McLaughlin
2010/0137106 A1 6/2010 Oshima et al.
2010/0137114 A1 6/2010 Keiser
2010/0144500 A1 6/2010 Canali
2010/0144501 A1 6/2010 Berhanu
2010/0146055 A1 6/2010 Hannuksela
2010/0152546 A1 6/2010 Behan et al.
2010/0156625 A1 6/2010 Ruha
2010/0156760 A1 6/2010 Cheswick
2010/0160013 A1 6/2010 Sanders
2010/0160014 A1 6/2010 Galasso et al.
2010/0160115 A1 6/2010 Morris et al.
2010/0164579 A1 7/2010 Acatrinei
2010/0167801 A1 7/2010 Karkanias et al.
2010/0167876 A1 7/2010 Cheng
2010/0167883 A1 7/2010 Grind
2010/0173276 A1 7/2010 Vasin
2010/0173755 A1 7/2010 Perez De Lazarraga
2010/0173759 A1 7/2010 Lalaoua
2010/0175634 A1 7/2010 Chang et al.
2010/0178981 A1 7/2010 Holcomb
2010/0179032 A1 7/2010 Perry
2010/0179035 A1 7/2010 Carnahan
2010/0179883 A1 7/2010 Devolites
2010/0182436 A1 7/2010 Boman et al.
2010/0184565 A1 7/2010 Avellino
2010/0184568 A1 7/2010 Schippers
2010/0184570 A1 7/2010 Cheng
2010/0188405 A1 7/2010 Haughay, Jr. et al.

(56) References Cited

U.S. PATENT DOCUMENTS

2010/0190610 A1 7/2010 Pryor
2010/0190615 A1 7/2010 Baker et al.
2010/0191462 A1 7/2010 Kobuya et al.
2010/0192715 A1 8/2010 Vauchel et al.
2010/0197462 A1 8/2010 Piane, Jr.
2010/0197465 A1 8/2010 Stevenson
2010/0204013 A1 8/2010 Chen
2010/0208038 A1 8/2010 Kutliroff et al.
2010/0208082 A1 8/2010 Buchner et al.
2010/0210418 A1 8/2010 Park
2010/0211439 A1 8/2010 Marci et al.
2010/0216536 A1 8/2010 Gagner
2010/0216599 A1 8/2010 Watterson
2010/0216600 A1 8/2010 Noffsinger
2010/0216603 A1 8/2010 Somers
2010/0216607 A1 8/2010 Mueller
2010/0216610 A1 8/2010 Gedeon-Janvier
2010/0217096 A1 8/2010 Nanikashvili
2010/0217099 A1 8/2010 Leboeuf
2010/0217102 A1 8/2010 Leboeuf et al.
2010/0222165 A1 9/2010 Nurnberg et al.
2010/0222178 A1 9/2010 Shea
2010/0222179 A1 9/2010 Temple et al.
2010/0222182 A1 9/2010 Park
2010/0227542 A1 9/2010 Goldmann
2010/0227740 A1 9/2010 Liu
2010/0233664 A1 9/2010 Wroclawsky
2010/0234184 A1 9/2010 Le Page
2010/0234185 A1 9/2010 Watt et al.
2010/0234193 A1 9/2010 Friedman
2010/0234693 A1 9/2010 Srinivasan et al.
2010/0235667 A1 9/2010 Mucignat et al.
2010/0240458 A1 9/2010 Gaiba et al.
2010/0240493 A1 9/2010 Wang
2010/0240495 A1 9/2010 Law
2010/0240945 A1 9/2010 Bikko
2010/0241018 A1 9/2010 Vogel
2010/0243514 A1 9/2010 Samain et al.
2010/0247081 A1 9/2010 Victoria Pons
2010/0248899 A1 9/2010 Bedell et al.
2010/0248900 A1 9/2010 Ashby
2010/0248901 A1 9/2010 Martens
2010/0248917 A1 9/2010 Reyes
2010/0251454 A1 10/2010 Kiernan
2010/0255884 A1 10/2010 Konkka et al.
2010/0255955 A1 10/2010 Hickman
2010/0255959 A1 10/2010 Dalebout et al.
2010/0255965 A1 10/2010 Chen
2010/0259043 A1 10/2010 Balsamo
2010/0261580 A1 10/2010 Lannon
2010/0267524 A1 10/2010 Stewart et al.
2010/0271367 A1 10/2010 Vaden et al.
2010/0273610 A1 10/2010 Johnson
2010/0274100 A1 10/2010 Behar
2010/0279822 A1 11/2010 Ford
2010/0279823 A1 11/2010 Waters
2010/0281463 A1 11/2010 Estrade
2010/0283601 A1 11/2010 Tai et al.
2010/0285933 A1 11/2010 Nalley
2010/0285935 A1 11/2010 Barnett
2010/0289466 A1 11/2010 Telefus
2010/0289772 A1 11/2010 Miller
2010/0292050 A1 11/2010 Dibenedetto et al.
2010/0292056 A1 11/2010 Birch
2010/0292599 A1 11/2010 Oleson et al.
2010/0292600 A1 11/2010 Dibenedetto et al.
2010/0298098 A1 11/2010 Ercan
2010/0298104 A1 11/2010 Turner
2010/0298106 A1 11/2010 Bowser
2010/0298655 A1 11/2010 Mccombie et al.
2010/0298656 A1 11/2010 Mccombie et al.
2010/0298661 A1 11/2010 Mccombie et al.
2010/0300272 A1 12/2010 Scherf
2010/0302142 A1 12/2010 French
2010/0302250 A1 12/2010 Hoebel
2010/0304931 A1 12/2010 Stumpf
2010/0304932 A1 12/2010 Kolman et al.
2010/0304934 A1 12/2010 Woodson
2010/0304938 A1 12/2010 Olson
2010/0304939 A1 12/2010 Svenberg
2010/0304940 A1 12/2010 Svenberg
2010/0311552 A1 12/2010 Sumners
2010/0312596 A1 12/2010 Saffari et al.
2010/0317488 A1 12/2010 Cartaya
2010/0317496 A1 12/2010 Abranchess
2010/0320956 A1 12/2010 Lumsden et al.
2010/0323852 A1 12/2010 Locsin
2010/0324387 A1 12/2010 Moon
2010/0327603 A1 12/2010 Suaan
2010/0331151 A1 12/2010 Signorile et al.
2010/0331153 A1 12/2010 Johnson
2011/0000024 A1 1/2011 Johnson et al.
2011/0003663 A1 1/2011 Chiu et al.
2011/0003664 A1 1/2011 Richard
2011/0009240 A1 1/2011 Chiu et al.
2011/0009249 A1 1/2011 Campanaro et al.
2011/0015039 A1 1/2011 Shea
2011/0015041 A1 1/2011 Shea
2011/0015468 A1 1/2011 Aarts et al.
2011/0021319 A1 1/2011 Nissila et al.
2011/0021323 A1 1/2011 Wu
2011/0021953 A1 1/2011 Sanematsu et al.
2011/0028277 A1 2/2011 Merli
2011/0028282 A1 2/2011 Sbragia
2011/0028286 A1 2/2011 Nortje
2011/0032105 A1 2/2011 Hoffman et al.
2011/0034300 A1 2/2011 Hall
2011/0039659 A1 2/2011 Kim et al.
2011/0045956 A1 2/2011 Colledge
2011/0046519 A1 2/2011 Raheman
2011/0048141 A1 3/2011 Svenberg
2011/0053131 A1 3/2011 Regnier
2011/0054242 A1 3/2011 Bender
2011/0054270 A1 3/2011 Derchak
2011/0054272 A1 3/2011 Derchak
2011/0054359 A1 3/2011 Sazonov et al.
2011/0054809 A1 3/2011 Templeman
2011/0056328 A1 3/2011 Ko
2011/0061515 A1 3/2011 Turner
2011/0061840 A1 3/2011 Goldmann et al.
2011/0063114 A1 3/2011 Ikoyan
2011/0065371 A1 3/2011 Leff
2011/0065373 A1 3/2011 Goldmann
2011/0065504 A1 3/2011 Dugan et al.
2011/0066056 A1 3/2011 Huang
2011/0067361 A1 3/2011 Sloan
2011/0072955 A1 3/2011 Turner
2011/0073743 A1 3/2011 Shamie
2011/0075835 A1 3/2011 Hill
2011/0077055 A1 3/2011 Pakula et al.
2011/0077128 A1 3/2011 Hamada et al.
2011/0082006 A1 4/2011 Ishii
2011/0082007 A1 4/2011 Birrell
2011/0082010 A1 4/2011 Dyer
2011/0082011 A1 4/2011 Ellis
2011/0082013 A1 4/2011 Bastian
2011/0082015 A1 4/2011 Dreissigacker et al.
2011/0082017 A1 4/2011 Arlie
2011/0082397 A1 4/2011 Alberts
2011/0086707 A1 4/2011 Loveland
2011/0087076 A1 4/2011 Brynelsen et al.
2011/0087137 A1 4/2011 Hanoun
2011/0087445 A1 4/2011 Sobolewski
2011/0087446 A1 4/2011 Redmond
2011/0090092 A1 4/2011 Birrell et al.
2011/0091842 A1 4/2011 Dugan
2011/0092779 A1 4/2011 Chang et al.
2011/0093100 A1 4/2011 Ramsay
2011/0096764 A1 4/2011 Tunioli et al.
2011/0098157 A1 4/2011 Whalen et al.
2011/0098615 A1 4/2011 Whalen et al.
2011/0105278 A1 5/2011 Fabbri
2011/0105279 A1 5/2011 Herranen
2011/0105920 A1 5/2011 Haataja

(56) References Cited

U.S. PATENT DOCUMENTS

2011/0106597 A1 5/2011 Ferdman et al.
2011/0109283 A1 5/2011 Kapels et al.
2011/0111925 A1 5/2011 Hobson
2011/0112771 A1 5/2011 French
2011/0117529 A1 5/2011 Barash
2011/0118084 A1 5/2011 Tsai et al.
2011/0118086 A1 5/2011 Radow
2011/0118089 A1 5/2011 Ellis
2011/0118090 A1 5/2011 Ellis
2011/0119027 A1 5/2011 Zhu et al.
2011/0124466 A1 5/2011 Nishimura
2011/0124469 A1 5/2011 Uhlir
2011/0124476 A1 5/2011 Holley
2011/0124978 A1 5/2011 Williams
2011/0125063 A1 5/2011 Shalon et al.
2011/0131005 A1 6/2011 Ueshima et al.
2011/0136627 A1 6/2011 Williams
2011/0140904 A1 6/2011 Kashi
2011/0143769 A1 6/2011 Jones et al.
2011/0143890 A1 6/2011 Reyes
2011/0143898 A1 6/2011 Trees
2011/0152032 A1 6/2011 Barnett
2011/0152033 A1 6/2011 Yang
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0152696 A1 6/2011 Ryan
2011/0163206 A1 7/2011 Bandera
2011/0163939 A1 7/2011 Tam et al.
2011/0164044 A1 7/2011 Huang
2011/0164175 A1 7/2011 Chung et al.
2011/0165995 A1 7/2011 Paulus
2011/0165996 A1 7/2011 Paulus
2011/0165997 A1 7/2011 Reich
2011/0165998 A1 7/2011 Lau et al.
2011/0167447 A1 7/2011 Wong
2011/0172058 A1 7/2011 Deaconu
2011/0172059 A1 7/2011 Watterson et al.
2011/0172060 A1 7/2011 Morales et al.
2011/0172068 A1 7/2011 Tyson, II
2011/0175744 A1 7/2011 Englert et al.
2011/0175989 A1 7/2011 Islam
2011/0176943 A1 7/2011 Tran et al.
2011/0177919 A1 7/2011 Tamari
2011/0177921 A1 7/2011 Olson
2011/0179068 A1 7/2011 O'Brien
2011/0181420 A1 7/2011 Mack et al.
2011/0183307 A1 7/2011 Shum et al.
2011/0184225 A1 7/2011 Whitall et al.
2011/0184247 A1 7/2011 Contant et al.
2011/0185309 A1 7/2011 Challinor et al.
2011/0188269 A1 8/2011 Hosotani
2011/0188668 A1 8/2011 Donaldson
2011/0188980 A1 8/2011 Pumroy
2011/0190096 A1 8/2011 Clarke
2011/0191123 A1 8/2011 Buzynski
2011/0195819 A1 8/2011 Shaw
2011/0195825 A1 8/2011 Liester
2011/0197157 A1 8/2011 Hoffman et al.
2011/0199393 A1 8/2011 Nurse et al.
2011/0199799 A1 8/2011 Hui et al.
2011/0201476 A1 8/2011 Solomon
2011/0201481 A1 8/2011 Lo
2011/0202236 A1 8/2011 Galasso et al.
2011/0205164 A1 8/2011 Golitschek edler von elbart et al.
2011/0207584 A1 8/2011 Webber et al.
2011/0214148 A1 9/2011 Gossweiler, III et al.
2011/0218086 A1 9/2011 Boren
2011/0221672 A1 9/2011 Osterhout et al.
2011/0222375 A1 9/2011 Tsubata et al.
2011/0224057 A1 9/2011 Wu
2011/0224058 A1 9/2011 Webber et al.
2011/0224498 A1 9/2011 Banet et al.
2011/0227268 A1 9/2011 Zheng
2011/0229862 A1 9/2011 Parikh
2011/0230732 A1 9/2011 Edman et al.
2011/0237396 A1 9/2011 Lu
2011/0237399 A1 9/2011 Toback
2011/0237405 A1 9/2011 Reyes
2011/0237407 A1 9/2011 Kaleal
2011/0238217 A1 9/2011 Kume et al.
2011/0240403 A1 10/2011 Meillet
2011/0245633 A1 10/2011 Goldberg et al.
2011/0247530 A1 10/2011 Coffman
2011/0251021 A1 10/2011 Zavadsky et al.
2011/0251023 A1 10/2011 Fedriga
2011/0251033 A1 10/2011 Blancher
2011/0252597 A1 10/2011 Burris et al.
2011/0256988 A1 10/2011 Weier
2011/0257797 A1 10/2011 Burris et al.
2011/0263384 A1 10/2011 Drazan
2011/0263385 A1 10/2011 Shea
2011/0264305 A1 10/2011 Choe
2011/0267196 A1 11/2011 Hu et al.
2011/0269517 A1 11/2011 Englert et al.
2011/0269604 A1 11/2011 Tseng
2011/0270135 A1 11/2011 Dooley
2011/0275482 A1 11/2011 Brodess et al.
2011/0275489 A1 11/2011 Apau
2011/0275496 A1 11/2011 Chou
2011/0275499 A1 11/2011 Eschenbach
2011/0276312 A1 11/2011 Shalon et al.
2011/0281249 A1 11/2011 Gammell et al.
2011/0281691 A1 11/2011 Ellis
2011/0283188 A1 11/2011 Farrenkopf et al.
2011/0283231 A1 11/2011 Richstein et al.
2011/0287905 A1 11/2011 Reyes
2011/0295083 A1 12/2011 Doelling et al.
2011/0306480 A1 12/2011 Beaulieu et al.
2011/0308919 A1 12/2011 Hahn
2011/0311955 A1 12/2011 Forsten et al.
2011/0312473 A1 12/2011 Chu et al.
2011/0312475 A1 12/2011 Towley, III et al.
2011/0319229 A1 12/2011 Corbalis et al.
2011/0319230 A1 12/2011 Brendle
2011/0320380 A1 12/2011 Zahn et al.
2012/0004074 A1 1/2012 Schelzig
2012/0004075 A1 1/2012 Kissel
2012/0004076 A1 1/2012 Fenster
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0015787 A2 1/2012 Crawley
2012/0020135 A1 1/2012 McCune
2012/0021873 A1 1/2012 Brunner
2012/0021875 A1 1/2012 Karl
2012/0021876 A1 1/2012 Hsiung
2012/0021877 A1 1/2012 Lundquist et al.
2012/0024237 A1 2/2012 Rice
2012/0028761 A1 2/2012 Dorogusker et al.
2012/0029666 A1 2/2012 Crowley et al.
2012/0032896 A1 2/2012 Vesely
2012/0035024 A1 2/2012 Price
2012/0035487 A1 2/2012 Werner et al.
2012/0036557 A1 2/2012 Li
2012/0046144 A1 2/2012 Lin et al.
2012/0050818 A1 3/2012 Watanabe
2012/0053024 A1 3/2012 Mendoza
2012/0055718 A1 3/2012 Chen
2012/0065031 A1 3/2012 Buzzanco
2012/0065034 A1 3/2012 Loach
2012/0071301 A1 3/2012 Kaylor et al.
2012/0078127 A1 3/2012 McDonald et al.
2012/0079429 A1 3/2012 Stathacopoulos et al.
2012/0079529 A1 3/2012 Harris et al.
2012/0081531 A1 4/2012 Deangelis et al.
2012/0083395 A1 4/2012 Carson
2012/0083396 A1 4/2012 Aquino
2012/0083669 A1 4/2012 Abujbara
2012/0083705 A1 4/2012 Yuen et al.
2012/0084807 A1 4/2012 Thompson et al.

(56) References Cited

U.S. PATENT DOCUMENTS

2012/0084811 A1 4/2012 Thompson
2012/0084812 A1 4/2012 Thompson et al.
2012/0088633 A1 4/2012 Crafton
2012/0088634 A1 4/2012 Heidecke
2012/0088638 A1 4/2012 Lull
2012/0088640 A1 4/2012 Wissink et al.
2012/0090446 A1 4/2012 Moreno
2012/0092327 A1 4/2012 Adhikari
2012/0094809 A1 4/2012 Nishimura
2012/0096357 A1 4/2012 Folgner et al.
2012/0096405 A1 4/2012 Seo
2012/0105867 A1 5/2012 Komatsu
2012/0108914 A1 5/2012 Bravomalo
2012/0113029 A1 5/2012 Ye et al.
2012/0115682 A1 5/2012 Homsi
2012/0115689 A1 5/2012 Dalebout et al.
2012/0115691 A1 5/2012 Munroe
2012/0115695 A1 5/2012 Watterson et al.
2012/0116550 A1 5/2012 Hoffman et al.
2012/0116684 A1 5/2012 Ingrassia et al.
2012/0116806 A1 5/2012 Stark et al.
2012/0122063 A1 5/2012 Chen et al.
2012/0125559 A1 5/2012 Fadell et al.
2012/0129139 A1 5/2012 Partovi
2012/0129653 A1 5/2012 Shalev
2012/0132877 A1 5/2012 Wang
2012/0133192 A1 5/2012 Simpson
2012/0142503 A1 6/2012 Sevadjian
2012/0143358 A1 6/2012 Adams et al.
2012/0149996 A1 6/2012 Stivoric et al.
2012/0153015 A1 6/2012 Gomez et al.
2012/0157265 A1 6/2012 Kao
2012/0158238 A1 6/2012 Daley
2012/0159563 A1 6/2012 Gomez et al.
2012/0165162 A1 6/2012 Lu
2012/0165703 A1 6/2012 Bottum
2012/0169603 A1 7/2012 Peterson et al.
2012/0174608 A1 7/2012 Kumamoto et al.
2012/0174833 A1 7/2012 Early
2012/0178590 A1 7/2012 Lu
2012/0178591 A1 7/2012 Remelius
2012/0178596 A1 7/2012 Vittone
2012/0179278 A1 7/2012 Riley et al.
2012/0183939 A1 7/2012 Aragones et al.
2012/0183940 A1 7/2012 Aragones et al.
2012/0187012 A1 7/2012 Tevault et al.
2012/0190502 A1 7/2012 Paulus et al.
2012/0190504 A1 7/2012 Lee et al.
2012/0202656 A1 8/2012 Dorsay
2012/0208153 A1 8/2012 Bolla et al.
2012/0212505 A1 8/2012 Burroughs et al.
2012/0214590 A1 8/2012 Newhouse et al.
2012/0216524 A1 8/2012 Browne et al.
2012/0217758 A1 8/2012 Chen
2012/0218184 A1 8/2012 Wissmar
2012/0220434 A1 8/2012 Lien
2012/0225412 A1 9/2012 Wagner
2012/0225758 A1 9/2012 Shaw
2012/0228385 A1 9/2012 Deluca
2012/0230504 A1 9/2012 Kuroda
2012/0233002 A1 9/2012 Abujbara
2012/0237906 A9 9/2012 Glass
2012/0237911 A1 9/2012 Watterson
2012/0238411 A1 9/2012 Mcbride et al.
2012/0238418 A1 9/2012 Reyes
2012/0238800 A1 9/2012 Naujokat et al.
2012/0238851 A1 9/2012 Kamen et al.
2012/0242774 A1 9/2012 Numano et al.
2012/0248263 A1 10/2012 Grotenhuis
2012/0251983 A1 10/2012 Golden
2012/0252580 A1 10/2012 Dugan
2012/0252642 A1 10/2012 Chen
2012/0253234 A1 10/2012 Yang et al.
2012/0253485 A1 10/2012 Weast et al.
2012/0253487 A1 10/2012 Dugan
2012/0253489 A1 10/2012 Dugan
2012/0258433 A1 10/2012 Hope et al.
2012/0263892 A1 10/2012 Rodgers
2012/0264575 A1 10/2012 Towley, III et al.
2012/0268592 A1 10/2012 Aragones et al.
2012/0270705 A1 10/2012 Lo
2012/0271121 A1 10/2012 Della Torre et al.
2012/0271143 A1 10/2012 Aragones et al.
2012/0277040 A1 11/2012 Vincent et al.
2012/0277068 A1 11/2012 Zhou et al.
2012/0277070 A1 11/2012 Sienna
2012/0277891 A1 11/2012 Aragones et al.
2012/0283071 A1 11/2012 Nalley
2012/0283074 A1 11/2012 Hutchins
2012/0285986 A1 11/2012 Irvin
2012/0289386 A1 11/2012 Yu
2012/0290109 A1 11/2012 Engelberg et al.
2012/0293141 A1 11/2012 Zhang et al.
2012/0295764 A1 11/2012 Brammer
2012/0295774 A1 11/2012 Dalebout et al.
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0306643 A1 12/2012 Dugan
2012/0313776 A1 12/2012 Utter, II
2012/0315986 A1 12/2012 Walling
2012/0315987 A1 12/2012 Walling
2012/0316406 A1 12/2012 Rahman et al.
2012/0316455 A1 12/2012 Rahman et al.
2012/0316456 A1 12/2012 Rahman et al.
2012/0316458 A1 12/2012 Rahman et al.
2012/0317024 A1 12/2012 Rahman et al.
2012/0319604 A1 12/2012 Walters
2012/0322625 A1 12/2012 Park
2012/0322628 A1 12/2012 Gautier
2012/0322629 A1 12/2012 Webb
2012/0323496 A1 12/2012 Burroughs
2012/0326873 A1 12/2012 Utter, II
2012/0329027 A1 12/2012 Lewolt
2012/0329611 A1 12/2012 Bouchard
2012/0329615 A1 12/2012 Jeong
2013/0002533 A1 1/2013 Burroughs et al.
2013/0004010 A1 1/2013 Royer
2013/0009993 A1 1/2013 Horseman
2013/0011818 A1 1/2013 Shum et al.
2013/0014155 A1 1/2013 Clarke et al.
2013/0015945 A1 1/2013 Chang
2013/0017888 A1 1/2013 King et al.
2013/0017929 A1 1/2013 Hendrickson et al.
2013/0018494 A1 1/2013 Amini
2013/0018668 A1 1/2013 Goldberg et al.
2013/0023933 A1 1/2013 Haas
2013/0029807 A1 1/2013 Amsel
2013/0034671 A1 2/2013 George
2013/0035209 A1 2/2013 Gilley et al.
2013/0035219 A1 2/2013 Williams et al.
2013/0035220 A1 2/2013 Adams
2013/0035612 A1 2/2013 Mason et al.
2013/0040271 A1 2/2013 Rytky et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053218 A1 2/2013 Barker
2013/0053220 A1 2/2013 Monaco
2013/0053222 A1 2/2013 Lo
2013/0053717 A1 2/2013 Vandine et al.
2013/0053990 A1 2/2013 Ackland
2013/0065680 A1 3/2013 Zavadsky
2013/0073093 A1 3/2013 Songkakul
2013/0083003 A1 4/2013 Perez et al.
2013/0085038 A1 4/2013 Fischer
2013/0090212 A1 4/2013 Wang
2013/0090216 A1* 4/2013 Jackson ..... A63B 21/018
482/52
2013/0090565 A1 4/2013 Quy
2013/0092647 A1 4/2013 Chen

(56) References Cited

U.S. PATENT DOCUMENTS

2013/0095959 A1 4/2013 Marty
2013/0095978 A1 4/2013 Sauter
2013/0097635 A1 4/2013 Yerli
2013/0102443 A1 4/2013 Lundquist et al.
2013/0105565 A1 5/2013 Kamprath
2013/0106684 A1 5/2013 Weast et al.
2013/0108995 A1 5/2013 DePasqua et al.
2013/0110264 A1 5/2013 Weast et al.
2013/0116091 A1 5/2013 Fritz
2013/0116092 A1 5/2013 Martinez et al.
2013/0116093 A1 5/2013 Kehoe
2013/0116095 A1 5/2013 Hsieh
2013/0116514 A1 5/2013 Kroner et al.
2013/0116605 A1 5/2013 Dephouse
2013/0123073 A1* 5/2013 Olson ..... A63B 22/02 482/54
2013/0123083 A1 5/2013 Sip
2013/0127636 A1 5/2013 Aryanpur et al.
2013/0129217 A1 5/2013 Gupta
2013/0130868 A1 5/2013 Hou
2013/0130869 A1 5/2013 Hou
2013/0135115 A1 5/2013 Johnson et al.
2013/0137552 A1 5/2013 Kemp et al.
2013/0139736 A1 6/2013 Flaherty
2013/0141235 A1 6/2013 Utter, II
2013/0143721 A1 6/2013 Dalebout
2013/0144464 A1 6/2013 Dorogusker et al.
2013/0147411 A1 6/2013 Pang et al.
2013/0148861 A1 6/2013 Ferlatte et al.
2013/0150214 A1 6/2013 Wu
2013/0154441 A1 6/2013 Redmond
2013/0158368 A1 6/2013 Pacione et al.
2013/0165195 A1 6/2013 Watterson
2013/0165297 A1 6/2013 Daly
2013/0172152 A1 7/2013 Watterson
2013/0173156 A1 7/2013 Wither et al.
2013/0174273 A1 7/2013 Grab et al.
2013/0177884 A1 7/2013 Root
2013/0178334 A1 7/2013 Brammer
2013/0178338 A1 7/2013 Ross
2013/0178346 A1 7/2013 Lin
2013/0182781 A1 7/2013 Matsutani
2013/0184843 A1 7/2013 Ellis et al.
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0191034 A1 7/2013 Weast et al.
2013/0193655 A1 8/2013 Kaye, Jr. et al.
2013/0196821 A1 8/2013 Watterson et al.
2013/0196822 A1 8/2013 Watterson et al.
2013/0196826 A1 8/2013 Colledge
2013/0196827 A1 8/2013 Chang
2013/0203557 A1 8/2013 Su et al.
2013/0203561 A1 8/2013 Lee et al.
2013/0208576 A1 8/2013 Loree, IV et al.
2013/0209972 A1 8/2013 Carter et al.
2013/0210578 A1 8/2013 Birrell
2013/0210581 A1 8/2013 Watterson et al.
2013/0210582 A1 8/2013 Del Toro et al.
2013/0211858 A1 8/2013 Ohnemus et al.
2013/0216982 A1 8/2013 Bennett et al.
2013/0216990 A1 8/2013 Chu et al.
2013/0225373 A1 8/2013 Poat
2013/0225377 A1 8/2013 Lee et al.
2013/0228063 A1 9/2013 Turner
2013/0228422 A1 9/2013 Mathieu et al.
2013/0231219 A1 9/2013 Huang et al.
2013/0231224 A1 9/2013 Svenberg
2013/0231226 A1 9/2013 Bonutti
2013/0231575 A1 9/2013 Erkkila et al.
2013/0233097 A1 9/2013 Hayner et al.
2013/0237383 A1 9/2013 Chen et al.
2013/0241696 A1 9/2013 Fabrizio
2013/0245966 A1 9/2013 Burroughs et al.
2013/0260965 A1 10/2013 Chia et al.
2013/0263418 A1 10/2013 Johnson, Jr.
2013/0267385 A1 10/2013 Watterson et al.
2013/0267386 A1 10/2013 Her
2013/0267392 A1 10/2013 Miranda
2013/0273509 A1 10/2013 Mutti
2013/0274040 A1 10/2013 Coza et al.
2013/0274064 A1 10/2013 Liang
2013/0274067 A1 10/2013 Watterson et al.
2013/0274069 A1 10/2013 Watterson et al.
2013/0274071 A1 10/2013 Wang
2013/0274074 A1 10/2013 Ghandour
2013/0274075 A1 10/2013 Habing et al.
2013/0274587 A1 10/2013 Coza et al.
2013/0274635 A1 10/2013 Coza et al.
2013/0274904 A1 10/2013 Coza et al.
2013/0280682 A1 10/2013 Levine et al.
2013/0282157 A1 10/2013 Shin et al.
2013/0282447 A1 10/2013 Himanen et al.
2013/0288223 A1 10/2013 Watterson et al.
2013/0289932 A1 10/2013 Baechler
2013/0290364 A1 10/2013 Minvielle
2013/0296144 A1 11/2013 Gvoich
2013/0297642 A1 11/2013 Minvielle
2013/0298019 A1 11/2013 Henderson
2013/0303334 A1* 11/2013 Adhami ..... A63B 21/025 482/4
2013/0303837 A1 11/2013 Berka et al.
2013/0310221 A1 11/2013 Zuber
2013/0310230 A1 11/2013 Norris
2013/0310658 A1 11/2013 Ricks
2013/0316830 A1 11/2013 Sedzin et al.
2013/0324368 A1 12/2013 Aragones et al.
2013/0325394 A1 12/2013 Yuen et al.
2013/0328416 A1 12/2013 Whitworth et al.
2013/0337974 A1 12/2013 Yanev et al.
2013/0337980 A1 12/2013 Himmelrick et al.
2013/0337981 A1 12/2013 Habing
2013/0338802 A1 12/2013 Winsper et al.
2013/0345978 A1 12/2013 Lush et al.
2013/0346043 A1 12/2013 Mewes et al.
2014/0005009 A1 1/2014 Giannelli
2014/0005811 A1 1/2014 Mikan et al.
2014/0011645 A1 1/2014 Johnson et al.
2014/0026788 A1 1/2014 Kallio, III et al.
2014/0031174 A1 1/2014 Huang
2014/0031181 A1 1/2014 Agostini
2014/0031703 A1 1/2014 Rayner et al.
2014/0038781 A1 2/2014 Foley
2014/0039329 A1 2/2014 Kampman et al.
2014/0039840 A1 2/2014 Yuen et al.
2014/0045656 A1 2/2014 Zhang
2014/0052280 A1 2/2014 Yuen et al.
2014/0056461 A1 2/2014 Afshar
2014/0058806 A1 2/2014 Guenette et al.
2014/0066264 A1 3/2014 Haddon
2014/0069838 A1 3/2014 Minvielle
2014/0073488 A1 3/2014 Wu
2014/0074265 A1 3/2014 Arginsky
2014/0077494 A1 3/2014 Sutkowski et al.
2014/0080678 A1 3/2014 Wu
2014/0081436 A1 3/2014 Crowley et al.
2014/0085077 A1 3/2014 Luna et al.
2014/0087923 A1 3/2014 Warren
2014/0089836 A1 3/2014 Damani et al.
2014/0094941 A1 4/2014 Atittas
2014/0099614 A1 4/2014 Hu et al.
2014/0100464 A1 4/2014 Kaleal et al.
2014/0102340 A1 4/2014 Kooistra
2014/0106322 A1 4/2014 Durand
2014/0106943 A1 4/2014 Simonetti
2014/0106948 A1 4/2014 Agostini
2014/0106949 A1 4/2014 Mestemaker
2014/0113776 A1 4/2014 Jaguan
2014/0113779 A1 4/2014 Loach
2014/0121066 A1 5/2014 Huang et al.
2014/0121071 A1 5/2014 Strom et al.
2014/0121072 A1 5/2014 Ercanbrack
2014/0121471 A1 5/2014 Walker

(56) References Cited

U.S. PATENT DOCUMENTS

2014/0125618 A1 5/2014 Panther et al.
2014/0129240 A1 5/2014 Zhang
2014/0134582 A1 5/2014 Konishi
2014/0135173 A1 5/2014 Watterson
2014/0135593 A1 5/2014 Jayalth et al.
2014/0135631 A1 5/2014 Brumback et al.
2014/0139450 A1 5/2014 Levesque et al.
2014/0141396 A1 5/2014 Spratt
2014/0142403 A1 5/2014 Brumback et al.
2014/0145935 A1 5/2014 Sztuk
2014/0147829 A1 5/2014 Jerauld
2014/0150042 A1 5/2014 Pacor et al.
2014/0156041 A1 6/2014 Martin
2014/0156084 A1 6/2014 Rahman et al.
2014/0156228 A1 6/2014 Molettiere et al.
2014/0156308 A1 6/2014 Ohnemus et al.
2014/0156645 A1 6/2014 Brust et al.
2014/0162230 A1 6/2014 Aramakopian
2014/0162854 A1 6/2014 Watterson
2014/0162856 A1 6/2014 Kramer
2014/0163429 A1 6/2014 Tropper et al.
2014/0164611 A1 6/2014 Molettiere et al.
2014/0171266 A1 6/2014 Hawkins et al.
2014/0171272 A1 6/2014 Hawkins, III et al.
2014/0172873 A1 6/2014 Varoglu et al.
2014/0173660 A1 6/2014 Correa et al.
2014/0180480 A1 6/2014 Lee et al.
2014/0187383 A1 7/2014 Martin
2014/0194260 A1 7/2014 Campanaro et al.
2014/0195103 A1 7/2014 Nassef
2014/0197946 A1 7/2014 Park et al.
2014/0200122 A1 7/2014 Hallmark
2014/0200691 A1 7/2014 Lee et al.
2014/0203943 A1 7/2014 Kates
2014/0205980 A1 7/2014 Braier et al.
2014/0206506 A1 7/2014 Huang
2014/0212857 A1 7/2014 Sullivan et al.
2014/0213416 A1 7/2014 Wang
2014/0214446 A1 7/2014 Nusbaum et al.
2014/0220514 A1 8/2014 Waldron et al.
2014/0221160 A1 8/2014 Hardy et al.
2014/0221168 A1 8/2014 Chen
2014/0221175 A1 8/2014 Liu
2014/0221784 A1 8/2014 Pacione et al.
2014/0221854 A1 8/2014 Wai
2014/0221881 A1 8/2014 Schlauder et al.
2014/0222173 A1 8/2014 Giedwoyn et al.
2014/0228118 A1 8/2014 Hardy et al.
2014/0228175 A1 8/2014 Lemos et al.
2014/0228181 A1 8/2014 Powell
2014/0228649 A1 8/2014 Rayner et al.
2014/0235409 A1* 8/2014 Salmon ..... A63B 21/0724 482/8
2014/0235411 A1 8/2014 Dailey
2014/0235937 A1 8/2014 Plath
2014/0249440 A1 9/2014 Banet et al.
2014/0257535 A1 9/2014 Morris et al.
2014/0257537 A1 9/2014 Stroupe et al.
2014/0265072 A1 9/2014 Chiu
2014/0265690 A1 9/2014 Henderson
2014/0266939 A1 9/2014 Baringer et al.
2014/0270375 A1 9/2014 Canavan et al.
2014/0272894 A1 9/2014 Grimes et al.
2014/0273858 A1 9/2014 Panther et al.
2014/0274564 A1 9/2014 Greenbaum
2014/0274574 A1 9/2014 Shorten et al.
2014/0274579 A1 9/2014 Olson
2014/0274596 A1 9/2014 Krull
2014/0274600 A1 9/2014 Dalebout et al.
2014/0275852 A1 9/2014 Hong et al.
2014/0275854 A1 9/2014 Venkatraman et al.
2014/0277637 A1 9/2014 Ventura et al.
2014/0278139 A1 9/2014 Hong et al.
2014/0278218 A1 9/2014 Chang
2014/0278220 A1 9/2014 Yuen
2014/0287886 A1 9/2014 Patti
2014/0288390 A1 9/2014 Hong et al.
2014/0288438 A1 9/2014 Venkatraman et al.
2014/0288680 A1 9/2014 Hoffman et al.
2014/0308629 A1 10/2014 Dugan
2014/0309085 A1 10/2014 Watterson et al.
2014/0309087 A1 10/2014 Uygan
2014/0309092 A1 10/2014 De Michele
2014/0316192 A1 10/2014 de Zambotti et al.
2014/0335490 A1 11/2014 Baarman et al.
2014/0336796 A1 11/2014 Agnew
2014/0338120 A1 11/2014 Baugh et al.
2014/0349257 A1 11/2014 Connor
2014/0351150 A1 11/2014 Ainsworth et al.
2014/0357457 A1* 12/2014 Boekema ..... A63B 21/00069 482/124
2014/0358012 A1 12/2014 Richards et al.
2014/0358473 A1 12/2014 Goel et al.
2014/0360413 A1 12/2014 Schenk
2014/0363797 A1 12/2014 Hu et al.
2014/0363800 A1 12/2014 Harris et al.
2014/0371887 A1 12/2014 Hoffman et al.
2014/0380167 A1 12/2014 Bloch et al.
2015/0001048 A1 1/2015 Koppes et al.
2015/0003621 A1 1/2015 Trammell
2015/0004579 A1 1/2015 Shelton
2015/0004580 A1 1/2015 Shum et al.
2015/0011362 A1 1/2015 Oh et al.
2015/0016623 A1 1/2015 Trammell
2015/0018989 A1 1/2015 Chen
2015/0019135 A1 1/2015 Kacyvenski et al.
2015/0025660 A1 1/2015 Prassler et al.
2015/0031964 A1 1/2015 Bly et al.
2015/0038300 A1 2/2015 Forhan et al.
2015/0044648 A1 2/2015 White et al.
2015/0048807 A1 2/2015 Fan et al.
2015/0051051 A1 2/2015 Liu et al.
2015/0059257 A1 3/2015 Beaver et al.
2015/0065301 A1 3/2015 Oteman
2015/0069738 A1 3/2015 Knight et al.
2015/0072842 A1 3/2015 Segal
2015/0079562 A1 3/2015 Yeh et al.
2015/0081209 A1 3/2015 Yeh et al.
2015/0081210 A1 3/2015 Yeh et al.
2015/0082408 A1 3/2015 Yeh et al.
2015/0087478 A1 3/2015 Zhang et al.
2015/0092972 A1 4/2015 Lai et al.
2015/0097700 A1 4/2015 Holthouse
2015/0099952 A1 4/2015 Lain et al.
2015/0105220 A1 4/2015 Hong
2015/0105881 A1 4/2015 Guerrero et al.
2015/0106868 A1 4/2015 Lo et al.
2015/0111708 A1 4/2015 Smith
2015/0118657 A1 4/2015 Shrake et al.
2015/0119197 A1 4/2015 Liu
2015/0126348 A1 5/2015 Kaye et al.
2015/0126873 A1 5/2015 Connor
2015/0135284 A1 5/2015 Bogard
2015/0141202 A1 5/2015 Ellis et al.
2015/0148204 A1 5/2015 Sleppy
2015/0151160 A1 6/2015 Balakrishnan et al.
2015/0154452 A1 6/2015 Bentley et al.
2015/0157918 A1 6/2015 Tracy
2015/0165259 A1 6/2015 Huppee et al.
2015/0165269 A1 6/2015 Herrala et al.
2015/0165270 A1 6/2015 Allos
2015/0168365 A1 6/2015 Connor
2015/0181314 A1 6/2015 Swanson
2015/0182773 A1 7/2015 Olson
2015/0186609 A1 7/2015 Utter, II
2015/0190679 A1 7/2015 Carbone
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0224363 A1 8/2015 Clark et al.
2015/0238801 A1 8/2015 Meredith

(56) References Cited

U.S. PATENT DOCUMENTS

| | | | |
|---|---|---|---|
| 2015/0238815 | A1 | 8/2015 | Lee |
| 2015/0246751 | A1 | 9/2015 | Spivack et al. |
| 2015/0248844 | A1 | 9/2015 | Ellis et al. |
| 2015/0250304 | A1 | 9/2015 | Dalebout |
| 2015/0250420 | A1 | 9/2015 | Longinotti-Buitoni et al. |
| 2015/0251048 | A1 | 9/2015 | Dalebout |
| 2015/0251055 | A1 | 9/2015 | Ashby |
| 2015/0253210 | A1 | 9/2015 | Ashby et al. |
| 2015/0255002 | A1 | 9/2015 | Harris et al. |
| 2015/0258382 | A1 | 9/2015 | Nolan et al. |
| 2015/0258384 | A1 | 9/2015 | Suzuki |
| 2015/0262459 | A1 | 9/2015 | Murvro |
| 2015/0265903 | A1 | 9/2015 | Kolen et al. |
| 2015/0269354 | A1 | 9/2015 | Klassen |
| 2015/0272262 | A1 | 10/2015 | Escamilla |
| 2015/0272473 | A1 | 10/2015 | Zafiroglu |
| 2015/0273267 | A1 | 10/2015 | Manzke |
| 2015/0273272 | A1 | 10/2015 | Wang |
| 2015/0283420 | A1 | 10/2015 | Chang |
| 2015/0283421 | A1 | 10/2015 | Gaylord |
| 2015/0288926 | A1 | 10/2015 | Glass et al. |
| 2015/0290490 | A1 | 10/2015 | Badarneh |
| 2015/0295397 | A1 | 10/2015 | Lin et al. |
| 2015/0296020 | A1 | 10/2015 | Granqvist et al. |
| 2015/0297932 | A1 | 10/2015 | Wehrell |
| 2015/0297936 | A1 | 10/2015 | Madden |
| 2015/0305961 | A1 | 10/2015 | Broerman et al. |
| 2015/0306456 | A1 | 10/2015 | Pasini et al. |
| 2015/0310062 | A1 | 10/2015 | Wang et al. |
| 2015/0314184 | A1 | 11/2015 | Moya Saez et al. |
| 2015/0318015 | A1 | 11/2015 | Bose et al. |
| 2015/0320588 | A1 | 11/2015 | Connor |
| 2015/0324751 | A1 | 11/2015 | Orenstein et al. |
| 2015/0327804 | A1 | 11/2015 | Lefever et al. |
| 2015/0331449 | A1 | 11/2015 | Ng |
| 2015/0335288 | A1 | 11/2015 | Toth et al. |
| 2015/0335941 | A1 | 11/2015 | Lo |
| 2015/0339946 | A1 | 11/2015 | Pacione et al. |
| 2015/0342815 | A1 | 12/2015 | Watson et al. |
| 2015/0346994 | A1 | 12/2015 | Chanyontpatanakul |
| 2015/0351690 | A1 | 12/2015 | Toth et al. |
| 2015/0352396 | A1 | 12/2015 | Dalebout |
| 2015/0352401 | A1 | 12/2015 | Johnson |
| 2015/0352402 | A1 | 12/2015 | Arnold et al. |
| 2015/0352404 | A1 | 12/2015 | Schwenger |
| 2015/0360073 | A1 | 12/2015 | Moran et al. |
| 2015/0360133 | A1 | 12/2015 | MacCallum et al. |
| 2015/0364026 | A1 | 12/2015 | Rubin et al. |
| 2015/0364058 | A1 | 12/2015 | Lagree |
| 2015/0366746 | A1 | 12/2015 | Ashby |
| 2015/0367158 | A1 | 12/2015 | Pretz et al. |
| 2015/0367176 | A1 | 12/2015 | Bejestan et al. |
| 2015/0369326 | A1 | 12/2015 | Modrezejewski et al. |
| 2015/0370320 | A1 | 12/2015 | Connor |
| 2015/0375028 | A1 | 12/2015 | Oteman et al. |
| 2015/0379239 | A1 | 12/2015 | Basta et al. |
| 2015/0379891 | A1 | 12/2015 | Wallace et al. |
| 2015/0381736 | A1 | 12/2015 | Seltzer et al. |
| 2016/0001123 | A1 | 1/2016 | Parrish, Jr. |
| 2016/0008650 | A1 | 1/2016 | Jue et al. |
| 2016/0012749 | A1 | 1/2016 | Connor |
| 2016/0016035 | A1 | 1/2016 | Hao |
| 2016/0018119 | A1 | 1/2016 | Desmet et al. |
| 2016/0023043 | A1 | 1/2016 | Grundy |
| 2016/0027325 | A1 | 1/2016 | Malhotra |
| 2016/0038785 | A1 | 2/2016 | Netter et al. |
| 2016/0047446 | A1 | 2/2016 | Hung |
| 2016/0051184 | A1 | 2/2016 | Wisbey et al. |
| 2016/0051857 | A1 | 2/2016 | Rasner |
| 2016/0058245 | A1 | 3/2016 | Smith et al. |
| 2016/0059077 | A1 | 3/2016 | Paul et al. |
| 2016/0059078 | A1 | 3/2016 | Liao |
| 2016/0059079 | A1 | 3/2016 | Watterson |
| 2016/0061300 | A1 | 3/2016 | Aoto et al. |
| 2016/0063615 | A1 | 3/2016 | Watterson |
| 2016/0066818 | A1 | 3/2016 | Cowley et al. |
| 2016/0067537 | A1 | 3/2016 | Bayerlein et al. |
| 2016/0071014 | A1 | 3/2016 | Brand et al. |
| 2016/0074691 | A1 | 3/2016 | Pearce et al. |
| 2016/0074701 | A1 | 3/2016 | Wiener et al. |
| 2016/0074705 | A1 | 3/2016 | Wiener et al. |
| 2016/0077547 | A1 | 3/2016 | Aimone et al. |
| 2016/0089559 | A1 | 3/2016 | Smith et al. |
| 2016/0089560 | A1 | 3/2016 | Smith et al. |
| 2016/0089569 | A1 | 3/2016 | Blahnik |
| 2016/0089575 | A1 | 3/2016 | Smith et al. |
| 2016/0096064 | A1 | 4/2016 | Gatti |
| 2016/0101311 | A1 | 4/2016 | Workman |
| 2016/0107019 | A1 | 4/2016 | Shah |
| 2016/0107029 | A1 | 4/2016 | Kim et al. |
| 2016/0112684 | A1 | 4/2016 | Connor |
| 2016/0114205 | A1 | 4/2016 | Giunchi |
| 2016/0114211 | A1 | 4/2016 | Schmidt |
| 2016/0121156 | A1 | 5/2016 | Bach |
| 2016/0121161 | A1 | 5/2016 | Mountain |
| 2016/0136483 | A1 | 5/2016 | Reich |
| 2016/0148535 | A1 | 5/2016 | Ashby |
| 2016/0148536 | A1 | 5/2016 | Ashby |
| 2016/0151603 | A1 | 6/2016 | Shouldice et al. |
| 2016/0157740 | A1 | 6/2016 | Kampman et al. |
| 2016/0166872 | A1 | 6/2016 | Cervone et al. |
| 2016/0166881 | A1 | 6/2016 | Ridgel et al. |
| 2016/0171110 | A1 | 6/2016 | Gao et al. |
| 2016/0175643 | A1 | 6/2016 | Kueker et al. |
| 2016/0184625 | A1 | 6/2016 | Chang |
| 2016/0184635 | A1 | 6/2016 | Kwon |
| 2016/0199683 | A1 | 7/2016 | Shamlin |
| 2016/0206248 | A1 | 7/2016 | Sartor et al. |
| 2016/0206922 | A1 | 7/2016 | Dalebout et al. |
| 2016/0211841 | A1 | 7/2016 | Harrison |
| 2016/0219968 | A1 | 8/2016 | Martin |
| 2016/0232811 | A9 | 8/2016 | Connor |
| 2016/0249365 | A1 | 8/2016 | Harel |
| 2016/0250514 | A1 | 9/2016 | Gvoich |
| 2016/0250519 | A1 | 9/2016 | Watterson |
| 2016/0253918 | A1 | 9/2016 | Watterson |
| 2016/0256082 | A1 | 9/2016 | Ely et al. |
| 2016/0256728 | A1 | 9/2016 | Tang |
| 2016/0256745 | A1 | 9/2016 | Brammer |
| 2016/0263426 | A1 | 9/2016 | Mueller et al. |
| 2016/0278487 | A1 | 9/2016 | Postolek |
| 2016/0279462 | A1 | 9/2016 | Sutherland |
| 2016/0279470 | A1 | 9/2016 | George Hampton |
| 2016/0287930 | A1 | 10/2016 | Moser |
| 2016/0296053 | A1 | 10/2016 | Umar Rahim Baldish |
| 2016/0303414 | A1 | 10/2016 | Werner |
| 2016/0303421 | A1 | 10/2016 | Tyger et al. |
| 2016/0317861 | A1 | 11/2016 | Dalebout |
| 2016/0317866 | A1 | 11/2016 | Fung |
| 2016/0319850 | A1 | 11/2016 | Kamen et al. |
| 2016/0321075 | A1 | 11/2016 | Catherwood et al. |
| 2016/0321932 | A1 | 11/2016 | Mitchell |
| 2016/0346586 | A1 | 12/2016 | Pullins et al. |
| 2016/0346598 | A1 | 12/2016 | Manzke et al. |
| 2016/0346616 | A1 | 12/2016 | Kirby et al. |
| 2016/0346617 | A1 | 12/2016 | Srugo |
| 2016/0351070 | A1 | 12/2016 | Aillon-Sohl |
| 2016/0367851 | A1 | 12/2016 | Astilean et al. |
| 2016/0367857 | A1 | 12/2016 | Aragones et al. |
| 2016/0371998 | A1 | 12/2016 | Fazeel |
| 2016/0375307 | A1 | 12/2016 | Durham |
| 2016/0375308 | A1 | 12/2016 | Anderson |
| 2017/0007886 | A1 | 1/2017 | Alessandri |
| 2017/0011210 | A1 | 1/2017 | Cheong et al. |
| 2017/0014661 | A1 | 1/2017 | Lin |
| 2017/0020440 | A1 | 1/2017 | Flitsch et al. |
| 2017/0021218 | A1 | 1/2017 | Peritz |
| 2017/0036106 | A1 | 2/2017 | Stechschulte et al. |
| 2017/0050069 | A1 | 2/2017 | Ky |
| 2017/0050074 | A1 | 2/2017 | Olson |
| 2017/0050102 | A1 | 2/2017 | Kelly |
| 2017/0056711 | A1 | 3/2017 | Dalebout et al. |
| 2017/0056712 | A1 | 3/2017 | Johnson |
| 2017/0056715 | A1 | 3/2017 | Dalebout et al. |

(56) References Cited

U.S. PATENT DOCUMENTS

| | | | |
|---|---|---|---|
| 2017/0056716 | A1 | 3/2017 | Cutler |
| 2017/0056726 | A1 | 3/2017 | Dalebout et al. |
| 2017/0063567 | A1 | 3/2017 | Tanaka et al. |
| 2017/0065187 | A1 | 3/2017 | Hsieh et al. |
| 2017/0065851 | A1 | 3/2017 | Deluca et al. |
| 2017/0065852 | A1 | 3/2017 | Cygan et al. |
| 2017/0065947 | A1 | 3/2017 | Haney et al. |
| 2017/0068782 | A1 | 3/2017 | Pillai et al. |
| 2017/0082983 | A1 | 3/2017 | Katzer et al. |
| 2017/0093451 | A1 | 3/2017 | Chen et al. |
| 2017/0097717 | A1 | 4/2017 | Anisetti et al. |
| 2017/0100636 | A1 | 4/2017 | Umetsu et al. |
| 2017/0104425 | A1 | 4/2017 | Meloche et al. |
| 2017/0106227 | A1 | 4/2017 | Lalaoua |
| 2017/0106240 | A1 | 4/2017 | Chuang |
| 2017/0113093 | A1 | 4/2017 | Bellavista et al. |
| 2017/0120102 | A1 | 5/2017 | Chen |
| 2017/0128783 | A1 | 5/2017 | Hasegawa et al. |
| 2017/0128784 | A1 | 5/2017 | Molins et al. |
| 2017/0136280 | A1 | 5/2017 | Lee |
| 2017/0136288 | A1 | 5/2017 | Huang |
| 2017/0136289 | A1 | 5/2017 | Frank |
| 2017/0136293 | A1 | 5/2017 | Caccia |
| 2017/0136301 | A1 | 5/2017 | Cameron |
| 2017/0136339 | A1 | 5/2017 | Habiche |
| 2017/0144051 | A1 | 5/2017 | Oleson et al. |
| 2017/0164876 | A1 | 6/2017 | Hyde et al. |
| 2017/0165523 | A1 | 6/2017 | Chou |
| 2017/0165552 | A1 | 6/2017 | Martin |
| 2017/0173394 | A1 | 6/2017 | Rider et al. |
| 2017/0180535 | A1 | 6/2017 | Esenwein et al. |
| 2017/0189745 | A1 | 7/2017 | Hamilton et al. |
| 2017/0193578 | A1 | 7/2017 | Watterson |
| 2017/0197103 | A1 | 7/2017 | Rau et al. |
| 2017/0197106 | A1 | 7/2017 | Dalebout et al. |
| 2017/0216660 | A1 | 8/2017 | Lernihan |
| 2017/0225034 | A1 | 8/2017 | Kass et al. |
| 2017/0235922 | A1 | 8/2017 | Weast et al. |
| 2017/0239509 | A1 | 8/2017 | Wang |
| 2017/0252599 | A1 | 9/2017 | Wang |
| 2017/0252623 | A1 | 9/2017 | Sharifi |
| 2017/0252641 | A1 | 9/2017 | Morimura et al. |
| 2017/0266481 | A1 | 9/2017 | Dalebout |
| 2017/0266483 | A1 | 9/2017 | Dalebout et al. |
| 2017/0266503 | A1 | 9/2017 | Watterson et al. |
| 2017/0266532 | A1 | 9/2017 | Watterson |
| 2017/0266533 | A1 | 9/2017 | Dalebout et al. |
| 2017/0266534 | A1 | 9/2017 | Watterson |
| 2017/0266535 | A1 | 9/2017 | Watterson |
| 2017/0270820 | A1 | 9/2017 | Ashby |
| 2017/0274237 | A1 | 9/2017 | Chang |
| 2017/0274242 | A1 | 9/2017 | Corbalis |
| 2017/0311817 | A9 | 11/2017 | Hsieh et al. |
| 2017/0312580 | A1 | 11/2017 | Chang |
| 2017/0319906 | A1 | 11/2017 | Chang et al. |
| 2017/0326411 | A1 | 11/2017 | Watterson |
| 2017/0333755 | A1 | 11/2017 | Rider |
| 2017/0340917 | A1 | 11/2017 | Chang |
| 2017/0354846 | A1 | 12/2017 | Von Rueckmann |
| 2017/0361145 | A1 | 12/2017 | Olson et al. |
| 2017/0364661 | A1 | 12/2017 | Hamilton, II et al. |
| 2017/0365048 | A1 | 12/2017 | Hamilton, II et al. |
| 2017/0367480 | A1 | 12/2017 | Dickerson et al. |
| 2017/0368442 | A1 | 12/2017 | Baudhuin |
| 2018/0001135 | A1 | 1/2018 | Powell |
| 2018/0008865 | A9 | 1/2018 | Lannon et al. |
| 2018/0036572 | A1 | 2/2018 | Hsu |
| 2018/0036585 | A1 | 2/2018 | Powell |
| 2018/0056111 | A1 | 3/2018 | Chiang et al. |
| 2018/0084817 | A1 | 3/2018 | Capell et al. |
| 2018/0085622 | A1 | 3/2018 | Ivan et al. |
| 2018/0085630 | A1 | 3/2018 | Capell et al. |
| 2018/0085654 | A1 | 3/2018 | Black et al. |
| 2018/0089396 | A1 | 3/2018 | Capell et al. |
| 2018/0092603 | A1 | 4/2018 | Duan et al. |
| 2018/0099116 | A1 | 4/2018 | Ashby |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0099184 | A1 | 4/2018 | Eder |
| 2018/0099205 | A1 | 4/2018 | Watterson |
| 2018/0104533 | A1 | 4/2018 | Powell et al. |
| 2018/0109838 | A1 | 4/2018 | Garcia et al. |
| 2018/0111018 | A1 | 4/2018 | Lee |
| 2018/0111034 | A1 | 4/2018 | Watterson |
| 2018/0116599 | A1 | 5/2018 | Bastide et al. |
| 2018/0117383 | A1 | 5/2018 | Workman |
| 2018/0117385 | A1 | 5/2018 | Watterson et al. |
| 2018/0117388 | A1 | 5/2018 | Porter et al. |
| 2018/0117419 | A1 | 5/2018 | Jackson |
| 2018/0140886 | A1 | 5/2018 | Hetrick et al. |
| 2018/0154205 | A1 | 6/2018 | Watterson |
| 2018/0154206 | A1 | 6/2018 | Kim |
| 2018/0256933 | A1 | 9/2018 | Olson et al. |

FOREIGN PATENT DOCUMENTS

| | | | |
|---|---|---|---|
| CN | 1658929 | | 8/2005 |
| CN | 1708333 | | 12/2005 |
| CN | 201516258 | | 6/2010 |
| CN | 201410258 | y | 2/2014 |
| CN | 10488413 | | 9/2015 |
| CN | 105848733 | | 8/2016 |
| EP | 2969058 | | 1/2016 |
| EP | 3086865 | A1 | 11/2016 |
| JP | 2013543749 | | 12/2013 |
| SU | 1533710 | | 1/1990 |
| WO | 1997006859 | | 2/1997 |
| WO | 2002053234 | A1 | 7/2002 |
| WO | WO 02-053234 | | 7/2002 |
| WO | 2007015096 | A3 | 2/2007 |
| WO | 2014153158 | | 9/2014 |
| WO | 2015/100429 | | 7/2015 |

OTHER PUBLICATIONS

International Search Report issued for PCT/US2015/034665 dated Oct. 8, 2015.

U.S. Appl. No. 61/920,834 filed Dec. 26, 2013, filed "Magnetic Resistance Mechanism in a Cable Machine", 31 pages.

Exxentric, Movie Archives, obtained from the Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *Icon Health & Fitness, Inc.*, Civil Case No. IPR2017-01363, Petition for Inter Partes Review of U.S. Pat. No. 9,403,047, filed May 5, 2017; 76 pages (paper 2).

*Nautilus, Inc.* v. *Icon Health & Fitness, Inc.*, Civil Case No. IPR2017-01363, Petitioner's Power of Attorney, filed May 5, 2017, 2 pages (paper 2).

*Nautilus, Inc.* v. *Icon Health & Fitness, Inc.*, Civil Case No. IPR2017-01363, Mandatory Notice to Patent Owner, filed May 19, 2017, 4 pages (paper 3).

*Nautilus, Inc.* v. *Icon Health & Fitness, Inc.*, Civil Case No. IPR2017-01363, Power of Attorney, filed May 19, 2017, 3 pages (paper 4).

*Nautilus, Inc.* v. *Icon Health & Fitness, Inc.*, Civil Case No. IPR2017-01363, Notice of Accord Filing Date, filed Jun. 9, 2017, 5 pages (paper 5).

U.S. Appl. No. 61/786,007 filed Mar. 14, 2013, titled "Strength Training Apparatus with Flywheel and Related Methods", 28 pages.

International Search Report & Written Opinion for PCT Application No. PCT/US2014/029353, dated Aug. 4, 2014, 9 pages.

Supplemental European Search Report for European Application No. 14768130, dated Oct. 11, 2016, 9 pages.

U.S. Appl. No. 15/472,954, filed Mar. 29, 2017, titled "Strength Tarining Apparatus with Flywheel and Related Methods", 22 pages.

(56) References Cited

OTHER PUBLICATIONS

U.S. Appl. No. 15/975,496, filed May 10, 2018, titled "Magnetic Resistance Mechanism in a Cable Machine", 36 pages.
*Nautilus, Inc.* v. *Icon Health & Fitness, Inc.*, Civil Case No. IPR2017-01407, Petition for Inter Partes Review of U.S. Pat. No. 9,616,276 (Claims 1-4, 7-10), filed May 5, 2017.
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01407, Petition for Inter Partes Review of U.S. Pat. No. 9,616,276 (Claims 1-20) filed May 5, 2017.
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 datedn Jun. 2, 2017.
*Nautilus, Inc.* v. *ICON Health & Fitness, Inc.*, Civil Case No. IPR2017-01363, Declaration of Tyson Hottinger in Support of Motion for Admission PRO HAC VICEe, filed Feb. 1, 2018 (Ex 2001).
*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of Inter Partes Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).
*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, Order Conduct of Proceedings 37 C.F.R. Sec 42.5, filed Apr. 27, 2018 (Paper 18).
*Nautilus, Inc.* v. *ICON Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01408, U.S. Appl. No. 13/754,361 (Patent Owner Ex. 2009).
*Nautilus, Inc.* v. *ICON Health & Fitness, Inc.*, Civil Case No. IPR2017-01408, Webster Dictionary p. 2211 (Merriam-Webster, Inc. 1961, 2002) (Ex. 3001).
*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of Inter Partes Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, Order Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for PRO HAC VICE Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for PRO HAC VICE Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, Order Conduct of Proceedings, filed Apr. 27, 2018 (Paper 19).
*Nautilus, Inc.* v. *ICON Health & Fitness, Inc.*, Civil Case No. IPR2017-01408, Order Conduct of Proceedings, filed May 7, 2018 (Paper 20).
*Nautilus, Inc.* v. *ICON Health & Fitness, Inc.*, Civil Case No. IPR2017-01363, Petitioner's Reply in Support of Petition for Inter Partes Review; filed Jun. 4, 2018; 18 pages (paper 21).
*Nautilus, Inc.* v. *ICON Health & Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *ICON Health & Fitness, Inc.*, Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).

(56) References Cited

OTHER PUBLICATIONS

*Nautilus, Inc.* v. *ICON Health & Fitness, Inc.*, Civil Case No. IPR2017-01363, Order granting Motion for Pro Hac Vice Admission—37 C.F.R. 42.10(c), filed Jun. 14, 2018; 4 pages (paper 23).
*Nautilus, Inc.* v. *ICON Health & Fitness, Inc.*, Civil Case No. IPR2017-01363, Petitioner's Updated Mandatory Notices, filed Jun. 20, 2018; 4 pages (paper 24).
*Nautilus, Inc.* v. *ICON Health & Fitness, Inc.*, Civil Case No. IPR2017-01363, Petitioner's Updated Power of Attorney, filed Jun. 20, 2018; 3 pages (paper 25).
*Nautilus, Inc.* v. *ICON Health & Fitness, Inc.*, Civil Case No. IPR2017-01363, Petitioner's Request for Oral Argument, filed Jul. 25, 2018; 4 pages (paper 26).
*Nautilus, Inc.* v. *ICON Health & Fitness, Inc.*, Civil Case No. IPR2017-01363, Patent Owner's Request for Oral Argument, filed Jul. 25, 2018; 4 pages (paper 27).
*Nautilus, Inc.* v. *ICON Health & Fitness, Inc.*, Civil Case No. IPR2017-01363, Order 37 C.F.R. 42.70, filed Aug. 14, 2018, 5 pages (paper 28).
*Nautilus, Inc.* v. *ICON Health & Fitness, Inc.*, Civil Case No. IPR2017-01363, Current Exhibit List of Patent Owner, filed Aug. 24, 2018, 3 pages (paper 29).
*Nautilus, Inc.* v. *ICON Health & Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *ICON Health & Fitness, Inc.*, Civil Case No. IPR2017-01363, Petitioner's Updated Exhibit List, filed Aug. 24, 2018, 4 pages (paper 31).
*Nautilus, Inc.* v. *ICON Health & Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *ICON Health & Fitness, Inc.*, Civil Case No. IPR2017-01363; Patent Owner Demonstrative Exhibits; filed Aug. 24, 2018, 10 pages (exhibit 2003).
*Nautilus, Inc.* v. *ICON Health & Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *ICON Health & Fitness, Inc.*, Civil Case No. IPR2017-01407, Patent Owner's Objections to Evidence, filed Jun. 7, 2018, 5 pages (paper 22).
*Nautilus, Inc.* v. *ICON Health & Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *ICON Health & Fitness, Inc.*, Civil Case No. IPR2017-01407, Order—Granting Motion for Pro Hac Vice Admission, filed Jun. 14, 2018, 4 pages (paper 24).
*Nautilus, Inc.* v. *ICON Health & Fitness, Inc.*, Civil Case No. IPR2017-01407, Petitioner's Updated Mandatory Notices, filed Jun. 20, 2018, 4 pages, (paper 25).
*Nautilus, Inc.* v. *ICON Health & Fitness, Inc.*, Civil Case No. IPR2017-01407, Petitioner's Updated Power of Attorney, filed Jun. 20, 2018, 3 pages, (paper 26).
*Nautilus, Inc.* v. *ICON Health & Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *ICON Health & Fitness, Inc.*, Civil Case No. IPR2017-01407, Current Exhibit List for Patent Owner, filed Jul. 5, 2018, 4 pages, (paper 28).
*Nautilus, Inc.* v. *ICON Health & Fitness, Inc.*, Civil Case No. IPR2017-01407, Patent Owners Updated Mandatory Notices, filed Jul. 5, 2018, 4 pages, (paper 29).
*Nautilus, Inc.* v. *ICON Health & Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *ICON Health & Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *ICON Health & Fitness, Inc.*, Civil Case No. IPR2017-01407, Petitioner's Objections to Evidence, filed Jul. 12, 2018, 4 pages (paper 32).
*Nautilus, Inc.* v. *ICON Health & Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *ICON Health & Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *ICON Health & Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *ICON Health & Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *ICON Health & Fitness, Inc.*, Civil Case No. IPR2017-01407, Order Conduct of the Proceeding, filed Aug. 7, 2018, 4 pages (paper 37).
*Nautilus, Inc.* v. *ICON Health & Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *ICON Health & Fitness, Inc.*, Civil Case No. IPR2017-01407, Patent Owner's Request for Oral Argument, filed Aug. 10, 2018, 4 pages, (paper 39).
*Nautilus, Inc.* v. *ICON Health & Fitness, Inc.*, Civil Case No. IPR2017-01407, Petitioner's Request for Oral Argument, filed Aug. 10, 2018, 4 pages, (paper 40).
*Nautilus, Inc.* v. *ICON Health & Fitness, Inc.*, Civil Case No. IPR2017-01407, Patent Owner's Motion to Exclude Evidence, filed Aug. 10, 2018, 11 pages (paper 41).
*Nautilus, Inc.* v. *ICON Health & Fitness, Inc.*, Civil Case No. IPR2017-01407, Order 37 C.F.R. 42.70, filed Aug. 14, 2018, 5 pages (paper 42).
*Nautilus, Inc.* v. *ICON Health & Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *ICON Health & Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *ICON Health & Fitness, Inc.*, Civil Case No. IPR2017-01407, Current Exhibit List of Patent Owner, filed Aug. 24, 2018, 4 pages (paper 46).
*Nautilus, Inc.* v. *ICON Health & Fitness, Inc.*, Civil Case No. IPR2017-01407, Order re PO Sur-Rebuttal at Hearing, filed Aug. 24, 2018, 4 pages (paper 47).
*Nautilus, Inc.* v. *ICON Health & Fitness, Inc.*, Civil Case No. IPR2017-01407, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01407, Exhibit 1013—U.S. Pat. No. 9,044,635 (Lull), filed Jun. 4, 2018, 21 pages.
*Nautilus, Inc.* v. *ICON Health & Fitness, Inc.*, Civil Case No. IPR2017-01407, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01407, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01407, Exhibit 1016—US20120258433A1 (Hope), filed Jun. 4, 2018, 51 pages.
*Nautilus, Inc.* v. *ICON Health & Fitness, Inc.*, Civil Case No. IPR2017-01407, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01407, Exhibit 1020—S. Ganaja Depo Transcript, filed Aug. 1, 2018, 58 pages.

(56) References Cited

OTHER PUBLICATIONS

*Nautilus, Inc.* v. *ICON Health & Fitness, Inc.*, Civil Case No. IPR2017-01407, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *ICON Health & Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *ICON Health & Fitness, Inc.*, Civil Case No. IPR2017-01407, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01407, Exhibit 2014—Patent Owner Demonstrative Exhibits, filed Aug. 24, 2018, 21 pages.
*Nautilus, Inc.* v. *ICON Health & Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *ICON Health & Fitness, Inc.*, Civil Case No. IPR2017-01408, Petitioners Motion for Pro Hac Vice Admission, filed Jun. 6, 2018, 5 pages (paper 22).
*Nautilus, Inc.* v. *ICON Health & Fitness, Inc.*, Civil Case No. IPR2017-01408, Patent Owner's Objections to Evidence, filed Jun. 7, 2018, 5 pags (paper 23).
*Nautilus, Inc.* v. *ICON Health & Fitness, Inc.*, Civil Case No. IPR2017-01408, Declaration R. Lee Rawls, Part 1, dated May 12, 2017, 447 pages, (paper 24).
*Nautilus, Inc.* v. *ICON Health & Fitness, Inc.*, Civil Case No. IPR2017-01408, Declaration R. Lee Rawls, Part 2, dated May 12, 2017, 216 pages, (paper 24).
*Nautilus, Inc.* v. *ICON Health & Fitness, Inc.*, Civil Case No. IPR2017-01408, Order granting Motion for Pro Hac Vice Admission, filed Jun. 14, 2018, 4 pages (paper 25).
*Nautilus, Inc.* v. *ICON Health & Fitness, Inc.*, Civil Case No. IPR2017-01408, Petitioner's Updated Mandatory Notices, filed Jun. 20, 2018, 4 pages, (paper 26).
*Nautilus, Inc.* v. *ICON Health & Fitness, Inc.*, Civil Case No. IPR2017-01408, Petitioner's Updated Power of Attorney, filed Jun. 20, 2018, 3 pages, (paper 27).
*Nautilus, Inc.* v. *ICON Health & Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *ICON Health & Fitness, Inc.*, Civil Case No. IPR2017-01408, Current Exhibit List of Patent Owner, filed Jul. 5, 2018, 4 pages, (paper 29).
*Nautilus, Inc.* v. *ICON Health & Fitness, Inc.*, Civil Case No. IPR2017-01408, Patent Owner's Updated Mandatory Notices, filed Jul. 5, 2018, 4 pages, (paper 30).
*Nautilus, Inc.* v. *ICON Health & Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *ICON Health & Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *ICON Health & Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *ICON Health & Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *ICON Health & Fitness, Inc.*, Civil Case No. IPR2017-01408, Order—Conduct of the Proceeding, 37 C.F.R. 42.5, filed Jul. 20, 2018, 5 pages (paper 35).
*Nautilus, Inc.* v. *ICON Health & Fitness, Inc.*, Civil Case No. IPR2017-01408, Petitioner's Sur-Reply in Support of Opposition to Patent Owners Motions to Amend, filed Aug. 1, 2018, 19 pages, (paper 36).
*Nautilus, Inc.* v. *ICON Health & Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *ICON Health & Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *ICON Health & Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *ICON Health & Fitness, Inc.*, Civil Case No. IPR2017-01408, Patent Owner's Request for Oral Argument, filed Aug. 10, 2018, 4 pages, (paper 40).
*Nautilus, Inc.* v. *ICON Health & Fitness, Inc.*, Civil Case No. IPR2017-01408, Petitioner's Request for Oral Argument, filed Aug. 10, 2018, 4 pages, (paper 41).
*Nautilus, Inc.* v. *ICON Health & Fitness, Inc.*, Civil Case No. IPR2017-01408, Patent Owner's Motion to Exclude Evidence, filed Aug. 10, 2018, 11 pages (paper 42).
*Nautilus, Inc.* v. *ICON Health & Fitness, Inc.*, Civil Case No. IPR2017-01408, Order—Oral Hearing 37 C.F.R. 42.70, filed Aug. 14, 2018, 5 pages (paper 43).
*Nautilus, Inc.* v. *ICON Health & Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *ICON Health & Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *ICON Health & Fitness, Inc.*, Civil Case No. IPR2017-01408, Current Exhibit List of Patent Owner, filed Aug. 24, 2018, 4 pages (paper 47).
*Nautilus, Inc.* v. *ICON Health & Fitness, Inc.*, Civil Case No. IPR2017-01408, Order Conduct of the Proceedings—37 C.F.R. 42.5, filed Aug. 24, 2018, 4 pages, (paper 48).
*Nautilus, Inc.* v. *ICON Health & Fitness, Inc.*, Civil Case No. IPR2017-01408, Petitioner's Updated Exhibit List, filed Aug. 24, 2018, 5 pages, (paper 49).
*Nautilus, Inc.* v. *ICON Health & Fitness, Inc.*, Civil Case No. IPR2017-01408, Exhibit 1012—U.S. Pat. No. 8,585,561 (Watt), filed Jun. 4, 2018, 32 pages.
*Nautilus, Inc.* v. *ICON Health & Fitness, Inc.*, Civil Case No. IPR2017-01408, Exhibit 1013—U.S. Pat. No. 9,044,635 (Lull), filed Jun. 4, 2018, 21 pages.
*Nautilus, Inc.* v. *ICON Health & Fitness, Inc.*, Civil Case No. IPR2017-01408, Exhibit 1014—U.S. Pat. No. 7,740,563 (Dalebout), filed Jun. 4, 2018, 31 pages.
*Nautilus, Inc.* v. *ICON Health & Fitness, Inc.*, Civil Case No. IPR2017-01408, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01408, Exhibit 1016—US20120258433A1 (Hope), filed Jun. 4, 2018, 51 pages.
*Nautilus, Inc.* v. *ICON Health & Fitness, Inc.*, Civil Case No. IPR2017-01408, Exhibit 1017—U.S. Pat. No. 7,771,320 (Riley), filed Jun. 4, 2018, 44 pages.
*Nautilus, Inc.* v. *ICON Health & Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01408, Exhibit 1020—Scott Ganaja Depo Transcript, filed Aug. 1, 2018, 58 pages.
*Nautilus, Inc.* v. *ICON Health & Fitness, Inc.*, Civil Case No. IPR2017-01408, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.

(56) References Cited

OTHER PUBLICATIONS

*Nautilus, Inc.* v. *ICON Health & Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.

*Nautilus, Inc.* v. *ICON Health & Fitness, Inc.*, Civil Case No. IPR2017-01408, Exhibit 2013—Cox, Christopher Depo Transcript Jun. 26, 2018, filed Jul. 5, 2018, 26 pages.

*Nautilus, Inc.* v. *ICON Health & Fitness, Inc.*, Civil Case No. IPR2017-01408, Exhibit 2014—Patent Owner's Demonstrative Exhibits, filed Aug. 24, 2018, 21 pages.

European Patent Office, Article 94(3) EPC Communication dated Jul. 10, 2018, issued in European Patent Application No. 14768130.8-1126, 3 pages.

United States Patent and Trademark Office; International Search Report and Written Opinion issued in application No. PCT/US2015/034665; dated Oct. 8, 2015 (14 pages).

*Nautilus, Inc.* v. *ICON Health & Fitness, Inc.*, Civil Case No's. IPR2017-01363, Record of Oral Hearing held Aug. 29, 2018; (paper 32) 104 pages.

*Nautilus, Inc.* v. *ICON Health & Fitness, Inc.*, Civil Case No. IPR2017-01363, Final Written Decision dated Nov. 28, 2018; (paper 33) 29 pages.

*Nautilus, Inc.* v. *ICON Health & Fitness, Inc.*, Civil Case No. IPR2017-01407—Petitioner's Updated Exhibit List, filed Aug. 24, 2018, (paper 48) 5 pages.

*Nautilus, Inc.* v. *ICON Health & Fitness, Inc.*, Civil Case No's. IPR2017-01407, Record of Oral Hearing held Aug. 29, 2018; (paper 49) 104 pages.

*Nautilus, Inc.* v. *ICON Health & Fitness, Inc.*, Civil Case No's. IPR2017-01407, Final Written Decision dated Dec. 3, 2018; (paper 50) 81 pages.

*Nautilus, Inc.* v. *ICON Health & Fitness, Inc.*, Civil Case No's. IPR2017-01408, Record of Oral Hearing held Aug. 29, 2018; (paper 50) 104 pages.

*Nautilus, Inc.* v. *ICON Health & Fitness, Inc.*, Civil Case No's. IPR2017-01408, Final Written Decision dated Dec. 3, 2018; (paper 51) 82 pages.

* cited by examiner

CABLE SYSTEM INCORPORATED INTO A TREADMILL

RELATED APPLICATIONS

This application claims priority to provisional Patent Application No. 62/009,607 titled "Cable System Incorporated Into a Treadmill" filed Jun. 9, 2014, which application is hereby incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or at home. Often, a user will use an aerobic exercise machine to have an aerobic workout indoors. One such type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and is within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include ellipticals, rowing machines, stepper machines, and stationary bikes, to name a few.

One type of treadmill is disclosed in U.S. Pat. No. 5,527,245 issued to William T. Dalebout, et al. In this reference, an aerobic and anaerobic treadmill exercise system includes a treadmill apparatus, an independent upper body exercise apparatus and an independent lower body exercise apparatus. The independent upper body exercise apparatus and lower body exercise apparatus are integrally connected to the treadmill, forming a unified exercise apparatus system. The upper body exercise apparatus may comprise independently movable arms used in conjunction with the treadmill for push-pull exercises or for butterfly-type exercises, an arm lift exercise apparatus, or an overhead pull type exercise apparatus. The lower body exercise apparatus may be a pull type apparatus. An adjustable cable resistance system is interconnected to the independent upper exercise apparatus and lower body exercise apparatus. Another type of treadmill is described in U.S. Pat. No. 8,398,529 issued to Joseph K. Ellis.

SUMMARY

In one aspect of the invention, a treadmill includes an opening formed in a surface of a running deck.

In one aspect of the invention, the treadmill includes a resistance mechanism incorporated into the running deck.

In one aspect of the invention, the treadmill includes a cable threaded through the opening where the cable comprises a resistance end connected to the resistance mechanism and a pull end accessible through the running deck.

In one aspect of the invention, the resistance mechanism is a magnetic resistance mechanism.

In one aspect of the invention, the opening is formed in a corner of the running deck.

In one aspect of the invention, the surface is configured to support a user.

In one aspect of the invention, the resistance mechanism is disposed within the running deck.

In one aspect of the invention, the running deck comprises a deck frame and at least one pulley positioned to route the cable within the running deck that is connected to the deck frame.

In one aspect of the invention, the treadmill comprises a motor that drives a tread belt of the running deck.

In one aspect of the invention, the pull end of the cable comprises a handle attachment.

In one aspect of the invention, the running deck is arranged to transition between a running orientation and a storage orientation about a pivot mechanism.

In one aspect of the invention, the pivot mechanism comprises an axle that supports a portion of the weight of the running deck.

In one aspect of the invention, the treadmill includes a first end of the axle that is configured to move within a first track formed along a first length of a first frame post of the treadmill and a second end of the axle that is configured to move within a second track formed along a second length of a second frame post of the treadmill.

In one aspect of the invention, the first end comprises a first gear shaped to intermesh with a first rack of the first track and the second end comprises a second gear shaped to intermesh with a second rack of the second track.

In one aspect of the invention, the pull end is positioned to allow a user to pull the cable while the running deck is in the running orientation.

In one aspect of the invention, the pull end is positioned to allow a user to pull the cable while the running deck is in the running orientation.

In one aspect of the invention, a treadmill includes an opening formed in a surface of a running deck where the surface is configured to support a user when the running deck is oriented in a running orientation.

In one aspect of the invention, the treadmill includes a magnetic resistance mechanism disposed within the running deck.

In one aspect of the invention, the treadmill includes a cable threaded through the opening where the cable comprises a resistance end connected to the resistance mechanism and a pull end accessible through the running deck.

In one aspect of the invention, the running deck is arranged to transition between the running orientation and a storage orientation.

In one aspect of the invention, the pull end is arranged to allow the user to pull the cable with the running deck in either the running orientation or the storage orientation.

In one aspect of the invention, the running deck comprises a deck frame and at least one pulley positioned to route the cable within the running deck that is connected to the deck frame.

In one aspect of the invention, the pull end of the cable comprises a handle attachment.

In one aspect of the invention, the running deck is arranged to transition between the running orientation and the storage orientation about a pivot mechanism.

In one aspect of the invention, the pivot mechanism comprises an axle that supports a portion of the weight of the running deck.

In one aspect of the invention, a treadmill includes an opening formed in a corner of a surface of a running deck where the surface is configured to support a user when the running deck is oriented in a running orientation.

In one aspect of the invention, the treadmill includes a motor that drives a tread belt of the running deck.

In one aspect of the invention, the treadmill includes a magnetic resistance mechanism disposed within the running deck.

In one aspect of the invention, the running deck comprises a deck frame and at least one pulley positioned to route the cable within the running deck that is connected to the deck frame.

In one aspect of the invention, the treadmill includes a cable threaded through the opening where the cable comprises a resistance end connected to the resistance mechanism and a pull end accessible through the running deck.

In one aspect of the invention, the pull end of the cable comprises a handle attachment.

In one aspect of the invention, the running deck is arranged to transition between the running orientation and a storage orientation about a pivot mechanism.

In one aspect of the invention, the pivot mechanism comprises an axle that supports a portion of the weight of the running deck.

In one aspect of the invention, the treadmill includes a first end of the axle that is configured to move within a first track formed along a first length of a first frame post of the treadmill and a second end of the axle that is configured to move within a second track formed along a second length of a second frame post of the treadmill.

In one aspect of the invention, the first end comprises a first gear shaped to intermesh with a first rack of the first track and the second end comprises a second gear shaped to intermesh with a second rack of the second track.

In one aspect of the invention, the pull end is arranged to allow the user to pull the cable with the running deck in either the running orientation or the storage orientation.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The principles described herein include a treadmill that has a running deck configured to reside in a running orientation and a storage orientation. A pull cable and a pull cable resistance mechanism are also incorporated into the running deck. An opening in a running side of the running deck positions pull ends of the pull cable so that a user can pull the cables regardless of whether the running deck is in the running orientation or the storage orientation. For purposes of this application, the running side of the running deck includes any component of the running deck that is located on the same side of the running deck on which the user can walk or run. Such a running side includes rails, housing elements, structural elements and so forth incorporated into the running deck. A releasable handle may be connected to the cable's pull end to provide an easy grip to the user. The pull cable resistance mechanism resists the pulling force exerted by the user when pulling the pull cable.

Figure 1:
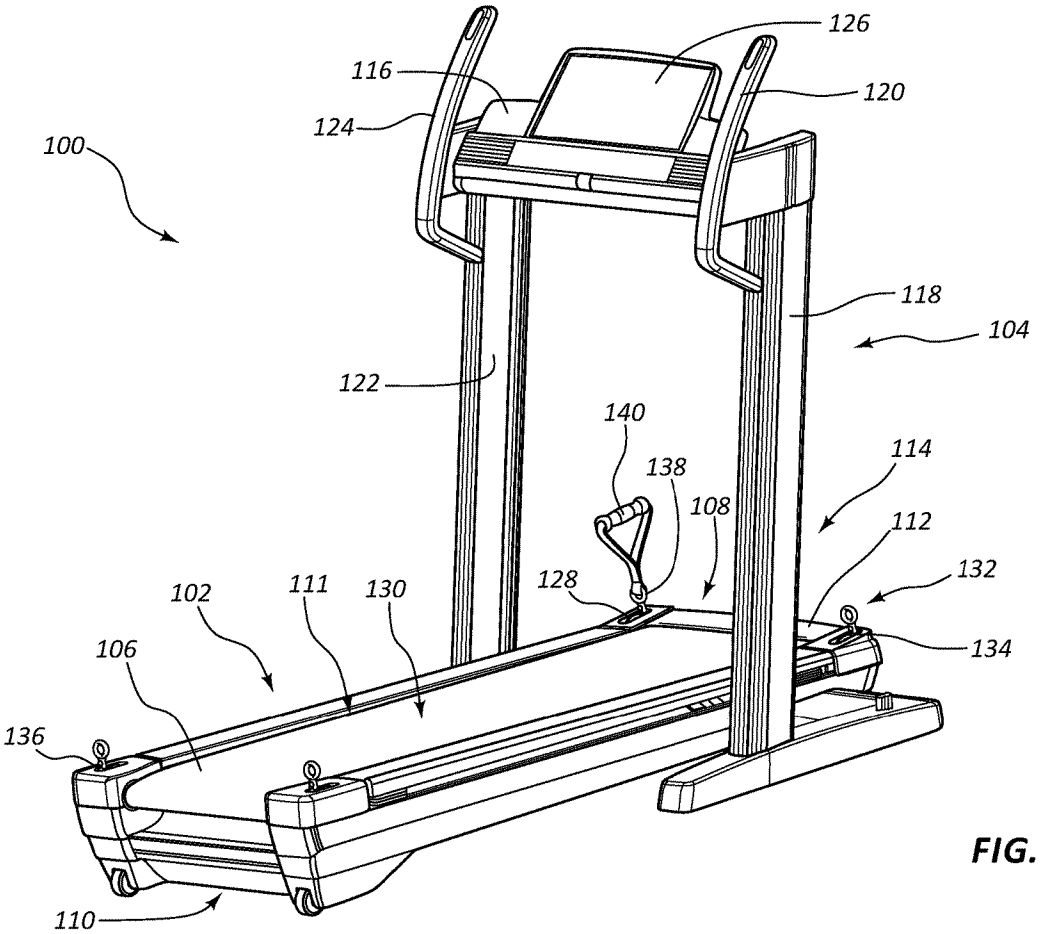
FIG. 1 illustrates a perspective view of an example of a treadmill in accordance with the present disclosure.

Particularly, with reference to the figures, FIG. 1 depicts a treadmill 100. The treadmill 100 includes a running deck 102 that can support the weight of a user and that is attached to a frame 104. The running deck 102 incorporates a tread belt 106 that extends from a first pulley at a first location 108 to a second pulley at a second location 110. The underside of the tread belt's mid-section is supported by a low friction belt support surface 111 that allows the tread belt's underside to move along the mid-section's length without creating significant drag. The tread belt 106 is moved by a motor that is connected to the first pulley and is disposed within a housing 112 formed in a front portion 114 of the running deck 102. As the tread belt 106 moves, a user positioned on the tread belt 106 can walk or run in place by keeping up with the tread belt's speed.

A control console 116 is also supported by the frame 104. In the example of FIG. 1, a first frame post 118 positions a first hand hold 120 near the control console 116, and a second frame post 122 positions a second hand hold 124 near the control console 116 such that a user can support himself or herself during exercise. The control console 116 allows the user to perform a predetermined task while simultaneously operating an exercise mechanism of the treadmill 100 such as control parameters of the running deck 102. For example, the control console 116 may include controls to adjust the speed of the tread belt 106, adjust a volume of a speaker integrated into the treadmill 100, adjust an incline angle of the running deck 102, adjust a decline of the running deck 102, adjust a lateral tilt of the running deck 102, select an exercise setting, control a timer, change a view on a display 126 of the control console 116, monitor the user's heart rate or other physiological parameters during the workout, perform other tasks, or combinations thereof. Buttons, levers, touch screens, voice commands, or other mechanisms may be incorporated into the control console 116 incorporated into the treadmill 100 and can be used to control the capabilities mentioned above. Information relating to these functions may be presented to the user through the display 126. For example, a calorie count, a timer, a distance, a selected program, an incline angle, a decline angle, a lateral tilt angle, another type of information, or combinations thereof may be presented to the user through the display 126.

In the example of FIG. 1, openings 128 are formed in the running side 130 of the running deck 102. A pull end 132 of pull cables 134 are located at the openings 128. Each of the pull cables 134 are routed within the running deck 102 and just the pull ends 132 are accessible through the running deck 102. For example, the pull ends 132 may be located outside of the running deck 102. In some examples, the pull ends 132 may be flush with the running deck 102. In yet other examples, the pull ends 132 may be retracted within the openings 128, but in such an example, the user may be able to reach into the opening 128 to access the pull ends 132, pull an object connected to the pull ends 132 to access the pull ends 132, or retrieve the pull end 132 with another mechanism. Each of the pull cables 134 has a resistance end which is connected to a resistance mechanism located within the running deck 102. As a user pulls on the pull ends 132 of the pull cables 134, the resistance mechanism resists the movement. While this example has been described with reference to openings being formed in the running side 130 of the running deck 102, the openings 128 may be formed in any appropriate location of the running deck 102. For example, the openings 128 may be formed in the sides or the underside of the running deck 102.

The resistance setting may be adjustable through the console 116. Thus, a user may adjust the resistance of the resistance mechanism to a desired level based on the user's strength and goals. The user may perform anaerobic exercises by pulling on the pull cables 134. Thus, the treadmill 100 in the example of FIG. 1 provides the user with an ability to perform both aerobic exercises and anaerobic exercises. Any appropriate type of resistance mechanism may be used. For example, the resistance mechanism may be a magnetic resistance mechanism. Such a magnetic resistance mechanism may provide the desired resistance while the running deck 102 is oriented in a running orientation or a storage orientation. In other examples, the resistance mechanism comprises weights, springs, elastomeric material, other types of resistance mechanisms, or combinations thereof.

The pull end 132 of the pull cables 134 may include a stopper 136 that has a cross sectional thickness greater than the openings 128 to prevent the pull end 132 from going inside of the openings 128. Such a stopper 136 may be a ball, bead, block, another type of shape, or combinations thereof. While this example has been described with a stopper, in other examples, the pull ends 132 do not incorporate a stopper 136. Further, in examples with stoppers 136, the stopper 136 may cause the pull ends 132 to be located outside the running deck 102, inside the running deck 102, flush with a surface of the running deck 102, or combinations thereof.

Also, the pull end 132 may include an eyelet 138 or another type of attachment mechanism that allows a handle 140 to be attached to the pull end 132. In some examples, the user can tie straps of a handle 140 to the eyelet 138 or other type of attachment. In other examples, the user can use a carabineer to connect the handle 140 to the pull end 132. In yet other examples, the user can use a quick release mechanism to attach the handle 140. Some quick release mechanisms may include an ability to snap the handle 140 into the pull end 132. In such an example, the user may release the handles from the pull end 132 by squeezing a release mechanism.

Figure 2:
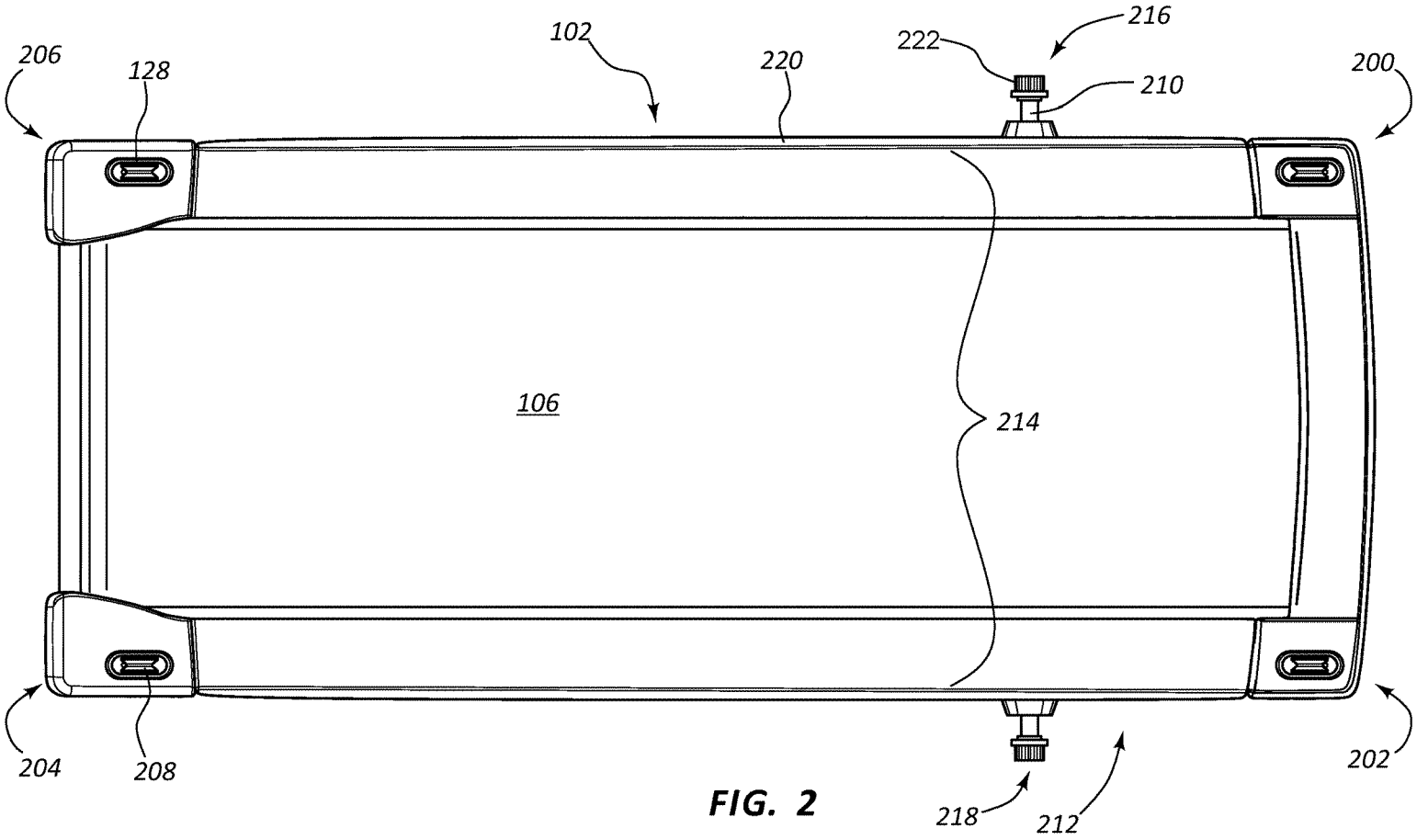
FIG. 2 illustrates a top view of the treadmill depicted in FIG. 1 with a console and frame posts removed.

FIG. 2 illustrates a top view of a treadmill 100 with the console 116 and frame posts 118, 122 removed for illustrative purposes. In this example, an opening 128 is located at a first corner 200, a second corner 202, a third corner 204, and a fourth corner 206 of the running deck 102. A pulley 208 is located within the openings 128 that guides the pull cable 134 as the user pulls.

An axle 210 is positioned in a front section 212 of the running deck 102 that extends beyond the width 214 of the running deck 102. Thus, a first end 216 and a second end 218 of the axle 210 protrude beyond the edges 220 of the running deck 102. The first end 216 and the second end 218 are configured to engage the first frame post 118 and the second frame post 122 through a pinion 222 attached to each of the first end 216 and second end 218. A motor may cause the axle 210 to rotate, which turns the pinions 222 of the first and second ends 216 and 218. When the pinions 222 rotate in a first direction, the pinions 222 climb upwards along a track incorporated into the first and second frame posts 118, 122. When the pinions 222 rotate in a second direction, the pinions 222 descend along the track incorporated into the first and second frame posts 118, 122.

While this example has been described with specific reference to a pinion 222 attached to the ends 216, 218 of the axle 210, any appropriate attachment mechanism may be used in accordance with the principles described in the present disclosure. For example, a racket, a cam assembly, another type of gear, another type of mechanism, of combination thereof may be used.

Figure 3:
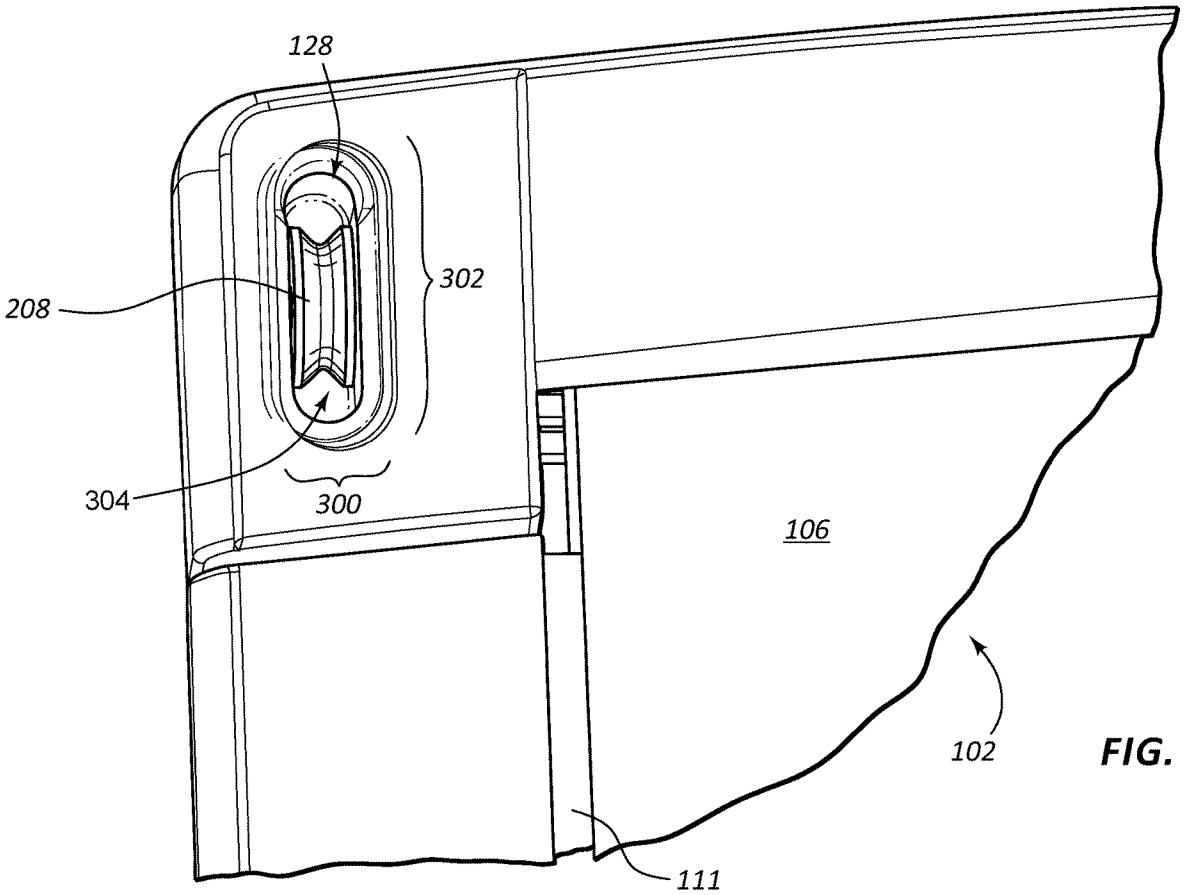
FIG. 3 illustrates a top view of a corner of a running deck of the treadmill depicted in FIG. 1.

FIG. 3 illustrates a top view of a corner 200 of a running deck 102 of the treadmill 100. In this example, the corner 200 includes an opening 128 with a pulley 208 disposed therein. The pulley 208 may rotate as the pull cable 134 moves to reduce friction between the pull cable 134 and the running deck's covering. Further, the pulley 208 may guide the pull cable 134 to move in desirable directions.

The opening 128 may include an opening width 300 and an opening length 302. The opening length 302 may be aligned with the length of the running deck 102. Further, the opening length 302 may be long enough to accommodate the length of the pulley 208 and thickness of the pull cable 134. The opening width 300 is wide enough to accommodate the thickness of the pull cable as well. The pulley 208 includes a V-shaped trough 304 shaped to center the pull cable 134 within the opening 128.

Figure 4:
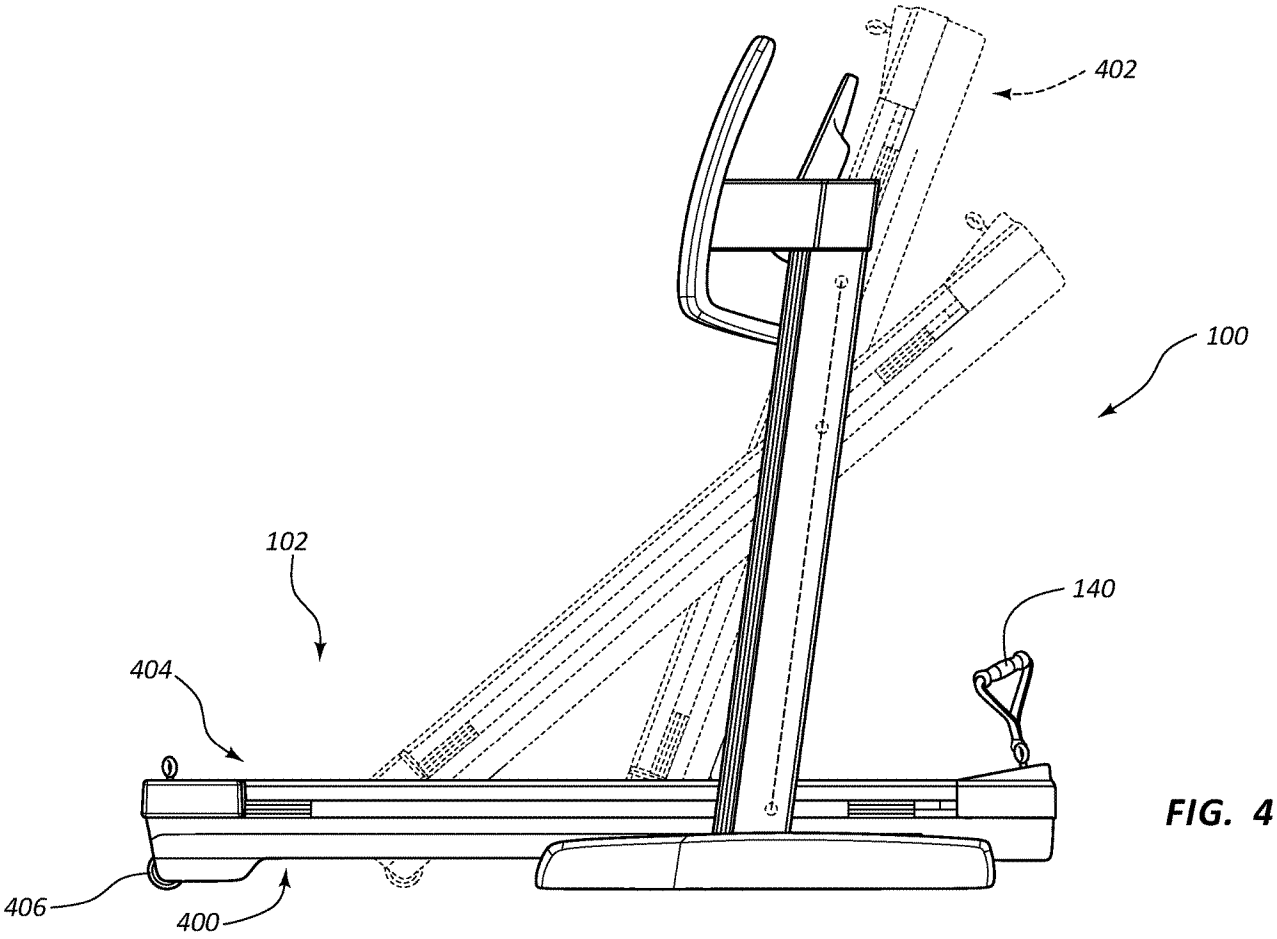
FIG. 4 illustrates a side view of the treadmill depicted in FIG. 1.

FIG. 4 illustrates a side view of a treadmill 100. In this example, the running deck 102 is oriented in a running orientation 400. Such a running orientation 400 orients the running deck so that a user can walk or run in place on the running side 130 of the running deck 102. In some examples, the running deck 102 is substantially parallel with the surface upon which the treadmill 100 is supported while in the running orientation 400. However, in other examples, the running deck is inclined to increase the difficulty of the user's workout while in the running orientation 400.

The axle 210 depicted in the example of FIG. 2 may be incorporated into the treadmill 100 where the axle's first and second ends 216, 218 are connected to the first and second frame posts 118, 122 respectively. The first and second ends 216, 218 of the axle 210 may be connected to the frame posts 118, 122 in such a way that the first and second ends 216, 218 can move along the length of the frame posts 118, 122. For example, the first and second ends 216, 218 may include a pinion gear that moves up or down a toothed track incorporated into the frame posts 118, 122. A motor may rotate the axle 210 to cause pinions (e.g., pinions 222) to engage the track to move the axle 210 in either the up or down direction. As the axle 210 moves, the front section 212 of the running deck 102 moves with the axle 210. Thus, the rotation of the axle 210 can adjust the incline/decline slope of the running deck 102 as well as position the running deck 102 into a storage orientation 402.

The storage orientation 402 may be an orientation of the running deck 102 where the length of the running deck 102 is substantially aligned with the length of the frame posts 118, 122. In such a position, the treadmill 100 takes up less floor space.

As the axle 210 positions the front section 212 of the running deck 102, a rear section 404 of the running deck moves with the front section 212. The rear section 404 is supported by wheels 406 that reduce the friction between the floor and the underside of the running deck 102.

Figure 5:
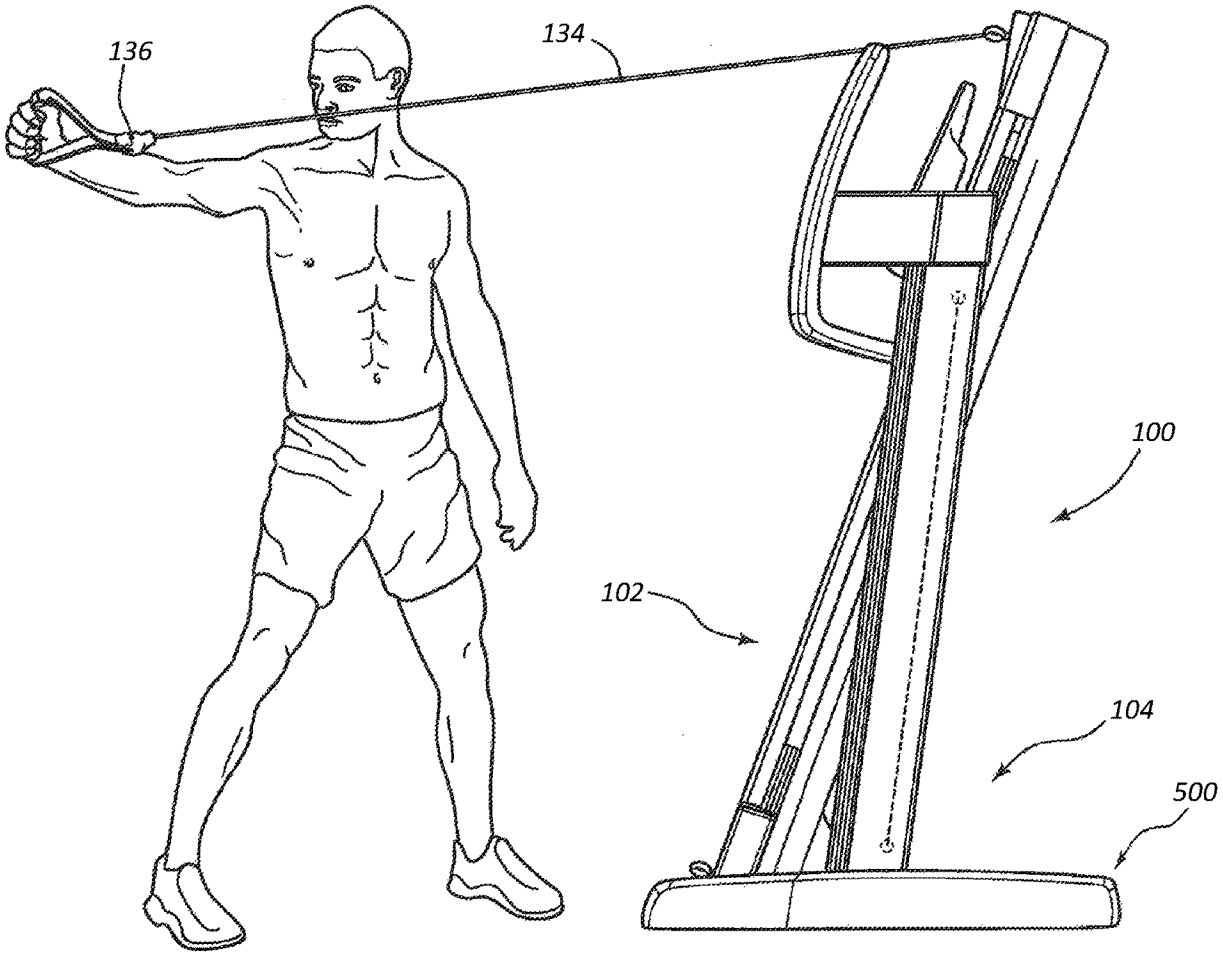
FIG. 5 illustrates a side view of the treadmill depicted in FIG. 1 with a running deck in a storage orientation.

FIG. 5 illustrates a side view of the treadmill 100 with a running deck 102 in a storage orientation 402. With the running deck 102 in the storage orientation 402, the openings 128 position the pull ends 132 of the pull cable 134 at angles that are well suited for a user to work out specific target muscles. For example, the openings 128 formed in the front section 212 of the running deck 102 may be positioned at an appropriate height for the user to pull the pull cable 134 to work out his upper back muscles, tricep muscles, chest muscles, and other muscles.

While the running deck 102 is in the storage orientation 402, the user may attach the handles 140 to any of the pull ends 132 as desired. For example, the user may attach a handle 140 to pull ends 132 that are positioned within in openings 128 formed in the front section 212 or the rear section 404 of the running deck 102. A base 500 of the treadmill may remain stationary as the running deck 102 transitions between the storage orientation 402 and the running orientation 400. The base 500 may have a sufficient weight to keep the running deck upright as the user pulls on the pull cables 134 in situations where the user attaches the handles to the pull ends 132 positioned in the front section while the running deck is in the storage orientation 402. Thus, the weight of the base 500 may stabilize the treadmill 100 as the user performs anaerobic exercises when the running deck 102 is in the storage orientation 402. The pull ends 132 positioned in the rear section 404 are well suited to allowing the user to work out his upper back muscles, bicep muscles, chest muscles, and other muscles when the running deck 102 is in the storage orientation 402.

Figure 6:
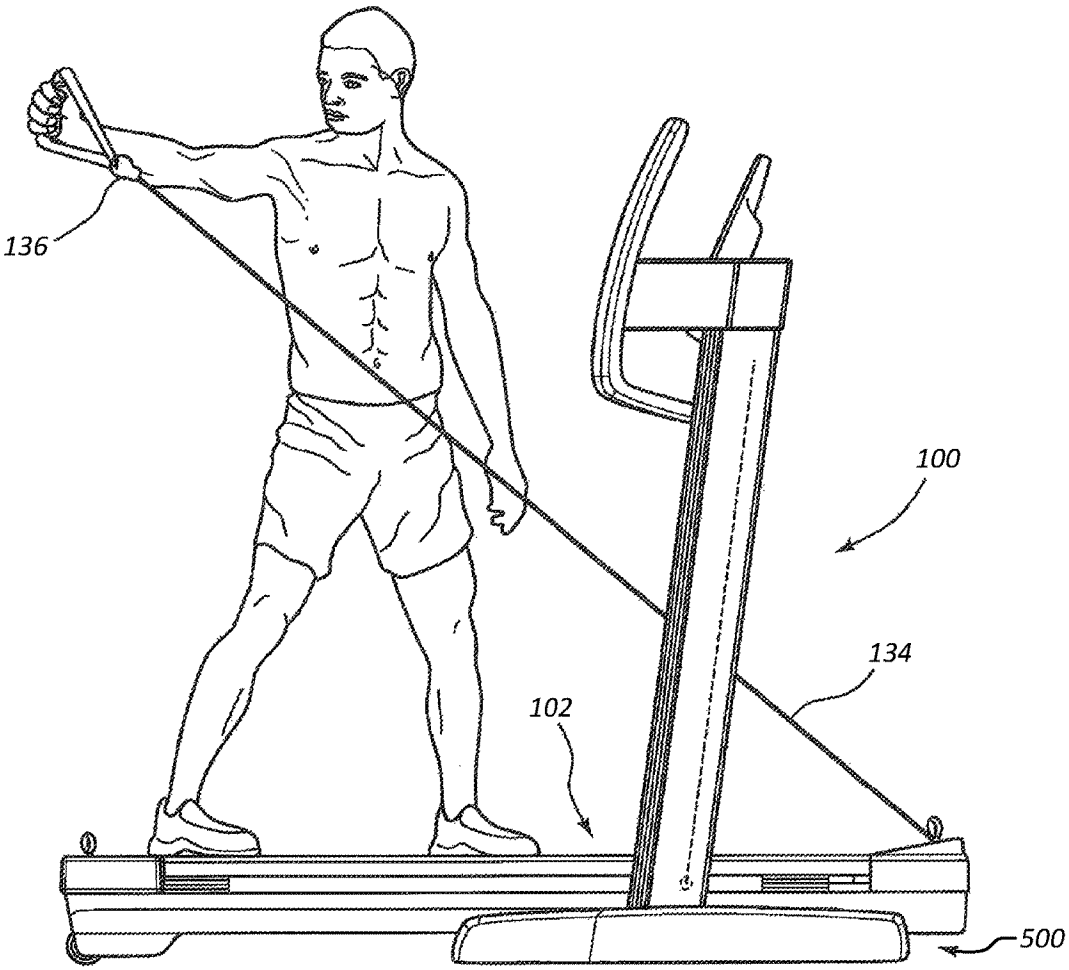
FIG. 6 illustrates a side view of the treadmill depicted in FIG. 1 with a running deck in a running orientation.

FIG. 6 illustrates a side view of the treadmill 100 with a running deck 102 in a running orientation 400. In this example, the user may pull any of the pull cables 134 while standing on the running deck 102. Such an arrangement is convenient for a user who desires to use the pull cables 134 without having to orient the running deck 102 into the storage orientation 402.

Figure 7:
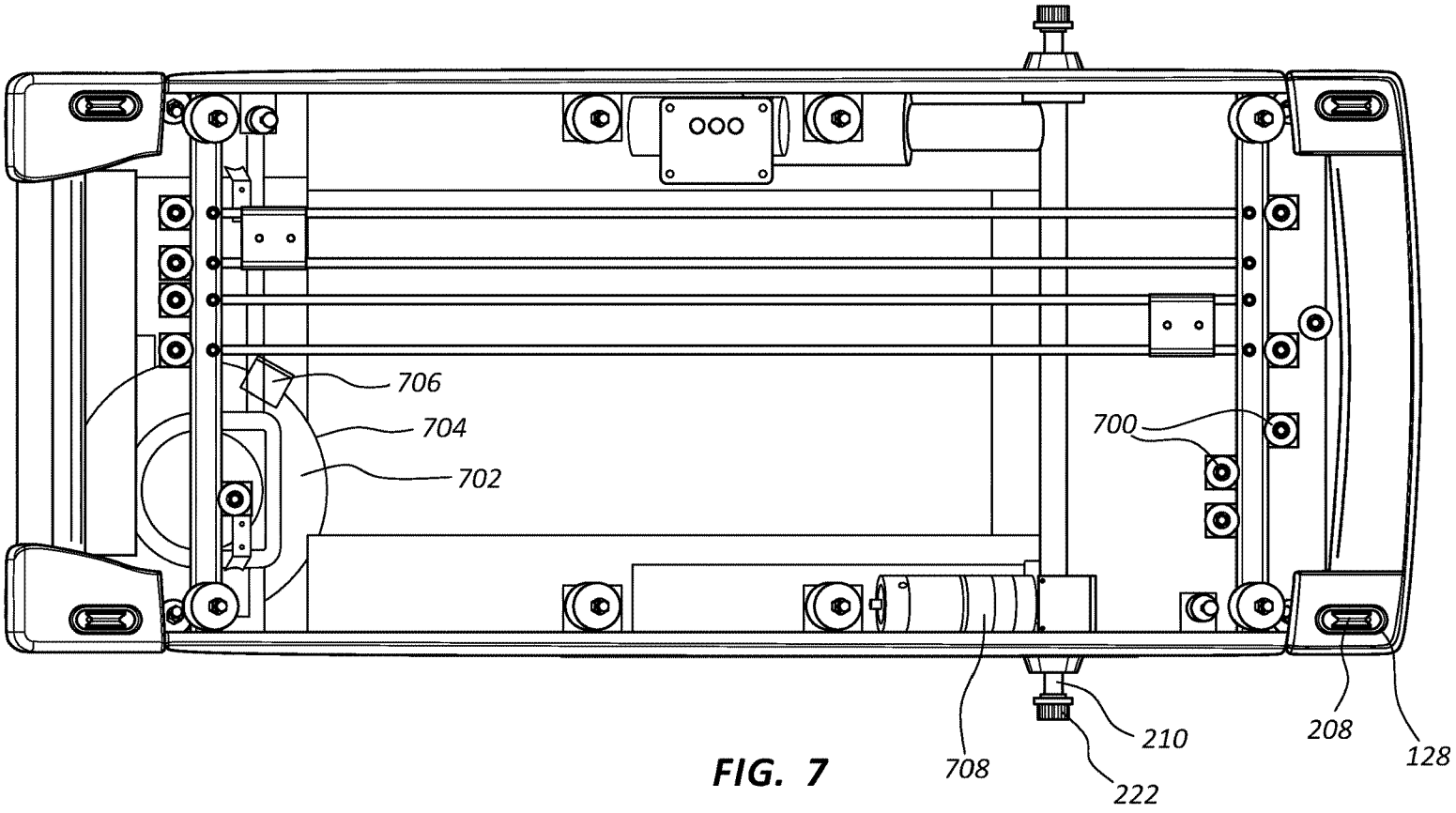
FIG. 7 illustrates a top view of the treadmill depicted in FIG. 1 with a tread belt and a belt support surface removed.

FIG. 7 illustrates a top view of the treadmill 100 with a tread belt 106 and a belt support surface 111 removed. In this example, the openings 128 are positioned in a first corner 200, a second corner 202, a third corner 204, and a fourth corner 206 of the running deck 102. An opening pulley 208 is disposed within each of the openings 128 to guide the pull cables 134 as the user pulls the pull cable 134. Additional internal pulleys 700 are positioned within the running deck 102 that route the pull cables 134 such that the pull ends 132 are positioned at the openings 128 and the resistance ends are attached to the resistance mechanism. In the example of FIG. 7, the pull cables 134 have been removed for illustrative purposes.

In the example of FIG. 7, the resistance mechanism is a magnetic resistance mechanism with a flywheel 702. The flywheel 702 may be made of a magnetically conductive material. In some examples, just a rim 704 or sections of the flywheel 702 are made of magnetically conductive material. An arm 706 is positioned adjacent to the flywheel 702, which is configured with a magnet that is constructed to resist movement of the flywheel 702. As the user pulls one of the pull cables 134, the flywheel 702 rotates. However, the amount of resistance applied to the flywheel 702 depends on the strength of the magnet in the arm 706 and the proximity of the arm 706. In some examples, the resistance is adjusted by adjusting the strength of the magnet. In other examples, the resistance is adjusted by changing the position of the arm 706 to change the arm's proximity to the flywheel 702.

In some examples, the flywheel 702 is oriented to rotate in a single direction. In such situations, the rotations of the flywheel 702 can be counted with a sensor within the running deck 102. Such a flywheel 702 rotation count can be used to determine how many times the flywheel 702 has rotated, how fast the flywheel 702 is rotating, and other parameters about the user's workout. Such parameters may be used to determine an amount of calories burned during the user's workout, the force the user is exerting to pull the pull cables 134, other parameters, or combinations thereof.

A motor 708 may be positioned within the running deck 102 to rotate the axle 210. In some examples, a single motor is used. However, in other examples, multiple motors are used to move the running deck 102.

Figure 8:
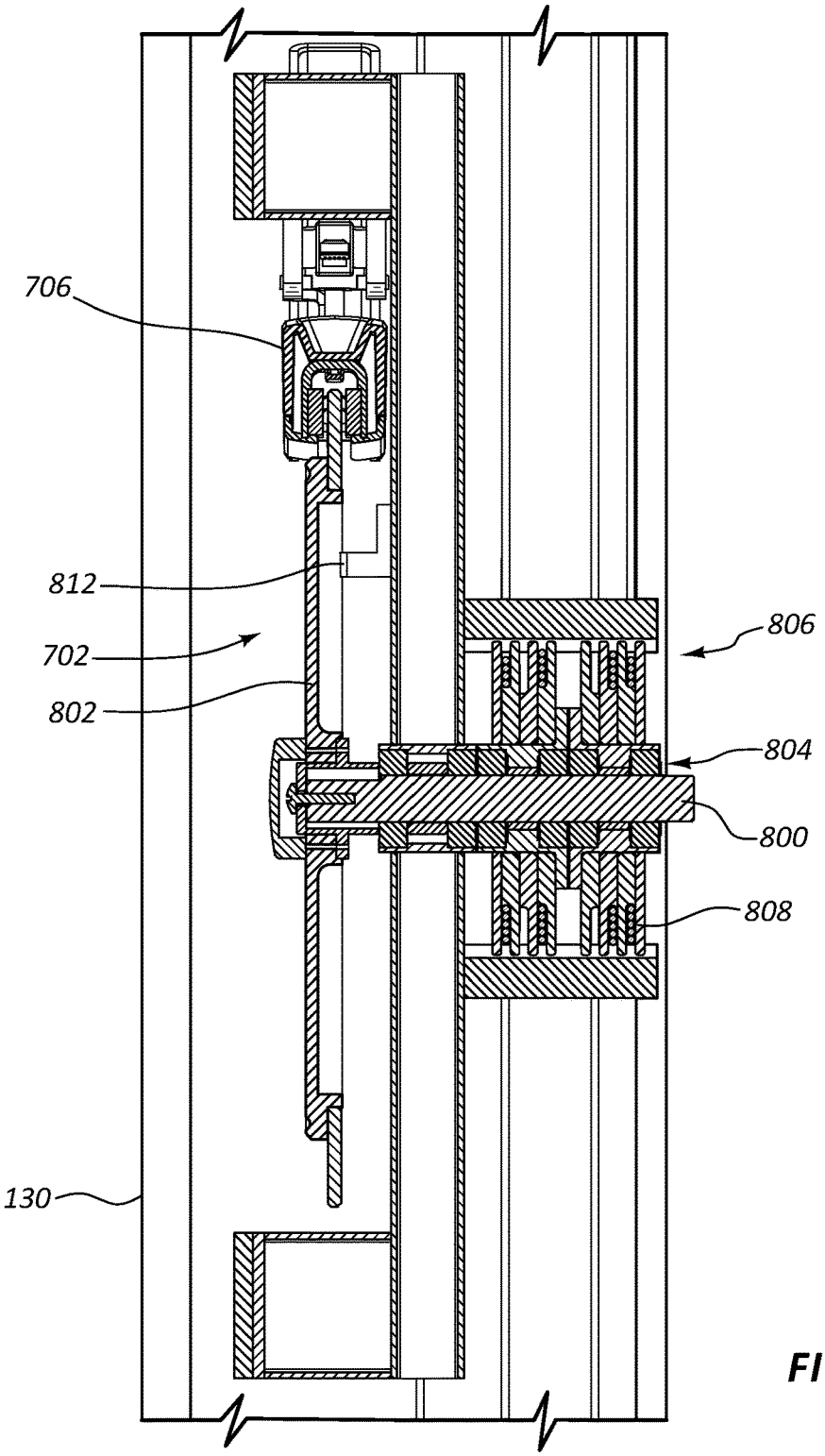
FIG. 8 illustrates a cross sectional view of an example of a resistance mechanism in accordance with the principles described in the present disclosure.

FIG. 8 illustrates a cross sectional view of a resistance mechanism of the treadmill 100. In this example, a central shaft 800 is rigidly connected to a body 802 of the flywheel 702. A bearing subassembly 804 is disposed around the central shaft 800 and is configured to transfer a rotational load imparted in a first direction to the flywheel 702 resulting from a user pulling on the pull cable 134. Concentric to the central shaft 800 and the bearing subassembly 804 is a spool subassembly 806 which is connected to at least one of the pull cables 134.

In a retracted position, a portion of a pull cable 134 connected to the spool subassembly 806 is wound in slots 808 formed in the spool subassembly 806. As the pull cable 134 is pulled by the user during a workout, the pull cable 134 exerts a force tangential to the spool subassembly 806 in the first direction and rotates the spool subassembly 806 in the first direction as the pull cable 134 unwinds. In some examples, a counterweight cable or a spring cable that is also connected to the spool subassembly 806 winds up in the slots 808 of the spool subassembly 806. This motion shortens the available amount of the counterweight cable or the spring cable and causes at least one of the counterweights to be moved or springs to be stretched. In examples with counterweights, when the force on the pull cable ceases, the force of gravity on the counterweight pulls the counterweight back to its original position, which imposes another tangential force in a second direction on the spool subassembly 806, causing it to unwind the counterweight cable in the second direction. The motion of the counterweight cable unwinding causes the pull cable 134 to rewind back into the slots 808 of the spool subassembly 806. This motion pulls the pull cable 134 back into the running deck 102 until the stoppers 136 attached to the pull ends 132 of the pull cables prevent the pull cables from entering the openings 128. In other examples, springs or other mechanisms can be used to retract the pull cables 134 back into the running deck 102.

As the spool subassembly 806 rotates in the first direction, the bearing subassembly 804 is configured to transfer the rotational load from the spool subassembly 806 to the central shaft 800 which transfers the rotational load to the flywheel body 802. As a result, the flywheel 702 rotates with the spool subassembly 806 in the first direction as the user pulls on the pull cables 134. However, as the spool subassembly 806 rotates in the second direction imposed by the counterweights, springs, or other mechanism returning to their original positions, the bearing subassembly 804 is not configured to transfer the rotational load from the spool subassembly 806 to the central shaft 800. Thus, no rotational load is transferred to the flywheel body 802. As a result, the flywheel 702 remains in its rotational orientation as the spool subassembly 806 rotates in the second direction. Consequently, the flywheel 702 moves in just the first direction.

While this example has been described with specific reference to the flywheel 702 rotating in just a single direction, in other examples, the flywheel is configured to rotate in multiple directions. Further, while this example has been described with reference to a specific arrangement of cables, pulleys, counterweights and/or springs, these components of the cable exercise machine 10 may be arranged in other configurations.

A sensor 812 can be arranged to track the rotational position of the flywheel 702. As the flywheel 702 rotates from the movement of the pull cables 134, the sensor 812 can track the revolutions that the flywheel 702 rotates. In some examples, the sensor 812 may track half revolutions, quarter revolutions, other fractional revolutions, or combinations thereof.

The sensor 812 may be any appropriate type of sensor that can determine the rotational position of the flywheel 702. Further, the sensor 812 may be configured to determine the flywheel's position based on features incorporated into the flywheel body 802, the magnetically conductive rim 704, or the central shaft 800 of the flywheel 702. For example, the sensor 812 may be a mechanical rotary sensor, an optical rotary sensor, a magnetic rotary sensor, a capacitive rotary sensor, a geared multi-turn sensor, an incremental rotary sensor, another type of sensor, or combinations thereof. In some examples, a visual code may be depicted on the flywheel body 802, and the sensor 812 may read the orientation of the visual code to determine the number of revolutions or partial revolutions. In other examples, the flywheel body 802 includes at least one feature that is counted as the features rotate with the flywheel body 802. In some examples, a feature is a magnetic feature, a recess, a protrusion, an optical feature, another type of feature, or combinations thereof.

The sensor 812 can send the number of revolutions and/or partial revolutions to a processor as an input. The processor can also receive as an input the level of resistance that was applied to the flywheel 702 when the revolutions occurred. As a result, the processor can cause the amount of energy or number of calories consumed to be determined. In some examples, other information, other than just the calorie count, is determined using the revolution count. Further, the processor may also use the revolution count to track when maintenance should occur on the machine, and send a message to the user indicating that maintenance should be performed on the machine based on usage.

In some examples, the sensor 812 is accompanied with an accelerometer. The combination of the inputs from the accelerometer and the sensor 812 can at least aid the processor in determining the force exerted by the user during each pull. The processor may also track the force per pull, the average force over the course of the workout, the trends of force over the course of the workout, and so forth. For example, the processor may cause a graph of force per pull to be displayed to the user. In such a graph, the amount of force exerted by the user at the beginning of the workout versus the end of the workout may be depicted. Such information may be useful to the user and/or a trainer in customizing a workout for the user.

The number of calories per pull may be presented to the user in a display of the console 116. In some examples, the calories for an entire workout are tracked and presented to the user. In some examples, the calorie count is presented to the user through the display, through an audible mechanism, through a tactile mechanism, through another type of sensory mechanism, or combinations thereof.

While this example has been described with reference to the resistance mechanism being a magnetic resistance mechanism, any appropriate type of resistance mechanism may be used. For example, a braking system, a pneumatic system, a hydraulic system, an elastic system, a spring system, or another type of system may be used to resist the movement of the pull cables 134. In the example of FIG. 7, the resistance mechanism is positioned inside of the running deck 102. However, in other examples, the resistance mechanism may be located outside of the running deck 102. In one such example, the resistance mechanism is attached to the underside of the running deck.

Figure 9:
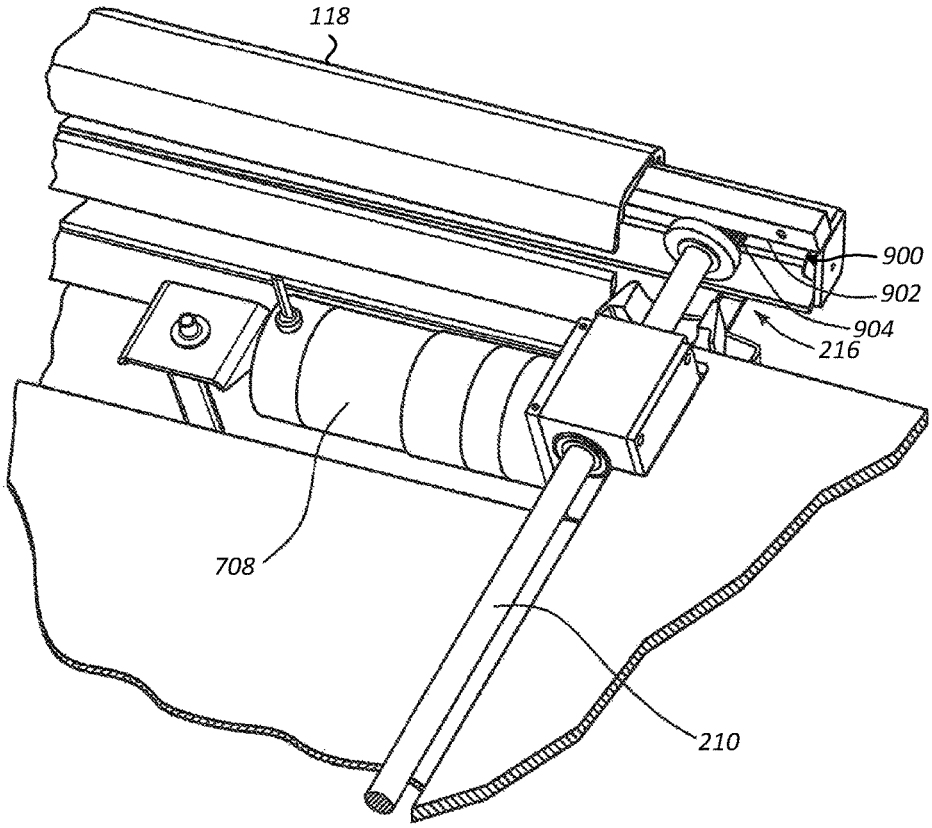
FIG. 9 illustrates a side view of a frame post of a treadmill depicted in FIG. 1.

FIG. 9 illustrates a side view of a frame post 118 of a treadmill 100. In this example, the frame post 118 includes a track 900 incorporated into the thickness of the frame post 118. The track 900 may include a toothed rack 902 into which the pinion 904 of the first end 216 of the axle 210 engages. A motor 708 is arranged to rotate the axle 210. As the axle 210 rotates, the pinion 904 attached to the first end 216 rotates with the axle 210. As the pinion 904 rotates, the pinion 904 climbs or descends the toothed rack 902 such that the axle 210 (and thus the front section 212 of the running deck) moves with the axle 210.

While this example has been described with specific reference to an axle 210, toothed rack 902 and pinion 904, any appropriate mechanisms to move the front section 212 of the running deck 102 may be used in accordance with the principles described in the present disclosure. For example, a hydraulic mechanism may be used to move the front section 212 along the length of the frame posts 118, 122. In another example, multiple pinions 904 may be driven by multiple motors 708 to move the front section 212 along the length of the frame posts 118, 122. In yet other examples, magnetic, compressed gas, springs, other types of mechanism, or combinations thereof may be used to move the front section 212 along the lengths of the frame posts 118, 122.

INDUSTRIAL APPLICABILITY

In general, the invention disclosed herein may provide an exercise device that allows a user to perform both aerobic and anaerobic exercises. For example, the exercise device may be a treadmill with a running deck on which the user can walk or run in place. In addition to the tread belt of the running deck, the treadmill may also incorporate pull cables that allow the user to perform pulling anaerobic exercises. The ends of the pull cables may be disposed in any appropriate location on the running deck or other location on the treadmill. In one example, the ends of the pull cables are positioned into openings that are formed in the running side of the running deck. A stopper prevents the ends of the pull cables from slipping into the running deck. The user can attach a handle to the ends of the pull cables. In other examples, the ends of the pull cables are permanently equipped with handles, a sufficient length of the cable for gripping, another gripping mechanism, or combinations thereof.

In some examples, the movement of the pull cables is resisted by a resistance mechanism disposed within the running deck. Thus, the tread belt can be positioned over the resistance mechanism. In some examples, the tread belt circumscribes the location where the resistance mechanism is located. Any appropriate type of resistance mechanism may be used, including a magnetic resistance mechanism. The resistance mechanism may be an independent mechanism from the mechanism that drives the tread belt. For example, the resistance mechanism may include a magnetic flywheel, and a motor drives the tread belt independent from the magnetic flywheel. Thus, the tread belt may be operated independently of the resistance mechanism. In some examples, however, movement of the tread belt also moves the resistance mechanism. In some examples, the treadmill includes an operational protocol that prevents the tread belt and the resistance mechanism to be operated at the same time even though the resistance mechanism is separate from the mechanism that drives the tread belt. However, in other examples, the tread belt and the resistance mechanism can be operated at the same time.

The running deck of the treadmill may include a running orientation and a storage orientation. A running orientation may include those orientations where a user can walk and/or run on the running deck. The storage orientation may include those orientations where a length of the running deck is substantially aligned with the length of the frame posts of the treadmill. The running deck may transition between such orientations by lifting the front section of the running deck. As the front section of the running deck is raised, the rear section of the running deck is dragged behind the front section. Wheels incorporated into the rear section of the running deck support the rear section as the rear section moves with the front portion. The wheels also reduce the friction between the weight of the running deck and the support structure (e.g. the floor upon which the treadmill rests).

One of the advantages of the principles described in the present disclosure is that a user can use the pull cables regardless of whether the running deck is in the storage orientation, the running orientation, or an orientation therein between. Thus, the user does not have to reorient the running deck if the user desires to perform exercises while the running deck is in the storage and/or running orientations. In some examples, specific angles from which the user desires to pull the pull cables to target a specific muscle group may be better suited with the running deck in a different orientation. In such situations, the user can increase the number of angles from which the user can target muscle groups by changing the orientation of the running deck.

The orientation of the running deck may be controlled by the user through the console. In other examples, a remote controller may be used to control the orientation of the running deck. In yet other examples, the user has an option to adjust the orientation of the running deck manually.

Another benefit of the principles described in the present disclosure is that a magnetic resistance mechanism may be well suited for tracking parameters of the user's workout. Such parameters may include determining the number of calories burned by the user, the amount of force generated by the user during the user's lift, other parameters, or combinations thereof. Such details and/or calculations may be presented to the user in the display of the console. Further, the details of the user's aerobic workout may also be presented to the user in the control console. Thus, the treadmill may be capable of tracking both the user's aerobic and anaerobic workouts, and may combine details, such as the calorie count, into to single display.

Another advantage of the principles described herein is that the space within the running deck can accommodate the pull cables. The pull cables can be routed within the running deck such that the length of the pull cables are concealed when the pull cables are not pulled out by the user. Further, an appropriate number of internal pulleys may be used within the running deck to appropriately route each of the pull cables to the appropriate opening in the running side of the running deck. In some cases, some of the internal pulleys are tensioning pulleys. Thus, the appropriate tensioning of the pull cables may also be accomplished within the running deck.

In some examples, the resistance mechanism is a magnetic resistance mechanism that is incorporated into the running deck. Such a resistance mechanism may have a substantial mass that is located in the rear section of the running deck. As the front section of the running deck is raised, the rear section of the running deck remains relatively close to the ground. By keeping the rear section low while the front section is raised (e.g. such as when the running deck is in the storage orientation), the mass of the resistance mechanism stays close to the ground. Keeping the resistance mechanism's mass at a low elevation increases the treadmill's stability when the running deck is in the storage position.

What is claimed is:

1. A treadmill, comprising;

an opening formed in a surface running side of a running deck;

a resistance mechanism including a flywheel incorporated into the running deck;

a sensor connected to the resistance mechanism, the sensor configured to determine one or more of a number of revolutions and a number of partial revolutions of the flywheel;

a cable threaded through the opening where the cable comprises a resistance end connected to the resistance mechanism and a pull end accessible through the running deck;

a display connected to the treadmill; and a processor in communication with the display and configured to perform:

measuring aerobic calories burned during aerobic exercise using the running deck;

measuring pulling anaerobic calories burned during pulling anaerobic exercise using the resistance mechanism and using the sensor to provide information to the processor about energy expended during pulling anaerobic exercise using the resistance mechanism using one or more of the number of revolutions and the number of partial revolutions of the flywheel; and displaying the aerobic calories burned and the anaerobic calories burned.

2. The treadmill of claim 1, wherein the running deck is arranged to transition between a running orientation and a storage orientation about a pivot mechanism.

3. The treadmill of claim 2, wherein the pivot mechanism comprises an axle that supports a portion of a weight of the running deck.

4. The treadmill of claim 3, wherein a first end of the axle is configured to move within a first track formed along a first length of a first frame post of the treadmill and a second end of the axle is configured to move within a second track formed along a second length of a second frame post of the treadmill.

5. The treadmill of claim 4, wherein the first end comprises a first pinion shaped to intermesh with a first rack of the first track and the second end comprises a second pinion shaped to intermesh with a second rack of the second track.

6. The treadmill of claim 2, wherein the pull end is positioned to allow a user to pull the cable while the running deck is in one or more of the running orientation and the storage orientation.

7. The treadmill of claim 1, further comprising an accelerometer in communication with the processor.

8. The treadmill of claim 7, wherein the processor is configured to determine a force exerted by a user during one or more pulls of the resistance mechanism using the accelerometer and the sensor.

9. The treadmill of claim 8, wherein the processor is further configured to display the force exerted by the user during each pull of the resistance mechanism.

10. The treadmill of claim 1, further comprising measuring pulling anaerobic calories burned during pulling anaerobic exercise using the running deck.

11. The treadmill of claim 1, wherein the processor is configured to send a message to a user when maintenance should be performed based on one or more of the number of revolutions and the number of partial revolutions of the flywheel.

12. A treadmill, comprising;

an opening formed in a running side of a running deck where the running side is configured to support a user when the running deck is oriented in a running orientation;

a magnetic resistance mechanism disposed within the running deck;

a cable threaded through the opening, where the cable includes a resistance end connected to the magnetic resistance mechanism and a pull end accessible through the running deck;

a display connected to the treadmill;

a processor in communication with the display; and a sensor connected to the magnetic resistance mechanism and in communication with the processor, the sensor configured to provide information to the processor about energy expended during pulling anaerobic exercise using the magnetic resistance mechanism, the sensor configured to determine one or more of a number of movements and a number of partial movements of the magnetic resistance mechanism;

wherein the processor is configured to perform:

measuring aerobic calories burned during aerobic exercise using the running deck;

measuring pulling anaerobic calories burned during pulling anaerobic exercise using the magnetic resistance mechanism using one or more of the number of movements and the number of partial movements of the magnetic resistance mechanism; and displaying the aerobic calories burned and the anaerobic calories burned; and wherein the pull end is arranged to allow the user to pull the cable with the running deck oriented in either the running orientation or a storage orientation.

13. The treadmill of claim 12, further comprising an accelerometer in communication with the processor.

14. The treadmill of claim 13, wherein the processor is configured to determine a force exerted by the user during one or more pulls of the magnetic resistance mechanism using the accelerometer.

15. The treadmill of claim 12, wherein the running deck is arranged to transition between the running orientation and the storage orientation about a pivot mechanism.

16. The treadmill of claim 15, wherein the pivot mechanism comprises an axle that supports a portion of a weight of the running deck.

17. A treadmill, comprising;

an opening formed in a corner of a running side of a running deck, where the running side is configured to support a user when the running deck is oriented in a running orientation;

a motor that drives a tread belt of the running deck;

a magnetic resistance mechanism disposed within the running deck and including a flywheel;

a display connected to the treadmill;

a processor in communication with the display;

an accelerometer connected to the flywheel and in communication with the processor, the accelerometer configured to provide information to the processor about force exerted by the user during each pull of the flywheel;

a sensor connected to the flywheel and in communication with the processor, the sensor configured to provide information to the processor about energy expended during pulling anaerobic exercise using the magnetic resistance mechanism, the sensor configured to determine one or more of a number of revolutions and a number of partial revolutions of the flywheel;

the processor configured to perform:

measuring aerobic calories burned during aerobic exercise using the running deck;

measuring pulling anaerobic calories burned during pulling anaerobic exercise using the magnetic resistance mechanism using one or more of the number of revolutions and the number of partial revolutions of the flywheel;

measuring pulling anaerobic calories burned during pulling anaerobic exercise using the running deck;

determining the force exerted by the user during one or more pulls of the magnetic resistance mechanism using the accelerometer; and displaying the aerobic calories burned and the anaerobic calories burned;

wherein the running deck includes a deck frame and at least one pulley connected to the deck frame and positioned to route a cable within the running deck;

wherein the cable is threaded through the opening;

wherein the cable includes a resistance end connected to the magnetic resistance mechanism and a pull end accessible through the running deck;

wherein the pull end of the cable includes a handle attachment;

wherein the running deck is arranged to transition between a running orientation and a storage orientation about a pivot mechanism;

wherein the pivot mechanism includes an axle that supports a portion of a weight of the running deck;

wherein a first end of the axle is configured to move within a first track formed along a first length of a first frame post of the treadmill and a second end of the axle is configured to move within a second track formed along a second length of a second frame post of the treadmill;

wherein the first end of the axle includes a first gear shaped to intermesh with a first rack of the first track and the second end of the axle includes a second gear shaped to intermesh with a second rack of the second track; and wherein the pull end is arranged to allow the user to pull the cable with the running deck in either the running orientation or the storage orientation;

wherein the flywheel is arranged to rotate as the cable is pulled; and wherein the flywheel is arranged to rotate in a single direction.

* * * * *